US010002564B2

(12) United States Patent
Kimura et al.

(10) Patent No.: US 10,002,564 B2
(45) Date of Patent: Jun. 19, 2018

(54) DISPLAY DEVICE, DISPLAY MODULE, AND ELECTRONIC DEVICE

(71) Applicant: SEMICONDUCTOR ENERGY LABORATORY CO., LTD, Kanagawa-ken (JP)

(72) Inventors: Hajime Kimura, Kanagawa (JP); Hiroyuki Miyake, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 108 days.

(21) Appl. No.: 14/925,744

(22) Filed: Oct. 28, 2015

(65) Prior Publication Data

US 2016/0232834 A1 Aug. 11, 2016

(30) Foreign Application Priority Data

Oct. 31, 2014 (JP) ..... 2014-222285

(51) Int. Cl.
*G09G 3/325* (2016.01)
*G09G 3/3233* (2016.01)

(52) U.S. Cl.
CPC ..... *G09G 3/325* (2013.01); *G09G 3/3233* (2013.01); *G09G 2300/043* (2013.01);
(Continued)

(58) Field of Classification Search
CPC ..... G09G 3/325; G09G 3/3233; G09G 2320/029; G09G 2300/0842;
(Continued)

(56) References Cited

U.S. PATENT DOCUMENTS 2,918,218 A * 12/1959 Lloyd ..... G06G 7/00 708/804
4,176,329 A * 11/1979 Moskowitz ..... G10H 1/06 333/167

(Continued)

FOREIGN PATENT DOCUMENTS

JP 11-219146 A 8/1999
JP 2003-195813 A 7/2003

(Continued)

OTHER PUBLICATIONS

Yoon.J et al., "55-inch OLED TV using Optimal Driving Method for Large-Size Panel based on InGaZnO TFTs", SID Digest '14 : SID International Symposium Digest of Technical Papers, Jun. 3, 2014, pp. 849-852.

*Primary Examiner* — Mihir K Rayan
(74) *Attorney, Agent, or Firm* — Nixon Peabody LLP; Jeffrey L. Costellia

(57) ABSTRACT

To provide a display device which can perform external correction and has a reduced area occupied by a read circuit. The display device includes a pixel and the read circuit. The pixel includes a transistor and a display element. The read circuit includes a function selection portion and an operational amplifier. The transistor is electrically connected to the function selection portion through a wiring. The operational amplifier is electrically connected to the function selection portion. The function selection portion includes at least one switch and can select the function of the read circuit by switching of the switch.

21 Claims, 55 Drawing Sheets

(52) U.S. Cl.
CPC ..... *G09G 2300/0426* (2013.01); *G09G 2300/0814* (2013.01); *G09G 2300/0842* (2013.01); *G09G 2310/061* (2013.01); *G09G 2320/029* (2013.01); *G09G 2320/0233* (2013.01); *G09G 2320/045* (2013.01); *G09G 2320/046* (2013.01); *G09G 2330/045* (2013.01)

(58) Field of Classification Search
CPC ..... G09G 2300/043; G09G 2300/0814; G09G 2300/0426; G09G 2310/061; G09G 2320/045; G09G 2320/046; G09G 2330/045; G09G 2320/0233
See application file for complete search history.

(56) References Cited

U.S. PATENT DOCUMENTS 4,243,975 A * 1/1981 Masuda ..... H03M 1/183 341/168
4,698,461 A * 10/1987 Meadows ..... G06F 3/0418 345/174
4,740,781 A * 4/1988 Brown ..... G06F 3/0412 341/33
5,489,910 A * 2/1996 Kuwata ..... G09G 3/3611 345/212
7,088,052 B2 8/2006 Kimura
7,679,422 B1 * 3/2010 Thiagarajan ..... G06G 7/18 327/337
8,947,328 B2 2/2015 Kimura
9,306,508 B1 * 4/2016 Alzaher ..... H03F 3/347
2001/0024186 A1 9/2001 Kane et al.
2003/0016190 A1 1/2003 Kondo
2003/0057895 A1 3/2003 Kimura
2003/0132931 A1 7/2003 Kimura et al.
2007/0268210 A1 11/2007 Uchino et al.
2008/0238833 A1 10/2008 Hioki et al.
2008/0297390 A1 * 12/2008 Ko ..... G09G 3/3685 341/144
2009/0207160 A1 * 8/2009 Shirasaki ..... G09G 3/3233 345/212
2009/0244049 A1 10/2009 Yamamoto et al.
2011/0241916 A1 * 10/2011 Fletcher ..... H03F 3/45475 341/122
2012/0293478 A1 * 11/2012 Chaji ..... G09G 3/3258 345/212
2014/0152642 A1 * 6/2014 Kim ..... G09G 3/3233 345/212
2014/0176622 A1 6/2014 Jung et al.
2015/0187818 A1 7/2015 Miyake et al.
2016/0093263 A1 3/2016 Kimura et al.

FOREIGN PATENT DOCUMENTS

JP 2007-310311 A 11/2007
JP 2008-233933 A 10/2008
JP 2009-053382 A 3/2009
JP 2014-126873 A 7/2014

* cited by examiner

300C

300C

300C

300D

300D

300D

300E

300E

300E

300F

300F

300F

300G

300G

300G

DISPLAY DEVICE, DISPLAY MODULE, AND ELECTRONIC DEVICE

BACKGROUND OF THE INVENTION

1. Field of the Invention

One embodiment of the present invention relates to a display device.

Note that one embodiment of the present invention is not limited to the above technical field. The technical field of the invention disclosed in this specification and the like relates to an object, a method, or a manufacturing method. In addition, one embodiment of the present invention relates to a process, a machine, manufacture, or a composition of matter. Specific examples of the technical field of one embodiment of the present invention disclosed in this specification include a semiconductor device, a display device, a light-emitting device, a power storage device, an imaging device, a memory device, a method for driving any of them, and a method for manufacturing any of them.

2. Description of the Related Art

In recent years, display devices have been used for various electronic devices such as television receivers, personal computers, and smart phones, and higher performance of the display devices in various aspects such as higher definition and lower power consumption has been achieved.

As such display devices, active matrix display devices in each of which a plurality of pixels are arranged in a matrix and is controlled by transistors provided in the pixels have been often used. In the active matrix display device, each pixel is controlled by a transistor, so that variation in transistor characteristics among pixels or deterioration in transistor characteristics causes variation in display among the pixels. Thus, display unevenness and image burn-in may be caused.

In an active matrix display device in which a light-emitting element is used as a display element, a driver transistor which controls current to be supplied to the light-emitting element in accordance with a video signal is provided. If at least one of the threshold voltage, the mobility, the channel length, the channel width, and the like of the driver transistor varies among pixels, luminance of a light-emitting element varies among the pixels.

As a method for preventing such variation in luminance of light-emitting elements, a method for correcting variation in the threshold voltages of driver transistors in pixels (hereinafter referred to as internal correction) has been suggested (Patent Document 1).

Furthermore, a method has been suggested in which the characteristics of a driver transistor is read out to the outside of a pixel and a signal for correcting variation in the characteristics of the driver transistor is input (hereinafter also referred to as external correction) (Patent Documents 2 and 3).

REFERENCE

Patent Document

[Patent Document 1] Japanese Published Patent Application No. 2008-233933

[Patent Document 2] Japanese Published Patent Application No. 2003-195813

[Patent Document 3] Japanese Published Patent Application No. 2014-126873

SUMMARY OF THE INVENTION

In the case of performing external correction, there is a case where current flowing through a transistor is output to the outside of a pixel. Alternatively, there is a case where a potential of a terminal of a transistor is output to the outside of a pixel. In the case of performing external correction, there is a case where a circuit for reading out data on current characteristics of a transistor, such as the current or the potential (hereinafter referred to as a read circuit in some cases) is provided outside a pixel, e.g., in a driver circuit portion. As the read circuit, there is a case where a circuit called an operational amplifier is used, for example. In general, an operational amplifier is formed of extremely many circuit components.

Therefore, especially when a read circuit including a plurality of operational amplifiers is provided in the driver circuit portion, the area occupied by the driver circuit portion is significantly increased. Such an increase in the area occupied by the driver circuit portion hinders, for example, a narrow frame of the display device. Furthermore, in the operational amplifiers, a constant current flows and a large amount of power is consumed. Accordingly, when a plurality of operational amplifiers are provided, an extremely large amount of power is consumed.

An object of one embodiment of the present is to provide a novel display device, a novel semiconductor device, a driving method thereof, or the like.

An object of one embodiment of the present invention is to provide a display device or the like which can perform external correction and in which the area occupied by a read circuit is reduced. An object of one embodiment of the present invention is to provide a display device or the like in which the area occupied by a driver circuit portion is reduced and which has a narrow frame. An object of one embodiment of the present invention is to provide a display device or the like with low power consumption. An object of one embodiment of the present invention is to provide a display device which performs external correction by reading out a plurality of kinds of data on current characteristics of a transistor. An object of one embodiment of the present invention is to provide a display device with small display unevenness. An object of one embodiment of the present invention is to provide a display device capable of high definition display. An object of one embodiment of the present invention is to provide a semiconductor device which can reduce adverse effects due to variation in transistor characteristics. An object of one embodiment of the present invention is to provide a semiconductor device which can reduce adverse effects due to variation in the threshold voltages of transistors. An object of one embodiment of the present invention is to provide a semiconductor device which can reduce adverse effects due to variation in the motilities of transistors.

Note that the objects of the present invention are not limited to the above objects. The objects described above do not disturb the existence of other objects. The other objects are the ones that are not described above and will be described below. The other objects will be apparent from and can be derived from the description of the specification, the drawings, and the like by those skilled in the art. One embodiment of the present invention is to solve at least one of the aforementioned objects and the other objects.

According to one embodiment of the present invention, an operational amplifier in a read circuit is shared between circuits having different functions to reduce the area occupied by the read circuit. By sharing an operational amplifier in a read circuit particularly between circuits which read out data on current characteristics of different transistors, the area occupied by the read circuit is reduced.

One embodiment of the present invention is a display device including a pixel and a first circuit. The pixel includes a transistor and a display element. The first circuit includes a second circuit and an operational amplifier. The transistor is electrically connected to the second circuit through a wiring. The operational amplifier is electrically connected to the second circuit. The second circuit includes a switch. The second circuit can select the function of the first circuit by controlling the conduction state of the switch.

In the above, the second circuit preferably includes a passive element.

Another embodiment of the present invention is a display device including a pixel and a first circuit. The pixel includes a transistor and a display element. The first circuit includes a capacitor, an operational amplifier, and a second circuit. The second circuit includes a capacitor. The transistor is electrically connected to the first circuit through a first wiring. One electrode of the capacitor is electrically connected to an inverting input terminal of the operational amplifier, and the other electrode of the capacitor is electrically connected to an output terminal of the operational amplifier. The second circuit has a function of selecting whether the inverting input terminal of the operational amplifier is electrically connected to the first wiring or to the output terminal of the operational amplifier. The second circuit has a function of selecting whether a non-inverting input terminal of the operational amplifier is electrically connected to the first wiring or to a second wiring.

In the above, the first circuit preferably includes first to fourth switches. The inverting input terminal of the operational amplifier is preferably electrically connected to the first wiring through the first switch. The non-inverting input terminal of the operational amplifier is preferably electrically connected to the first wiring through the second switch. The non-inverting input terminal of the operational amplifier is preferably electrically connected to the second wiring through the third switch. The output terminal of the operational amplifier is preferably electrically connected to the inverting input terminal of the operational amplifier through the fourth switch.

Another embodiment of the present invention is a display device including a pixel and a first circuit. The pixel includes a transistor and a display element. The first circuit includes an operational amplifier and a second circuit. The second circuit includes a resistor. The transistor is electrically connected to the first circuit through a first wiring. One electrode of the resistor is electrically connected to an output terminal of the operational amplifier. The second circuit has a function of selecting whether an inverting input terminal of the operational amplifier is electrically connected to the first wiring and the other electrode of the resistor or to the output terminal of the operational amplifier. The second circuit has a function of selecting whether a non-inverting input terminal of the operational amplifier is electrically connected to the first wiring or to a second wiring.

In the above, the first circuit preferably includes first to fifth switches. The inverting input terminal of the operational amplifier is preferably electrically connected to the first wiring through the first switch. The non-inverting input terminal of the operational amplifier is preferably electrically connected to the first wiring through the second switch. The non-inverting input terminal of the operational amplifier is preferably electrically connected to the second wiring through the third switch. The output terminal of the operational amplifier is preferably electrically connected to the inverting input terminal of the operational amplifier through the fourth switch. The other electrode of the resistor is preferably electrically connected to the inverting input terminal of the operational amplifier.

Another embodiment of the present invention is a display device including a pixel and a first circuit. The pixel includes a transistor and a display element. The first circuit includes an operational amplifier and a second circuit. The second circuit includes a capacitor, a resistor, and a first switch. The transistor is electrically connected to the first circuit through a first wiring. One electrode of the capacitor is electrically connected to an output terminal of the operational amplifier. One electrode of the resistor is electrically connected to the output terminal of the operational amplifier. An inverting input terminal of the operational amplifier is electrically connected to the first wiring. A non-inverting input terminal of the operational amplifier is electrically connected to a second wiring. The output terminal of the operational amplifier is electrically connected to the inverting input terminal of the operational amplifier through the first switch. The second circuit has a function of selecting whether the inverting input terminal of the operational amplifier is electrically connected to the other electrode of the capacitor or the other electrode of the resistor.

In the above, the second circuit preferably includes a second switch and a third switch. The inverting input terminal of the operational amplifier is preferably electrically connected to the other electrode of the capacitor through the second switch. The inverting input terminal of the operational amplifier is preferably electrically connected to the other electrode of the resistor through the third switch.

Another embodiment of the present invention is a display module including the above-described display device, and a circuit board, an FPC, or a touch sensor.

Another embodiment of the present invention is an electronic device including the above-described display device or display module, and a speaker, a microphone, an operation key, or a housing.

Note that other embodiments of the present invention will be described in the following embodiments with reference to the drawings.

According to one embodiment of the present invention, a novel display device, a novel semiconductor device, or the like can be provided.

According to one embodiment of the present invention, a display device or the like which can perform external correction and in which the area occupied by a read circuit is reduced can be provided. According to one embodiment of the present invention, a display device or the like in which the area occupied by a driver circuit portion is reduced and which has a narrow frame can be provided. According to one embodiment of the present invention, a display device or the like with low power consumption can be provided. According to one embodiment of the present invention, a display device which performs external correction by reading out a plurality of kinds of data on current characteristics of a transistor can be provided. According to one embodiment of the present invention, a display device with small display unevenness is suppressed can be provided. According to one embodiment of the present invention, a display device capable of high definition display can be provided. According to one embodiment of the present invention, a semiconductor device which can reduce adverse effects due to variation in transistor characteristics can be provided. According to one embodiment of the present invention, a semiconductor device which can reduce adverse effects due to variation in the threshold voltages of transistors can be provided. According to one embodiment of the present invention, a semiconductor device which can reduce adverse effects due to variation in the motilities of transistors can be provided.

Note that the effects of one embodiment of the present invention are not limited to the above effects. The effects described above do not disturb the existence of other effects. The other effects are the ones that are not described above and will be described below. The other effects will be apparent from and can be derived from the description of the specification, the drawings, and the like by those skilled in the art. One embodiment of the present invention is to have at least one of the aforementioned effects and the other effects. Accordingly, one embodiment of the present invention does not have the aforementioned effects in some cases.

DETAILED DESCRIPTION OF THE INVENTION

Figure 1:
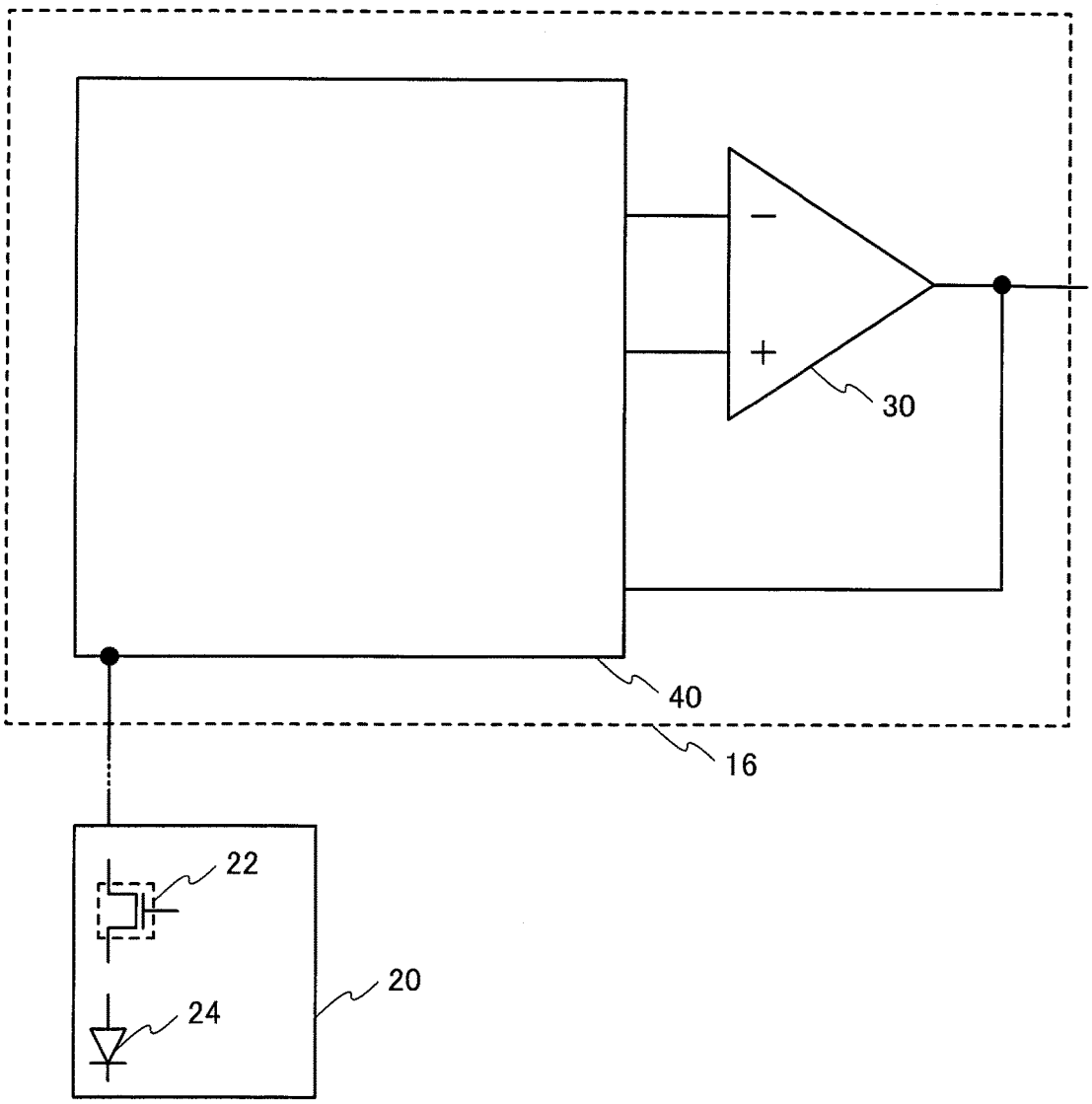
FIG. 1 is a block diagram illustrating one embodiment of the present invention.

Hereinafter, embodiments will be described with reference to drawings. However, the embodiments can be implemented with various modes. It will be readily appreciated by those skilled in the art that modes and details can be changed in various ways without departing from the spirit and scope of the present invention. Thus, the present invention should not be interpreted as being limited to the following description of the embodiments.

In this specification and the like, ordinal numbers such as first, second, and third are used in order to avoid confusion among components. Thus, the terms do not limit the number or order of components. In the present specification and the like, a "first" component in one embodiment can be referred to as a "second" component in other embodiments or claims. Alternatively, in the present specification and the like, a "first" component in one embodiment can be referred to without the ordinal number in other embodiments or claims.

In the drawings, the same components, components having similar functions, components formed of the same material, or components formed at the same time are denoted by the same reference numerals in some cases, and description thereof is not repeated in some cases.

Embodiment 1

In this embodiment, a structure of a display device according to one embodiment of the disclosed invention and a driving method thereof will be described with reference to FIG. 1, FIGS. 2A and 2B, FIGS. 3A and 3B, FIGS. 4A and 4B, FIG. 5, FIGS. 6A and 6B, FIGS. 7A and 7B, FIGS. 8A and 8B, FIG. 9, FIG. 10, FIGS. 11A and 11B, FIGS. 12A and 12B, FIG. 13, FIGS. 14A and 14B, FIG. 15, FIG. 16, FIGS. 17A and 17B, FIGS. 18A and 18B, FIGS. 19A and 19B, FIG. 20, FIG. 21, FIG. 22, FIG. 23, FIG. 24, FIG. 25, FIG. 26, FIGS. 27A and 27B, FIGS. 28A and 28B, FIG. 29, FIGS. 30A and 30B, FIG. 31, FIGS. 32A and 32B, FIG. 33, FIGS. 34A and 34B, FIG. 35, FIG. 36, FIG. 37, and FIG. 38.

<Configuration of Read Circuit>

A configuration of a read circuit used for the display device of one embodiment of the disclosed invention is described using a schematic diagram in FIG. 1. Note that the read circuit has, for example, a function of reading out data from a pixel (e.g., a potential or a current). Note that the read circuit may have another function. For example, the read circuit may have a function of supplying a predetermined potential to a pixel. Alternatively, the read circuit may have a function of holding data. Further alternatively, the read circuit may have a function of converting an analog signal into a digital signal. Thus, the read circuit is simply referred to as a circuit in some cases. For example, the read circuit is referred to as a first circuit, a second circuit, or the like in some cases.

As illustrated in FIG. 1, the display device of this embodiment includes a pixel 20 and a read circuit 16, for example. The pixel 20 is electrically connected to the read circuit 16. The pixel 20 includes, for example, a transistor 22 and a display element (e.g., a light-emitting element 24). The read circuit 16 includes, for example, a function selection portion 40 and an operational amplifier 30. The transistor 22 of the pixel 20 is electrically connected to the function selection portion 40 through a wiring. The function selection portion 40 is electrically connected to the operational amplifier 30.

The function selection portion has, for example, a function of switching or selecting the function. Note that the function selection portion may have another function. Thus, the function selection portion is simply referred to as a circuit in some cases. For example, the function selection portion is referred to as a first circuit, a second circuit, or the like in some cases.

The transistor 22 functions, for example, as a transistor for supplying a current to the light-emitting element 24 (hereinafter referred to as a driver transistor in some cases). The transistor such as the transistor 22 has, for example, a function of driving a display element such as the light-emitting element 24. Alternatively, the transistor such as the transistor 22 has, for example, a function of controlling the amount of current flowing through the display element such as the light-emitting element 24. The transistor such as the transistor 22 has, for example, another function in some cases. Thus, the transistor such as the transistor 22 is simply referred to as a transistor in some cases. For example, the transistor such as the transistor 22 is referred to as a first transistor, a second transistor, or the like in some cases.

The read circuit 16 has a function of reading data on current characteristics of the transistor 22 in the pixel 20. Alternatively, the read circuit 16 has a function of detecting characteristics of the pixel 20. Alternatively, the read circuit 16 has a function of retaining characteristics of the pixel 20. Alternatively, the read circuit 16 has a function of converting an analog signal into a digital signal. Examples of the current characteristics include a current flowing through the driver transistor, the threshold voltage of the driver transistor, and a voltage based on the threshold voltage of the driver transistor at the time when a predetermined voltage is supplied to the driver transistor. The transistor from which data on current characteristics can be read out by the read circuit 16 is not limited to the driver transistor. The read circuit 16 may read out data on current characteristics of another transistor included in the pixel 20. Note that the read circuit 16 may read out data on current characteristics of the display element such as the light-emitting element 24 included in the pixel 20.

The function selection portion 40 includes at least one switch. By switching the switch, i.e., controlling the conduction of the switch, the function of the read circuit 16 can be changed or selected.

As described above, various data on current characteristics, such as a current, a voltage, and the threshold voltage, of the transistor can be read out. Because these data are related to each other, by obtaining a plurality of kinds of data, variation in current characteristics of the driver transistor can be corrected more accurately. In particular, in the case where current characteristics of a driver transistor are not current characteristics of a desired transistor, by obtaining a plurality of kinds of data, variation in current characteristics of the driver transistor can be corrected more accurately. An example of a desired transistor includes a transistor in which gradual channel approximation is made. For example, in the case where the transistor is a thin film transistor, the transistor does not have current characteristics of a desired transistor in many cases; therefore, the reading out method according to one embodiment of the present invention is useful.

The read circuit 16 of this embodiment can read out data by selecting the data from a plurality of kinds of data at the time of reading out data on current characteristics of the transistor, for example. In other words, the function selection portion 40 has a function of selecting which data is to be read out at the time of reading out data on current characteristics of the transistor. Thus, the read circuit 16 can read out a plurality of kinds of data as data on current characteristics of the transistor and correct variation in transistors or pixels more accurately.

In such a circuit that reads out data such as a current or a voltage, an operational amplifier is used in many cases, for example. Instead of an operational amplifier, another circuit, e.g., a differential circuit, may be used. However, an operational amplifier and the like are formed of an extremely large number of circuit components. Therefore, when a circuit where an operational amplifier is provided for each kind of data is placed, the area occupied by the read circuit 16 might be increased dramatically. Furthermore, the area of the driver circuit portion where the read circuit 16 is provided is also increased; thus, the frame of the display device might be widened. Because a steady-state current flows through operational amplifiers, the power consumption is increased when a large number of operational amplifiers are provided.

Therefore, in the display device described in this embodiment, for example, when a circuit which reads out a plurality of kinds of data has a plurality of functions, an operational amplifier is shared between a plurality of functions and one operational amplifier is configured to serve the plurality of functions. In other words, a plurality of data are read out using one operational amplifier. In order to achieve this, a configuration that enables electrical contacts between circuit components, wirings, and the like other than the operational amplifier is controlled and selected in the function selection portion 40. Thus, one operational amplifier can function as a variety of circuits. As a result, the number of kinds of data to be read out by the read circuit 16 can be increased without increasing the number of operational amplifiers.

Thus, the accuracy of correcting variation in the characteristics of the driver transistor can be increased with little increase in the area occupied by the read circuit 16. Accordingly, the area occupied by the driver circuit portion where the read circuit 16 is provided can be reduced, so that the frame of the display device can be narrowed.

Among transistors provided in the operational amplifier, there is a transistor through which a current always flows; therefore, the power consumption of the operational amplifier is large in some cases. Moreover, a transistor provided in the operational amplifier needs measures such as an increase in channel length of the transistor so that a drain current can be stable in a saturated region even when the drain voltage becomes high. Even in such a case, the number of operational amplifiers can be reduced in the display device described in this embodiment as compared to the case where operational amplifiers corresponding to the number of kinds of data are simply provided; thus, an increase in such a problem caused by increasing the number of kinds of data to be read out can be prevented. In addition, since the number of operational amplifiers can be reduced, low power consumption can be achieved.

With the above-described configuration, the display device described in this embodiment which can perform external correction and in which the area occupied by the read circuit is reduced can be provided. With the above-described structure, a display device in which the area occupied by a driver circuit portion can be reduced and whose frame is narrowed can be provided. With the above-described structure, a display device which can perform external correction by reading out a plurality of kinds of data on current characteristics of a transistor can be provided. With the above-described structure, a display device having small display unevenness can be provided. With the above-described structure, a display device capable of high definition display can be provided. With the above-described structure, a semiconductor device capable of reducing adverse effects due to variation in transistor characteristics can be provided. With the above-described structure, a semiconductor device capable of reducing adverse effects due to variation in the threshold voltages of transistors can be provided. With the above-described structure, a semiconductor device capable of reducing adverse effects due to variation in the mobilities of transistors can be provided. With the above-described structure, a semiconductor device with low power consumption can be provided.

A circuit which reads out data such as a current or a voltage is formed of an operational amplifier and a passive element (e.g., a resistor, a capacitor, or a coil) in many cases. Thus, the function selection portion 40 preferably includes at least one passive element (e.g., a resistor, a capacitor, or a coil), for example.

<Specific Configuration of Read Circuit>

Next, specific configuration examples of the read circuit 16 are described with reference to circuit diagrams in FIGS. 2A and 2B, FIGS. 3A and 3B, FIGS. 4A and 4B, FIG. 5, FIGS. 6A and 6B, FIGS. 7A and 7B, FIGS. 8A and 8B, FIG. 9, FIG. 10, FIGS. 11A and 11B, FIGS. 12A and 12B, FIG. 13, FIGS. 14A and 14B, FIG. 15, FIG. 16, FIGS. 17A and 17B, FIGS. 18A and 18B, FIGS. 19A and 19B, and FIG. 20.

Figure 2A:
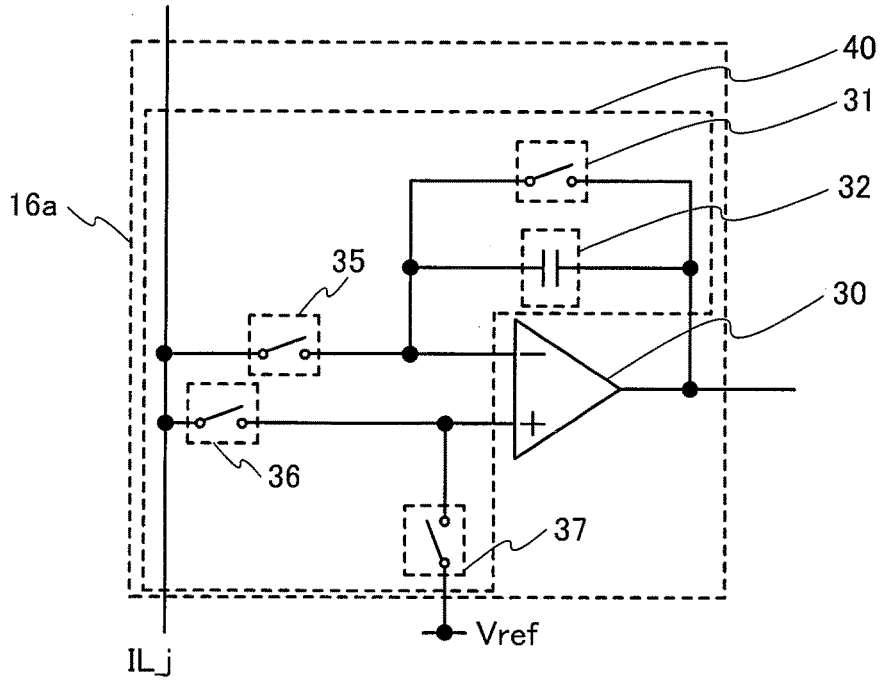
FIGS. 2A and 2B are circuit diagrams illustrating one embodiment of the present invention.

First, a read circuit in FIG. 2A is described. A read circuit 16*a* in FIG. 2A includes the operational amplifier 30 and the function selection portion 40. The function selection portion 40 includes a capacitor 32, a switch 31, a switch 35, a switch 36, and a switch 37. An inverting input terminal of the operational amplifier 30 is electrically connected to a wiring IL_j through the switch 35. The inverting input terminal of the operational amplifier 30 is electrically connected to an output terminal of the operational amplifier 30 through the switch 31. A non-inverting input terminal of the operational amplifier 30 is electrically connected to the wiring IL_j through the switch 36. The non-inverting input terminal of the operational amplifier 30 is electrically connected to a wiring to which a reference potential is supplied, through the switch 37. The inverting input terminal of the operational amplifier 30 is electrically connected to one electrode of the capacitor 32. The output terminal of the operational amplifier 30 is electrically connected to the other electrode of the capacitor 32.

Although not illustrated, the wiring IL_j is electrically connected to the pixel 20 as is clear from FIG. 1. For example, the transistor 22 is also electrically connected to the wiring IL_j. That is, the wiring IL_j is electrically connected to the pixel 20 and the read circuit 16*a*.

The wiring Vref to which the reference potential is supplied may be supplied with an arbitrary potential without limitation to the reference potential so that the arbitrary potential can be supplied to the non-inverting input terminal of the operational amplifier 30. The operational amplifier 30 operates in some cases so that the potential of the non-inverting input terminal is equal to the potential of the inverting input terminal. Thus, the potential of the wiring IL_j can be controlled by the potential of the non-inverting input terminal. By controlling the potential of the non-inverting input terminal of the operational amplifier 30, the read circuit 16 can control the potential of the wiring IL_j. Accordingly, for example, at the time of reading, a current flowing through the transistor 22 can be prevented from flowing to the light-emitting element 24.

The read circuit 16 can operate in the following manner, for example. The switch 35 and the switch 37 can operate in synchronization with each other, for example. Note that one embodiment of the present invention is not limited thereto. For example, in the case where a reading operation is not performed, a predetermined potential is supplied from the read circuit 16 to the wiring IL_j in some cases. In such a case, the switch 35 may be turned off and the switches 36 and 37 may be turned on. Consequently, the potential of the wiring Vref can be supplied to the wiring IL_j and the pixel 20. Alternatively, the switch 35 (and/or the switch 37) and the switch 36 can operate inversely from each other, for example. In other words, the switch 35 (and/or the switch 37) and the switch 36 can operate so that when one of the switch 35 (and/or the switch 37) and the switch 36 is in an on state, the other is in an off state. Furthermore, controlling the conduction states of the switches 31 and 35 enables selecting whether the inverting input terminal of the operational amplifier 30 is electrically connected to the wiring IL_j or to the output terminal of the operational amplifier 30. Furthermore, controlling the conduction states of the switches 37 and 36 enables selecting whether the non-inverting input terminal of the operational amplifier 30 is electrically connected to the wiring Vref to which the reference potential is supplied or to the wiring IL_j.

Figure 2B:
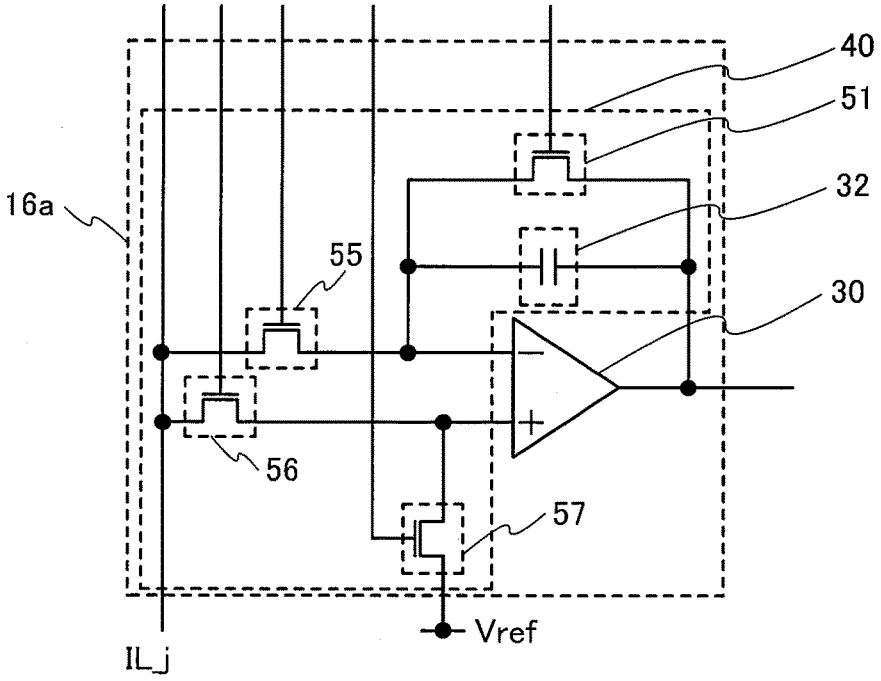

As switches such as the switches 31, 35, 36, and 37, electrical switches, mechanical switches, MEMS elements, or the like may be used. For example, transistors described later are preferably used as electrical switches. FIG. 2B is a circuit diagram in the case where transistors are used. The read circuit in FIG. 2B is the read circuit in FIG. 2A in which a transistor 51, a transistor 55, a transistor 56, and a transistor 57 are used as the switch 31, the switch 35, the switch 36, and the switch 37, respectively.

Figure 3A:
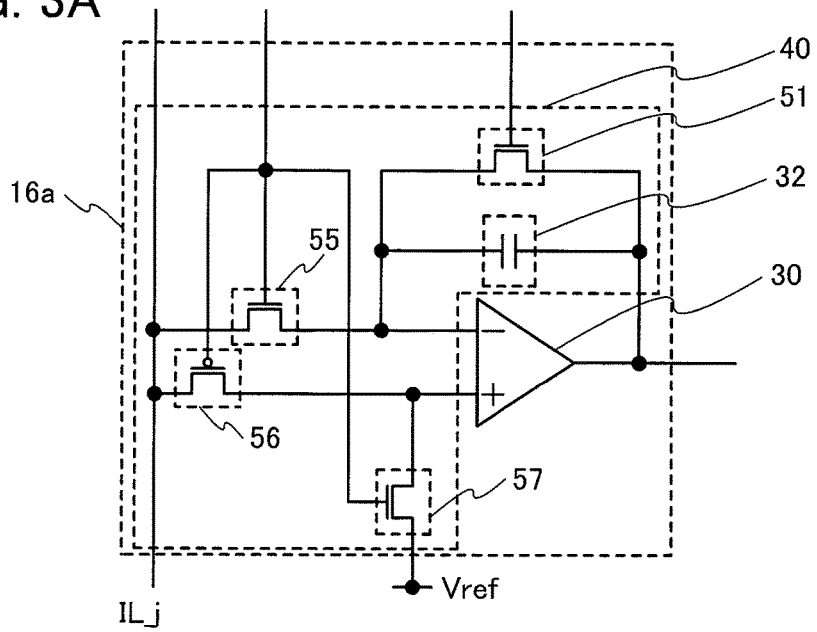
FIGS. 3A and 3B are circuit diagrams each illustrating one embodiment of the present invention.
Figure 3B:
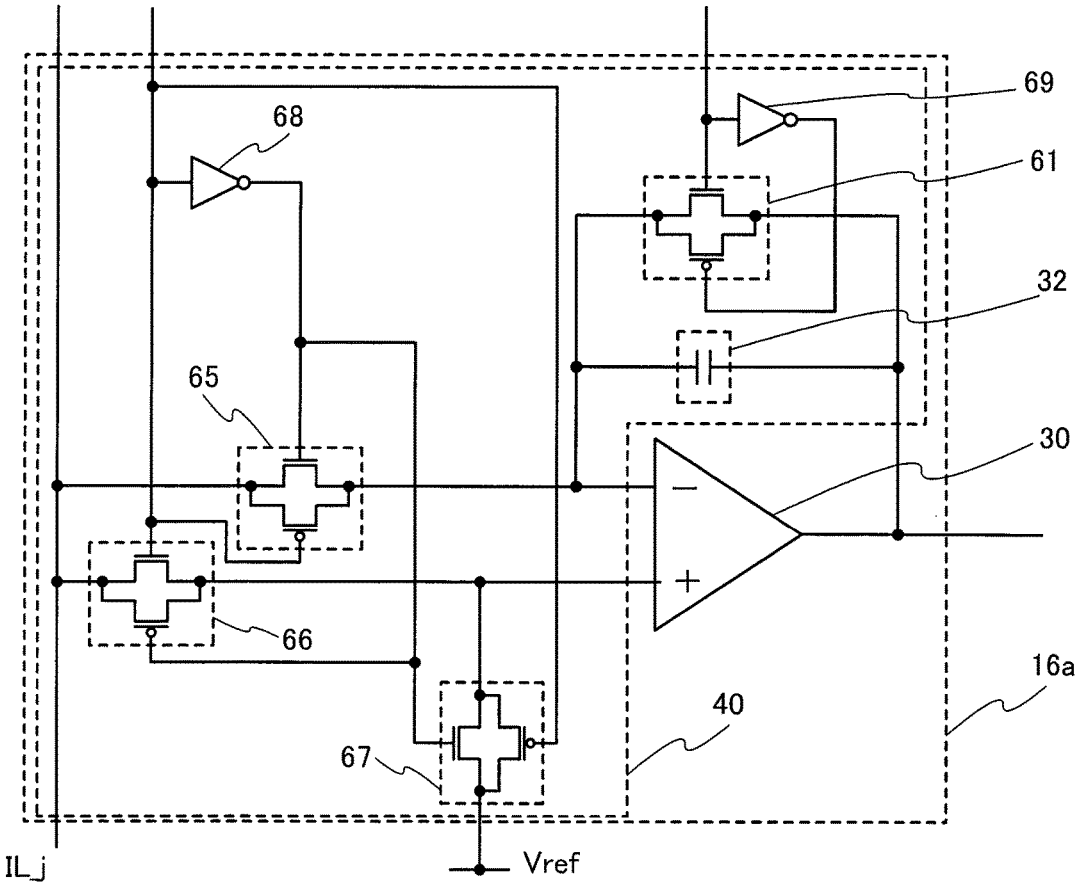

By selecting the polarities of the transistors, a CMOS structure may be employed. FIGS. 3A and 3B and the like illustrate an example of that case. FIG. 3A illustrates the read circuit in FIG. 2B in which the transistors 51, 55, and 57 are n-channel transistors and the transistor 56 is a p-channel transistor. Furthermore, gates of the transistors 55 to 57 are electrically connected to each other. Thus, the transistor 55 and the transistor 57 can operate in synchronization with each other. Moreover, the transistors 55 to 57 can operate so that when one of the transistor 56 and the transistors 55 and 57 is in an on state, the other thereof is in an off state.

FIG. 3B illustrates the read circuit in FIG. 2A in which an analog switch 61, an analog switch 65, an analog switch 66, and an analog switch 67 are used as the switch 31, the switch 35, the switch 36, and the switch 37, respectively. The analog switches 61 and 65 to 67 each have a structure where a source and a drain of an n-channel transistor and a source and a drain of a p-channel transistor are connected in parallel. In the circuit in FIG. 3B, in the analog switch 61, a gate of the n-channel transistor and a gate of the p-channel transistor are electrically connected to each other through an inverter 69. A gate of the n-channel transistor in the analog switch 66 and gates of the p-channel transistors in the analog switches 65 and 67 are electrically connected to each other. These gates are electrically connected to a gate of the p-channel transistor in the analog switch 66 and gates of the n-channel transistors in the analog switches 65 and 67 through the inverter 68. With such a structure, the analog switches 65 and 67 can operate in synchronization with each other. The analog switches 65 to 67 can operate so that when one of the analog switch 66 and the analog switches 65 and 67 is in an on state, the other is in an off state. Note that the read circuits in FIGS. 3A and 3B are not limited thereto; however, the polarities of the transistors can be changed as appropriate, if necessary.

Next, a circuit configuration that can serve the functions of the read circuit 16*a* is described. The read circuit 16*a* has a plurality of functions. The circuit configuration of the read circuit 16*a* varies depending on which function is carried out. In other words, by controlling the conduction states of the switches in the function selection portion 40, the read circuit 16*a* can perform a plurality of functions.

Figure 4A:
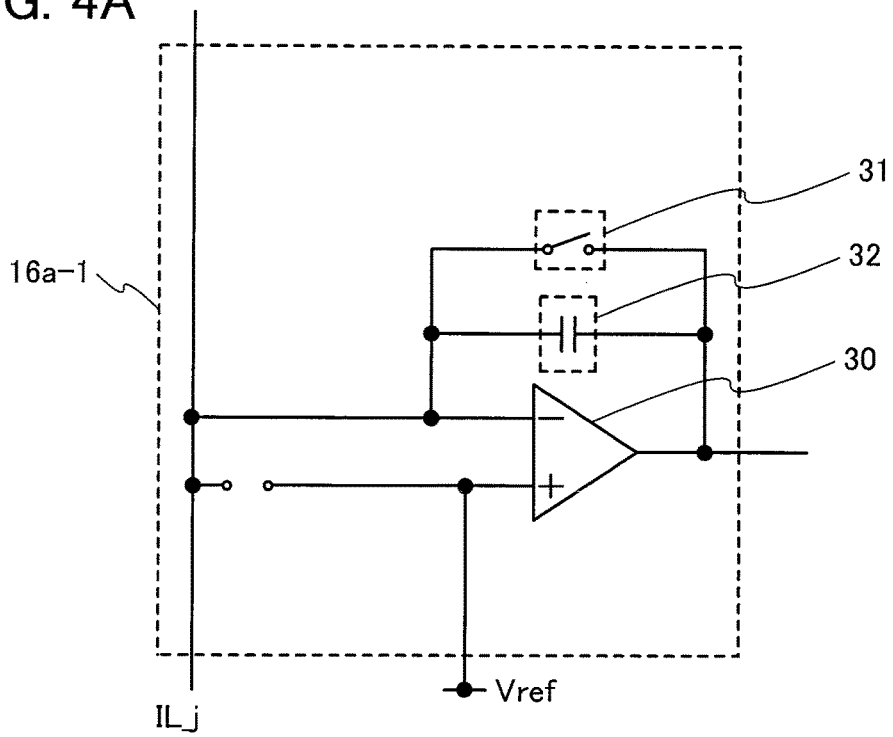
FIGS. 4A and 4B are circuit diagrams each illustrating one embodiment of the present invention.

For example, a circuit configuration in a certain operation state is illustrated in FIG. 4A. FIG. 4A illustrates the read circuit 16*a*-1 that corresponds to the read circuit 16*a* in FIG. 2A in which the switches 35 and 37 are on and the switch 36 is off. In the read circuit 16*a*-1, the inverting input terminal of the operational amplifier 30 is electrically connected to the wiring IL_j and the non-inverting input terminal of the operational amplifier 30 is electrically connected to the wiring Vref to which the reference potential is supplied. Here, the switch 31 is turned on when charge held in the capacitor 32 is initialized.

With this configuration, the read circuit 16*a* can function as an integrator circuit. For example, when a current flows through the wiring IL_j, charge based on the current flowing time is accumulated in the capacitor 32, and a potential difference is generated between electrodes of the capacitor 32 in accordance with the accumulated charge. In other words, a voltage of the output terminal of the operational amplifier 30 can be obtained by integrating the current flowing through the wiring IL_j with respect to the measurement time. Consequently, the total amount of the current flowing through the wiring IL_j can be read out. Note that the output terminal of the operational amplifier 30 is connected to, for example, an A/D converter circuit or a memory circuit. By utilizing the read current value, variation in current characteristics of the transistor 22 in the pixel 20 can be corrected.

Since the read circuit 16*a*-1 functions as the integrator circuit as described above, the integral value of the current passing through the wiring IL_j can be read.

By turning on the switch 31 before current measurement, charge accumulated in the capacitor 32 may be discharged. That is, the switch 31 functions as a reset circuit in the read circuit 16*a*-1. Therefore, depending on conditions, the switch 31 preferably operates independently of the switch 36, for example.

Figure 4B:
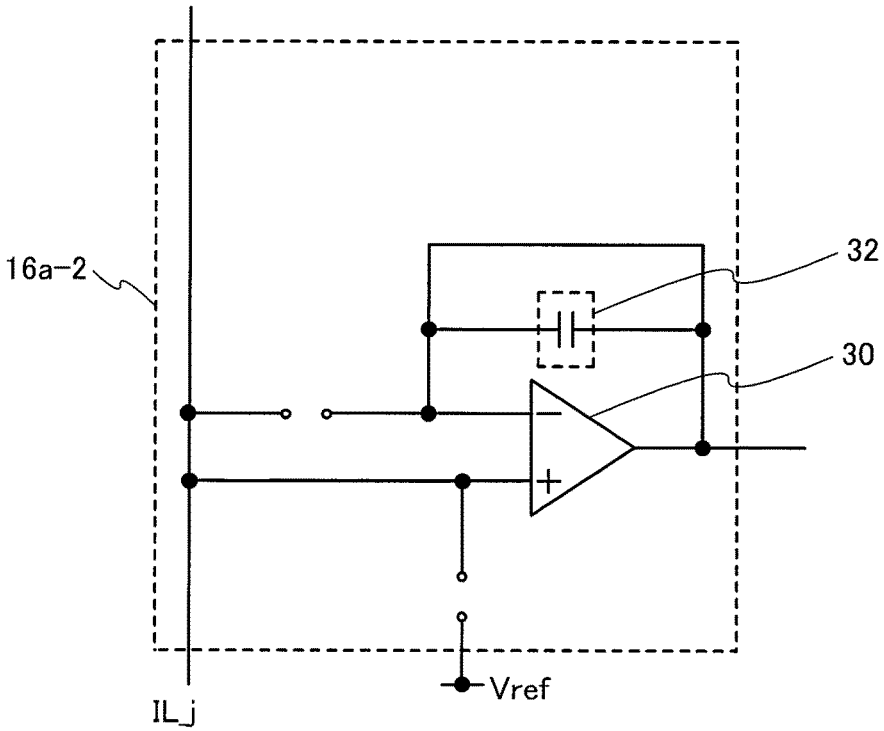

FIG. 4B illustrates a circuit configuration in an operation state different from the operation state in FIG. 4A. FIG. 4B illustrates the read circuit 16*a*-2 that corresponds to the read circuit 16*a* in FIG. 2A in which the switches 35 and 37 are off and the switches 31 and 36 are on. In the read circuit 16*a*-2, the inverting input terminal of the operational amplifier 30 is electrically connected to the output terminal of the operational amplifier 30 and the non-inverting input terminal of the operational amplifier 30 is electrically connected to the wiring IL_j.

With such a configuration, the read circuit 16*a*-2 can function as a buffer circuit or an impedance converter circuit. For example, the potential of the wiring IL_j is supplied to the non-inverting input terminal of the operational amplifier 30, and the potential of the output terminal of the operational amplifier 30 becomes equal to the potential of the wiring IL_j.

Since the read circuit 16*a*-2 functions as a voltage follower circuit as described above, the potential of the wiring IL_j can be read out. In other words, the read circuit 16*a*-2 can function as an impedance converter circuit. For example, in the case where a potential based on the threshold voltage of the transistor 22 is output from the pixel 20 to the wiring IL_j, the potential of the wiring IL_j, i.e., the potential based on the threshold voltage of the transistor 22, can be read out by the read circuit 16*a*-2.

Figure 5:
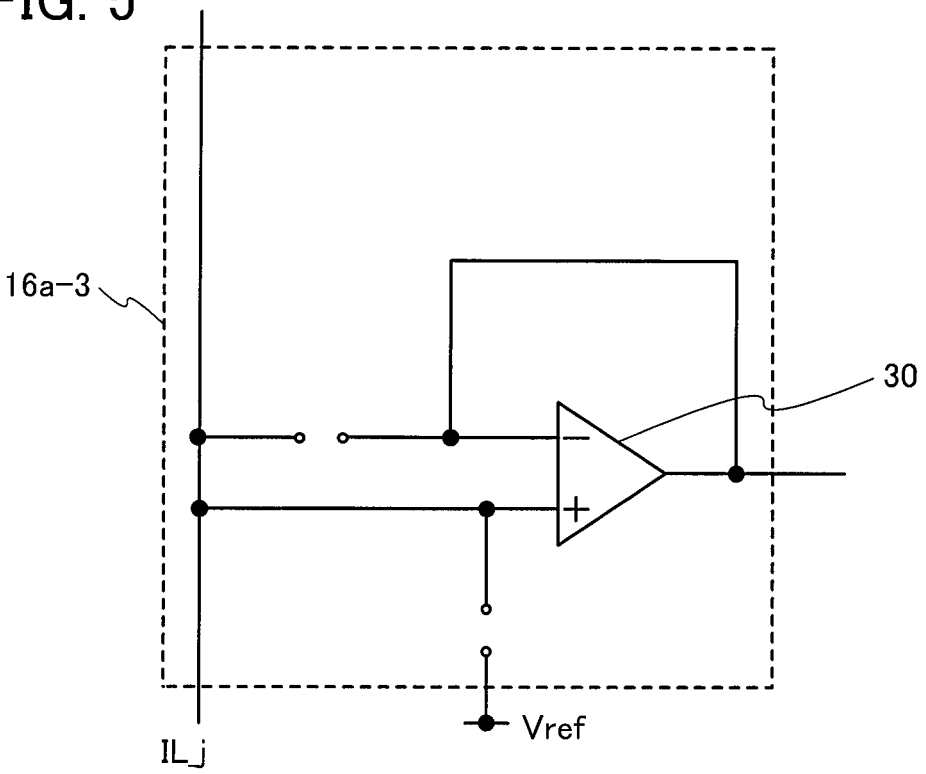
FIG. 5 is a circuit diagram illustrating one embodiment of the present invention.

Instead of the read circuit 16*a*-2 in FIG. 4B, the circuit configuration of a read circuit 16*a*-3 in FIG. 5 may be selectable. The circuit configuration of the read circuit 16*a*-3 is the circuit configuration of the read circuit 16*a*-2 in which the capacitor 32 that does not function in the circuit in FIG. 4B is omitted. The circuit configuration in FIG. 5 can be made by connecting the capacitor 32 to a switch in series and turning off the switch.

Figure 6A:
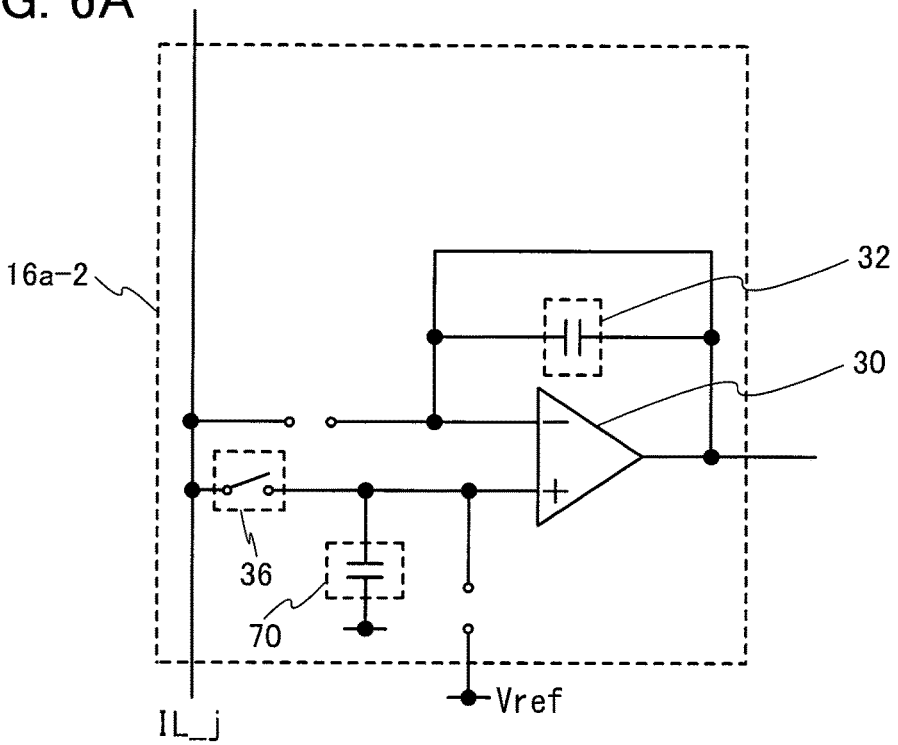
FIGS. 6A and 6B are circuit diagrams each illustrating one embodiment of the present invention.

A circuit which samples and holds the potential of the wiring IL_j may be provided. FIG. 6A illustrates the circuit configuration in FIG. 4B in which such a circuit is provided. The configuration of the read circuit 16*a*-2 in FIG. 6A is the circuit configuration in FIG. 4B in which a capacitor 70 is further provided and the conduction state of the switch 36 can be selected. The switch 36 is turned on, and the potential of the wiring IL_j is held in the capacitor 70. After that, the switch 36 is turned off. Consequently, the potential of the wiring IL_j can be sampled and held. Thus, even when the potential of the wiring IL_j is changed after the sample-and-hold operation, the operational amplifier 30 can operate without any problem. In order that the circuit configuration in FIG. 6A is selectable, the capacitor 70 is additionally provided in the read circuit 16*a* in FIG. 2A as in FIG. 6B. In the case where parasitic capacitance in the non-inverting input terminal of the operational amplifier 30 is large, the capacitor 70 is not necessarily provided. In the case where the capacitor 70 is provided, one terminal of the capacitor 70 is connected to the non-inverting input terminal of the operational amplifier 30 and the other terminal of the capacitor 70 is connected to a dedicated wiring. Note that the other terminal of the capacitor 70 may be connected to another wiring. For example, the other terminal of the capacitor 70 may be connected to the wiring Vref.

Figure 7A:
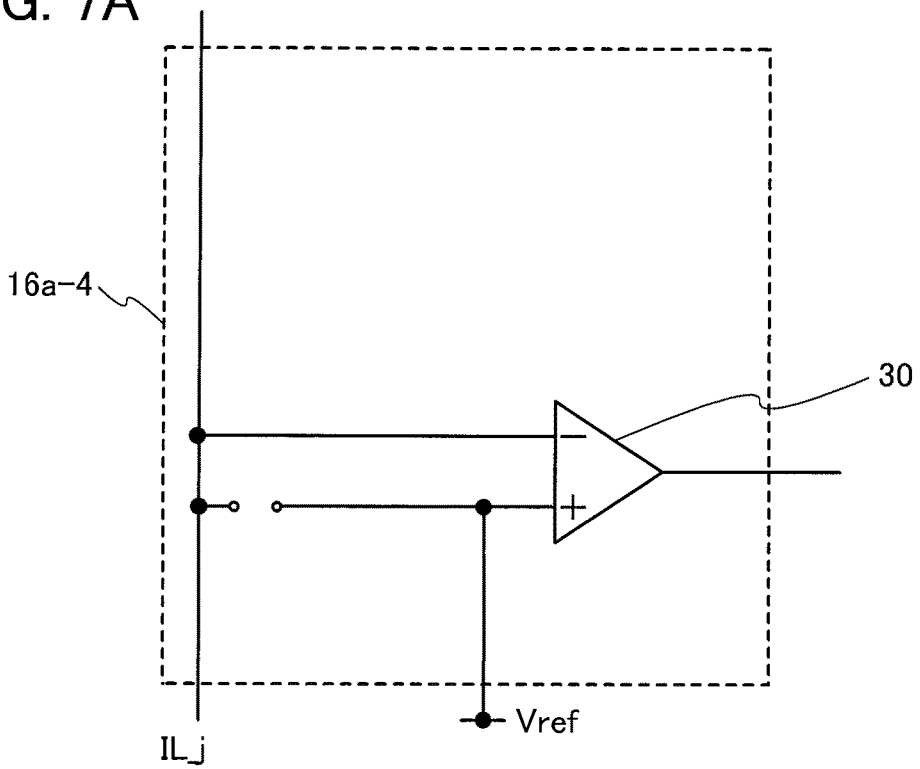
FIGS. 7A and 7B are circuit diagrams each illustrating one embodiment of the present invention.
Figure 7B:
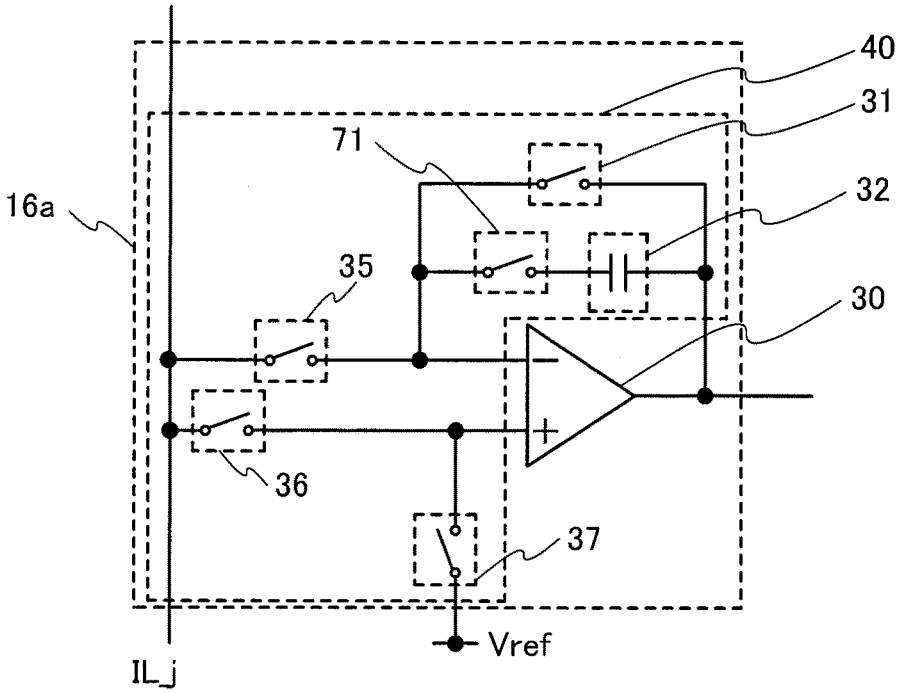

Alternatively, as illustrated in FIG. 7A, the circuit configuration of a read circuit 16*a*-4 may be selected instead of the read circuit 16*a*-2 in FIG. 4B. In the circuit configuration of the read circuit 16*a*-4, the operational amplifier 30 is not a feedback circuit. Therefore, the operational amplifier 30 functions as a comparator circuit. In other words, the potential of the wiring Vref which is electrically connected to the non-inverting input terminal of the operational amplifier 30 and the potential of the wiring IL_j which is electrically connected to the inverting input terminal of the operational amplifier 30 are compared in height, and in accordance with the comparison result, a signal is output from the output terminal of the operational amplifier 30. Here, by controlling the potential of the wiring Vref, the read circuit 16*a*-4 can function as an A/D converter circuit. For example, A/D conversion can be performed by changing the potential of the wiring Vref to a sawtooth wave shape, a step-like wave shape, a triangular wave shape, or the like. In this case, in order to prevent formation of a feedback circuit, the capacitor 32 and the switch 71 may be connected in series as illustrated in FIG. 7B. By turning off the switch 71, the circuit illustrated in FIG. 7A or FIG. 5 can be provided.

Figure 8A:
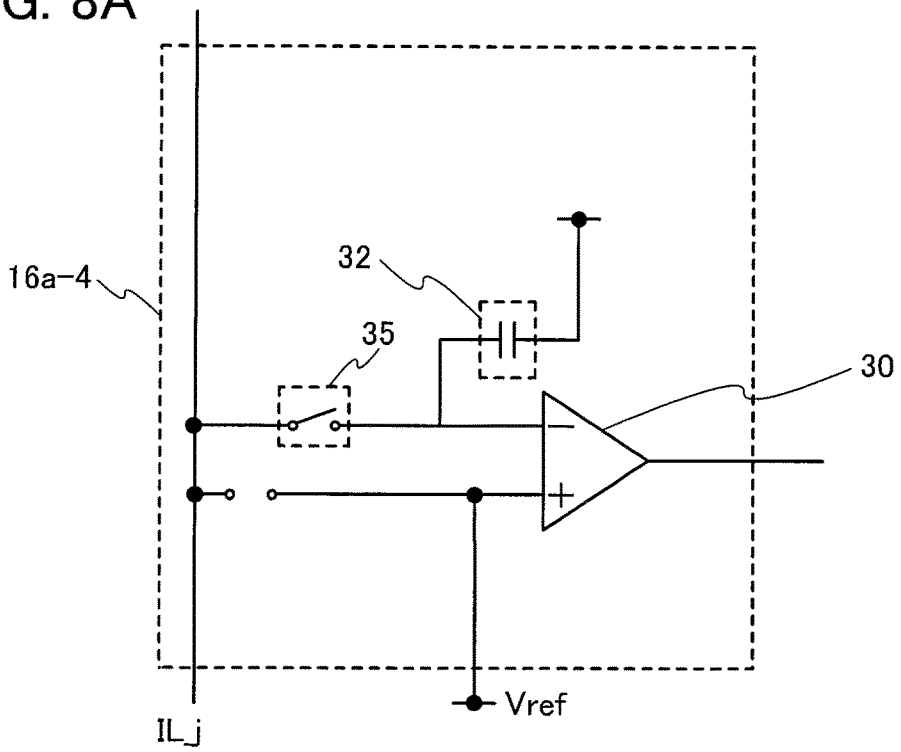
FIGS. 8A and 8B are circuit diagrams each illustrating one embodiment of the present invention.
Figure 8B:
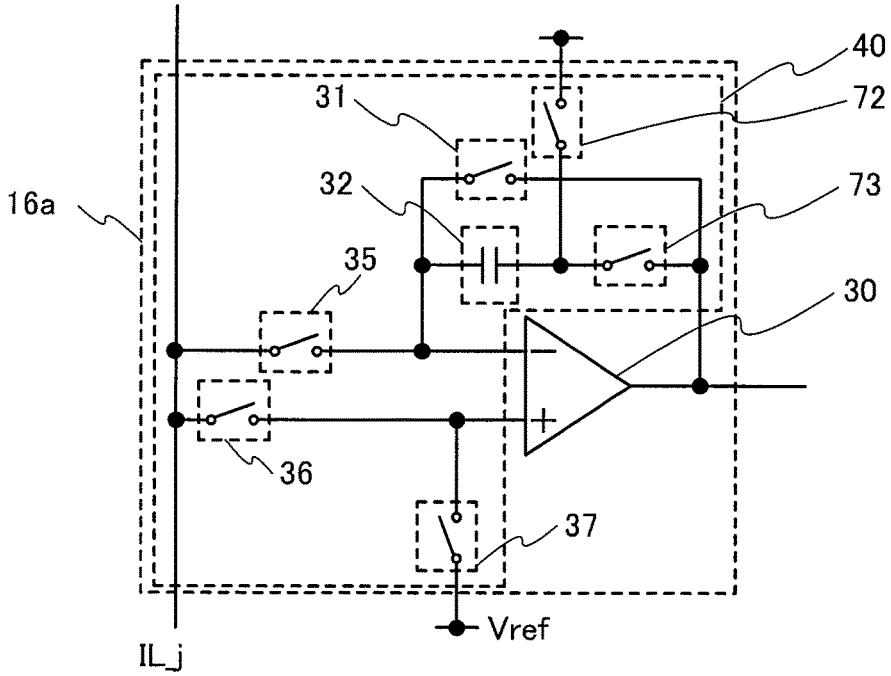

A sample-and-hold circuit may be provided also in the case of the read circuit 16*a*-4. For example, the capacitor 32 may be used as a sample-and-hold capacitor. FIG. 8A illustrates the circuit configuration of the read circuit 16*a*-4 in that case. First, the switch 35 is turned on, and the potential of the wiring IL_j is held in the capacitor 32. Then, the switch 35 is turned off. Consequently, the potential of the wiring IL_j can be sampled and held. Thus, even when the potential of the wiring IL_j is changed after the sample-and-hold operation, the operational amplifier 30 can operate without any problem. In order that the circuit configuration in FIG. 8A is selectable, a switch 72 and a switch 73 are additionally provided in the read circuit 16*a* in FIG. 2A as illustrated in FIG. 8B. The switch 72 is provided between a dedicated wiring and the other electrode of the capacitor 32, and the switch 73 is provided between the other electrode of the capacitor 32 and the output terminal of the operational amplifier 30. In the case of forming the configuration of the read circuit 16*a*-4 in FIG. 8A, the switch 72 is on and the switch 73 is off. In the case of forming the configuration of the read circuit 16*a*-1 in FIG. 4A, the switch 72 is off and the switch 73 is on.

Figure 9:
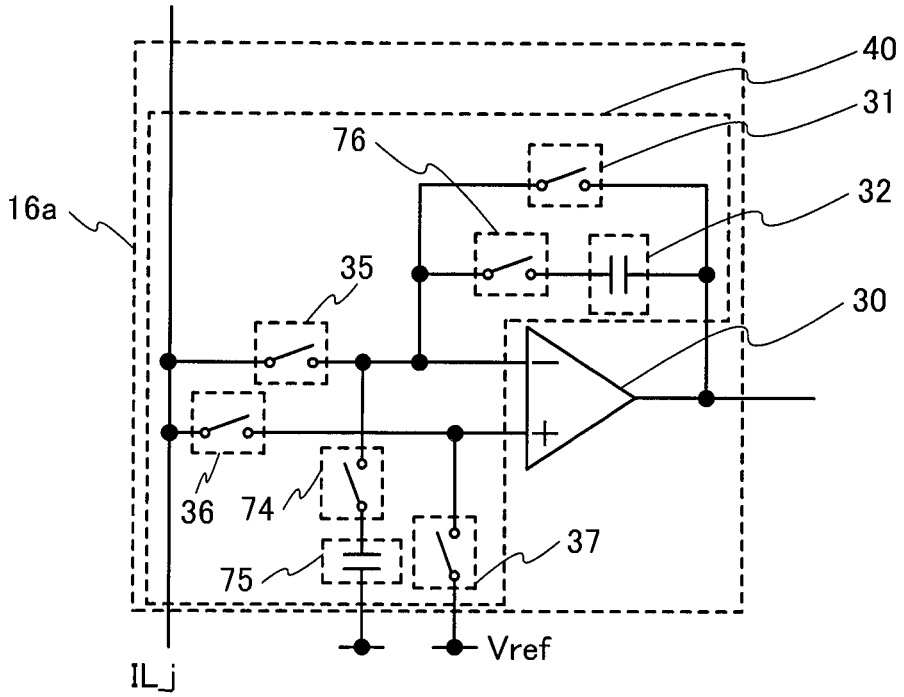
FIG. 9 is a circuit diagram illustrating one embodiment of the present invention.

In order that the circuit configuration in FIG. 8A is selectable, a switch 74, a switch 76, and a capacitor 75 are provided in the read circuit 16*a* in FIG. 2A as illustrated in FIG. 9. The switch 74 and the capacitor 75 are provided in series between a dedicated wiring and the inverting input terminal of the operational amplifier 30, and the switch 76 is provided between the inverting input terminal of the operational amplifier 30 and the one electrode of the capacitor 32. In the case where charge is held in the capacitor 75, the switch 74 is on and the switch 76 is off.

Figure 10:
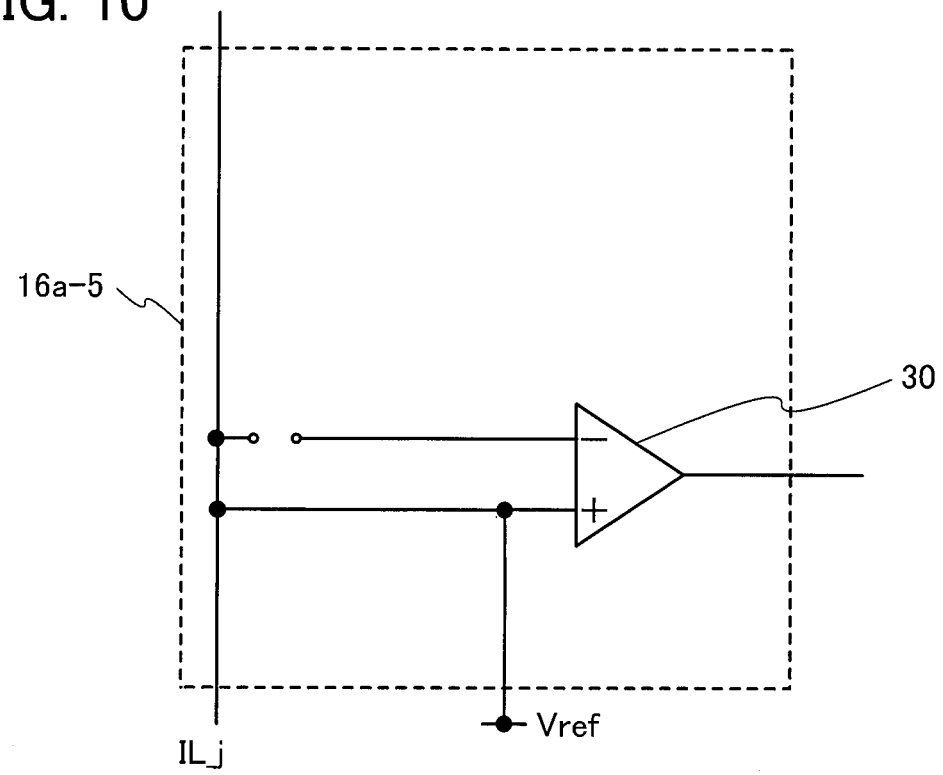
FIG. 10 is a circuit diagram illustrating one embodiment of the present invention.

FIG. 10 illustrates a circuit configuration in an operation state different from the operation states in FIGS. 4A and 4B and the like. FIG. 10 illustrates a read circuit 16*a*-5 that corresponds to the read circuit 16*a* in FIG. 2A in which the switch 35 is off and the switches 36 and 37 are on. The switch 31 may be on or off. Thus, a predetermined potential can be supplied from the read circuit 16*a*-5 to the wiring IL_j. That is, the potential of the wiring Vref can be supplied to the wiring IL_j and the pixel 20. Also in FIG. 4A, the potential of the wiring Vref can be supplied to the wiring IL_j and the pixel 20. However, in that case, the operational amplifier 30 needs to operate as an integrator circuit. In contrast, in FIG. 10, the operational amplifier 30 does not need to operate. In other words, in FIG. 10, while the power consumption of the operational amplifier is suppressed, the potential of the wiring Vref can be supplied to the wiring IL_j and the pixel 20.

By changing the conduction states of the switches in this manner, the read circuit can perform a variety of functions utilizing the operational amplifier 30.

Note that the switches 31 and 35 to 37 and the like in the read circuit 16*a* are not necessarily provided to have the connection relations illustrated in FIG. 2A, FIG. 6B, FIG. 7B, FIG. 8B, and FIG. 9. The switches are provided as appropriate in order that at least two of the circuit configurations of the read circuits 16*a*-1 to 16*a*-5 are selectable by controlling the conduction states of the switches. Thus, a novel circuit may be formed by partly combining FIG. 2A, FIG. 6B, FIG. 7B, FIG. 8B, and FIG. 9. For example, the switches are preferably provided as appropriate in order that whether the inverting input terminal of the operational amplifier 30 is electrically connected to the wiring IL_j or to the output terminal of the operational amplifier 30 can be selected and whether the non-inverting input terminal of the operational amplifier 30 is electrically connected to the wiring Vref to which the reference potential is supplied or to the wiring IL_j can be selected.

As described above, the read circuit 16*a* can switch between at least two of the read circuit 16*a*-1 functioning as an integrator circuit, the read circuit 16*a*-2 functioning as a voltage follower circuit, the read circuit 16*a*-4 functioning as a comparator circuit, and the read circuit 16*a*-5 having a function of supplying a predetermined voltage to a pixel. Note that all of the functions of the read circuit 16*a*-1 functioning as an integrator circuit, the read circuit 16*a*-2 functioning as a voltage follower circuit, the read circuit 16*a*-4 functioning as a comparator circuit, and the read circuit 16*a*-5 having a function of supplying a predetermined voltage to a pixel do not need to be achieved. It is only necessary that at least one of, desirably, at least two of the functions be achieved.

Since the read circuit 16*a* can read out a plurality of kinds of data as data on current characteristics of a transistor, variation in the current characteristics can be corrected more accurately. In addition, the read circuit 16*a* carries out a function of reading a plurality of kinds of data by switching the connection of the operational amplifier 30.

Thus, the accuracy of correcting variation in the current characteristics can be increased with little increase in the area occupied by the read circuit 16. Accordingly, the area occupied by the driver circuit portion where the read circuit 16 is provided can be reduced, so that the frame of the display device can be narrowed.

The example where the capacitor 32 is used as a passive element in the function selection portion 40 is described above. However, one embodiment of the present invention is not limited thereto. As the passive element, a resistor, a capacitor, a coil, or the like can be used.

An example where a resistor is used is described below. In the case of using a resistor, the capacitor may be replaced with a resistor. Alternatively, the capacitor may be replaced with a resistor and a switch which is connected to the resistor in series. The circuit configuration can be obtained by such replacement.

Figure 11A:
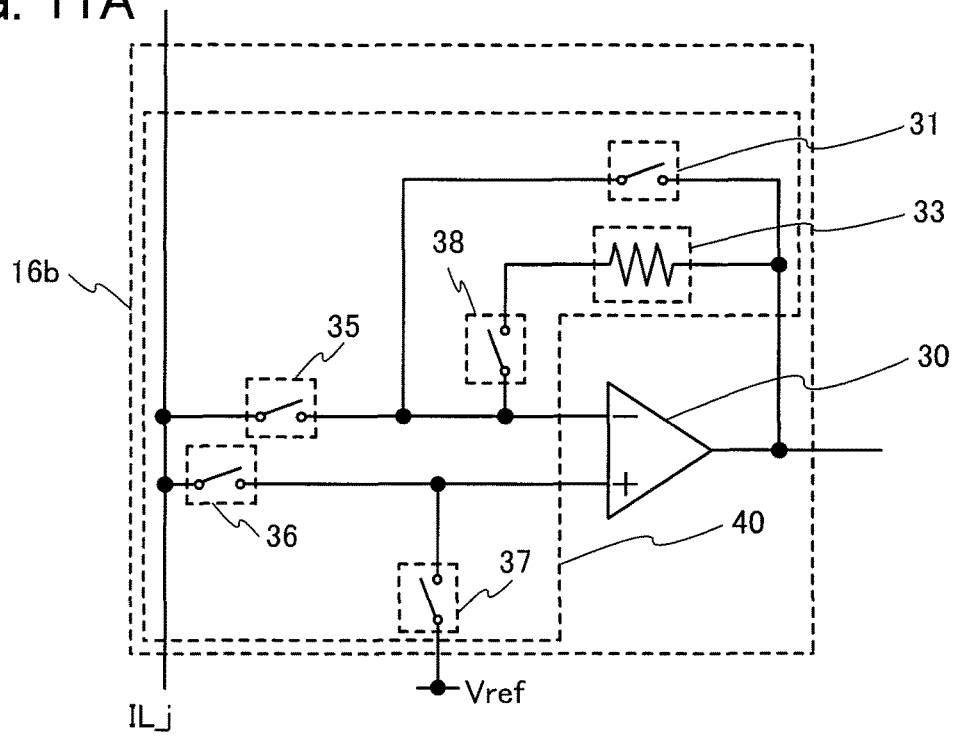
FIGS. 11A and 11B are circuit diagrams illustrating one embodiment of the present invention.

FIG. 11A illustrates an example where the capacitor 32 is replaced with a resistor 33 and a switch 38 in FIG. 2A. The switch 38 is connected to the resistor 33 in series. Although the example where the passive element is changed in FIG. 2A is described here, one embodiment of the present invention is not limited thereto. Another circuit configuration can be obtained by changing the passive element, as in FIG. 2A and FIG. 11A.

Next, a read circuit in FIG. 11A is described. A read circuit 16*b* in FIG. 11A includes the operational amplifier 30 and the function selection portion 40. The function selection portion 40 includes the resistor 33, the switch 31, the switch 35, the switch 36, the switch 37, and the switch 38. The inverting input terminal of the operational amplifier 30 is electrically connected to the wiring IL_j through the switch 35, is electrically connected to the output terminal of the operational amplifier 30 through the switch 31, and is electrically connected to the one electrode of the resistor 33 through the switch 38. The non-inverting input terminal of the operational amplifier 30 is electrically connected to the wiring IL_j through the switch 36 and is electrically connected to the wiring Vref to which the reference potential is supplied through the switch 37. The output terminal of the operational amplifier 30 is electrically connected to the other electrode of the resistor 33.

Although not illustrated, the wiring IL_j is electrically connected to the pixel 20, and the transistor 22 is also electrically connected to the wiring IL_j.

The wiring Vref to which the reference potential is supplied may be supplied with an arbitrary potential without limitation to the reference potential so that the arbitrary potential can be supplied to the non-inverting input terminal of the operational amplifier 30. The operational amplifier 30 operates so that the potential of the non-inverting input terminal is equal to the potential of the inverting input terminal; thus, the potential of the wiring IL_j can be controlled by the potential of the non-inverting input terminal. By controlling the potential of the non-inverting input terminal of the operational amplifier 30, the read circuit 16 can control the potential of the wiring IL_j. Accordingly, for example, at the time of reading, a current flowing through the transistor 22 can be prevented from flowing to the light-emitting element 24.

The read circuit 16 can operate in the following manner, for example. The switches 35, 37, and 38 can operate in synchronization with each other, for example. Note that one embodiment of the present invention is not limited thereto. For example, in the case where the reading operation is not performed, a predetermined potential is supplied from the read circuit 16 to the wiring IL_j in some cases. In such a case, the switch 35 may be turned off and the switches 36 and 37 may be turned on. Consequently, the potential of the wiring Vref can be supplied to the wiring IL_j and the pixel 20. Alternatively, the switch 35 (and/or the switch 37) and the switch 36 can operate inversely, for example. In other words, the switch 35 (and/or the switch 37) and the switch 36 can operate so that when one of the switch 35 (and/or the switch 37) and the switch 36 is in an on state, the other is in an off state. Furthermore, controlling the conduction states of the switches 31, 35, and 38 enables selecting whether the inverting input terminal of the operational amplifier 30 is electrically connected to the wiring IL_j and the one electrode of the resistor 33 or to the output terminal of the operational amplifier 30. Furthermore, controlling the conduction states of the switches 37 and 36 enables selecting whether the non-inverting input terminal of the operational amplifier 30 is electrically connected to the wiring Vref to which the reference potential is supplied or to the wiring IL_j.

Figure 11B:
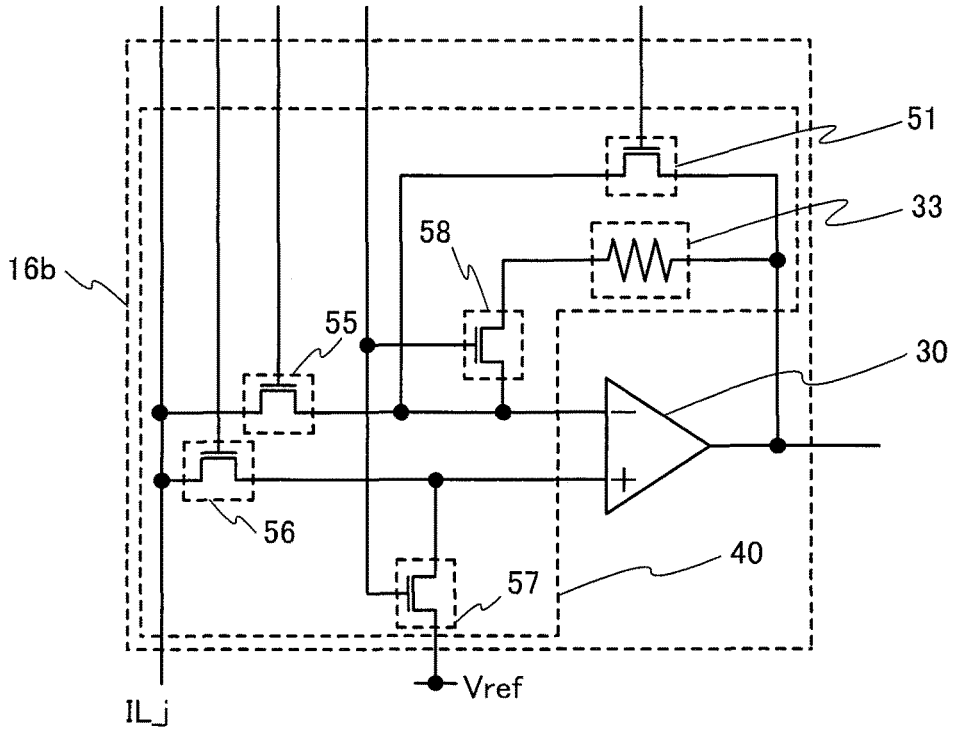

As switches such as the switch 38, like the switches 31 and 35 to 37, electrical switches, mechanical switches, MEMS elements, or the like may be used. For example, transistors described later are preferably used as electrical switches. FIG. 11B is a circuit diagram in the case where transistors are used, for example. The read circuit in FIG. 11B is the read circuit in FIG. 11A in which the transistor 51, the transistor 55, the transistor 56, the transistor 57, and a transistor 58 are used as the switch 31, the switch 35, the switch 36, the switch 37, and the switch 38, respectively. By selecting the polarities of the transistors, a CMOS structure may be employed as in FIGS. 3A and 3B.

Next, a circuit configuration that can serve the functions of the read circuit 16*b* is described. The read circuit 16*b* has a plurality of functions. The circuit configuration of the read circuit 16*b* varies depending on which function is carried out. In other words, by controlling the conduction states of the switches in the function selection portion 40, the read circuit 16*b* can perform a plurality of functions.

Figure 12A:
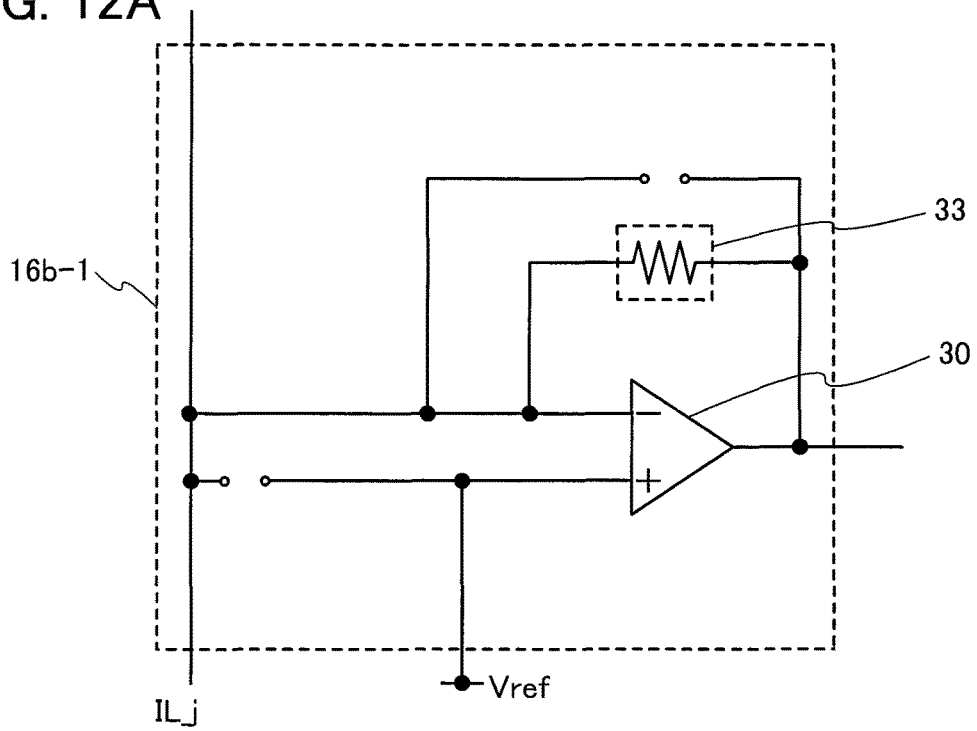
FIGS. 12A and 12B are circuit diagrams illustrating one embodiment of the present invention.

For example, a circuit configuration in a certain operation state is illustrated in FIG. 12A. FIG. 12A illustrates a read circuit 16*b*-1 that corresponds to the read circuit 16*b* in FIG. 11A in which the switches 35, 37, and 38 of are on and the switches 31 and 36 are off. In the read circuit 16*b*-1, the inverting input terminal of the operational amplifier 30 is electrically connected to the wiring IL_j and the one electrode of the resistor 33, and the non-inverting input terminal of the operational amplifier 30 is electrically connected to the wiring Vref to which the reference potential is supplied.

With such a configuration, the read circuit 16*b* can function as a current-voltage converter circuit. For example, when a current flows through the wiring IL_j, a voltage drop occurs between the electrodes of the resistor 33 electrically connected to the wiring IL_j. In other words, a current flowing through the wiring IL_j can be obtained from the voltage of the output terminal of the operational amplifier 30 and the resistance value of the resistor 33. Consequently, the value of the current flowing through the wiring IL_j can be read out. Note that the output terminal of the operational amplifier 30 is connected to, for example, an A/D converter circuit or a memory circuit. By utilizing the read current value, variation in current characteristics of the transistor 22 in the pixel 20 can be corrected.

Since the read circuit 16*b*-1 functions as the current-voltage converter circuit as described above, the current value of the wiring IL_j can be read out.

Figure 12B:
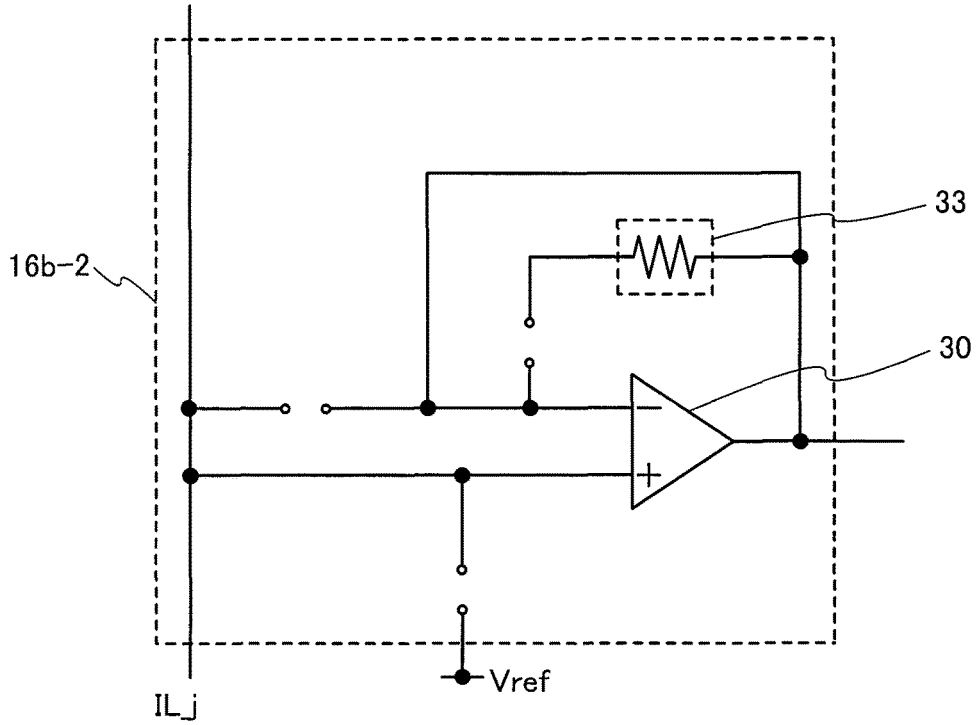

FIG. 12B illustrates a circuit configuration in an operation state different from the operation state in FIG. 12A. FIG. 12B illustrates the read circuit 16*b*-2 that corresponds to the read circuit 16*b* in FIG. 11A in which the switches 35, 37, and 38 are off and the switches 31 and 36 are on. In the read circuit 16*b*-2, the inverting input terminal of the operational amplifier 30 is electrically connected to the output terminal of the operational amplifier 30 and the non-inverting input terminal of the operational amplifier 30 is electrically connected to the wiring IL_j.

With such a configuration, the read circuit 16*b*-2 can function as a buffer circuit or an impedance converter circuit. For example, the potential of the wiring IL_j is supplied to the non-inverting input terminal of the operational amplifier 30, and the potential of the output terminal of the operational amplifier 30 becomes equal to the potential of the wiring IL_j.

Since the read circuit 16*b*-2 functions as a voltage follower circuit as described above, the potential of the wiring IL_j can be read out. In other words, the read circuit 16*b*-2 can function as an impedance converter circuit. For example, in the case where a potential based on the threshold voltage of the transistor 22 is output from the pixel 20 to the wiring IL_j, the potential of the wiring IL_j, i.e., the potential based on the threshold voltage of the transistor 22, can be read out by the read circuit 16*b*-2.

Figure 13:
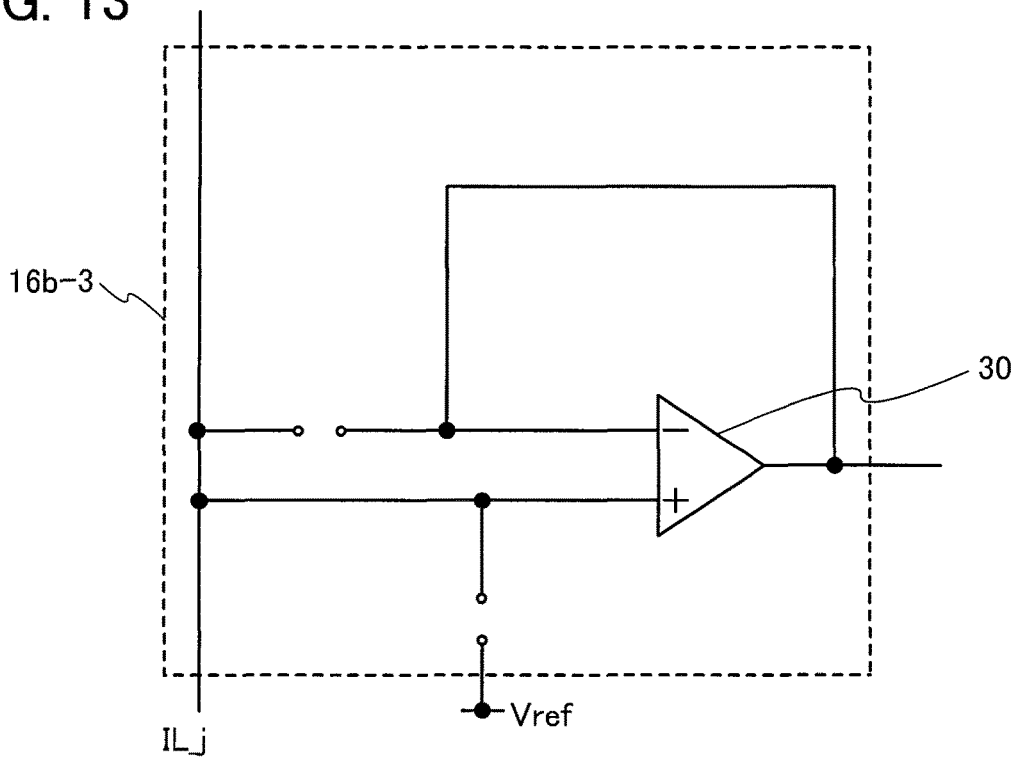
FIG. 13 is a circuit diagram illustrating one embodiment of the present invention.

Instead of the read circuit 16*b*-2 in FIG. 12B, the circuit configuration of a read circuit 16*b*-3 in FIG. 13 may be selectable. The circuit configuration of the read circuit 16*b*-3 is the circuit configuration of the read circuit 16*b*-2 in which the resistor 33 that does not function in the circuit in FIG. 12B is omitted.

Figure 6B:
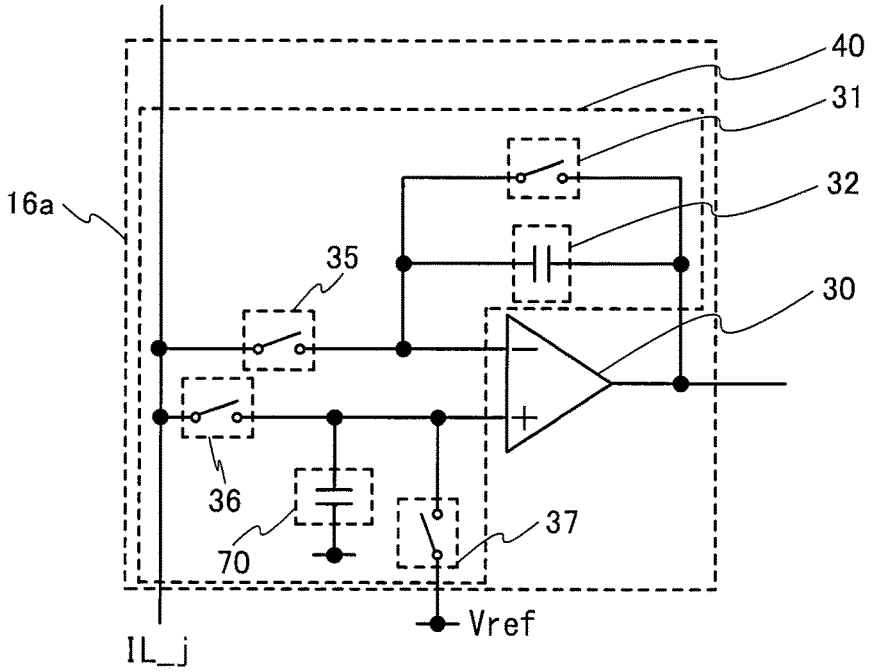
Figure 14A:
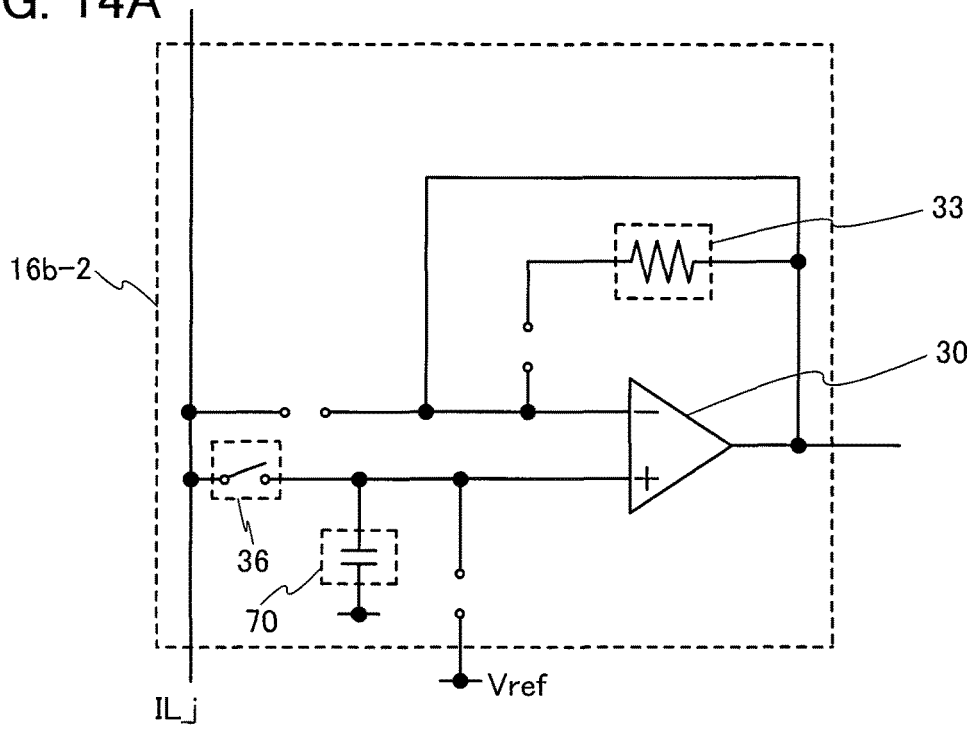
FIGS. 14A and 14B are circuit diagrams illustrating one embodiment of the present invention.
Figure 14B:
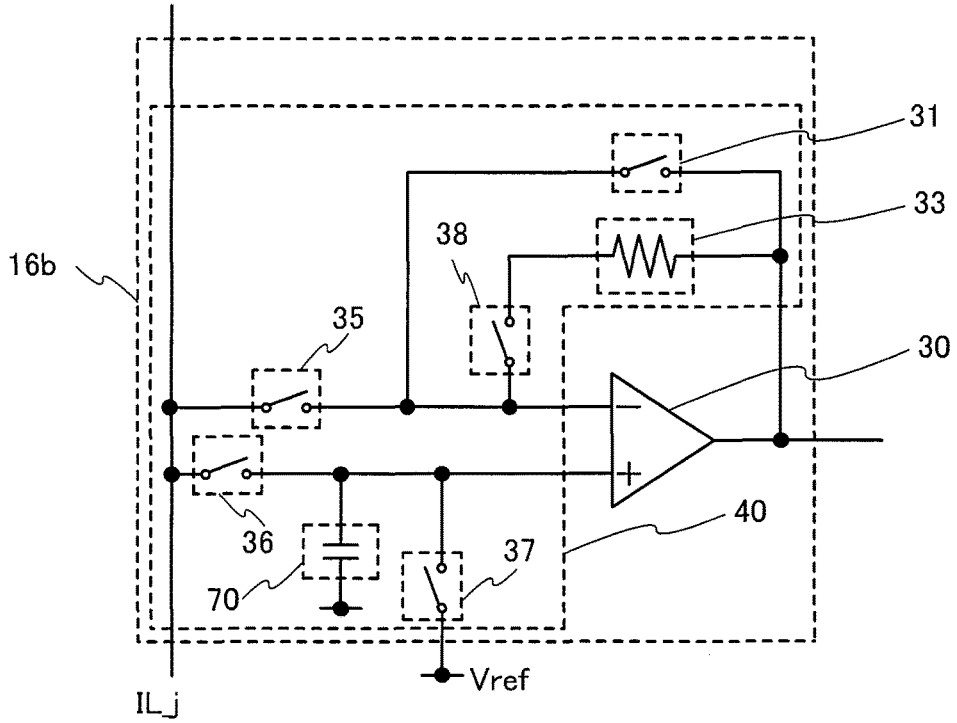
Figure 15:
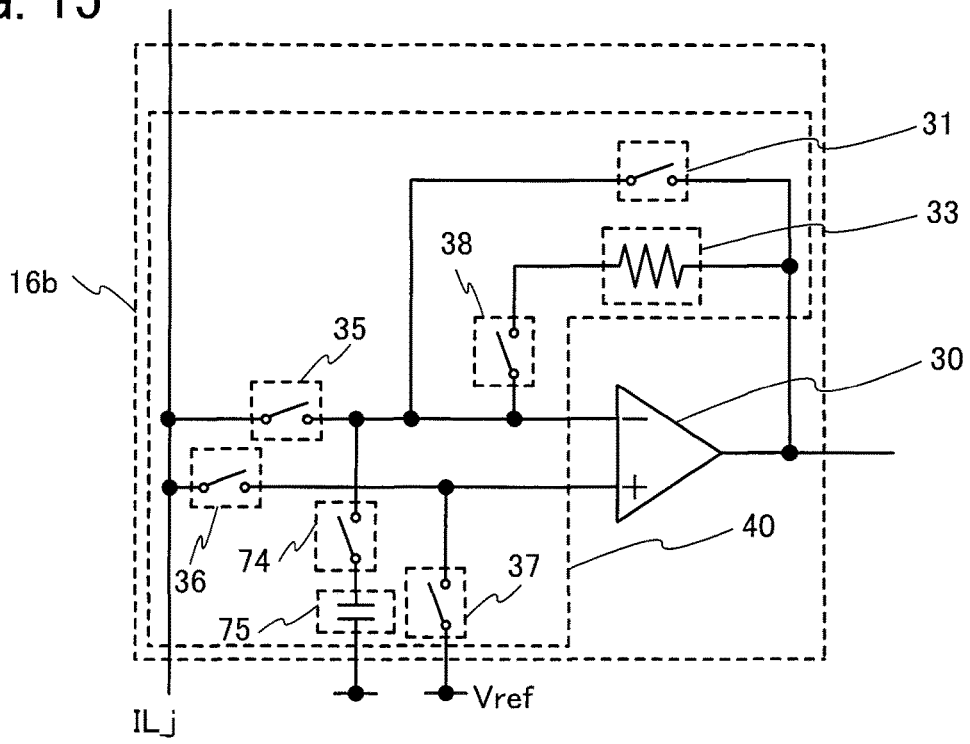
FIG. 15 is a circuit diagram illustrating one embodiment of the present invention.

In the read circuit 16*b*, a circuit which samples and holds the potential of the wiring IL_j may be provided as in FIGS. 6A and 6B. FIGS. 14A and 14B illustrate examples of that case. The read circuit 16*b*-2 in FIG. 14A has the circuit configuration in FIG. 12B in which as in FIG. 6A, the capacitor 70 and the switch 36 are provided. The read circuit 16*b* in FIG. 14B has the circuit configuration in FIG. 11A in which as in FIG. 6B, the capacitor 70 is provided. Alternatively, the read circuit 16*b* may have the circuit configuration illustrated in FIG. 7A or FIG. 10. Alternatively, in the read circuit 16*b*, a circuit which samples and holds the potential of the wiring IL_j may be provided, as in FIG. 8A and FIG. 9. FIG. 15 illustrates an example of that case. The read circuit 16*b* in FIG. 15 has the circuit configuration in FIG. 11A in which as in FIG. 9, the switch 74 and the capacitor 75 are provided.

By changing the conduction states of the switches in this manner, the read circuit can perform a variety of functions utilizing the operational amplifier 30.

The switches 31 and 35 to 38 in the read circuit 16*b* are not necessarily provided to have the connection relations illustrated in FIG. 11A, FIG. 14B, and FIG. 15. The switches are provided as appropriate in order that the circuit configurations of the read circuits 16*b*-1 and 16*b*-2 and the like can be selected by controlling the conduction states of the switches. Thus, a novel circuit may be formed by partly combining FIG. 11A, FIG. 14B, FIG. 15, FIGS. 2A and 2B, FIG. 6B, FIG. 7B, FIG. 8B, and FIG. 9. For example, the switches are preferably provided as appropriate in order that whether the inverting input terminal of the operational amplifier 30 is electrically connected to the wiring IL_j and the resistor 33 or to the output terminal of the operational amplifier 30 can be selected and whether the non-inverting input terminal of the operational amplifier 30 is electrically connected to the wiring Vref to which the reference potential is supplied or to the wiring IL_j can be selected.

As described above, the read circuit 16*b* can switch between the read circuit 16*b*-1 functioning as the current-voltage converter circuit, the read circuit 16*b*-2 functioning as the voltage follower circuit, and the like.

Since the read circuit 16*b* can read out a plurality of kinds of data as data on current characteristics of a transistor, variation in the threshold voltage can be corrected more accurately. In addition, the read circuit 16*b* carries out a function of reading a plurality of kinds of data by switching the connection of the operational amplifier 30.

Thus, the accuracy of correcting variation in the current characteristics can be increased with little increase in the area occupied by the read circuit 16. Accordingly, the area occupied by the driver circuit portion where the read circuit 16 is provided can be reduced, so that the frame of the display device can be narrowed.

The example where one of the capacitor 32 and the resistor 33 is used as the passive element in the function selection portion 40 is described above. However, one embodiment of the present invention is not limited thereto. For example, a plurality of passive elements can be used.

An example where a resistor and a capacitor are used is described. In the case of using a resistor and a capacitor, the resistor and the capacitor are connected to the respective switches in series. The switch and the resistor are connected in parallel to the switch and the capacitor. The circuit configuration can be obtained by such replacement.

Figure 16:
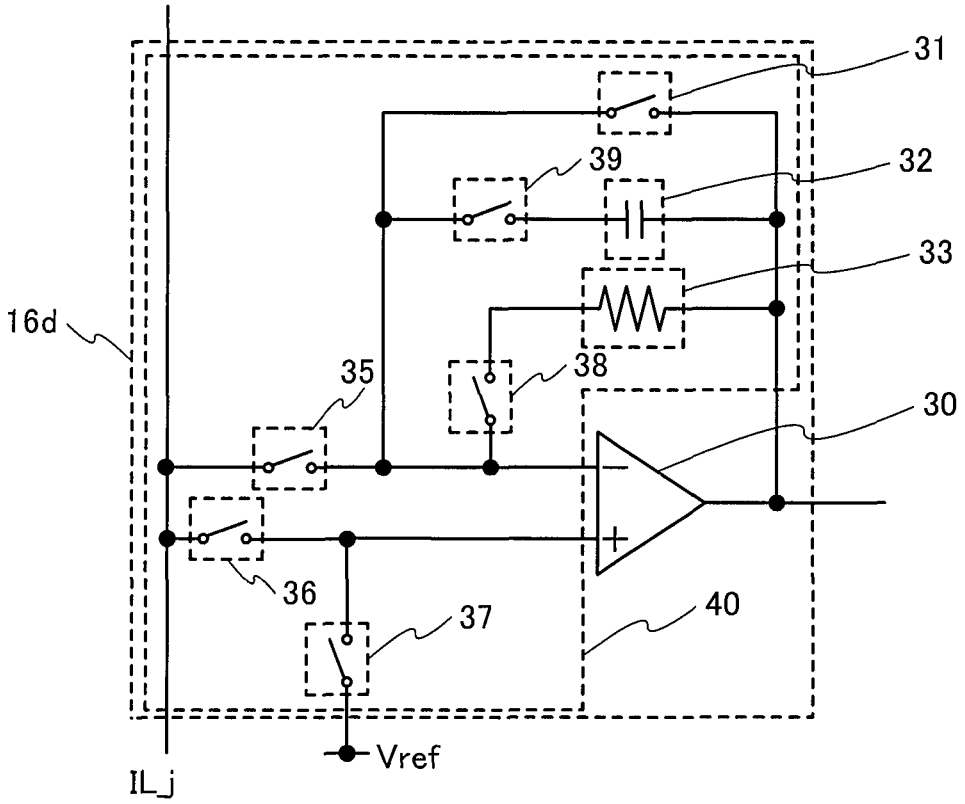
FIG. 16 is a circuit diagram illustrating one embodiment of the present invention.

FIG. 16 illustrates an example where both of the capacitor 32 in FIG. 2A and the resistor 33 in FIG. 11A are provided. In the read circuit 16*d* in FIG. 16, three or more kinds of data can be selectively read out.

The read circuit 16*d* includes the operational amplifier 30 and the function selection portion 40. The function selection portion 40 includes the capacitor 32, the switch 31, the resistor 33, and the switches 35 to 39. The inverting input terminal of the operational amplifier 30 is electrically connected to the wiring IL_j through the switch 35, is electrically connected to the output terminal of the operational amplifier 30 through the switch 31, is electrically connected to the one electrode of the capacitor 32 through the switch 39, and is electrically connected to the one electrode of the resistor 33 through the switch 38. The non-inverting input terminal of the operational amplifier 30 is electrically connected to the wiring IL_j through the switch 36, and is electrically connected to the wiring Vref to which the reference potential is supplied through the switch 37. The output terminal of the operational amplifier 30 is electrically connected to the other electrode of the capacitor 32 and is electrically connected to the other electrode of the resistor 33.

The read circuit 16*d* functions as an integrator circuit when the switches 35, 37, and 39 are on and the switches 36 and 38 are off. In this case, the switch 31 functions as a reset circuit of the integrator circuit. The read circuit 16*d* functions as a current-voltage converter circuit when the switches 35, 37, and 38 are on and the switches 31, 36, and 39 are off. Furthermore, the read circuit 16*d* functions as the voltage follower circuit when the switches 31 and 36 are on and the switches 35 and 37 to 39 are off.

In the case where the read circuit 16*d* in FIG. 16 does not operate as the voltage follower circuit, the switches 35 to 37 may be omitted in FIG. 16. An example of that case is illustrated in FIG. 17A.

Figure 17A:
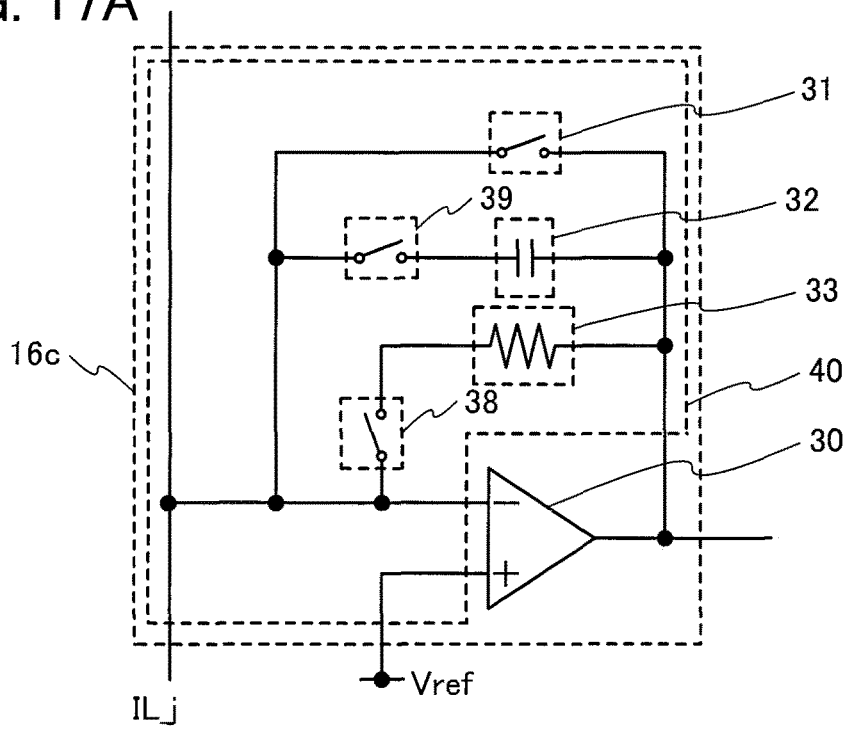
FIGS. 17A and 17B are circuit diagrams illustrating one embodiment of the present invention.

Next, a read circuit in FIG. 17A is described. A read circuit 16*c* in FIG. 17A includes the operational amplifier 30 and the function selection portion 40. The function selection portion 40 includes the capacitor 32, the resistor 33, the switch 31, the switch 38, and the switch 39. The inverting input terminal of the operational amplifier 30 is electrically connected to the wiring IL_j, is electrically connected to the output terminal of the operational amplifier 30 through the switch 31, is electrically connected to the one electrode of the capacitor 32 through the switch 39, and is electrically connected to the one electrode of the resistor 33 through the switch 38. The non-inverting input terminal of the operational amplifier 30 is electrically connected to the wiring Vref to which the reference potential is supplied. The output terminal of the operational amplifier 30 is electrically connected to the other electrode of the capacitor 32 and is electrically connected to the other electrode of the resistor 33. By controlling the conduction states of the switches 38 and 39, whether the inverting input terminal of the operational amplifier 30 is electrically connected to the capacitor 32 or to the resistor 33 can be selected.

Although not illustrated, the wiring IL_j is electrically connected to the pixel 20, and the transistor 22 is also electrically connected to the wiring IL_j.

The wiring Vref to which the reference potential is supplied may be supplied with an arbitrary potential without limitation to the reference potential so that the arbitrary potential can be supplied to the non-inverting input terminal of the operational amplifier 30. The operational amplifier 30 operates so that the potential of the non-inverting input terminal is equal to the potential of the inverting input terminal; thus, the potential of the wiring IL_j can be controlled by the potential of the non-inverting input terminal. By controlling the potential of the non-inverting input terminal of the operational amplifier 30, the read circuit 16 can control the potential of the wiring IL_j. Accordingly, for example, at the time of reading, a current flowing through the transistor 22 can be prevented from flowing to the light-emitting element 24.

Figure 17B:
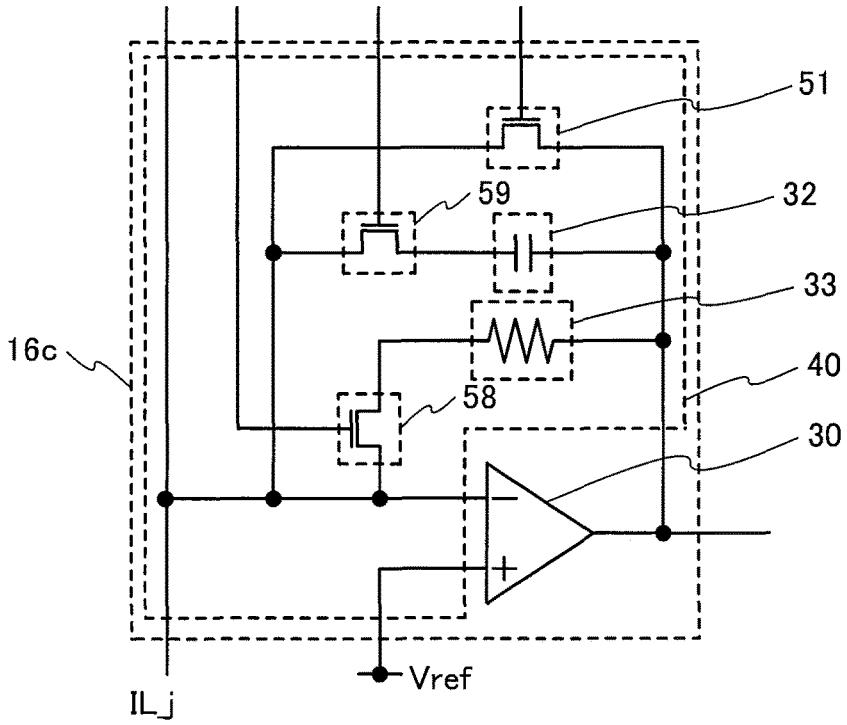

As switches such as the switch 39, like the switches 31 and 35 to 38, electrical switches, mechanical switches, MEMS elements, or the like may be used. For example, transistors described later are preferably used as electrical switches. FIG. 17B is a circuit diagram in the case where transistors are used, for example. The read circuit in FIG. 17B is the read circuit in FIG. 17A in which the transistor 51, the transistor 58, and a transistor 59 are used as the switch 31, the switch 38, and the switch 39, respectively. By selecting the polarities of the transistors, a CMOS structure may be employed as in FIGS. 3A and 3B.

Next, a circuit configuration that can serve the functions of the read circuit 16*c* is described. The read circuit 16*c* has a plurality of functions. The circuit configuration of the read circuit 16*c* varies depending on which function is carried out. In other words, by controlling the conduction states of the switches in the function selection portion 40, the read circuit 16*c* can perform a plurality of functions.

Figure 18A:
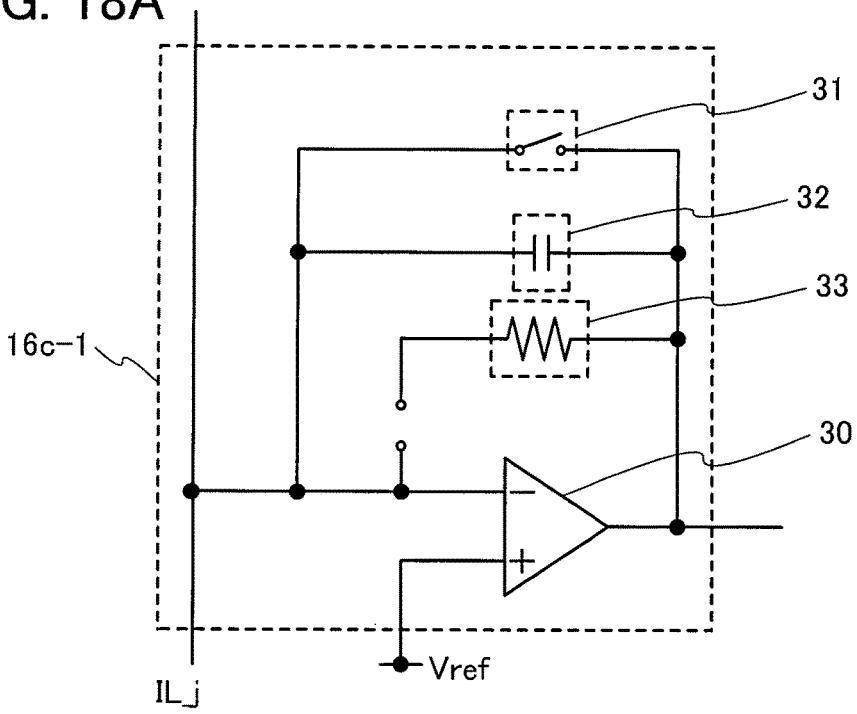
FIGS. 18A and 18B are circuit diagrams illustrating one embodiment of the present invention.

For example, a circuit configuration in one operation state is illustrated in FIG. 18A. FIG. 18A illustrates a read circuit 16*c*-1 that corresponds to the read circuit 16*c* in FIG. 17A in which the switch 39 is on and the switch 38 is off. In the read circuit 16*c*-1, the inverting input terminal of the operational amplifier 30 is electrically connected to the wiring IL_j and the one electrode of the capacitor 32. Here, the switch 31 is turned on when charge held in the capacitor 32 is initialized.

With this configuration, the read circuit 16*c* can function as an integrator circuit. For example, when a current flows through the wiring IL_j, charge based on the current flowing time is accumulated in the capacitor 32, and a potential difference is generated between electrodes of the capacitor 32 in accordance with the accumulated charge. In other words, a voltage of the output terminal of the operational amplifier 30 can be obtained by integrating the current flowing through the wiring IL_j with respect to the measurement time. Consequently, the total amount of the current flowing through the wiring IL_j can be read out. Note that the output terminal of the operational amplifier 30 is connected to, for example, an A/D converter circuit or a memory circuit. By utilizing the read current value, variation in current characteristics of the transistor 22 in the pixel 20 can be corrected.

Since the read circuit 16*c*-1 functions as an integrator circuit as described above, an integral value of the current passing through the wiring IL_j can be read out.

By turning on the switch 31 before current measurement, charge accumulated in the capacitor 32 may be discharged. That is, the switch 31 functions as a reset circuit in the read circuit 16*c*-1. Therefore, depending on conditions, the switch 31 preferably operates independently of the switch 39, for example.

Figure 18B:
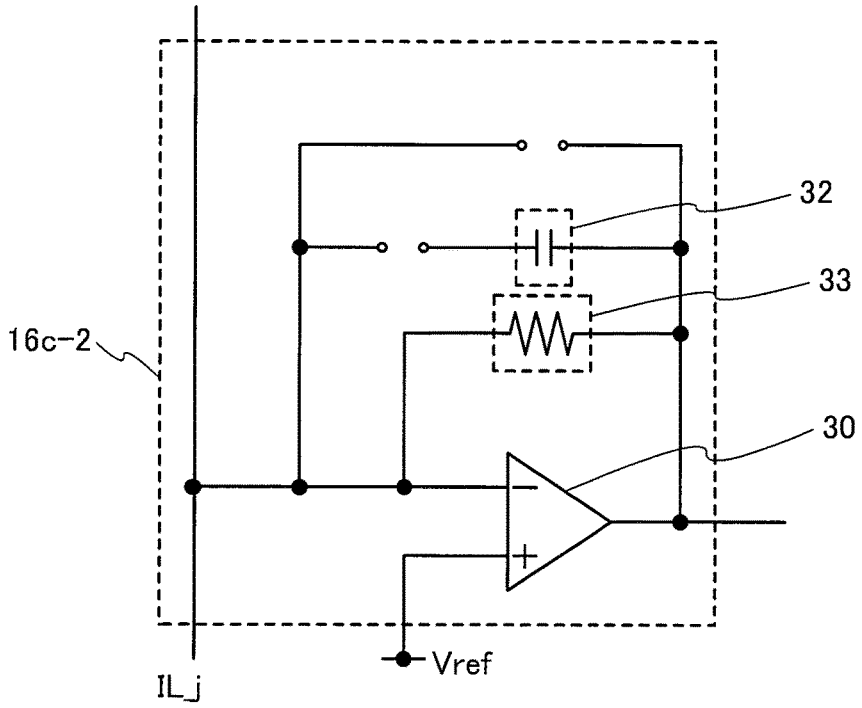

Next, FIG. 18B illustrates a circuit configuration in an operation state different from the operation state in FIG. 18A. FIG. 18B illustrates a read circuit 16*c*-2 that corresponds to the read circuit 16*c* in FIG. 17A in which the switches 31 and 39 are off and the switch 38 is on. In the read circuit 16*c*-2, the inverting input terminal of the operational amplifier 30 is electrically connected to the one electrode of the resistor 33.

With such a configuration, the read circuit 16*c* can function as a current-voltage converter circuit. For example, when a current flows through the wiring IL_j, a voltage drop occurs between the electrodes of the resistor 33 electrically connected to the wiring IL_j. In other words, a current flowing through the wiring IL_j can be obtained from the voltage of the output terminal of the operational amplifier 30 and the resistance value of the resistor 33. Consequently, the value of the current flowing through the wiring IL_j can be read out. Note that the output terminal of the operational amplifier 30 is connected to, for example, an A/D converter circuit or a memory circuit. By utilizing the read current value, variation in current characteristics of the transistor 22 in the pixel 20 can be corrected.

Since the read circuit 16*c*-2 functions as a current-voltage converter circuit as described above, the current value of the wiring IL_j can be read out.

The switches 31, 38, and 39 in the read circuit 16*c* are not necessarily provided to have the connection relations illustrated in FIGS. 17A and 17B. The switches are provided as appropriate in order that the circuit configurations of the read circuits 16*c*-1 and 16*c*-2 can be selected by switching. In other words, the switches are preferably provided as appropriate in order that whether the inverting input terminal of the operational amplifier 30 is electrically connected to the capacitor 32 or to the resistor 33 can be selected.

Figure 19A:
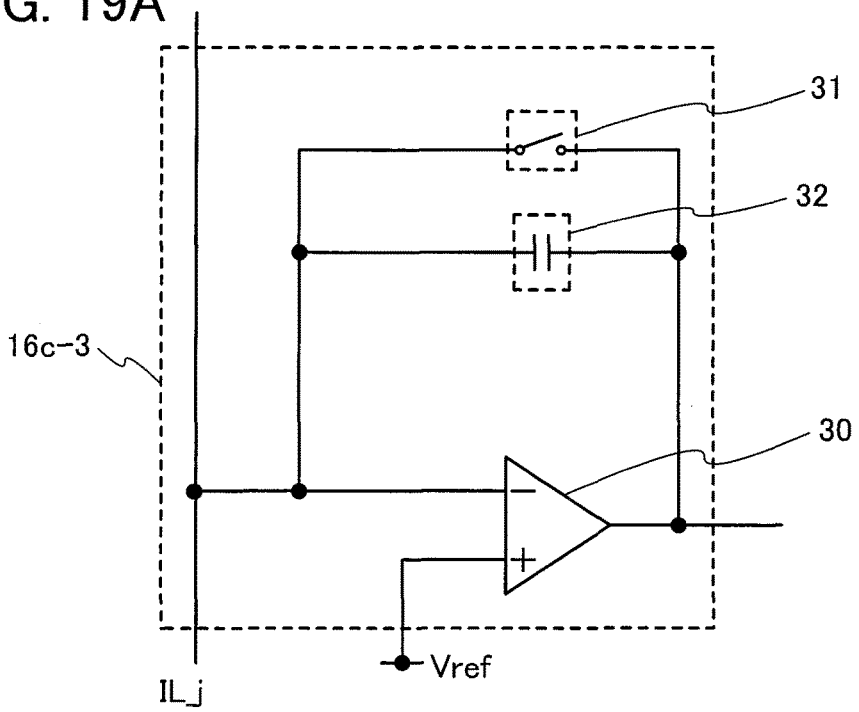
FIGS. 19A and 19B are circuit diagrams illustrating one embodiment of the present invention.

Instead of the read circuit 16*c*-1 in FIG. 18A, a circuit configuration of a read circuit 16*c*-3 in FIG. 19A may be selectable. The circuit configuration of the read circuit 16*c*-3 is the circuit configuration of the read circuit 16*c*-1 in which the resistor 33 that does not function in the circuit in FIG. 18A is omitted.

Figure 19B:
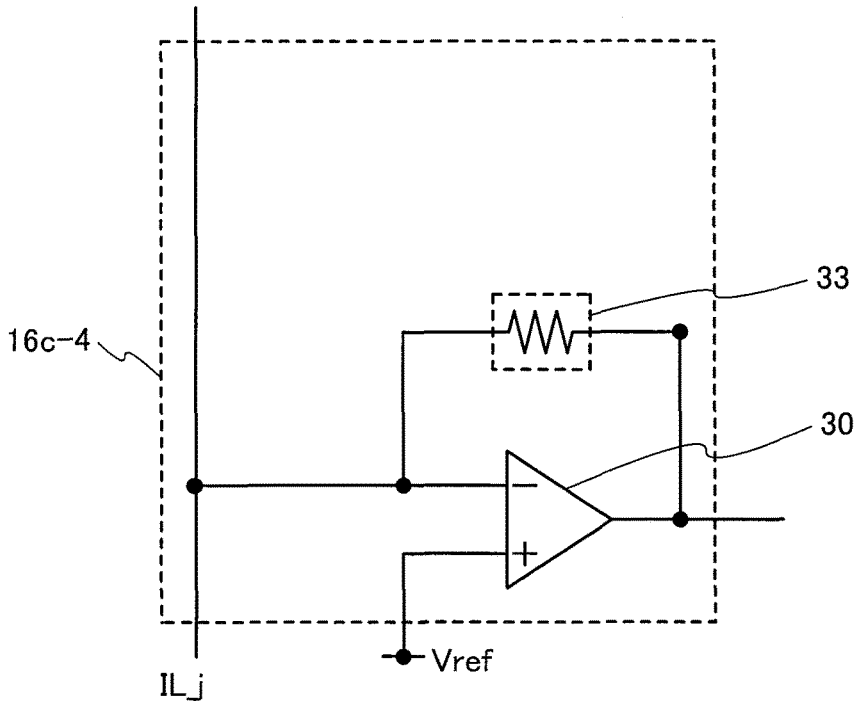

Instead of the read circuit 16*c*-2 in FIG. 18B, a circuit configuration of a read circuit 16*c*-4 in FIG. 19B may be selectable. The circuit configuration of the read circuit 16*c*-4 is the circuit configuration of the read circuit 16*c*-2 in which the capacitor 32 that does not function in the circuit in FIG. 18B is omitted.

In FIG. 17A or FIG. 16, as in FIGS. 6A and 6B, a circuit which samples and holds the potential of the wiring IL_j may be provided. Alternatively, the circuit configuration illustrated in FIG. 7A or FIG. 10 may be selected. Alternatively, a circuit which samples and holds the potential of the wiring IL_j may be provided as in FIG. 8A and FIG. 9.

Figure 20:
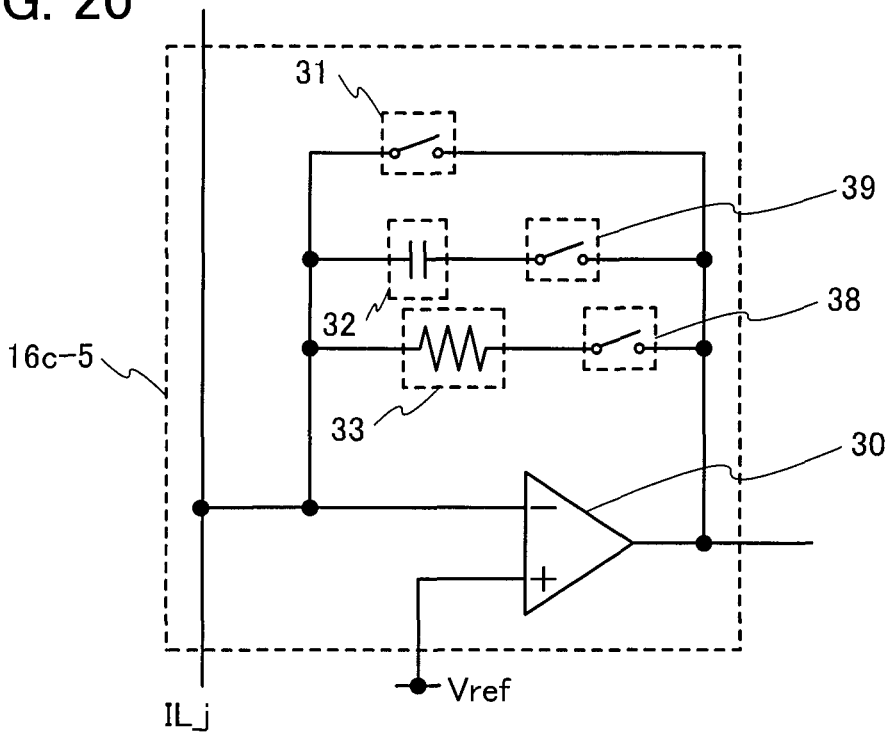
FIG. 20 is a circuit diagram illustrating one embodiment of the present invention.

For example, a read circuit 16*c*-5 illustrated in FIG. 20 can be given as a modification example of the read circuit 16*c*. The circuit configuration of the read circuit 16*c*-5 is the circuit configuration of the read circuit 16*c* in which the switch 39 is provided between the output terminal of the operational amplifier 30 and the other electrode of the capacitor 32 and the switch 38 is provided between the output terminal of the operational amplifier 30 and the other electrode of the resistor 33. Even in the circuit configuration of the read circuit 16*c*-5, the circuit configurations of the read circuit 16*c*-1 and the read circuit 16*c*-2 can be changed by switching.

As described above, the read circuit 16*c* can switch the read circuit 16*c*-1 functioning as the integrator circuit and the read circuit 16*c*-2 functioning as the current-voltage converter circuit.

Since the read circuit 16*c* can read out a plurality of kinds of data as data on current characteristics of the transistor, variation in current characteristics can be corrected more accurately. In addition, the read circuit 16*c* carries out a function of reading a plurality of kinds of data by switching the connection of the operational amplifier 30.

Thus, the accuracy of correcting variation in the current characteristics can be increased with little increase in the area occupied by the read circuit 16. Accordingly, the area occupied by the driver circuit portion where the read circuit 16 is provided can be reduced, so that the frame of the display device can be narrowed.

With the above-described configuration, the display device described in this embodiment which can perform external correction and in which the area occupied by the read circuit is reduced can be provided. With the above-described structure, a display device in which the area occupied by a driver circuit portion can be reduced and whose frame is narrowed can be provided. With the above-described structure, a display device which can perform external correction by reading out a plurality of kinds of data on current characteristics of a transistor can be provided. With the above-described structure, a display device having small display unevenness can be provided. With the above-described structure, a display device capable of high definition display can be provided. With the above-described structure, a semiconductor device capable of reducing adverse effects due to variation in transistor characteristics can be provided. With the above-described structure, a semiconductor device capable of reducing adverse effects due to variation in the threshold voltages of transistors can be provided. With the above-described structure, a semiconductor device capable of reducing adverse effects due to variation in the mobilities of transistors can be provided.

<Structure of Display Device>

Figure 21:
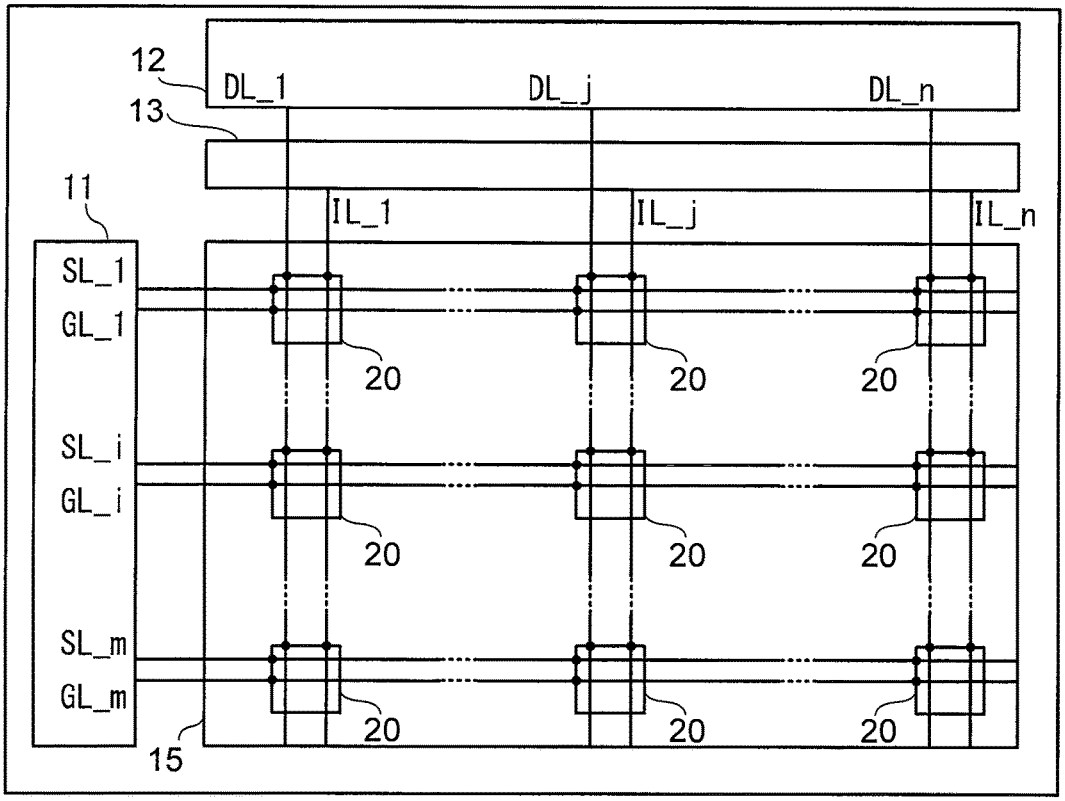
FIG. 21 is a block diagram illustrating one embodiment of the present invention.

Next, a specific structure example of the display device according to one embodiment of the disclosed invention is described with reference to the block diagram in FIG. 21 and the circuit diagram in FIG. 22. FIG. 21 is an example of a block diagram of a pixel portion 15 including (m×n) pixels 20 (m and n are each an integer of 2 or more) and peripheral circuits.

The display device in FIG. 21 includes a driver circuit 11, a driver circuit 12, a circuit portion 13, the pixel portion 15 including (m×n) pixels 20 (m rows and n columns) arranged in a matrix, wirings SL_1 to SL_m (m is an integer greater than or equal to 2) which extend in the row direction, wirings GL_1 to GL_m which extend in the row direction, wirings DL_1 to DL_n (n is an integer greater than or equal to 2) which extend in the column direction, and wirings IL_1 to IL_n which extend in the column direction.

The driver circuit 11 is electrically connected to the wirings SL_1 to SL_m and the wirings GL_1 to GL_m. The driver circuit 11 is configured to select a pixel or a row. The driver circuit 11 is configured to sequentially select a pixel or a row, row by row. The driver circuit 11 is configured to select a specific pixel or a specific row. The driver circuit 11 is configured to output a selection signal or a non-selection signal to a pixel. Thus, the driver circuit 11 has a function as a gate line driver circuit or a scan line driver circuit.

The driver circuit 12 is electrically connected to the wirings DL_1 to DL_n. The driver circuit 12 is configured to supply a video signal to a pixel or a column. The driver circuit 12 is configured to supply a reading signal to a pixel or a column. Thus, the driver circuit 12 has a function as a source line driver circuit, a data line driver circuit, or a video signal line driver circuit.

The circuit portion 13 (hereinafter also referred as a read circuit portion) is electrically connected to the wirings IL_1 to IL_n. Furthermore, the circuit portion 13 is electrically connected to the wirings DL_1 to DL_n. The circuit portion 13 includes a plurality of read circuits described in this embodiment, and for example, the read circuit 16 is provided for each of the wirings IL_1 to IL_n. By the read circuit 16, data on current characteristics can be read out from the transistor 22 of each pixel 20. Thus, the circuit portion 13 has a function of reading data that is output from the pixels. Alternatively, the circuit portion 13 has a function of reading the potential of a terminal in each pixel.

The read circuit 16 can be appropriately selected from, for example, the read circuits given as the specific configuration examples, depending on the kinds of data on current characteristics of the transistor from which data is read out.

The driver circuit 11, the driver circuit 12, and the circuit portion 13 except the pixel portion 15 in the display device are collectively referred to as a driver circuit portion in some cases. In the display device of one embodiment of the present invention, the number of operational amplifiers is reduced and the area occupied by the operational amplifiers can be reduced in the read circuit 16 of the circuit portion 13 as described above. Thus, since the area occupied by the driver circuit portion where the read circuit 16 is provided can be reduced, the frame of the display device can be narrowed.

Note that the read circuit 16 may be provided not only in the circuit portion 13 of the display device but also in a flexible printed circuit (FPC) connected to the display device, or a display module.

Figure 23:
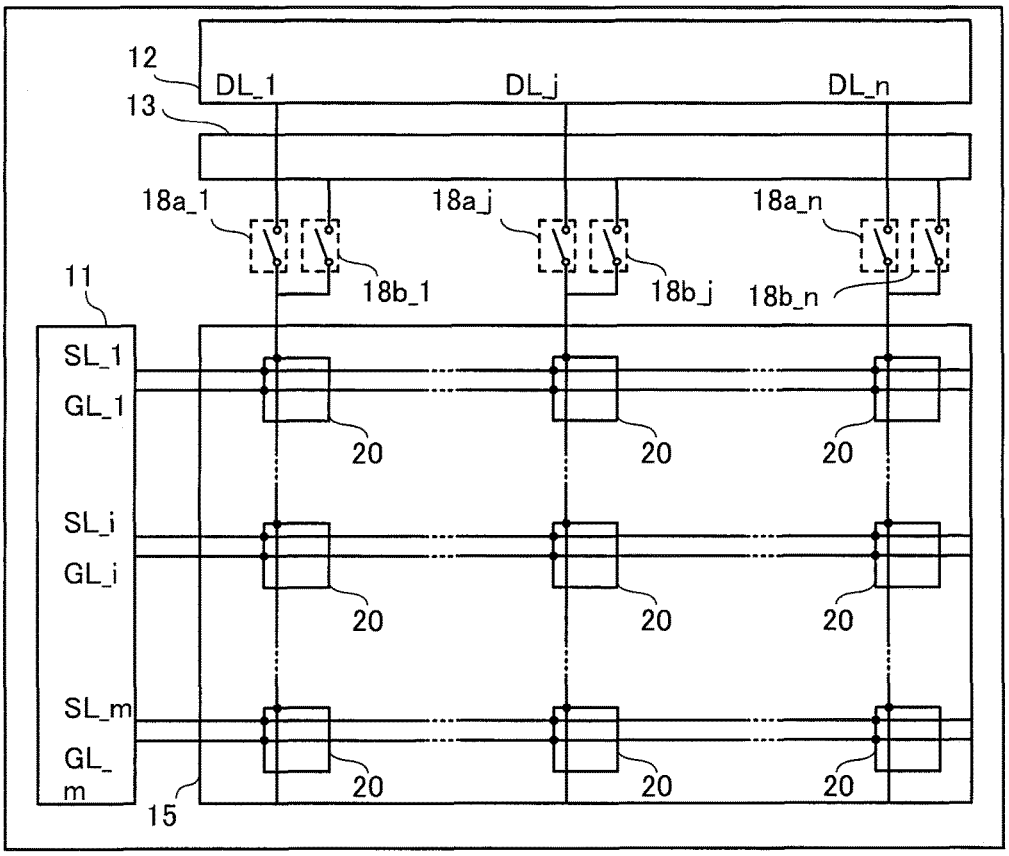
FIG. 23 is a block diagram illustrating one embodiment of the present invention.

Note that when the wirings DL_1 to DL_n are connected to the circuit portion 13 and the driver circuit 12, as shown in FIG. 23, switches 18*a*_1 to 18*a*_n and switches 18*b*_1 to 18*b*_n are provided. By switching the switches, the wirings DL_1 to DL_n may be electrically connected to one of the circuit portion 13 and the driver circuit 12.

Note that the driver circuit 12 and the circuit portion 13 may be integrally formed as one circuit.

Figure 22:
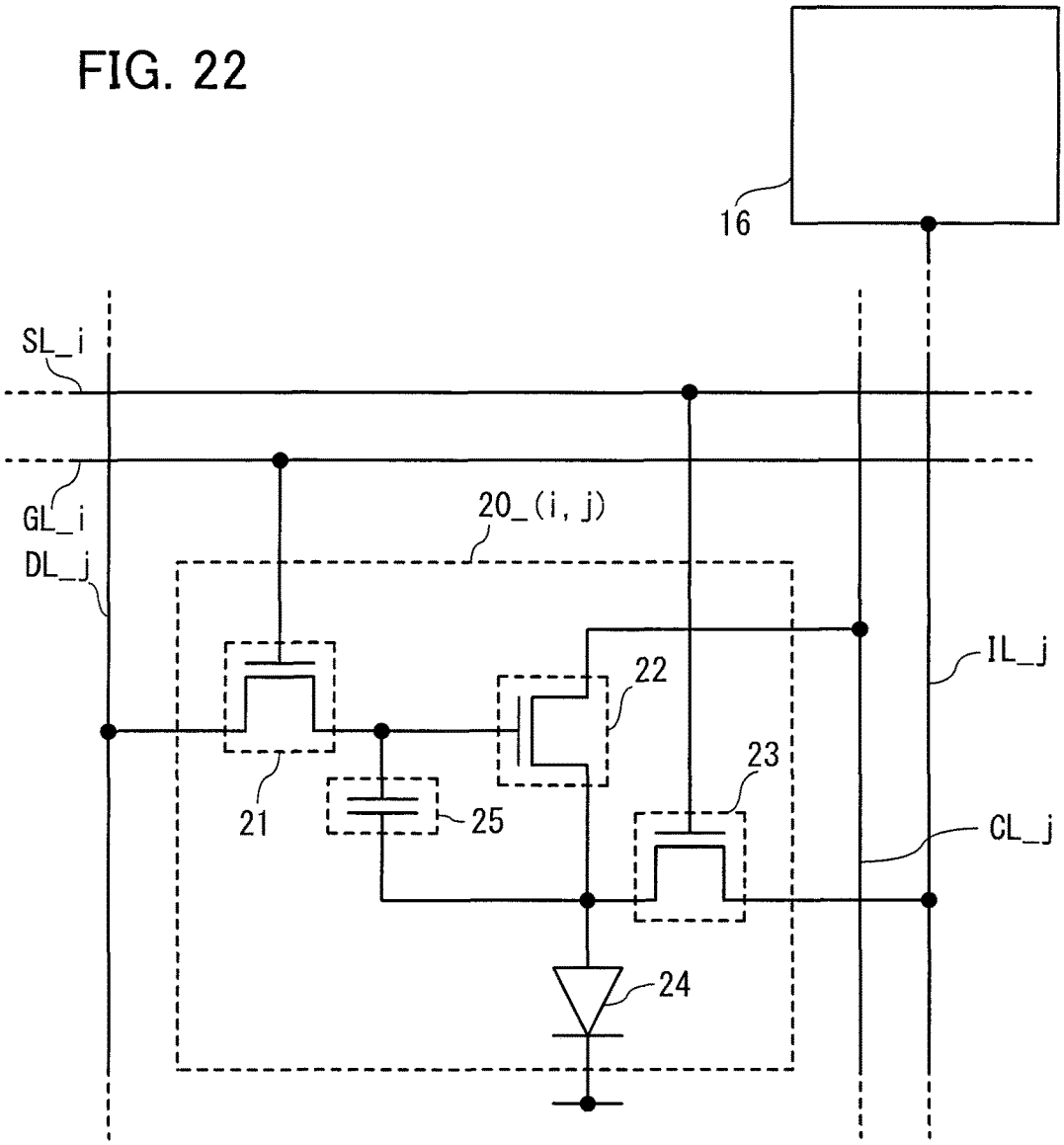
FIG. 22 is a circuit diagram illustrating one embodiment of the present invention.

FIG. 22 shows a structure of a pixel 20_(i, j) in the i-th row and the j-th column (i is an integer greater than or equal to 1 and less than or equal to m, and j is an integer greater than or equal to 1 and less than or equal to n). The pixel 20_(i, j) includes a transistor 21, a transistor 22, a transistor 23, a light-emitting element 24, and a capacitor 25. Note that each of the transistors may have a multi-gate structure, that is, a structure in which a plurality transistors are connected in series. Note that each of the transistors may have a structure in which gate electrodes are formed above and below a channel. These elements included in the pixel 20_(i, j) are electrically connected to the wirings GL_i, SL_i, DL_j, CL_j, and IL_j. Wirings CL_1 to CL_n are not shown in FIG. 21; however, they are provided so as to extend in the column direction. The wiring CL extends in the column direction in FIG. 22; however, the present invention is not limited thereto, and the direction in which the wiring CL extends may be changed as appropriate. For example, the wiring CL may be formed by connection of a wiring provided in the column direction and a wiring provided in the row direction.

A specific connection relation in the pixel 20_(i, j) is as follows. A gate electrode of the transistor 21 is electrically connected to the wiring GL_i, one of a source electrode and a drain electrode thereof is electrically connected to the wiring DL_j, the other of the source electrode and the drain electrode thereof is electrically connected to a gate electrode of the transistor 22. One of a source electrode and a drain electrode of the transistor 22 is electrically connected to the wiring CL_j, and the other of the source electrode and the drain electrode thereof is electrically connected to one of a source electrode and a drain electrode of the transistor 23 and one of electrodes (hereinafter also referred to as a pixel electrode) of the light-emitting element 24. A gate electrode of the transistor 23 is electrically connected to the wiring SL_I and the other of the source electrode and the drain electrode thereof is electrically connected to the wiring IL_j. A common potential is supplied to the other of the electrodes (hereinafter also referred to as a common electrode) of the light-emitting element 24.

Figure 24:
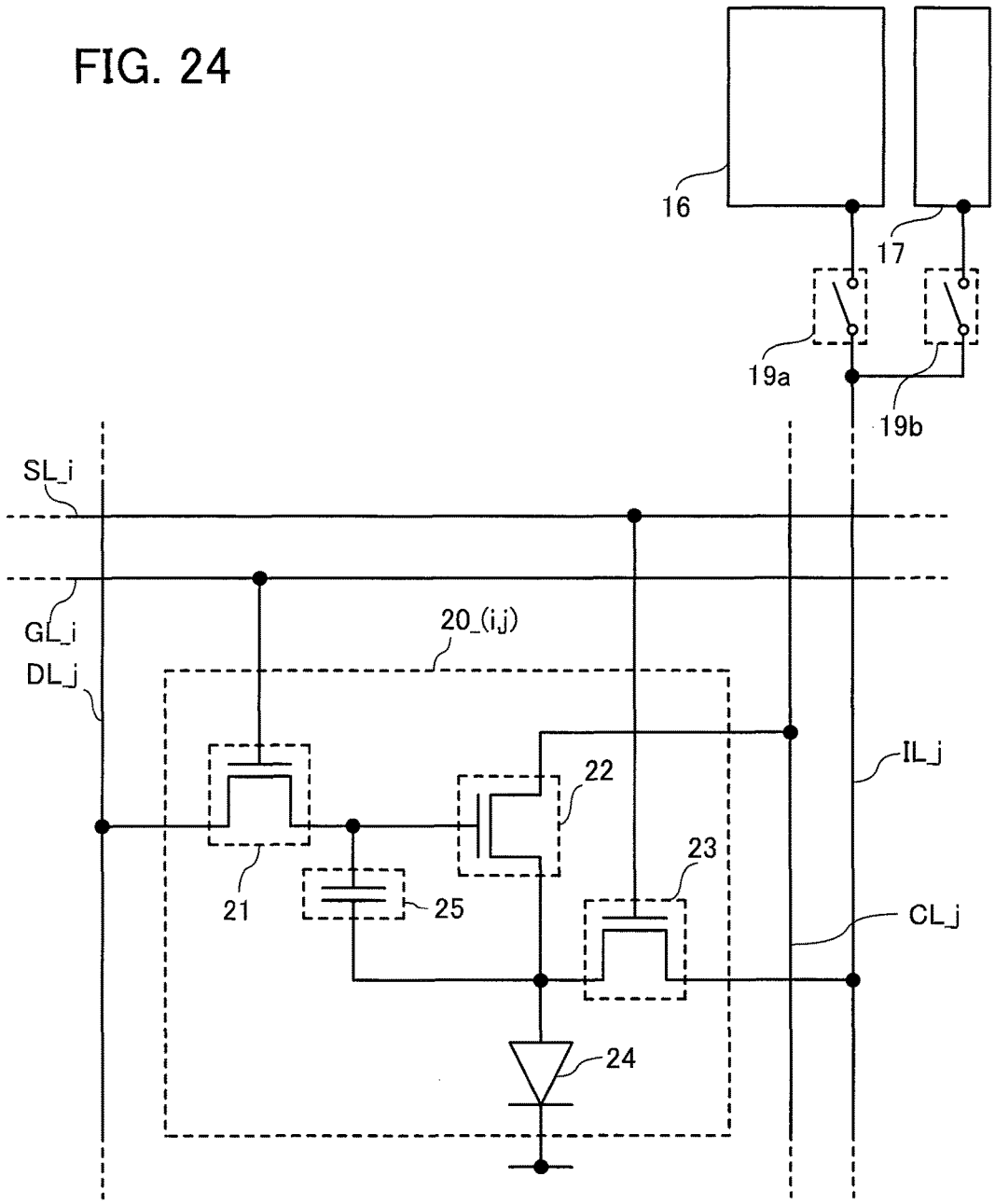
FIG. 24 is a circuit diagram illustrating one embodiment of the present invention.

The wiring IL_j is electrically connected to the read circuit 16 included in the circuit portion 13. The wiring IL_j may be connected to another circuit, for example, a circuit having a function of supplying a certain potential in the case where reading operation is not performed or in the address period. For example, the wiring IL_j may be connected to a wiring which supplies a certain potential. Note that in the case where the wiring IL_j is connected to the read circuit 16 and another circuit 17 as shown in FIG. 24, a switch 19*a* and a switch 19*b* may be provided between the wiring IL_j and the read circuit 16 and between the wiring IL_j and the circuit 17, respectively. By switching the switches, the wiring IL_j and one of the read circuit 16 and the circuit 17 may be electrically connected to each other.

One of electrodes of the capacitor 25 is electrically connected to the other of the source electrode and the drain electrode of the transistor 21 and the gate electrode of the transistor 22, and the other electrode thereof is electrically connected to the other of the source electrode and the drain electrode of the transistor 22, the one of the source electrode and the drain electrode of the transistor 23, and the pixel electrode of the light-emitting element 24. With the capacitor 25 provided as described above, more charge can be held in the gate electrode of the transistor 22, and a holding period of image data can be made longer.

Note that the capacitor 25 is not necessarily provided. For example, a high parasitic capacitance of the transistor 22 can be an alternative to the capacitor 25.

The driver circuit 11 can control the on/off states of the transistor 21 by the wiring GL, and the on/off states of the transistor 23 by the wiring SL.

The driver circuit 12 can supply a video signal or a reading signal to the gate electrode of the transistor 22 via the wiring DL.

The wiring CL has a function as a high potential power supply line which supplies current to the light-emitting element 24.

However, the structures of the driver circuit 11, the driver circuit 12, and the circuit portion 13 are not limited to that described above. The positions of the driver circuit 11, the driver circuit 12, and the circuit portion 13 may be changed; alternatively, functions of the plurality of driver circuits may be combined into one driver circuit. For example, in FIG. 21, the driver circuit 11 is provided on only one side of the pixel portion 15; however, the driver circuit 11 may be divided and provided on both sides of the pixel portion 15. Furthermore, in FIG. 21, the driver circuit 12 and the pixel portion 13 are separately provided; however, they may be combined as one driver circuit portion.

Figure 25:
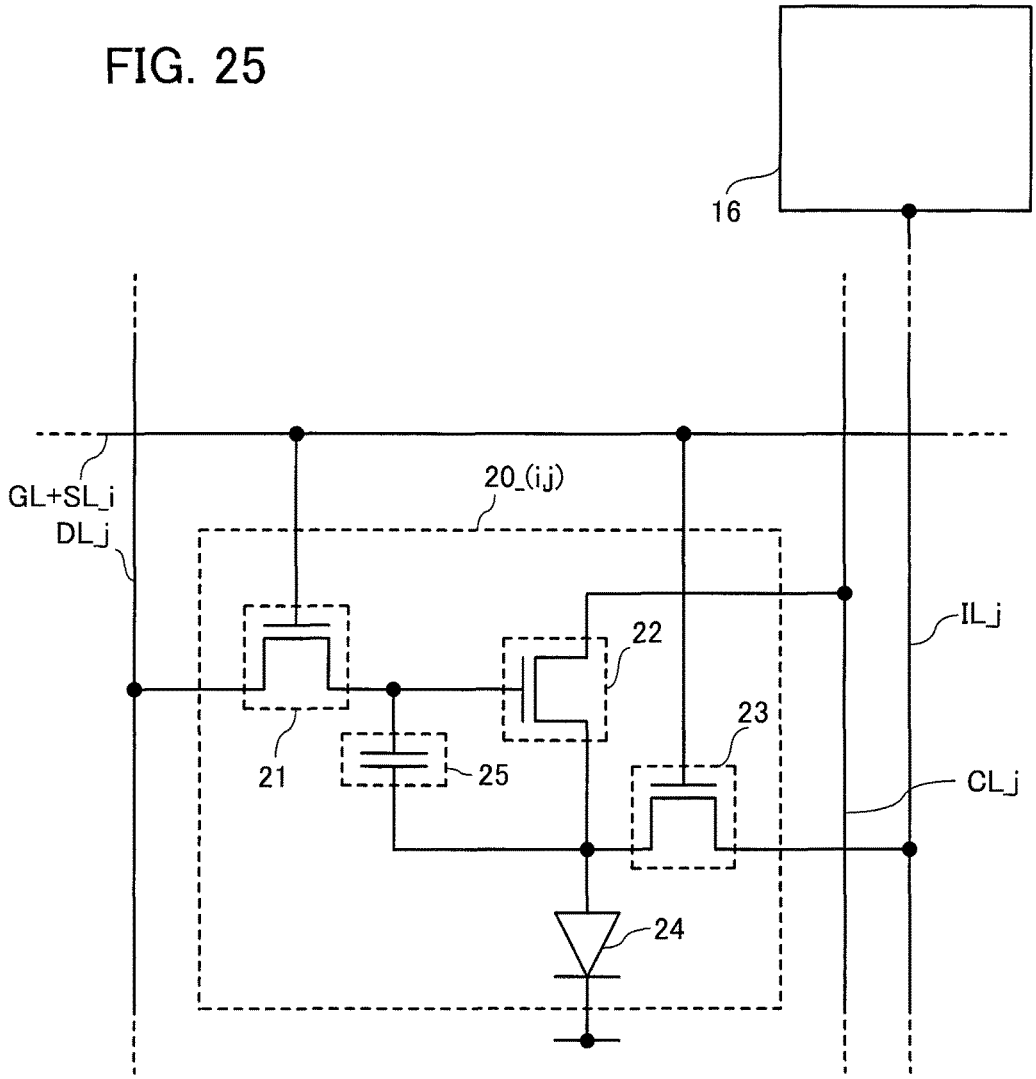
FIG. 25 is a circuit diagram illustrating one embodiment of the present invention.

The directions in which the wiring GL, the wiring SL, the wiring DL, the wiring IL, and the wiring CL extend, the number of the wirings, and the like can be appropriately changed in accordance with changes in the positions, structures, and the like of the driver circuit 11, the driver circuit 12, and the circuit portion 13. For example, the wiring IL may extend in the row direction. Alternatively, for example, the wiring GL and the wiring SL may be combined into one wiring. FIG. 25 shows a circuit diagram in that case. In the case where the wiring GL and the wiring SL are combined into one wiring, the wiring acts similarly to the case where the wiring GL and the wiring SL are turned on/off at the same time. Thus, in the case where a driving method in which the wiring GL and the wiring SL are turned on/off at the same time is employed, the wiring GL and the wiring SL can be combined into one wiring.

The amount of current flowing through the light-emitting element 24 is controlled by the transistor 22 that is controlled in accordance with a video signal input to the pixel 20. The luminance of the light emitting element 24 depends on the amount of current flowing between the pixel electrode and the common electrode. For example, in the case where an OLED (an organic light-emitting diode) is used as the light-emitting element 24, one of an anode and a cathode serves as the pixel electrode and the other thereof serves as the common electrode. FIG. 22 illustrates a configuration of the pixel 20 in which the anode of the light-emitting element 24 is used as the pixel electrode and the cathode of the light-emitting element 24 is used as the common electrode.

Figure 26:
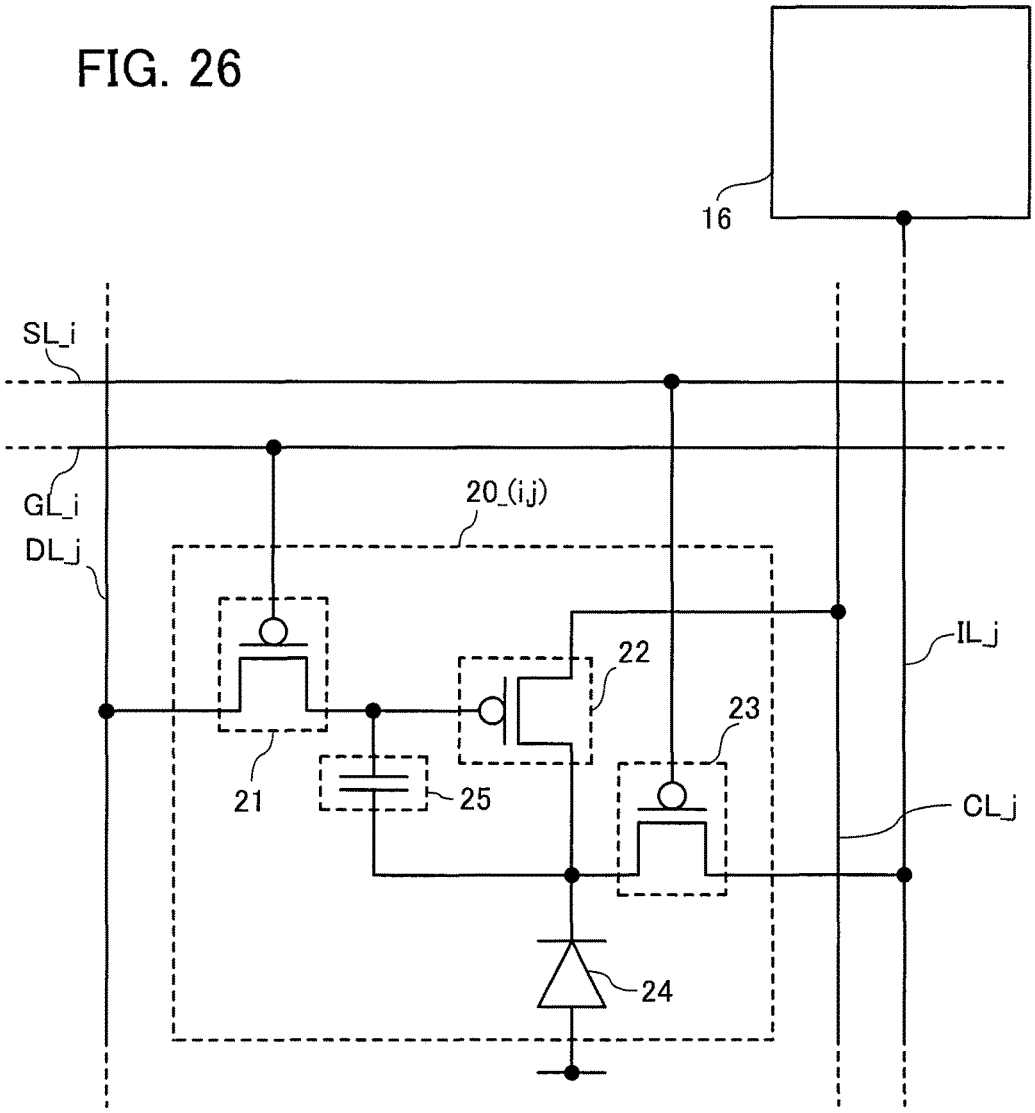
FIG. 26 is a circuit diagram illustrating one embodiment of the present invention.

Operation can be performed with a circuit configuration in which the polarity of the transistors, the orientation of the light-emitting element, the potential of the wirings, the potential of the signals, or the like is changed. FIG. 26 illustrates a variation example of the structure in FIG. 22. In FIG. 26, the transistors 21 to 23 are p-channel transistors, and the direction of the light-emitting element 24 is opposite to that in FIG. 22. Without limitation to the pixel circuit in FIG. 22, a circuit can be similarly formed.

In at least one of the transistors 21 to 23 and another transistor included in the pixel 20, an oxide semiconductor can be used. Alternatively, an amorphous, microcrystalline, polycrystalline, or single crystal semiconductor can be used. As a material of such a semiconductor, silicon, germanium, or the like can be used. Specifically, when the transistor 21 includes an oxide semiconductor in a channel formation region, the off-state current of the transistor 21 can be extremely low. Furthermore, when the transistor 21 having the above-described structure are used in the pixels 20, leakage of charge accumulated in the gate of the transistor 22 or the capacitor 25 can be prevented effectively as compared with the case where a transistor including a normal semiconductor such as silicon or germanium is used as the transistor 21.

Accordingly, for example, in the case where video signals each having the same image information are written to the pixel portion 15 for some consecutive frame periods, like a still image, display of an image can be maintained even when driving frequency is low, in other words, the number of writing operations of a video signal to the pixel portion 15 for a certain period is reduced. For example, a purified oxide semiconductor in which impurities serving as electron donors (donors), such as moisture or hydrogen, are reduced and oxygen vacancies are reduced is used for a semiconductor film of the transistor 21, whereby the interval between the operations of writing video signals can be set to 10 seconds or longer, preferably 30 seconds or longer, or further preferably one minute or longer. As the interval between writings of video signals is made longer, power consumption can be further reduced.

In addition, since the potential of the video signal can be held for a longer period, the quality of an image to be displayed can be prevented from being lowered even when the capacitor 25 for holding the potential of the gate of the transistor 22 is not provided in the pixel 20.

The transistors each have the gate on at least one side of a semiconductor film; alternatively, the transistors may each have a pair of gates with a semiconductor film positioned therebetween.

Here, when a transistor T has a pair of gates between which a semiconductor film is interposed, a signal A may be applied to one gate and a fixed potential Vb may be applied to the other gate.

The signal A is, for example, a signal for controlling the on/off state. The signal A may be a digital signal with two kinds of potentials, V1 and V2 (V1>V2). For example, the potential V1 may be a high power supply potential and the potential V2 may be a low power supply potential. The signal A may be an analog signal.

The fixed potential Vb is, for example, a potential for controlling a threshold voltage VthA of the transistor T. The fixed potential Vb is preferably the potential V1 or the potential V2, in which case a potential generation circuit for generating the fixed potential Vb does not need to be provided additionally. The fixed potential Vb may be a potential different from the potential V1 or the potential V2. When the fixed potential Vb is low, the threshold voltage VthA can be increased in some cases. As a result, drain current generated when gate-source voltage Vgs is 0 V can be reduced and leakage current in the circuit including the transistor T can be reduced in some cases. The fixed potential Vb may be, for example, lower than the low power supply potential. When the fixed potential Vb is high, the threshold voltage VthA can be decreased in some cases. As a result, drain current generated when the gate-source voltage Vgs is VDD can be increased and the operating speed of the circuit including the transistor T can be improved in some cases. The fixed potential Vb may be, for example, higher than the low power supply potential.

The signal A may be applied to one gate and a signal B may be applied to the other gate of the transistor T. The signal B is, for example, a signal for controlling the on/off state of the transistor T. The signal B may be a digital signal with two kinds of potentials, V3 and V4 (V3>V4). For example, the potential V3 may be a high power supply potential and the potential V4 may be a low power supply potential. The signal B may be an analog signal.

When both the signal A and the signal B are digital signals, the signal B may have the same digital value as the signal A. In that case, the on-state current of the transistor T and the operating speed of the circuit including the transistor T can be increased in some cases. Here, the potential V1 of the signal A may be different from the potential V3 of the signal B. Furthermore, the potential V2 of the signal A may be different from the potential V4 of the signal B. For example, if a gate insulating film used with the gate to which the signal B is input is thicker than a gate insulating film used with the gate to which the signal A is input, the potential amplitude of the signal B (V3−V4) can be larger than the potential amplitude of the signal A (V1−V2). In this way, influence of the signal A and that of the signal B on the on/off state of the transistor T can be substantially the same in some cases.

When both the signal A and the signal B are digital signals, the signal B may be a signal with a different digital value from that of the signal A. In that case, the signal A and the signal B can separately control the transistor T, and thus higher performance may be achieved. For example, if the transistor T is an n-channel transistor, the transistor T may be turned on only when the signal A has the potential V1 and the signal B has the potential V3, or may be turned off only when the signal A has the potential V2 and the signal B has the potential V4, in which case the transistor T, a single transistor, may function as a NAND circuit, a NOR circuit, or the like. The signal B may be a signal for controlling the threshold voltage VthA. For example, the potential of the signal B in a period when the circuit including the transistor T operates may be different from the potential of the signal B in a period when the circuit does not operate. The signal B may be a signal whose potential is different between operation modes of the circuit. In that case, sometimes the potential of the signal B is not changed as often as the potential of the signal A.

When both the signal A and the signal B are analog signals, the signal B may be an analog signal with the same potential as that of the signal A, an analog signal with a potential that is a constant multiple of the potential of the signal A, an analog signal with a potential that is higher or lower than the potential of the signal A by a constant, or the like. In that case, the on-state current of the transistor T and the operating speed of the circuit including the transistor T can be increased in some cases. The signal B may be an analog signal that is different from the signal A. In that case, the signal A and the signal B can separately control the transistor T, and thus higher performance may be achieved.

The signal A and the signal B may be a digital signal and an analog signal, respectively. Alternatively, the signal A and the signal B may be an analog signal and a digital signal, respectively.

A fixed potential Va may be applied to one gate and a fixed potential Vb may be applied to the other gate of the transistor T. When both of the gates of the transistor T are supplied with the fixed potentials, the transistor T can serve as an element equivalent to a resistor in some cases. For example, when the transistor T is an n-channel transistor, the effective resistance of the transistor can be sometimes low (high) by making the fixed potential Va or the fixed potential Vb high (low). When both the fixed potential Va and the fixed potential Vb are high (low), the effective resistance can be lower (higher) than that of a transistor with only one gate in some cases.

FIG. 22 illustrates the case where the transistors are all n-channel transistors. When the transistors in the pixel 20 have the same channel type, it is possible to omit some of steps for fabricating the transistors, for example, a step of adding an impurity element imparting one conductivity type to the semiconductor film. Note that in the display device, not all the transistors in the pixel 20 are necessarily n-channel transistors. For example, the transistor 21 and the transistor 23 may be p-channel transistors.

Instead of the transistors 21 and 23, an electrical switch, a mechanical switch, a MEMS element, or the like can be used.

<Driving Method of Display Device>

Figure 27A:
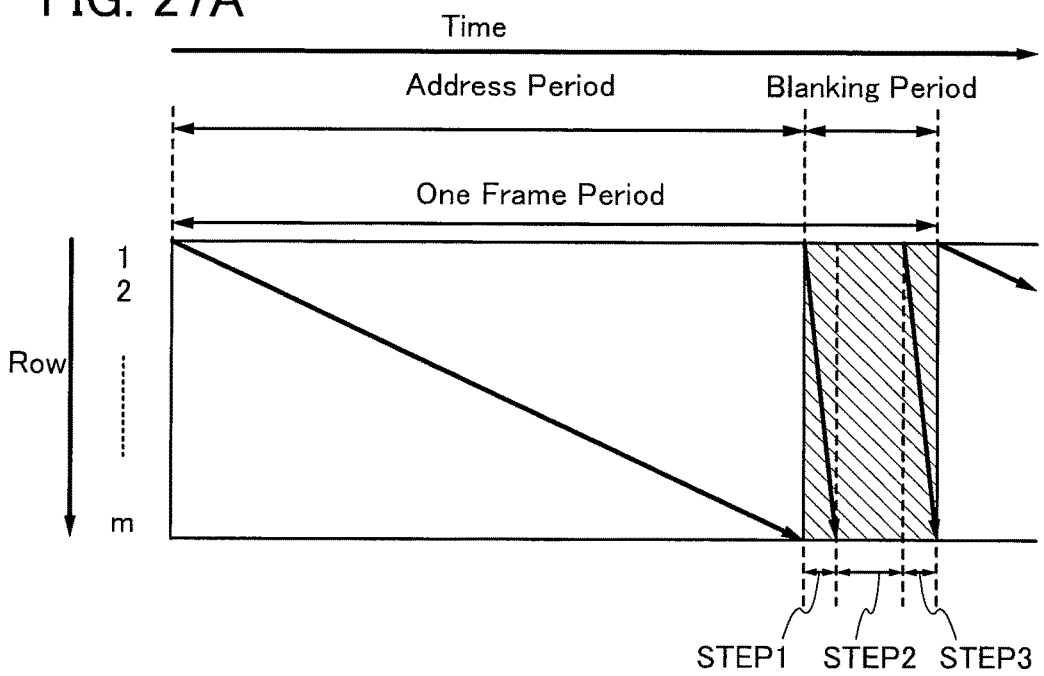
FIGS. 27A and 27B are a timing chart and a flow chart illustrating one embodiment of the present invention.

FIG. 27A is a timing chart illustrating an example of a driving method of a display device. In the timing chart in FIG. 27A, the horizontal direction indicates elapsed time and the vertical direction indicates the row on which scanning is performed.

As shown in FIG. 27A, in the display device of this embodiment, an image is displayed by sequentially scanning pixels row by row from the first row to the m-th row and repeating this scanning operation. The period of time from the start of the scanning in the first row through the scanning of the m-th row and time up to but not including the next scanning is referred to as one frame period. In the one frame period, there is a period called a blanking period in which scanning for displaying an image is not performed, which starts after the scanning of the m-th row and ends before the next scanning of the first row. The period of time for scanning from the first row to the m-th row is sometimes called an address period or a signal writing period. That is, the one frame period includes the address period and the blanking period. However, the one frame period may include a plurality of sub-frame periods. In that case, each sub-frame period may include an address period. Furthermore, a period from an input of a video signal to a selected row until an input of a new signal to the row in the next frame period may be referred to as a display period. That is, in a pixel, a period during which one gray scale level is substantially displayed may be referred to as a display period. Note that the length of the display period is the same in all the rows; however, timing of the start and the end of the display period may varies depending on the row.

When current characteristics of the driver transistor is read out while scanning for displaying an image is performed, display of the image may be disturbed by an input of a signal for reading data. However, in the case of reading current characteristics by selecting a row in which all the pixel are displayed in black in the blanking period, the current characteristics can be read out without disturbance of the black display in that row. Specifically, for example, in the case where all the pixels in one row are displayed in black, current characteristics can be easily read out from that row. Note that a black display state may be referred to as a non-display state. Alternatively, the black display state may be referred to as a display state of a zero gray level. The state where display is performed with any gray levels except black may be referred to as a display state. Alternatively, the state where display is performed with any gray levels except black may be referred to as a state where a gray level is higher than zero. The state where display is performed with the highest gray level may be referred to as a white display state. Alternatively, the state where display is performed with the highest gray level may be referred to as a state where display is performed with the highest gray level.

As an example of the driving method of the display device, description is made below on a driving method of a display device, in which variation in current characteristics of driver transistors is corrected by reading data on the current characteristics of the driver transistors in one row in which all the pixels are displayed in black in a blanking period.

An example of a driving method of the display device shown in FIG. 21 and FIG. 22 is described with reference to FIGS. 27A and 27B. Specifically, explanation is made focusing on the pixel 20_(i, j) in the i-th row and the j-th column in FIG. 22. Note that explanation is made in the case where all the pixels 20 in the i-th row are in black display.

First, a method of driving the display device in an address period is described. When an address period of one frame period starts, as shown in FIG. 27A, pixels are sequentially scanned row by row from the first row to the m-th row. When the pixels in the i-th row are selected, a selection signal is input to the wiring SL_i and the transistor 23 is turned on. When the transistor 23 is turned on, the wiring IL_j and the other of the source electrode and the drain electrode of the transistor 22 (hereinafter also referred to as the source electrode of the transistor 22) are electrically connected to each other, and the potential of the wiring IL_j is supplied to the source electrode of the transistor 22. Note that the potential of the wiring IL_j is a potential at which the light-emitting element 24 does not emit light. For example, the potential of the wiring IL_j is the same potential as the potential of the common electrode of the light-emitting element 24.

Here, the operational amplifier 30 used in the read circuit 16 operates so that the potential of the non-inverting input terminal is equal to the potential of the inverting input terminal; thus, the potential of the wiring IL_j can be controlled by the potential of the non-inverting input terminal. It can be said that the read circuit 16 has a function of controlling the potential of the wiring IL_j. Therefore, also in the above, the potential of the wiring IL_j may be controlled by the read circuit 16.

After that, or at the same time, the selection signal is input to the wiring GL_i, whereby the transistor 21 is turned on. When the transistor 21 is turned on, the wiring DL_j is electrically connected to the gate electrode of the transistor 22. Here, a video signal of the pixel 20_(i, j) is supplied to the wiring DL_j, so that a potential corresponding to the video signal of the pixel 20_(i, j) is supplied to the gate electrode of the transistor 22. That is, a voltage between the potential of the wiring DL_j and the potential of the wiring IL_j is supplied between the gate and the source of the transistor 22.

Accordingly, a potential difference between the gate and the source of the transistor 22 is stabilized, and current based on the video signal held in the gate electrode of the transistor 22 or the capacitor 25 can be supplied to the light-emitting element 24 via the wiring CL_j.

In the case where the wiring GL_i and the wiring CL_j are combined into one wiring, the wiring operates in a manner similar to that in the case when the wiring GL_i and the wiring CL_j are selected at the same time.

When pixels in the (i+1)th row are selected, the selection signal that has been input is not supplied to the wiring GL_i and the wiring SL_i, and a non-selection signal is supplied to the wiring GL_i and the wiring SL_i. As a result, the transistor 21 and the transistor 23 are turned off. Thus, a potential difference between the gate and the source of the transistor 22 is held, and a light-emitting state or a non-light-emitting state of the light-emitting element 24 is maintained until the pixel 20_(i, j) is selected in the next frame. As a result, current based on the voltage between the gate and the source of the transistor 22 is supplied to the light-emitting element 24 from the transistor 22. Thus, an image corresponding to the video signal can be displayed. In the case where the video signal supplied from the wiring DL_j is a signal for black display, no current flows into the transistor 22; also, no current flows into the light-emitting element 24. As a result, the light-emitting element 24 is in black display or a non-display state.

Next, a method of driving the display device in the blanking period in the first frame is described. FIG. 27B is a flow chart showing an example of the method of driving the display device. STEP 1 to STEP 3 of the method of driving the display device are separately described with reference to FIG. 27B.

STEP 1 in which the row in which all the pixels are displayed in black is selected and a signal for reading out data on the current characteristics (hereinafter also referred to as a reading signal) is input to the selected row is described.

When the blanking period starts, as shown in FIG. 27A, scanning is sequentially performed row by row from the first row to the m-th row. Note that pixels in the rows other than a target row are not selected. That is, the selection signal is not supplied to the rows other than the target row, and the non-selection signal is supplied thereto.

Scanning is sequentially performed from the first row to the m-th row, for example, in the case where a gate line driver circuit includes a shift register circuit. Row-by-row sequential scanning from the first row to the m-th row is performed only in the gate line driver circuit, and a selection signal is not supplied to all pixels from the gate line driver circuit. The selection signal is supplied only to the row in black display. Thus, a signal stored in pixels in the rows other than the row in black display is kept. Note that in the case where a decoder circuit or the like is used as the gate line driver circuit, an arbitrary row can be selected in an arbitrary order. Thus, in that case, the row-by-row sequential scanning from the first row to the m-th row is not necessarily performed in the gate line driver circuit in the blanking period. Without the scanning, only a predetermined row (the row in black display) may be instantly selected, and a reading signal may be input to the pixels. Note that the selected row is desirably only one row, so that signals can be prevented from being mixed.

When the pixels in the i-th row are selected, a selection signal is input to the wiring SL_i, and the transistor 23 is turned on. When the transistor 23 is turned on, the wiring IL_j and the source electrode of the transistor 22 are electrically connected to each other, and the potential of the wiring IL_j is supplied to the source electrode of the transistor 22. Note that the potential of the wiring IL_j can be set by the read circuit 16.

At that time, the potential of the wiring IL_j is preferably lower than the common potential, or at the same level as that of the common potential. The potential of the wiring IL_j is set as described above, so that reverse bias is applied to the light-emitting element 24 or bias is not applied to the light-emitting element 24. Thus, the black display state of the pixels in the i-th row can be maintained. Furthermore, even if forward bias is applied to the light-emitting element 24 so that the black display state of the pixels in the i-th row can be maintained at least until STEP 3, the potential difference between the wiring IL_j and the common potential can be suppressed to extremely small. The extremely small potential difference is preferably a potential difference of approximately several volts or lower, for example, 2 volts or lower, further preferably 1 volt or lower. The current flowing into the transistor 22 does not flow into the light-emitting element 24, and becomes ready to flow into the wiring IL_j.

After or at the same time as the input of the selection signal into the wiring SL_i, the selection signal is input to the wiring GL_i, and the transistor 21 is turned on. When the transistor 21 is turned on, the wiring DL_j and the gate electrode of the transistor 22 are electrically connected to each other. The transistor 22 can be turned on since the wiring DL_j is supplied with the reading signal.

The signal with which the transistor 21 is kept in an off state is input to the wiring GL so that the reading signal is not input to the rows other than the i-th row. Thus, a video signal input in the address period is maintained in the pixels on the rows other than the i-th row.

Next, STEP 2 in which data on current characteristics of the transistor 22 (driver transistor) on the selected row is read out by the read circuit is described. After STEP1, since scanning shifts from the i-th row to the (i+1)th row, the supply of the selection signal that has been input to the wiring GL_i is stopped, and the transistor 21 is turned off. Thus, the reading signal that has been input to the gate electrode of the transistor 22 in STEP1 is maintained.

In contrast, the transistor 23 needs to be turned on during STEP 2. Thus, as in STEP 1, the signal which makes the transistor 23 in an on state needs to be continuously input to the wiring SL_i also in STEP 2. For example, a latch circuit is connected to the wiring SL so that the input signal at the time of STEP 1 is held also in STEP 2.

In the case where a decoder circuit and the like is used in the gate line driver circuit, the selection signal can be continued to be supplied to the wiring SL_i, even without connection of a latch circuit and the like to the wiring SL, by controlling a signal input to the decoder circuit.

The transistor 21 is turned off, and the transistors 22 and 23 are turned on in such a manner, whereby the wiring CL_j and the read circuit 16 are electrically connected to each other via the transistor 22 and the transistor 23. In accordance with the voltage of the reading signal supplied to the transistor 22, current flows into the wiring IL_j and the read circuit 16 from the transistor 22. Thus, data on the current characteristics of the transistor 22 in the pixel 20_(i, j) can be read out by the read circuit 16.

Furthermore, during STEP 2, the transistor 21 may remain in an on state, and the reading signal may continue to be supplied to the wiring DL_j. In that case, for example, the potential at which the transistor 22 is turned on is once supplied to the wiring IL_j. After that, the wiring IL_j may be in a floating state. Consequently, the potential of the wiring IL_j is gradually increased. When the potential is set to the level at which the transistor 22 is turned off, that is, when the gate-source voltage of the transistor 22 is close to the threshold voltage of the transistor 22, the transistor 22 is turned off. As a result, a rise of the potential of the wiring IL_j is stopped. The potential of the wiring IL_j at that time, that is the potential of a source terminal of the transistor 22 may be read out by the read circuit 16. Consequently, the threshold voltage of the transistor 22 can be read out. Note that in the case where the potential of the source terminal of the transistor 22 is read out, the potential just before the transistor 22 is turned off may be read out.

Here, as the data on current characteristics of the transistor 22, any data on variation in current characteristics of the transistors 22 among pixels is available. For example, it may be data on current values of the transistors 22, or may be data on the threshold voltages of the transistors 22. By reading out the current values, how at least one of the threshold voltages, the motilities, the channel lengths, and the channel widths vary or deteriorate can be known from the current values. For example, in the case where current values are read out as the data, the amount of current depends on the reading signal that is input in STEP 1.

Data on current characteristics of a transistor that can be read varies depending on a circuit configuration of the read circuit 16. With the above-described read circuits given as the specific configuration examples, data on current characteristics of the transistor can be obtained by selecting at least two kinds of data. Since these data are related with each other, variation in current characteristics of the driver transistors can be corrected more accurately by obtaining a plurality of kinds of data.

Next, STEP 3 in which a signal for black display is input to the selected row so that black display is obtained is described. The reading signal input in STEP1 is a signal that turns on the transistor 22. When the transistor 23 is turned off with this signal input, forward bias is applied to the light-emitting element 24, which causes a light-emitting state of the light-emitting element 24. To prevent this, in STEP 3, a signal for black display is input to the selected row that is selected again.

To input the signal for black display, scanning is sequentially performed row by row from the first row to the m-th row again. However, the pixels in the rows other than the target row are not selected. That is, the selection signal is not supplied to the rows other than the target row, and the non-selection signal is supplied thereto.

As in STEP 1, for example, in the case where the gate line driver circuit includes a shift register circuit in STEP 3, scanning is sequentially performed from the first row to the m-th row. Row-by-row sequential scanning from the first row to the m-th row is performed only in the gate line driver circuit, and a selection signal is not supplied to all pixels from the gate line driver circuit. The selection signal is supplied only to the row in black display. Thus, a signal stored in pixels in the rows other than the row in black display is kept. Note that in the case where a decoder circuit or the like is used as the gate line driver circuit, an arbitrary row can be selected in an arbitrary order. Thus, in that case, the row-by-row sequential scanning from the first row to the m-th row is not necessarily performed in the gate line driver circuit. Without the scanning, only a predetermined row (the row in black display) may be instantly selected, and a signal for black display may be input to the pixels.

When the pixels in the i-th row are selected, a selection signal is input to the wiring GL_i that is the target row, and the transistor 21 is turned on. Since the signal for black display, which turns off the transistor 22, is input to the wiring DL_j, the signal is applied to the gate electrode of the transistor 22, and the transistor 22 is turned off.

Note that at that time, the selection signal to turn on the transistor 23 is supplied to the wiring SL_i. As a result, a voltage at which the transistor 22 is turned off can be supplied between the gate and source of the transistor 22 through the wiring IL_j.

Here, the operational amplifier 30 used in the read circuit 16 operates so that the potential of the non-inverting input terminal is equal to the potential of the inverting input terminal; thus, the potential of the wiring IL_j can be controlled by the potential of the non-inverting input terminal. Therefore, also in the above, the potential of the wiring IL_j may be controlled by the read circuit 16.

After that, a non-selection signal to turn off the transistor 23 is supplied to the wiring SL_i to turn off the transistor 23. Similarly, a non-selection signal to turn off the transistor 21 is supplied to the wiring GL_i so that the transistor 21 is turned off. As described above, the non-light-emitting states of the pixels 20 in the i-th row can be maintained from STEP 3 to scanning of pixels in the next frame.

As shown in FIG. 27A, after STEP 3, the display device in FIG. 21 terminates one frame period and starts display of the next frame. Here, in accordance with the data on the current characteristics of the transistor 22 that has been read out in STEP 2, a video signal for correcting the variation in the current characteristics of the transistors 22 can be produced and input to a corresponding pixel. As a result, variation in transistors or adverse effects due to deterioration can be reduced.

Figure 27B:
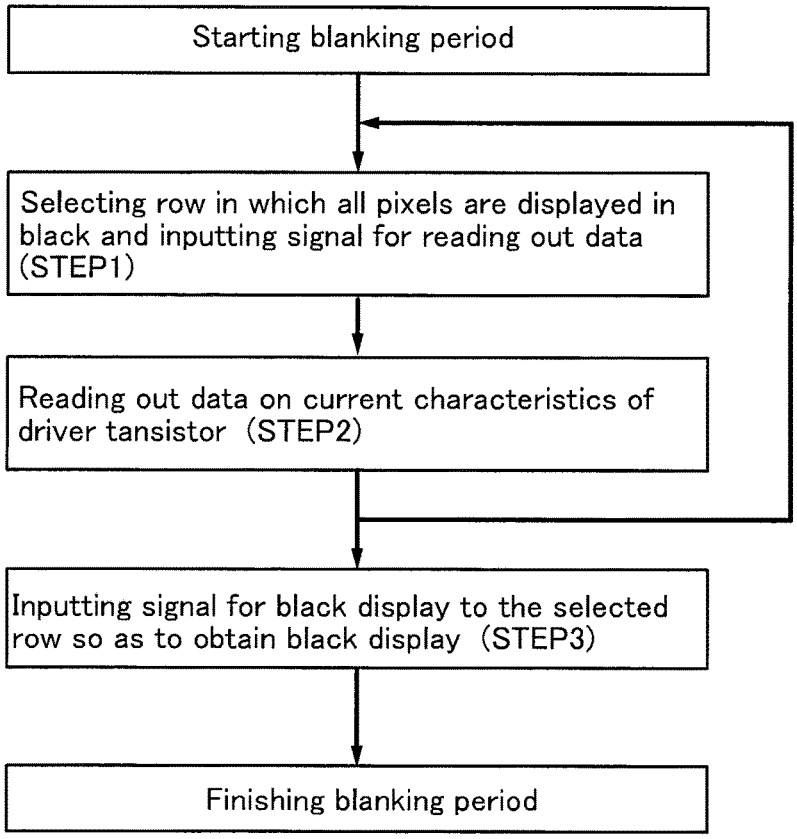

Note that in the case where there are a plurality of rows in each of which all the pixels are displayed in black, other than the i-th row, as shown in FIG. 27B, STEP 1 and STEP 2 may be repeatedly performed in the blanking period. Alternatively, in one frame period, STEP 1 to STEP 3 may be performed on only one of the rows as a target. For the other rows, STEP 1 to STEP 3 may be performed in the next or later frame period.

As for a row in which all the pixels have never been displayed in black since display of an image was started, for example, it is preferable that data on the current characteristics of the transistors 22 in that row be read out on at least one of the following occasions: when the power of the display device is turned off; just after the power of the display device is turned on; when the display device is not used in a predetermined period; at late-night; at early-morning; and the like.

Alternatively, in the blanking period, data on the current characteristics of the transistors 22 is not necessarily read out. Data on the current characteristics of the transistors 22 in all or some of the pixels may be read out on at least one of the following occasions, for example: when the power of the display device is turned off; just after the power of the display device is turned on; when the display device is not used in a predetermined period; at late-night; at early-morning; and the like.

The variation in current characteristics of the driver transistors among pixels of the display device of this embodiment can be corrected by the above-described driving method. In this driving method, the variation in current characteristics of the driver transistors can be corrected in parallel with the display operation of the display device.

A display device with small display unevenness can be provided. A display device capable of high definition display can be provided. A semiconductor device capable of reducing adverse effects due to variation in transistor characteristics can be provided. A semiconductor device capable of reducing adverse effects due to variation in the threshold voltages of transistors can be provided. A semiconductor device capable of reducing adverse effects due to variation in the mobilities of transistors can be provided.

In a product including the display device described in this embodiment, variation in luminance of pixels of the product can be corrected while display inspection of the product is performed in pre-shipment inspection. Thus, the period of the pre-shipment inspection of the product can be shortened, resulting in cost reduction of the product.

With regard also to a product that has been shipped, the above-described driving method of the display device is performed each time the power is turned on and an image is displayed. Thus, variation in luminance due to deterioration over time and the like after the shipment of the product can be automatically corrected. This enables a longer product lifetime.

Note that in the above-described driving method of the display device, data on the current characteristics is read out in the blanking period; however, the driving method of the display device of this embodiment is not necessarily limited thereto. For example, the data on the current characteristics may be read out when the display screen becomes dark and all the pixels are displayed in black, or when a black picture is inserted so as to improve moving characteristics.

Figure 28A:
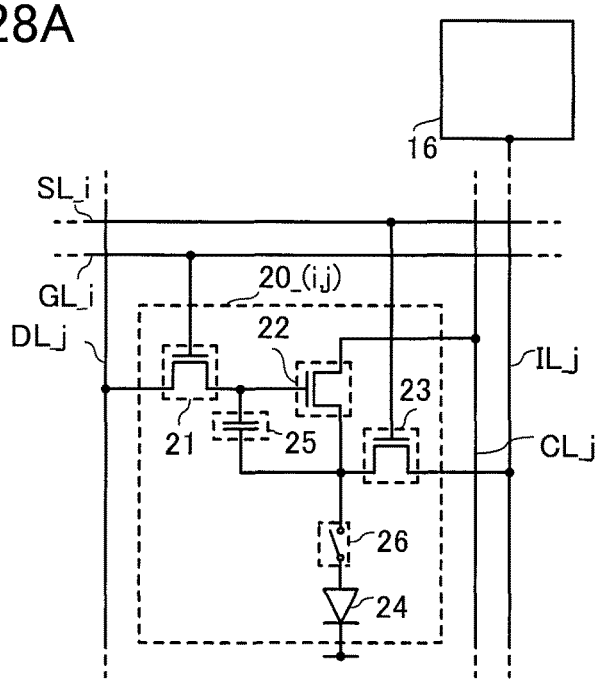
FIGS. 28A and 28B are circuit diagrams each illustrating one embodiment of the present invention.
Figure 28B:
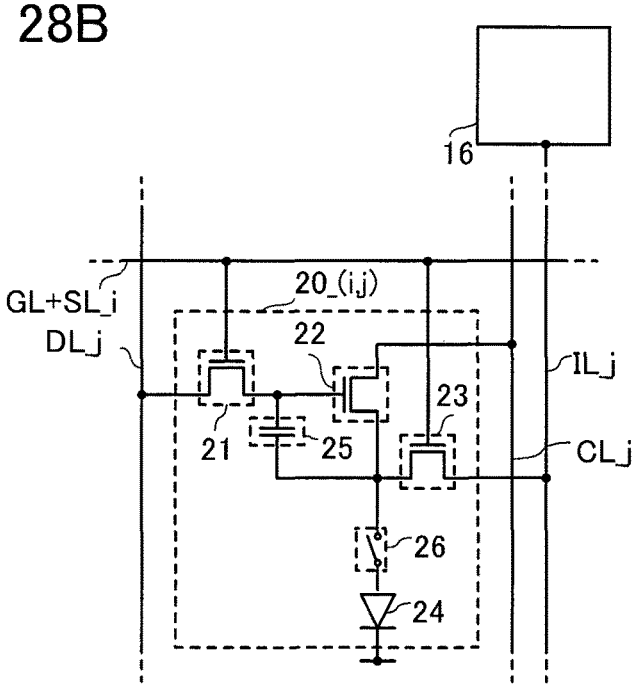

The pixel structure of the display device of this embodiment is not limited to that shown in FIG. 22. For example, in the pixel 20_(i, j) in FIG. 22, a switch 26 may be provided between the light-emitting element 24 and the transistor 22. FIGS. 28A and 28B show circuit diagrams in that case. FIG. 28A shows the case where the switch 26 is provided in the structure of FIG. 22, and FIG. 28B shows the case where the switch 26 is provided in the structure of FIG. 25. The switch 26 is turned off in STEP 1 and STEP 2, so that the non-light-emitting state of the light-emitting element 24 can be surely maintained during STEP 1 and STEP 2.

<Structure Example for Reading Current Characteristics from Pixels with Specific Hue>

In the driving method of a display device shown in FIG. 21 and FIG. 22, data on the current characteristics of all the pixels in a selected row is collectively read out; however, the driving method of a display device of this embodiment is not limited thereto, and data on current characteristics can be read out from a specific pixel in the selected row. For example, data on the current characteristics can be read out from a pixel in the same row and in a specific column, or a pixel displaying a specific hue in the same column.

Figure 29:
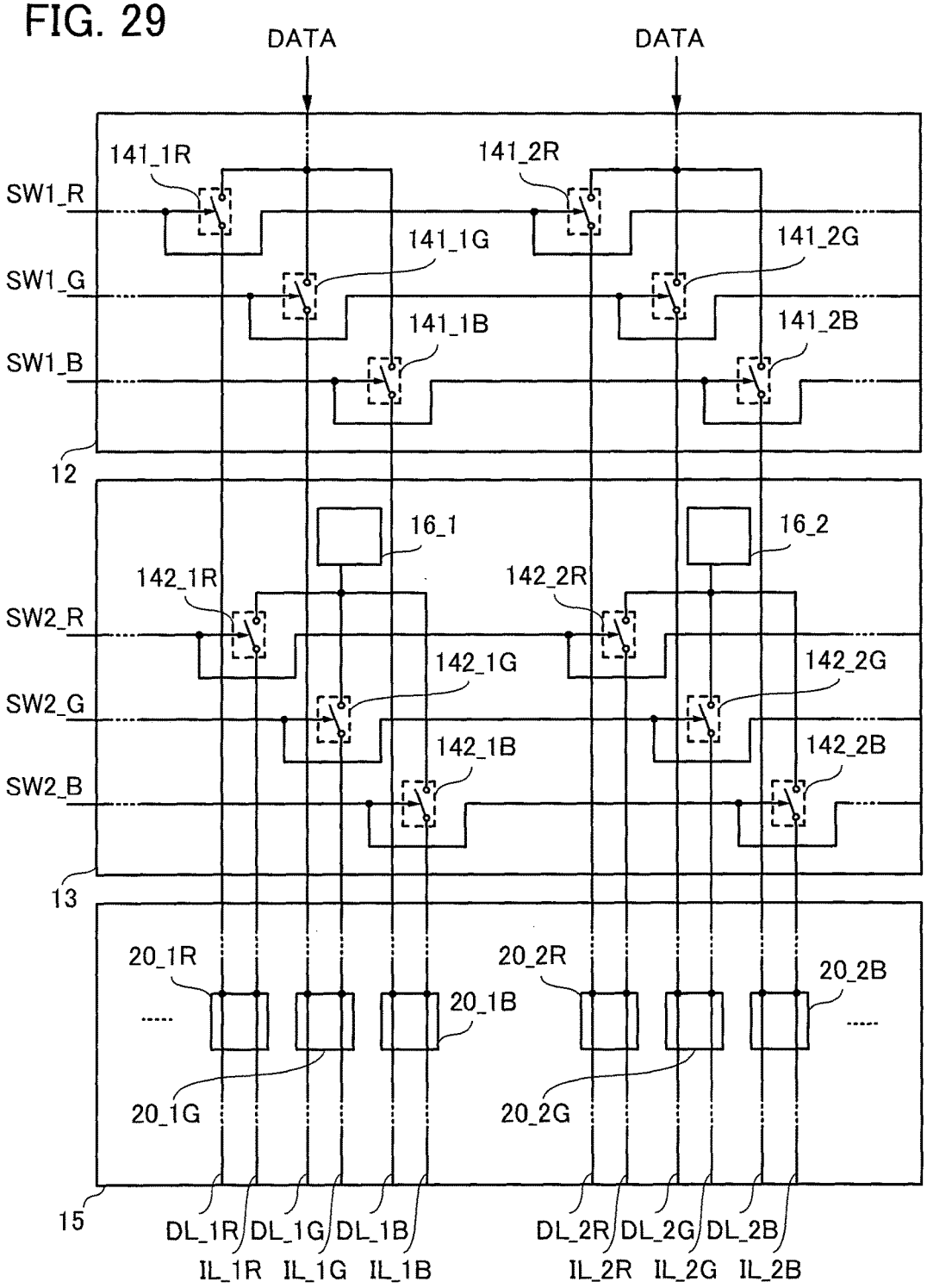
FIG. 29 is a circuit diagram illustrating one embodiment of the present invention.

FIG. 29 illustrates an example of a structure of the driver circuit 12, the circuit portion 13, and the pixel portion 15, in which data on current characteristics can be read out from pixels displaying a specific hue in the same row. FIG. 29 illustrates an example in which each of the wiring DL and the wiring IL is divided into three columns; however, one embodiment of the present invention is not limited thereto. Those wirings may be divided for more columns.

The display device in FIG. 29 has a structure in which a pixel exhibiting red, a pixel exhibiting green, and a pixel exhibiting blue are provided in the same row in the pixel portion 15 to form one pixel unit that exhibits one color. In the driver circuit 12, a kind of a video signal or a reading signal for one unit is supplied, and is divided into signals corresponding to the pixels of red, green, and blue. In the circuit portion 13, one read circuit 16 is provided for one unit.

To a pixel 20_1R exhibiting red, a signal is input from the driver circuit 12 via a wiring DL_1R and a switch 141_1R, and the pixel 20_1R is electrically connected to a read circuit 16_1 via a wiring IL_1R and a switch 142_1R. Similarly, to a pixel 20_1G exhibiting green, a signal is input from the driver circuit 12 via a wiring DL_1G and a switch 141_1G, and the pixel 20_1G is electrically connected to the read circuit 16_1 via a wiring IL_1G and a switch 142_1G. Similarly, to a pixel 20_1B exhibiting blue, a signal is input from the driver circuit 12 via a wiring DL_1B and a switch 141_1B, and the pixel 20_1B is electrically connected to the read circuit 16_1 via a wiring IL_1B and a switch 142_1B.

Pixels 20_2R to 20_2B provided in the adjacent column of the pixels 20_1R to 20_1B have structures similar to those of the pixels 20_1R to 20_1B.

The switch 141_1R and a switch 141_2R are controlled by a wiring SW1_R which extends in the row direction. The switch 141_1G and a switch 141_2G are controlled by a wiring SW1_G which extends in the row direction. The switch 141_1B and a switch 141_2B are controlled by a wiring SW1_B which extends in the row direction. The switch 142_1R and a switch 142_2R are controlled by a wiring SW2_R which extends in the row direction. The switch 142_1G and a switch 142_2G are controlled by a wiring SW2_G which extends in the row direction. The switch 142_1B and a switch 142_2B are controlled by a wiring SW2_B which extends in the row direction.

Use of the display device with such a structure enables data on the current characteristics to be read out from the pixels displaying a specific hue in the same row. For example, a reading signal is input only to pixels exhibiting red in the same row (the pixels 20_1R and 20_2R in FIG. 29), and data on the current characteristics can be read out only from the pixels exhibiting red in the same row.

With such a structure, a circuit which has been provided in one to one correspondence (e.g., a read circuit or the like) with a pixel may be provided for one unit including three pixels, so that an occupation area of the circuit can be reduced. In FIG. 29, one unit includes three pixels; however, one embodiment of the present invention is not limited thereto. One unit may include more pixels.

Note that in the display device in FIG. 29, the switches are provided for both of the driver circuit 12 and the circuit portion 13 so that processing can be separately performed per pixel with a specific hue; however, the display device of this embodiment is not limited thereto. The switch may be provided for only one of the driver circuit 12 and the circuit portion 13. Furthermore, the wirings which are electrically connected to the same pixel, such as the wiring SW1_R or the wiring SW2_R, may be electrically connected, or its wiring signals may be synchronized.

<Configuration Example of Output Control Circuit>

Figure 30A:
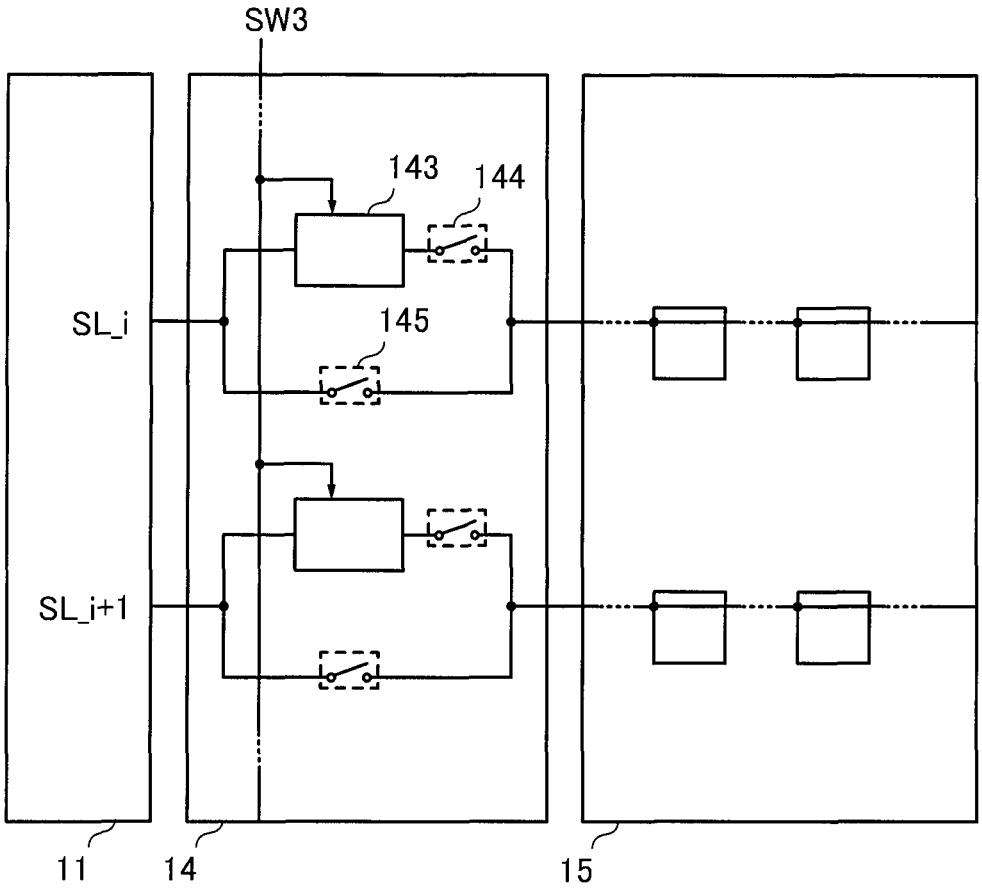
FIGS. 30A and 30B are circuit diagrams illustrating one embodiment of the present invention.
Figure 30B:
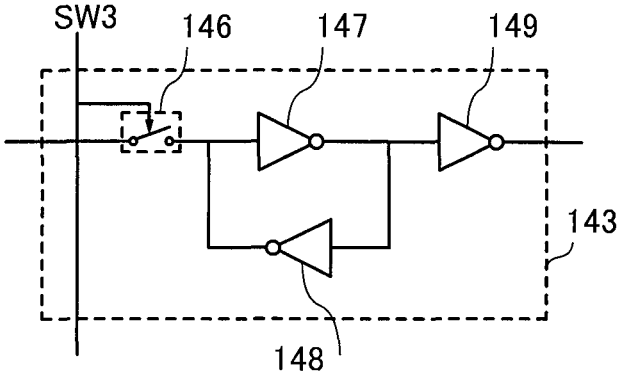

In the driving method of the display device shown in FIG. 21 and FIG. 22, data on the current characteristics is read out by sequentially performing scanning from the first row and selecting a row in which all the pixels are displayed in black. When such a driving method is employed, an output control circuit which controls a signal output from the driver circuit 11 is preferably provided. An example of a structure of the output control circuit is described with reference to FIGS. 30A and 30B. FIG. 30A shows the driver circuit 11, an output control circuit 14, and the pixel portion 15 of the display device. FIG. 30B shows an example of a structure of a latch circuit 143 shown in FIG. 30A.

The display device in FIG. 30A includes the output control circuit 14 between the driver circuit 11 and the pixel portion 15. The wiring SL_i electrically connected to the driver circuit 11 is branched into two circuits in the output control circuit 14, and one extends in the row direction via the latch circuit 143 and a switch 144, and the other extends in the row direction via a switch 145. The branched wirings SL_i are joined via the switch 144 and the switch 145, and the wiring SL_i extends to the pixel portion 15 in the row direction.

As shown in FIG. 30B, the latch circuit 143 includes a switch 146, an inverter 147, an inverter 148, and an inverter 149. One terminal of the switch 146 is electrically connected to the wiring SL_i and the other terminal is electrically connected to an input terminal of the inverter 147 and an output terminal of the inverter 148. An output terminal of the inverter 147 is electrically connected to an input terminal of the inverter 148 and an input terminal of the inverter 149. An output terminal of the inverter 149 is electrically connected to one terminal of the switch 144. The switch 146 is controlled by the wiring SW3 which extends in the column direction.

In a normal display mode, the switch 144 is turned off and the switch 145 is turned on, so that a signal is output from the driver circuit 11. When a row in which all the pixels are displayed in black is selected, the switch 144 is turned on and the switch 145 is turned off, whereby a signal is output from the driver circuit 11.

Furthermore, when the row in which all the pixels are displayed in black is selected in the blanking period, the switch 146 is turned on by the wiring SW3. Accordingly, in STEP1, a signal input to the wiring SL_i can be held in the latch circuit 143. Thus, when the wiring SL_i+1 is selected and the signal input to the wiring SL_i from the driver circuit 11 is stopped, the transistor 23 can be kept turned on by the signal held in the latch circuit 143 via the wiring SL_i.

In the display device in FIGS. 30A and 30B, an example is illustrated in which a signal is output from the wiring SL via the output control circuit 14; however, the display device of this embodiment is not limited thereto. For example, a signal may be output from the wiring GL, in addition to the wiring SL, via the output control circuit 14.

In the display device of this embodiment, in the case of using the wiring GL, the above driving method can be used without holding a signal using the latch circuit 143; thus, a structure without the latch circuit 143 may be employed.

In the display device of this embodiment, the output control circuit 14 is not necessarily provided. For example, in the case where a signal of the driver circuit 11 can be selectively output to an arbitrary row by using a decoder or the like, the output control circuit 14 is not necessarily provided.

This embodiment shows an example of a basic principle. Thus, part or the whole of this embodiment can be freely combined with, applied to, or replaced with part or the whole of another embodiment.

Embodiment 2

Modification Example 1 of Display Device

In this embodiment, a structure of a display device and a driving method thereof which are different from those described in Embodiment 1 are described with reference to FIG. 31 and FIGS. 32A and 32B.

Figure 31:
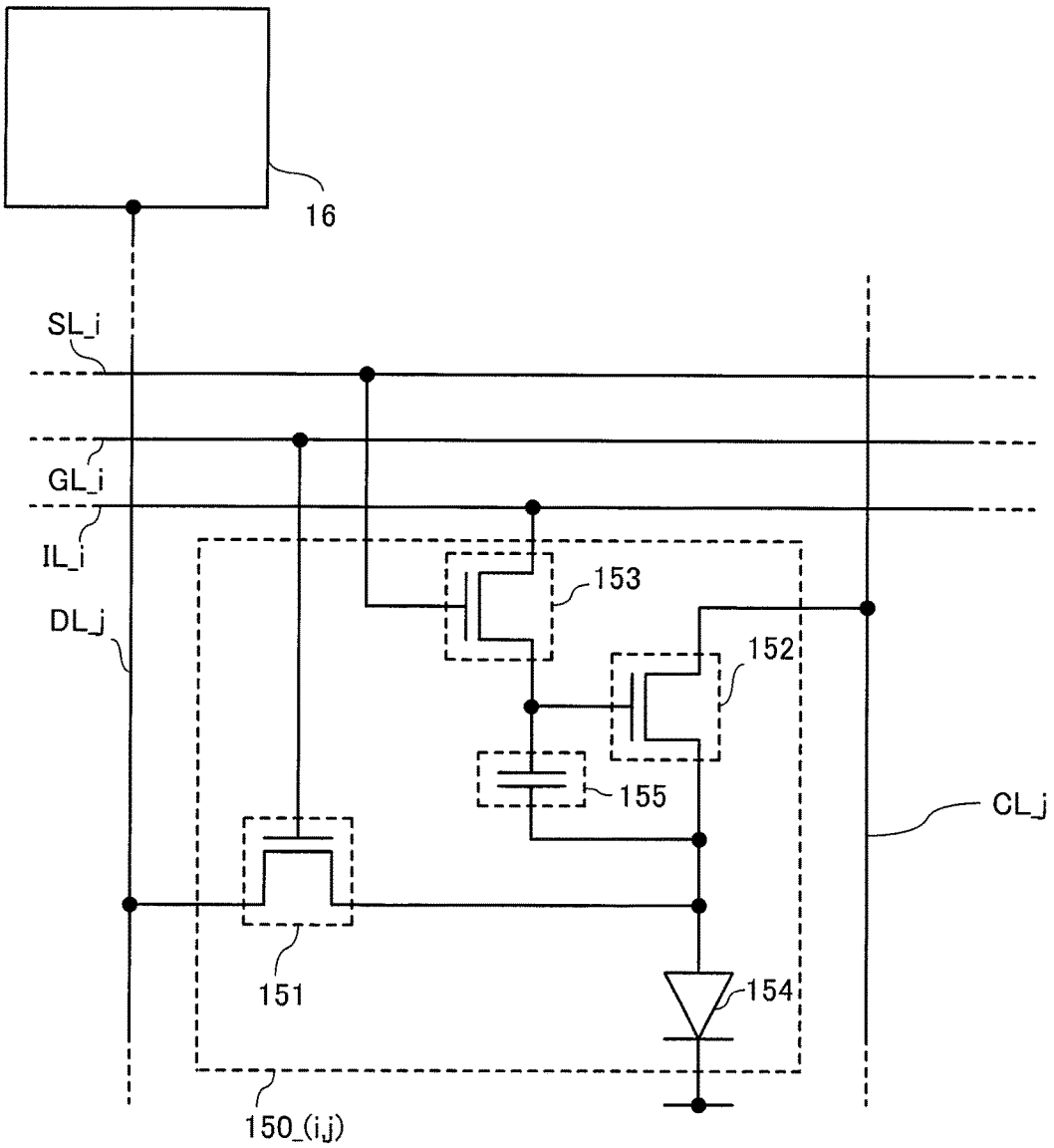
FIG. 31 is a circuit diagram illustrating one embodiment of the present invention.

FIG. 31 shows a pixel structure of the display device of this embodiment. The display device of this embodiment includes, as in the display device in FIG. 21, the pixel portion 15 including (m×n) pixels 150, a variety of peripheral circuits, and a variety of wirings. The same numerals and symbols are used for the peripheral circuits and the wirings.

Because the pixel structure is different from that in Embodiment 1, the structures of the peripheral circuit and the wiring are partly different from those in FIG. 21. Specifically, the different points are that the wiring IL extends in the row direction and the circuit portion 13 is electrically connected to the wiring DL. In that case, as shown in FIG. 23, switches may be provided so that the circuit portion 13 and the driver circuit 12 are electrically connected to the wiring DL by switching the switches.

FIG. 31 shows a structure of a pixel 150_(i, j) in the i-th row and the j-th column (i is an integer greater than or equal to 1 and less than or equal to m, and j is an integer greater than or equal to 1 and less than or equal to n). The pixel 150_(i, j) includes a transistor 151, a transistor 152, a transistor 153, a light-emitting element 154, and a capacitor 155. Note that these elements included in the pixel 150_(i, j) are electrically connected to the wiring GL_i, the wiring SL_i, the wiring DL_j, the wiring CL_j, and a wiring IL_i. Note that in FIG. 31, the wiring CL extends in the column direction and the wiring IL extends in the row direction; however the present invention is not limited to this, and the directions of the wirings may be changed as appropriate.

A specific connection relation in the pixel 150_(i, j) is as follows. A gate electrode of the transistor 151 is electrically connected to the wiring GL_i, one of a source electrode and a drain electrode thereof is electrically connected to the wiring DL_j, and the other of the source electrode and the drain electrode thereof is electrically connected to one of electrodes of the light-emitting element 154 (hereinafter also referred to as a pixel electrode). A gate electrode of the transistor 152 is electrically connected to one of a source electrode and a drain electrode of the transistor 153, one of a source electrode and a drain electrode thereof is electrically connected to the wiring CL_j, and the other of the source electrode and the drain electrode thereof (hereinafter also referred to as a source electrode of the transistor 152) is electrically connected to the one of electrodes of the light-emitting element 154. A gate electrode of the transistor 153 is electrically connected to the wiring SL_i and the other of the source electrode and the drain electrode thereof is electrically connected to the wiring IL_i. A common potential is supplied to the other of the electrodes (hereinafter also referred to as a common electrode) of the light-emitting element 154.

The wiring DL_j is electrically connected to the read circuit 16 included in the circuit portion 13.

One of electrodes of the capacitor 155 is electrically connected to the one of the source electrode and the drain electrode of the transistor 153 and the gate electrode of the transistor 152, and the other electrode thereof is electrically connected to the other of the source electrode and the drain electrode of the transistor 152, the other of the source electrode and the drain electrode of the transistor 151, and the pixel electrode of the light-emitting element 154. With the capacitor 155 provided as described above, more charge can be held in the gate electrode of the transistor 152, and a holding period of image data can be made longer.

Note that the capacitor 155 is not necessarily provided. For example, a high parasitic capacitance of the transistor 152 can be an alternative to the capacitor 155.

The wiring CL functions as a high potential power supply line which supplies current to the light-emitting element 154. Furthermore, the potential of the wiring IL may be changed in an analog manner.

Figure 33:
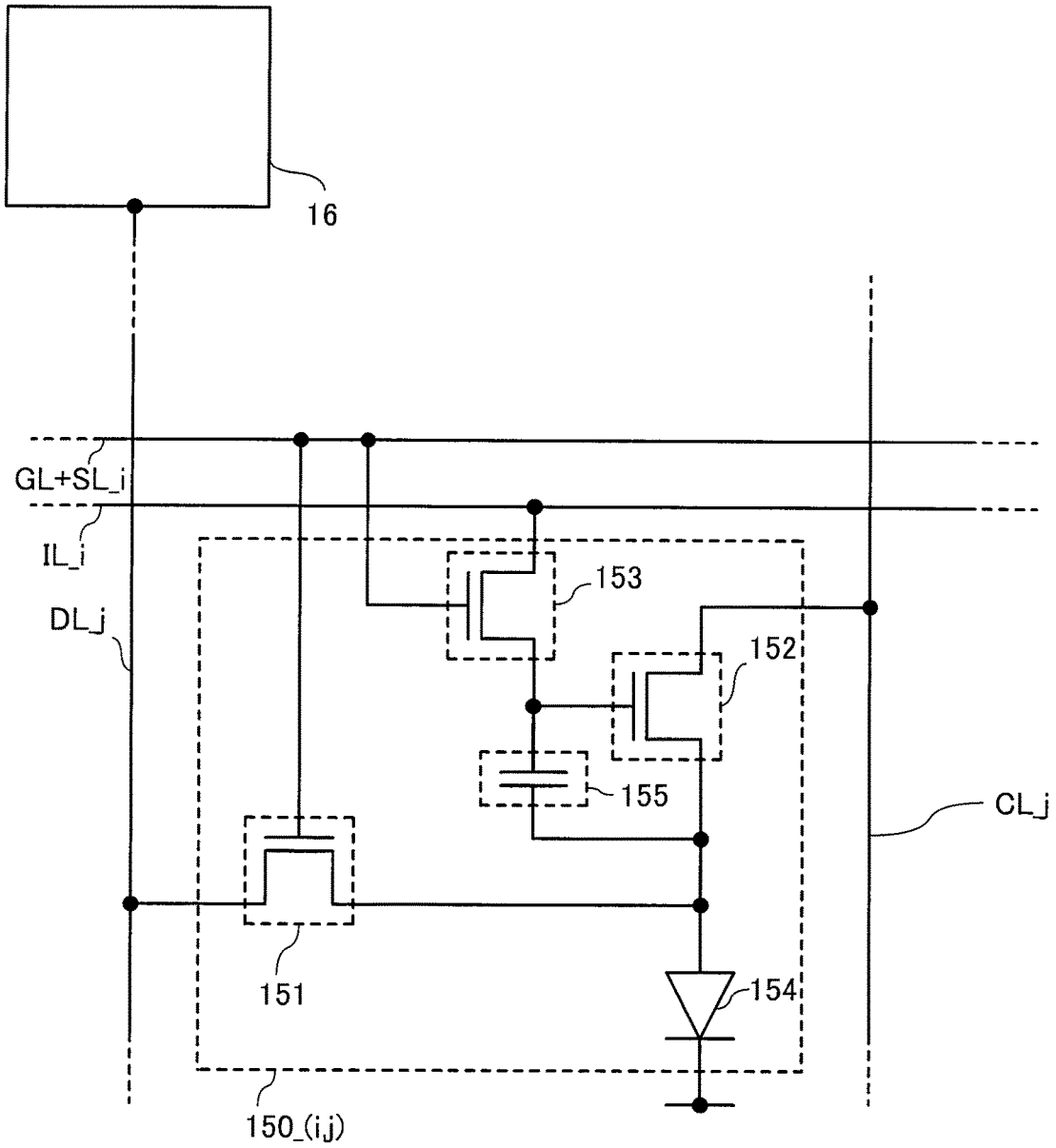
FIG. 33 is a circuit diagram illustrating one embodiment of the present invention.

Note that the wiring GL and the wiring SL may be combined into one wiring. FIG. 33 shows a circuit diagram in that case. In the case where the wiring GL and the wiring SL are combined into one wiring, the wiring acts similarly to the case where the wiring GL and the wiring SL are turned on/off at the same time. Thus, in the case where a driving method in which the wiring GL and the wiring SL are turned on/off at the same time is employed, the wiring GL and the wiring SL can be combined into one wiring.

Note that the description on the transistors 21 to 23 can be referred to for the structures of the transistors 151 to 153. Furthermore, the description on the light-emitting element 24 can be referred to for the structure of the light-emitting element 154.

In this embodiment, the wiring DL is electrically connected to the read circuit 16 and the driver circuit 12. A connection relation of the wiring DL_j, the read circuit 16, and the driver circuit 12 is described with reference to FIG. 32A.

Figure 32A:
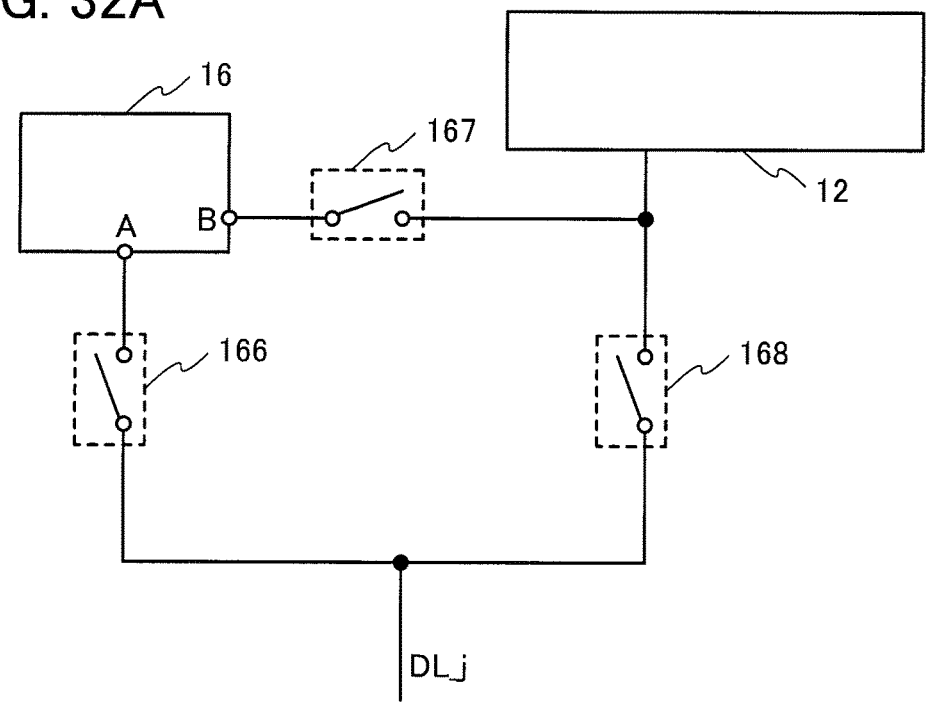
FIGS. 32A and 32B are circuit diagrams illustrating one embodiment of the present invention.

As shown in FIG. 32A, the wiring DL_j is electrically connected to a terminal A of the read circuit 16 via the switch 166 and is electrically connected to the driver circuit 12 via the switch 168. Furthermore, a terminal B of the read circuit 16 is electrically connected to the driver circuit 12 via the switch 167.

In a normal display mode, the switch 168 is turned on and the switches 166 and 167 are turned off, whereby a video signal is output from the driver circuit 12 to the wiring DL_j.

In the blanking period, the switches 166 and 167 are turned on and the switch 168 is turned off, whereby a reading signal is output from the driver circuit 12 to the wiring DL_j via the read circuit 16.

Next, a specific structure example of the read circuit 16 is described with reference to the circuit diagram in FIG. 32B.

Figure 32B:
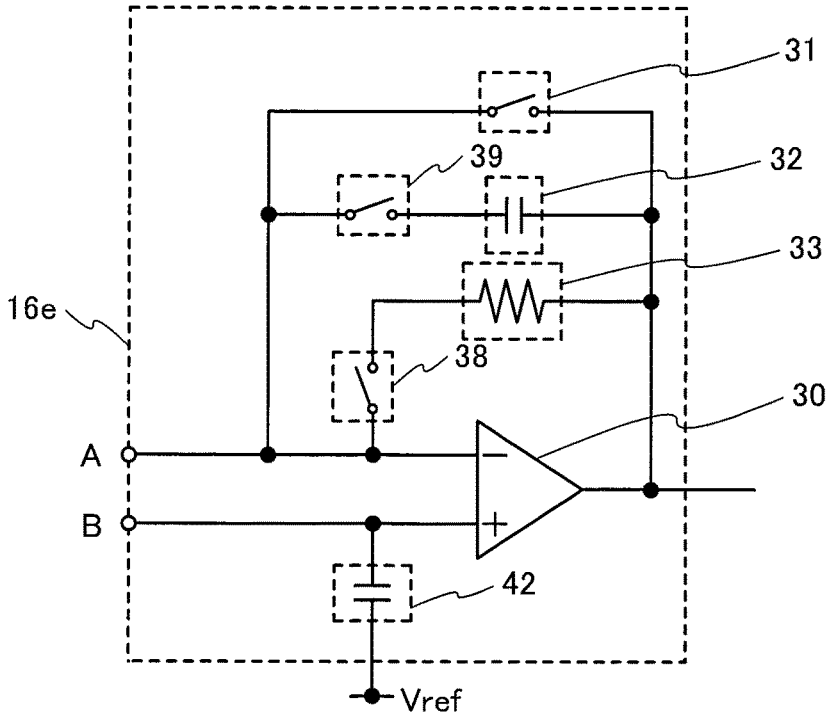

A read circuit 16*e* in FIG. 32B includes the operational amplifier 30, the capacitor 32, the resistor 33, a capacitor 42, the switch 31, the switch 38, and the switch 39. The inverting input terminal of the operational amplifier 30 is electrically connected to the output terminal of the operational amplifier 30 through the switch 31, is electrically connected to the one electrode of the capacitor 32 through the switch 39, and is electrically connected to the one electrode of the resistor 33 through the switch 38. The non-inverting input terminal of the operational amplifier 30 is electrically connected to one electrode of the capacitor 42. The output terminal of the operational amplifier 30 is electrically connected to the other electrode of the capacitor 32 and is electrically connected to the other electrode of the resistor 33. The other electrode of the capacitor 42 is electrically connected to the wiring Vref to which the reference potential is supplied, and as the reference potential, a constant potential such as a ground potential or a low voltage power supply potential is supplied. The inverting input terminal of the operational amplifier 30 functions as a terminal A of the read circuit 16*e*, and the non-inverting input terminal of the operational amplifier 30 functions as a terminal B of the read circuit 16*e*.

The read circuit 16*e* is different from the read circuit 16*c* in that the inverting input terminal of the operational amplifier 30 is electrically connected to the wiring DL_j through the switch 166, the non-inverting input terminal of the operational amplifier 30 is electrically connected to the wiring DL_j through the switch 167 and the switch 168, and the capacitor 42 is provided between the non-inverting input terminal of the operational amplifier 30 and the wiring Vref to which the reference potential is supplied. However, the structures of the other components of the read circuit 16*e* are the same as those of the other components of the read circuit 16*c*.

The operational amplifier 30 operates so that the potential of the non-inverting input terminal is equal to the potential of the inverting input terminal. Thus, the potential of the inverting input terminal of the operational amplifier 30; that is, the potential of the wiring DL_j can be controlled by the potential of the non-inverting input terminal.

In the blanking period, the reading signal output from the driver circuit 12 is output to the wiring DL_j via the operational amplifier 30. The reading signal can be held with the switch 167 turned off since the capacitor 42 is provided. Note that the switch 167 and the capacitor 42 are not necessarily provided. For example, if the reading signal continues to be output from the driver circuit 12, the switch 167 and the capacitor 42 are not necessarily provided.

The read circuit 16*e* functions as an integrator circuit when the switch 39 is on and the switch 38 is off. Thus, the read circuit 16*e* can read out the integral value of the current passing through the wiring DL_j.

The read circuit 16*e* functions as a current-voltage converter circuit when the switches 31 and 39 are off and the switch 38 is on. Thus, the read circuit 16*e* converts the current value of the wiring DL_j into a voltage value to be read out.

Since the read circuit 16*e* can read out a plurality of kinds of data as data on current characteristics of the transistor, variation in threshold voltages can be corrected more accurately. In addition, the read circuit 16*e* carries out a function of reading a plurality of kinds of data by switching the connection of the operational amplifier 30.

Thus, the accuracy of correcting variation in the threshold voltages can be increased with little increase in the area occupied by the read circuit 16. Accordingly, the area occupied by the driver circuit portion where the read circuit 16 is provided can be reduced, so that the frame of the display device can be narrowed.

As an example of the driving method of the display device having the pixel structure shown in FIG. 31, operation of the display device in the address period is described with reference to FIGS. 27A and 27B.

First, the wiring GL_i and the wiring SL_i are selected, so that a voltage between the wiring IL_i and the wiring DL_j is input to the capacitor 155, i.e., between the gate and the source of the transistor 152. At this time, the potential of the wiring DL_j changes in accordance with a video signal.

At that time, the wiring DL_j has a potential such that the light-emitting element 154 does not emit light regardless of the video signal. For example, the potential of the wiring DL_j is equal to the potential of the cathode of the light-emitting element 154 even in the case of the highest potential.

The potential of the wiring IL_i becomes lower since the potential of the wiring DL_j is low. For example, the potential of the wiring IL_i is lower than that of the wiring CL_j.

Note that it is not necessary that the wiring GL_i and the wiring SL_i be selected at the same time.

The wiring GL_i and the wiring SL_i are not selected, so that current corresponding to the voltage between the gate and the source of the transistor 152 is supplied from the transistor 152 to the light-emitting element 154, and display operation is performed.

Note that it is not necessary that the wiring GL_i and the wiring SL_i be not selected at the same time.

Such operation is sequentially performed while each row is selected and scanned. Thus, operation of the address period is terminated.

As an example of the driving method of the display device having the pixel structure shown in FIG. 31, a method for correcting variation in current characteristics in the blanking period is described with reference to FIGS. 27A and 27B. Note that explanation is made on the case where all the pixels 150 in the i-th row are displayed in black.

When the blanking period starts, as shown in FIG. 27A, scanning is sequentially performed row by row from the first row to the m-th row. However, the pixels in the rows other than the target row are not selected. That is, the selection signal is not supplied to the rows other than the target row, and the non-selection signal is supplied thereto.

First, STEP 1 in which the row in which all the pixels are displayed in black is selected and a reading signal is input thereto is described. When the pixels in the i-th row are selected, a selection signal is input to the wiring SL_i, and the transistor 153 is turned on. When the transistor 153 is turned on, the wiring IL_i and the gate electrode of the transistor 152 are electrically connected to each other, and the potential of the wiring IL_i is supplied to the gate electrode of the transistor 152.

After that, or at the same time, the selection signal is input to the wiring GL_i, and the transistor 151 is turned on. When the transistor 151 is turned on, the wiring DL_j and the source electrode of the transistor 152 are electrically connected to each other. Here, the reading signal is supplied to the wiring DL_j, so that the potential difference between the gate and the source of the transistor 152 is larger than the threshold voltage of the transistor 152, and the transistor 152 can be turned on.

At that time, the potential of the wiring DL_j is preferably lower than the common potential, or at the same level as the common potential. The potential of the wiring DL_j is set as described above, so that reverse bias is applied to the light-emitting element 154 or bias is not applied to the light-emitting element 154. Thus, the black display state of the pixels in the i-th row can be maintained. Furthermore, even if forward bias is applied to the light-emitting element 154 so that the black display state of the pixels in the i-th row can be maintained at least until STEP 3, the potential difference between the wiring DL_j and the common potential can be suppressed to extremely small. The extremely small potential difference is preferably approximately several volts, for example, 2 volts or lower, further preferably 1 volt or lower. The current flowing into the transistor 152 does not flow into the light-emitting element 154, and becomes ready to flow into the wiring DL_j.

The signal with which the transistor 151 is kept turned off is input to the wiring GL so that the reading signal is not input to the rows other than the i-th row.

Next, STEP 2 in which data on current characteristics of the transistor 152 (driver transistor) is read out is described. After STEP1, scanning shifts from the i-th row to the (i+1)th row, and the supply of the selection signal that has been input to the wiring SL_i is stopped, and the transistor 153 is turned off. Thus, the potential of the wiring IL_i that has been input to the gate electrode of the transistor 152 in STEP1 is maintained.

In contrast, the transistor 151 needs to be turned on during STEP 2. Thus, as in STEP 1, the signal which makes the transistor 151 in an on state needs to be continuously input to the wiring GL_i also in STEP 2. For example, a latch circuit is connected to the wiring GL so that the input signal at the time of STEP 1 is held also in STEP 2.

In the case where a decoder circuit and the like are used in the gate line driver circuit, the selection signal can be continued to be supplied to the wiring GL_i, even without connection of a latch circuit and the like to the wiring GL, by controlling a signal input to the decoder circuit.

The transistor 153 is turned off, and the transistors 151 and 152 are turned on in such a manner, so that the wiring CL_j and the read circuit 16 are electrically connected to each other via the transistor 152 and the transistor 151. In accordance with the voltage of the reading signal supplied to the transistor 152, current flows into the wiring DL_j and the read circuit 16 from the transistor 152. Thus, data on the current characteristics of the transistor 152 in the pixel 150_(i, j) can be read out by the read circuit 16.

Also during STEP 2, the transistor 153 may remain in an on state. In that case, for example, the potential at which the transistor 152 is turned on is once supplied to the wiring DL_j. After that, the wiring DL_j may be in a floating state. Consequently, the potential of the wiring DL_j is gradually increased. Then, when the potential is set to the level at which the transistor 152 is turned off, that is, when the gate-source voltage of the transistor 152 is close to the threshold voltage of the transistor 152, the transistor 152 is turned off. As a result, a rise of the potential of the wiring DL_j is stopped. The potential of the wiring DL_j at that time, that is the potential of a source terminal of the transistor 152 may be read out by the read circuit 16. Consequently, the threshold voltage of the transistor 152 can be read out. Note that in the case where the potential of the source terminal of the transistor 152 is read out, the potential just before the transistor 152 is turned off may be read out.

As the data on the current characteristics of the transistor 152, any data on variation in the current characteristics of the transistors 152 among pixels may be taken. For example, it may be the current value of the transistor 152, or may be the threshold voltage of the transistor 152.

Next, STEP 3 in which a signal for black display is input to the selected row so as to obtain black display is described. The reading signal input in STEP1 is a signal that turns on the transistor 152. When the transistor 151 is turned off with this signal input, forward bias is applied to the light-emitting element 154, which causes a light-emitting state of the light-emitting element 154.

To prevent this, scanning is sequentially performed row by row from the first row to the m-th row. However, the pixels in the rows other than the target row are not selected. That is, the selection signal is not supplied to the pixels in the rows other than the target row, and the non-selection signal is supplied thereto. When the wiring GL_i that is the target row is selected, the signal for black display, which makes the transistor 152 turned off is input to the wiring DL_j. The signal is supplied to the source electrode of the transistor 152, so that the potential difference between the gate and the source of the transistor 152 is smaller than the threshold voltage of the transistor 152, and the transistor 152 can be turned off.

Note that at that time, a selection signal to turn on the transistor 153 is supplied to the wiring SL_i. As a result, a voltage at which the transistor 152 is turned off can be supplied between the gate and the source of the transistor 152.

As described above, the non-light-emitting state of the pixels 150 in the i-th row from STEP 3 to scanning of pixels in the next frame can be maintained.

As shown in FIG. 27A, after STEP 3, the display device in FIG. 21 terminates one frame period and starts display of the next frame. Here, in accordance with the data on the current characteristics of the transistors 152 that has been read out in STEP 2, a video signal for correcting the variation in the current characteristics of the transistors 152 can be produced and input to a corresponding pixel. As a result, variation in transistors or adverse effects of deterioration can be reduced.

Note that in the case where there are a plurality of rows in each of which all the pixels are displayed in black, other than the i-th row, as shown in FIG. 27B, STEP 1 and STEP 2 may be repeatedly performed in the blanking period. Alternatively, in one frame period, STEP 1 to STEP 3 may be performed on only one of the rows as a target. For the other rows, STEP 1 to STEP 3 may be performed in the next or later frame period.

As for a row in which all the pixels have never been displayed in black since the display of an image was started, for example, it is preferable that data on the current characteristics of the transistors 152 in that row be read out on the occasion of turning off the power of the display device.

The variation in current characteristics of the driver transistors among pixels of the display device of this embodiment can be corrected by the above-described driving method. In this driving method, the variation in current characteristics of the driver transistors can be corrected in parallel with the display operation of the display device.

Figure 34A:
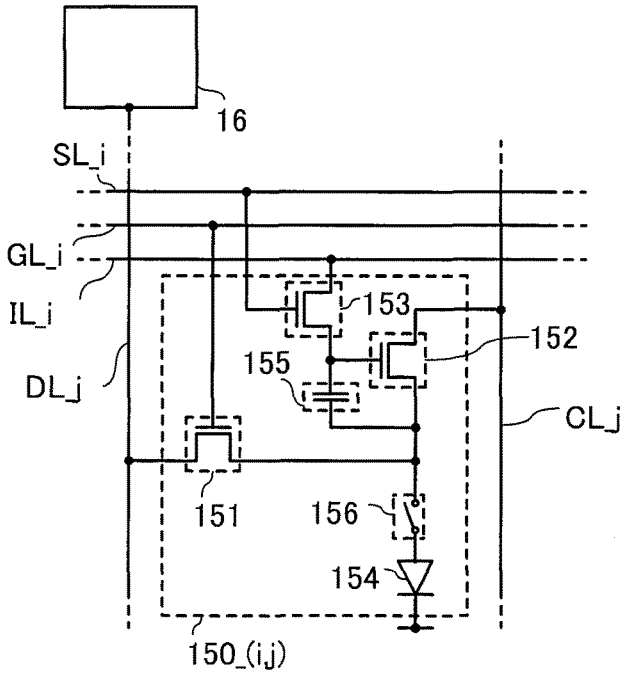
FIGS. 34A and 34B are circuit diagrams each illustrating one embodiment of the present invention.
Figure 34B:
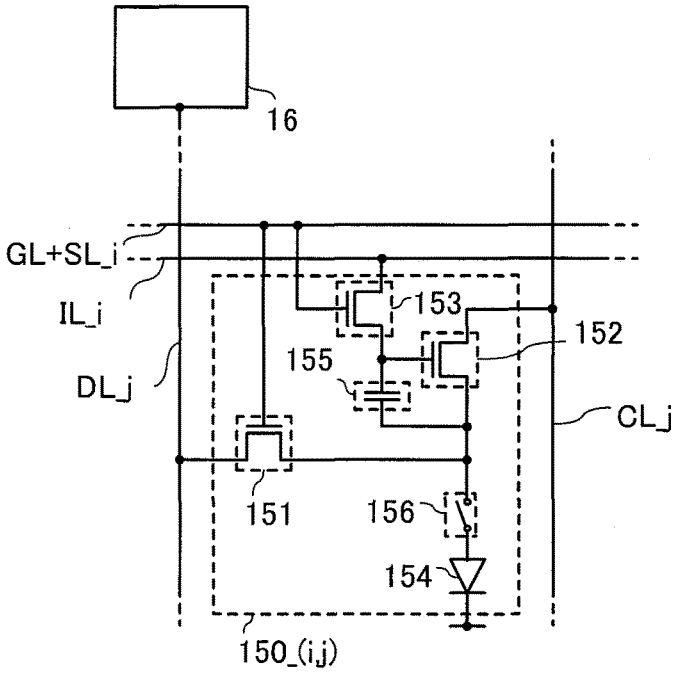

The pixel structure of the display device of this embodiment is not limited to that shown in FIG. 31. For example, in the pixel 150_(i, j) in FIG. 31, a switch 156 may be provided between the light-emitting element 154 and the transistor 152. FIGS. 34A and 34B show circuit diagrams in that case. FIG. 34A shows the case where the switch 156 is provided in the structure of FIG. 31, and FIG. 34B shows the case where the switch 156 is provided in the structure of FIG. 33. The switch 156 is turned off during STEP 1 and STEP 2, so that the non-light-emitting state of the light-emitting element 154 can be surely maintained in STEP 1 and STEP 2.

This embodiment is obtained by performing change, addition, modification, removal, application, superordinate conceptualization, or subordinate conceptualization on part or the whole of another embodiment. Thus, part or the whole of this embodiment can be freely combined with, applied to, or replaced with part or the whole of another embodiment.

Embodiment 3

Modification Example 2 of Display Device

In this embodiment, a structure of a display device and a driving method thereof which are different from those described in Embodiment 1 are described with reference to FIG. 35 and FIG. 36.

Figure 35:
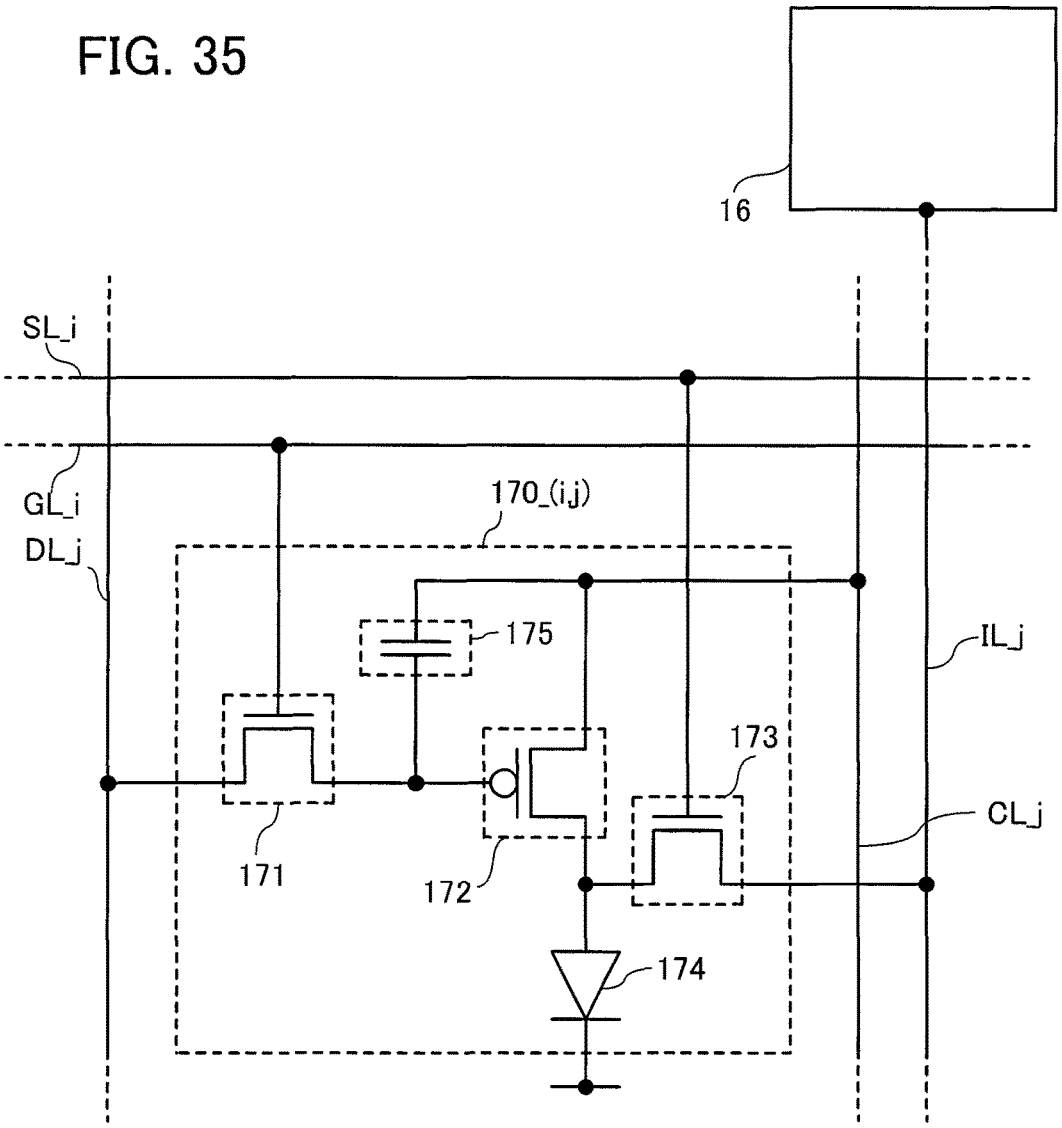
FIG. 35 is a circuit diagram illustrating one embodiment of the present invention.

FIG. 35 shows a pixel structure of the display device of this embodiment. The display device of this embodiment includes, as in the display device in FIG. 21, the pixel portion 15 including (m×n) pixels 170, a variety of peripheral circuits, and a variety of wirings. The same numerals and symbols are used for the peripheral circuits and the wirings.

FIG. 35 shows a structure of a pixel 170_(i, j) in the i-th row and the j-th column (i is an integer greater than or equal to 1 and less than or equal to m, and j is an integer greater than or equal to 1 and less than or equal to n). The pixel 170_(i, j) includes a transistor 171, a p-channel transistor 172, a transistor 173, a light-emitting element 174, and a capacitor 175. Note that these elements included in the pixel 170_(i, j) are electrically connected to the wiring GL_i, the wiring SL_i, the wiring DL_j, the wiring CL_j, and the wiring IL_j.

A specific connection relation in the pixel 170_(i, j) is as follows. A gate electrode of the transistor 171 is electrically connected to the wiring GL_i, one of a source electrode and a drain electrode thereof is electrically connected to the wiring DL_j, and the other of the source electrode and the drain electrode thereof is electrically connected to a gate electrode of the transistor 172. One of a source electrode and a drain electrode of the transistor 172 is electrically connected to one of a source electrode and a drain electrode of the transistor 173 and one of electrodes of the light-emitting element 174 (hereinafter also referred to as a pixel electrode), and the other of the source electrode and the drain electrode thereof (hereinafter also referred to as a source electrode of the transistor 172) is electrically connected to the wiring CL_j. A gate electrode of the transistor 173 is electrically connected to the wiring SL_i and the other of the source electrode and the drain electrode thereof is electrically connected to the wiring IL_j. A common potential is supplied to the other of the electrodes (hereinafter also referred to as a common electrode) of the light-emitting element 174.

The wiring IL_j is electrically connected to the read circuit 16 included in the circuit portion 13.

One of electrodes of the capacitor 175 is electrically connected to the other of the source electrode and the drain electrode of the transistor 171 and the gate electrode of the transistor 172, and the other electrode thereof is electrically connected to the other of the source electrode and the drain electrode of the transistor 172. With the capacitor 175 provided as described above, more charge can be held in the gate electrode of the transistor 172, and a holding period of image data can be made longer.

Note that the capacitor 175 is not necessarily provided. For example, a high parasitic capacitance of the transistor 172 can be an alternative to the capacitor 175.

Note that the description on the transistors 21 and 23 can be referred to for the structures of the transistors 171 and 173. Furthermore, the description on the light-emitting element 24 can be referred to for the structure of the light-emitting element 174.

The pixel structure in FIG. 35 is different from the pixel structure in FIG. 22 in the use of a p-channel transistor for the transistor 172 and accordingly in a connection relation of the capacitor 175. The driving method of the display device illustrated in FIG. 35 can be referred to for the driving method of the display device in Embodiment 1, considering a potential of the transistor 172 which is opposite to a potential of the transistor 22.

Figure 36:
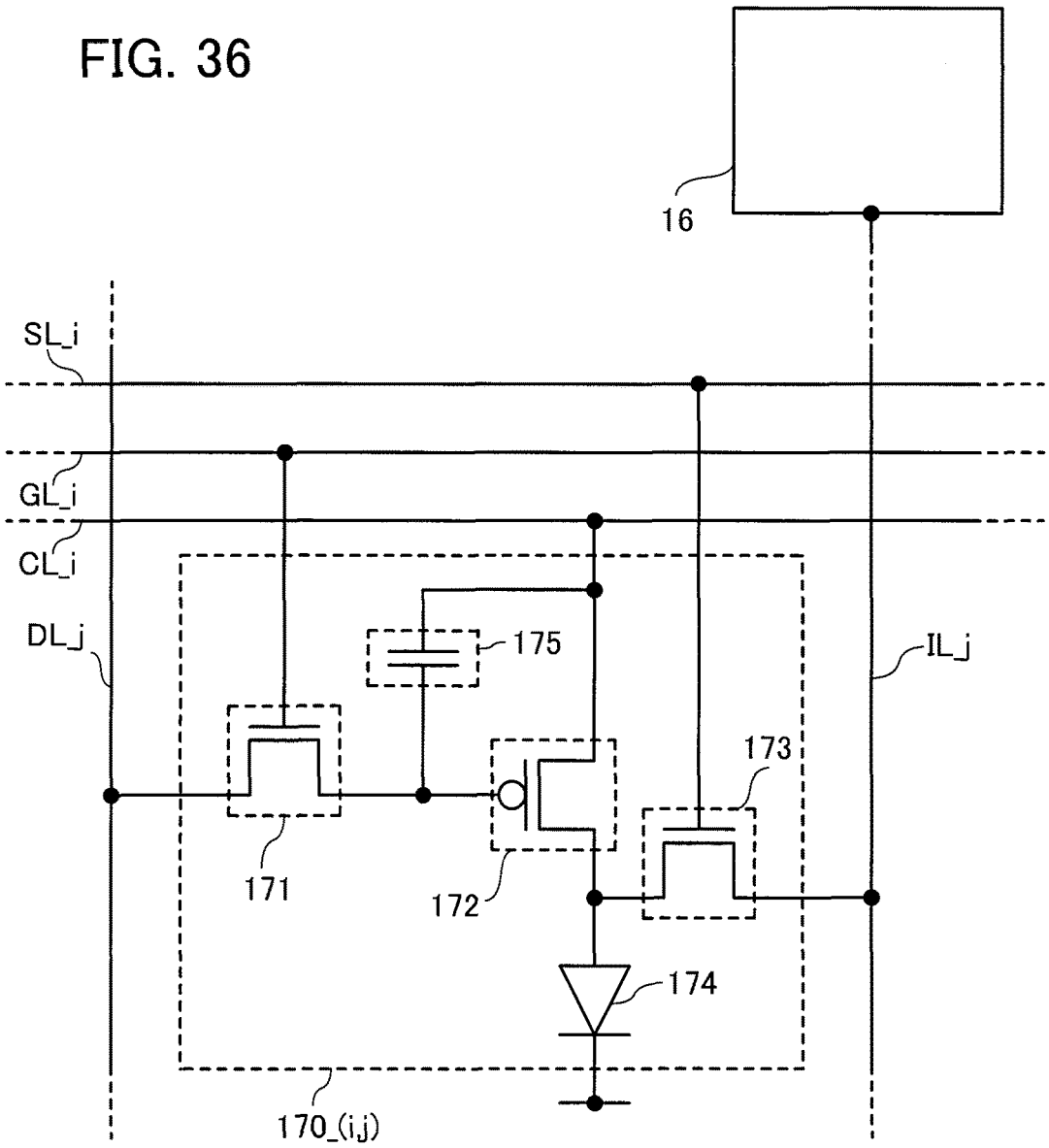
FIG. 36 is a circuit diagram illustrating one embodiment of the present invention.

FIG. 36 shows a pixel structure that is different from that in FIG. 35. The pixel structure in FIG. 36 is different from that in FIG. 35 in that the wiring CL extends in the row direction, and the other structures are similar to those in FIG. 35.

Here, the potential of the wiring CL may be changed in an analog manner, so that the potential of the wiring CL can be adjusted in accordance with the changes in the potentials of the wiring GL and the wiring SL. For example, in STEP 1 and STEP 2 in FIG. 27B, the potential of the wiring CL_j can be lower than the common potential, or at the same level as the common potential. The potential of the wiring CL_j is set as described above, so that reverse bias is applied to the light-emitting element 174 or bias is not applied to the light-emitting element 174. Thus, the black display state of the pixels in the i-th row can be maintained. Furthermore, even if forward bias is applied to the light-emitting element 174 so that the black display state of the pixels in the i-th row can be maintained at least until STEP 3, the potential difference between the wiring CL_j and the common potential can be suppressed to extremely small. The extremely small potential difference is preferably approximately several volts, for example, 2 volts or lower, further preferably 1 volt or lower.

The variation in current characteristics of the driver transistors among pixels of the display device of this embodiment can be corrected by the above-described driving method. In this driving method, the variation in current characteristics of the driver transistors can be corrected in parallel with the display operation of the display device.

Figure 37:
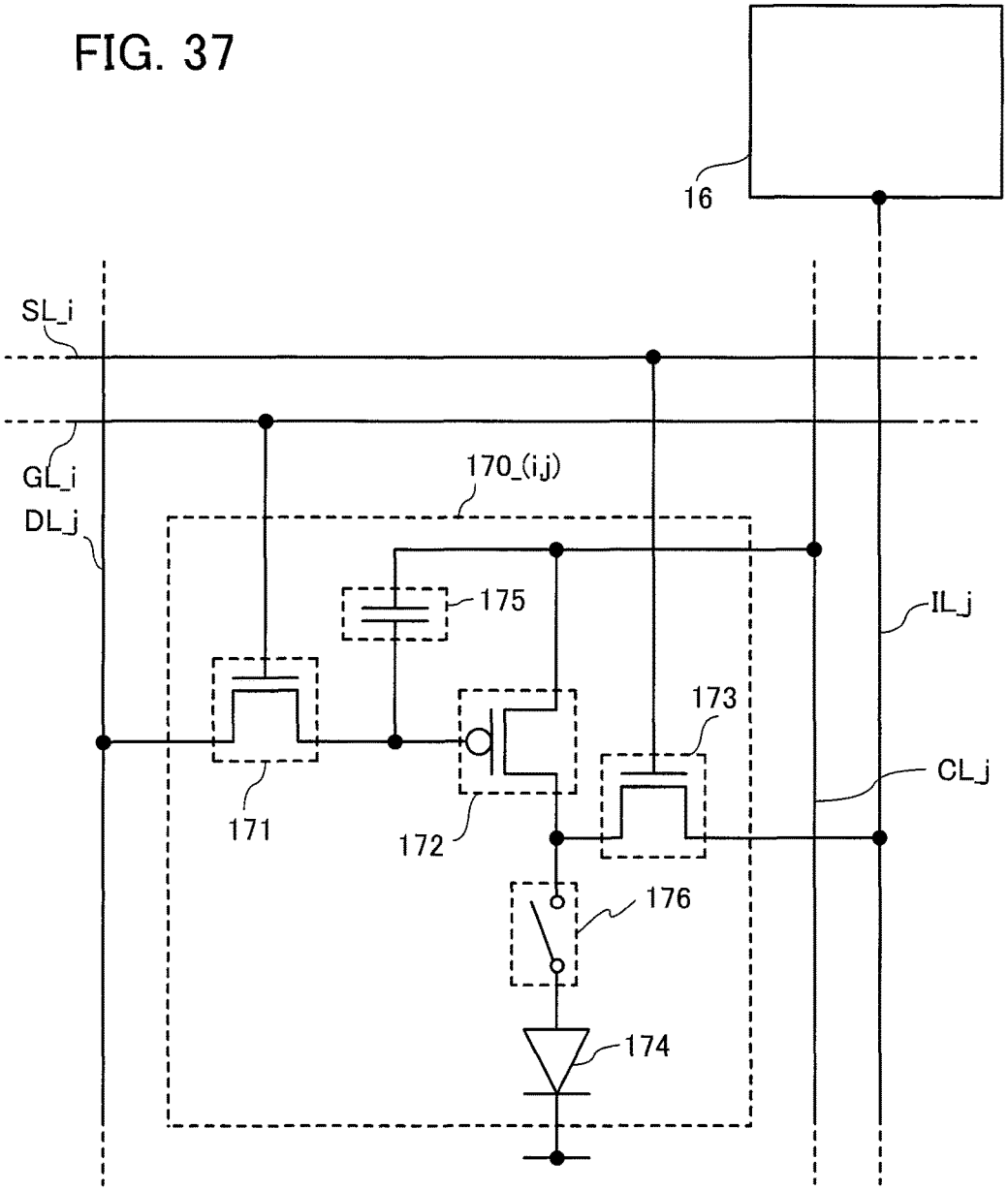
FIG. 37 is a circuit diagram illustrating one embodiment of the present invention.
Figure 38:
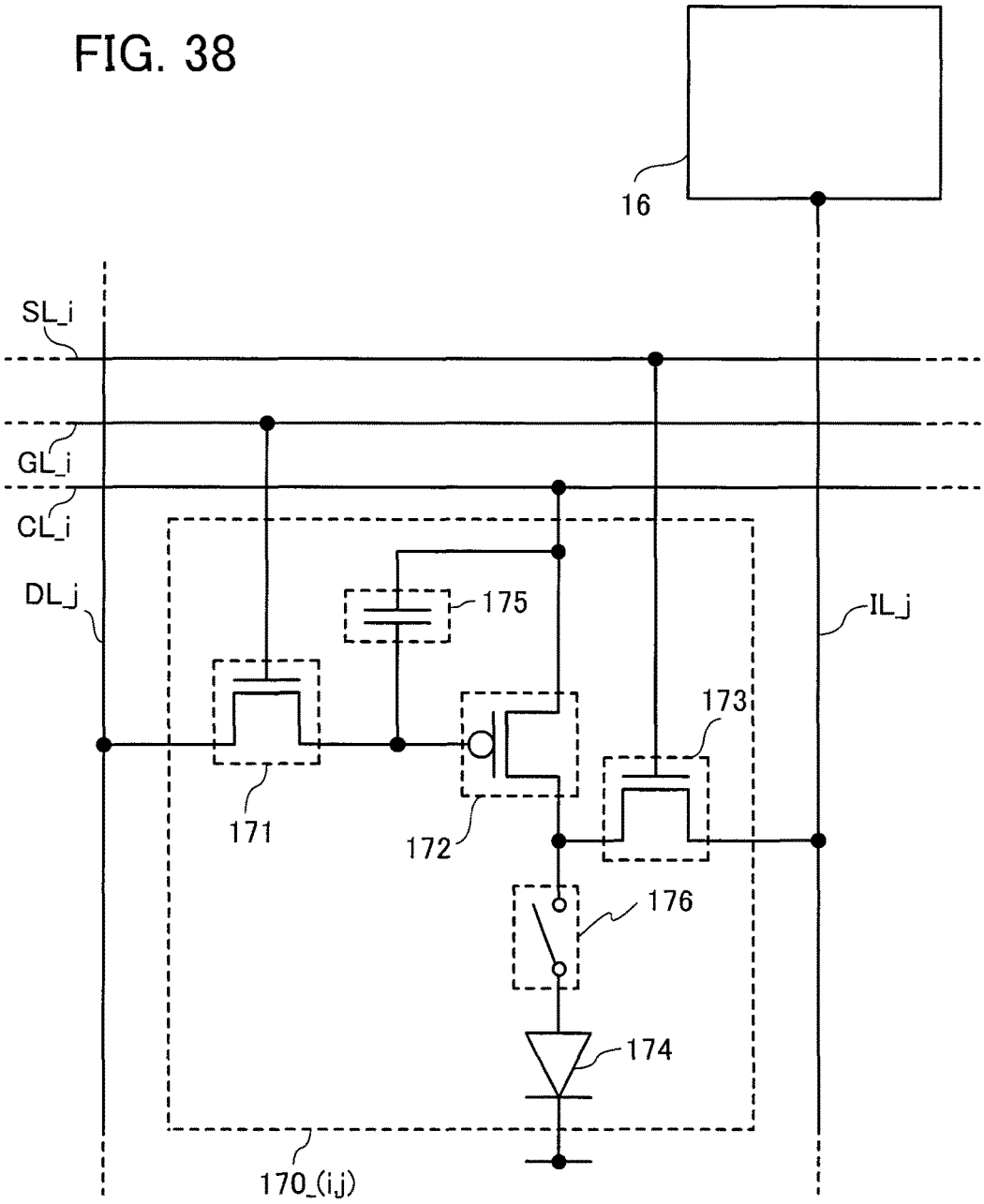
FIG. 38 is a circuit diagram illustrating one embodiment of the present invention.

The pixel structure of the display device of this embodiment is not limited to those shown in FIG. 35 and FIG. 36. For example, in the pixel 170_(i, j) in FIG. 35 and FIG. 36, a switch 176 may be provided between the light-emitting element 174 and the transistor 172. FIG. 37 and FIG. 38 show circuit diagrams in that case. FIG. 37 shows the case where the switch 176 is provided in the structure of FIG. 35, and FIG. 38 shows the case where the switch 176 is provided in the structure of FIG. 38. The switch 176 is turned off during STEP 1 and STEP 2, so that the non-light-emitting state of the light-emitting element 174 can be surely maintained in STEP 1 and STEP 2.

This embodiment is obtained by performing change, addition, modification, removal, application, superordinate conceptualization, or subordinate conceptualization on part or the whole of another embodiment. Thus, part or the whole of this embodiment can be freely combined with, applied to, or replaced with part or the whole of another embodiment.

Embodiment 4

Specific Structure Example of Display Device

Figure 39:
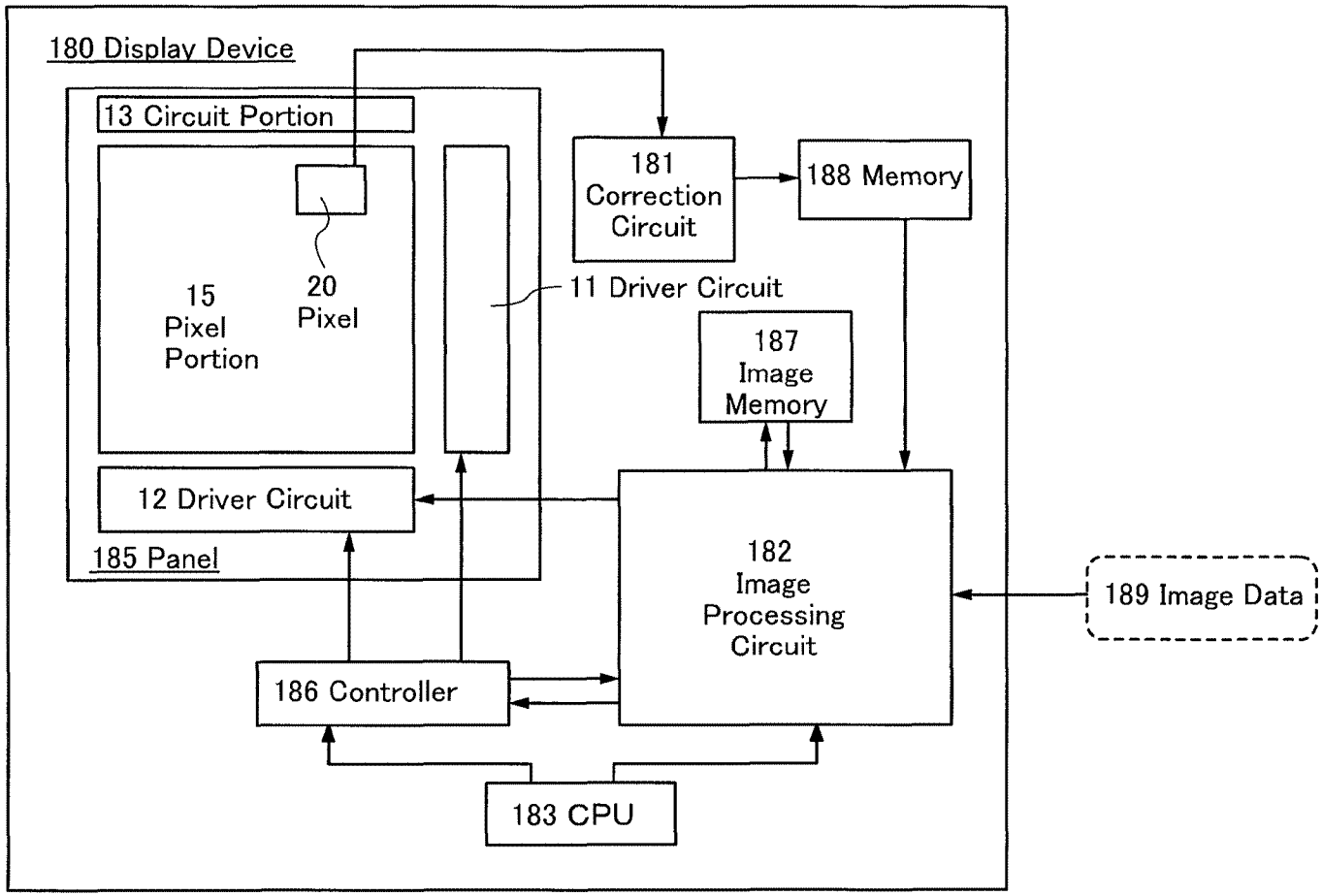
FIG. 39 is a block diagram illustrating one embodiment of the present invention.

An example of a structure of a display device is described. FIG. 39 shows a block diagram of a structure of a display device 180. Although the block diagram shows components classified according to their functions in independent blocks, it may be practically difficult to separate the components according to their functions and, in some cases, one component may have a plurality of functions.

The display device 180 illustrated in FIG. 39 includes a panel 185 including the plurality of pixels 20 in the pixel portion 15, a controller 186, a CPU 183, an image processing circuit 182, an image memory 187, a memory 188, and a correction circuit 181. Furthermore, the panel 185 includes the driver circuit 11, the driver circuit 12, and the circuit portion 13. Note that the description in the above embodiments can be referred to for the driver circuit 11, the driver circuit 12, the circuit portion 13, the pixel portion 15, and the pixel 20.

The CPU 183 is configured to decode an instruction input from the outside or an instruction stored in a memory provided in the CPU 183 and execute the instruction by controlling the overall operations of various circuits included in the display device 180.

By the method described in Embodiment 1, the correction circuit 181 generates data for correcting current characteristics on the basis of data on current characteristics of driver transistors included in the respective display pixels. The memory 188 is configured to store data for correcting current characteristics.

The image memory 187 is configured to store image data 189 which is input to the display device 180. Note that although just one image memory 187 is provided in the display device 180 in FIG. 39, a plurality of image memories 187 may be provided in the display device 180. For example, in the case where the pixel portion 15 displays a full-color image with the use of three pieces of image data 189 corresponding to hues such as red, blue, and green, the image memory 187 corresponding to each of the pieces of image data 189 may be provided.

As the image memory 187, for example, a memory circuit such as a dynamic random access memory (DRAM) or a static random access memory (SRAM) can be used. Alternatively, as the image memories 187, video RAMs (VRAMs) may be used.

The image processing circuit 182 is configured to write and read the image data 189 to and from the image memory 187 in response to an instruction from the CPU 183 and to generate a video signal from the image data 189. In addition, the image processing circuit 182 is configured to read the data stored in the memory 188 in response to an instruction from the CPU 183 and correct the video signal using the data.

The controller 186 is configured to process the video signal in accordance with the specification of the panel 185 and then supply the processed video signal to the panel 185.

Note that the controller 186 is configured to supply various driving signals used for driving the driver circuit 12, the driver circuit 11, and the like to the panel 185. The driving signal includes a start pulse signal SSP, a clock signal SCK, and a latch signal LP for controlling operation of the driver circuit 12, a start pulse GSP and a clock signal GCK for controlling operation of the driver circuit 11, and the like.

Note that the display device 180 may include an input device which is configured to give data or an instruction to the CPU 183 included in the display device 180. As the input device, a keyboard, a pointing device, a touch panel, a sensor, or the like can be used.

Structure Example 1 of Transistor

In FIGS. 40A and 40B and FIGS. 45A and 45B, transistors each having a top-gate structure are shown as examples of transistors included in a display device.

Figure 40A:
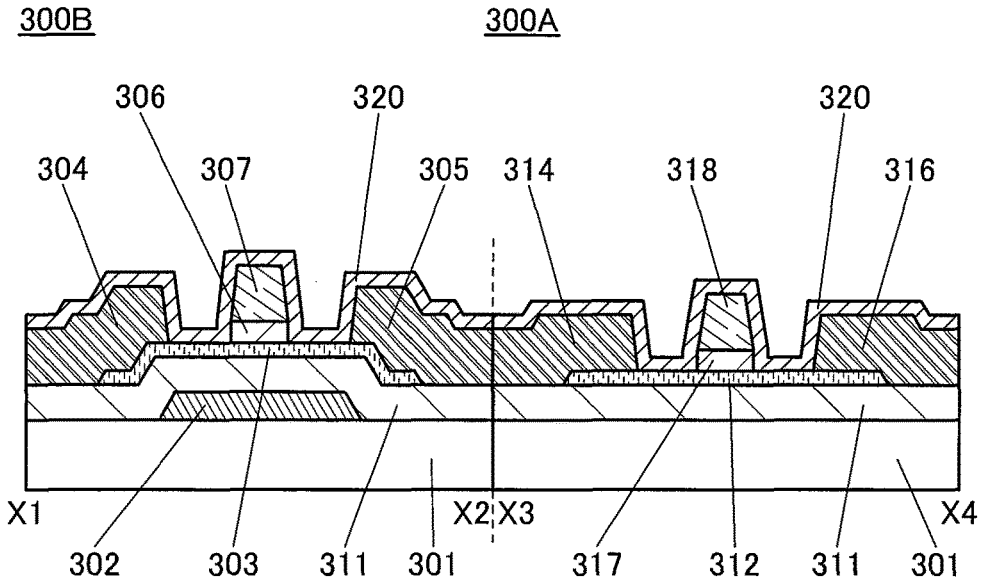
FIGS. 40A and 40B are cross-sectional views illustrating one embodiment of the present invention.
Figure 40B:
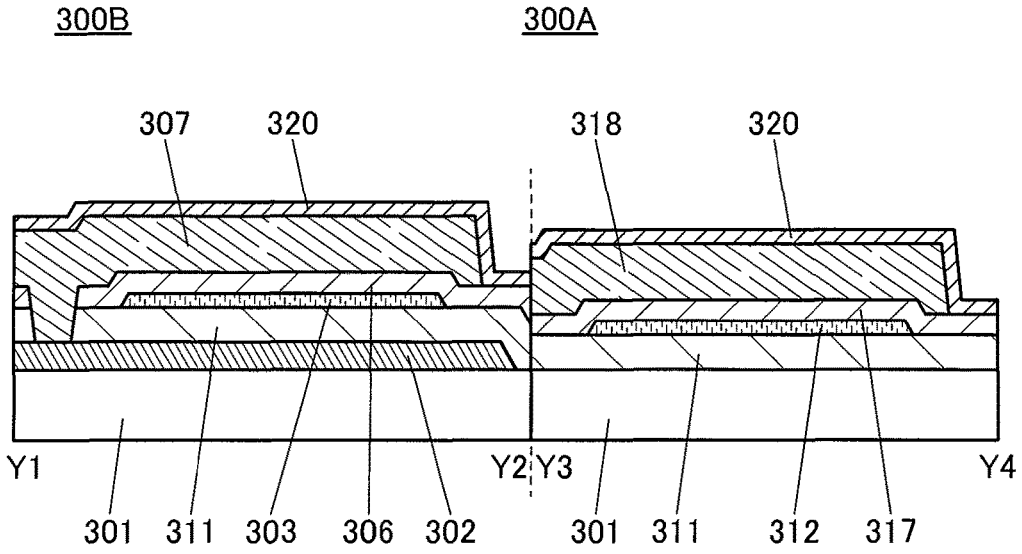
Figure 45A:
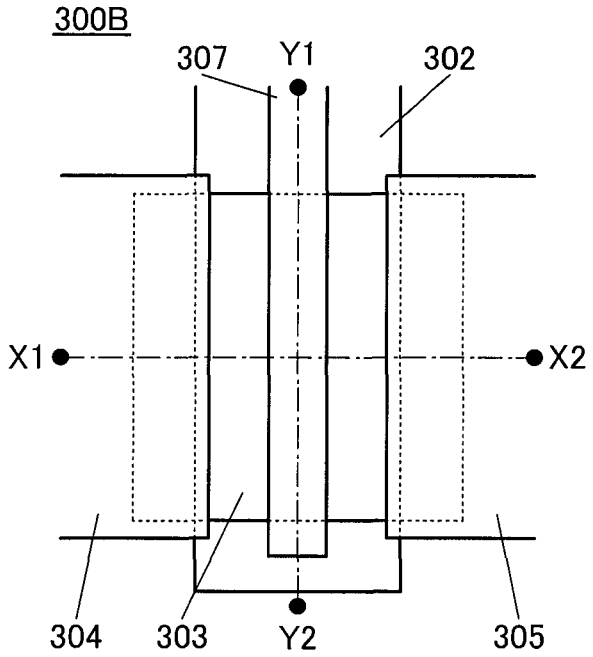
FIGS. 45A and 45B are top views each illustrating one embodiment of the present invention.
Figure 45B:
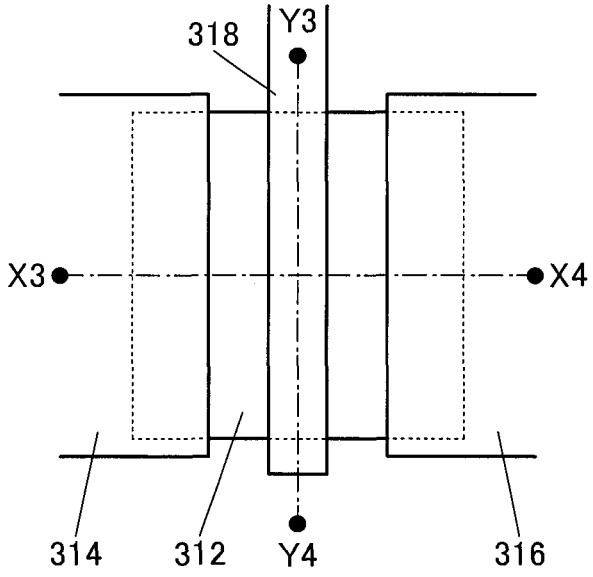

FIGS. 45A and 45B are top views of a transistor 300B provided in the driver circuit portion (e.g., the driver circuit 11, the driver circuit 12, the circuit portion 13, the read circuit 16, or the like) and a transistor 300A provided in the pixel portion 15. FIGS. 40A and 40B are cross sectional views of the transistor 300B and the transistor 300A. FIG. 45A is the top view of the transistor 300B and FIG. 45B is the top view of the transistor 300A. FIG. 40A shows a cross section along the dashed-dotted line X1-X2 in FIG. 45A and a cross section along the dashed-dotted line X3-X4 in FIG. 45B. FIG. 40B shows a cross section along the dashed-dotted line Y1-Y2 in FIG. 45A and a cross section along the dashed-dotted line Y3-Y4 in FIG. 45B. FIG. 40A is a cross-sectional view of the transistors 300A and 300B in a channel length direction, and FIG. 40B is a cross-sectional view of the transistors 300A and 300B in a channel width direction.

In a manner similar to that of the transistors 300A and 300B, some components are not illustrated in some cases in top views of transistors described below. Furthermore, the directions of the dashed-dotted line X1-X2 and the dashed-dotted line X3-X4 may be called a channel length direction, and the direction of the dashed-dotted line Y1-Y2 and the dashed-dotted line Y3-Y4 may be called a channel width direction.

The transistor 300A illustrated in FIGS. 40A and 40B includes an oxide semiconductor film 312 over an insulating film 311 over a substrate 301; a conductive film 314, a conductive film 316, and an insulating film 317 that are in contact with the oxide semiconductor film 312; and a conductive film 318 that overlaps with the oxide semiconductor film 312 with the insulating film 317 placed therebetween. Note that an insulating film 320 is provided over the transistor 300A.

The transistor 300B illustrated in FIGS. 40A and 40B includes an oxide semiconductor film 303 over the insulating film 311 over the substrate 301; a conductive film 304, a conductive film 305, and an insulating film 306 that are in contact with the oxide semiconductor film 303; and a conductive film 307 that overlaps with the oxide semiconductor film 303 with the insulating film 306 placed therebetween. The insulating film 320 is provided over the transistor 300B.

The transistor 300B includes a conductive film 302 that overlaps with the oxide semiconductor film 303 with the insulating film 311 placed therebetween. That is, the conductive film 302 serves as a gate electrode. Furthermore, the transistor 300B is a transistor having a dual-gate structure. The other components of the transistor 300B are the same as those of the transistor 300A and have similar functions as those in the transistor 300A.

The conductive film 302 and the conductive film 307 are supplied with different potentials, whereby the threshold voltage of the transistor 300B can be controlled. Alternatively, as illustrated in FIG. 40B, the conductive film 302 and the conductive film 307 are supplied with the same potential, whereby an increase in the on-state current, a reduction in variation in initial characteristics, a reduction in deterioration in a negative gate bias temperature (–GBT) stress test, and suppression in changes in the rising voltage of on-state current at different drain voltages are possible.

In the display device, the transistor in the driver circuit portion (e.g., the driver circuit 11, the driver circuit 12, the circuit portion 13, the read circuit 16, or the like) and the transistor in the pixel portion 15 have different structures. The transistor included in the driver circuit portion has a dual-gate structure. That is, the transistor included in the driver circuit portion has a higher on-state current than that included in the pixel portion 15.

Furthermore, the transistor in the driver circuit portion and the transistor in the pixel portion 15 may have different channel lengths.

Typically, the channel length of the transistor 300B included in the driver circuit portion can be less than 2.5 μm, or greater than or equal to 1.45 μm and less than or equal to 2.2 μm. The channel length of the transistor 300A included in the pixel portion 15 can be greater than or equal to 2.5 μm, or greater than or equal to 2.5 μm and less than or equal to 20 μm.

When the channel length of the transistor 300B included in the driver circuit portion is less than 2.5 μm, preferably greater than or equal to 1.45 μm and less than or equal to 2.2 μm, as compared with the transistor 300A included in the pixel portion 15, the amount of on-state current can be increased. As a result, a driver circuit portion that can operate at high speed can be formed.

In the oxide semiconductor film 312, an element that forms an oxygen vacancy is included in a region that does not overlap with the conductive film 314, the conductive film 316, and the conductive film 318. In the oxide semiconductor film 303, an element that forms an oxygen vacancy is included in a region that does not overlap with the conductive film 304, the conductive film 305, and the conductive film 307. The elements which form oxygen vacancies are described below as impurity elements. Typical examples of the impurity elements are hydrogen, rare gas elements, and the like. Typical examples of rare gas elements are helium, neon, argon, krypton, and xenon. Furthermore, boron, carbon, nitrogen, fluorine, aluminum, silicon, phosphorus, chlorine, or the like may be contained in the oxide semiconductor film 312 and the oxide semiconductor film 303 as an impurity element.

The insulating film 320 is a film containing hydrogen and is typically a nitride insulating film. The insulating film 320 is in contact with the oxide semiconductor film 312 and the oxide semiconductor film 303; thus, hydrogen contained in the insulating film 320 is diffused into the oxide semiconductor film 312 and the oxide semiconductor film 303. Consequently, much hydrogen is contained in the regions of the oxide semiconductor film 312 and the oxide semiconductor film 303 in contact with the insulating film 320.

When a rare gas element is added as an impurity element to the oxide semiconductor film, a bond between a metal element and oxygen in the oxide semiconductor film is cut, whereby an oxygen vacancy is formed. By interaction between hydrogen and the oxygen vacancy included in the oxide semiconductor film, the conductivity of the oxide semiconductor film is increased. Specifically, hydrogen enters the oxygen vacancies in the oxide semiconductor film, whereby an electron serving as a carrier is produced. As a result, the conductivity is increased.

Figure 41A:
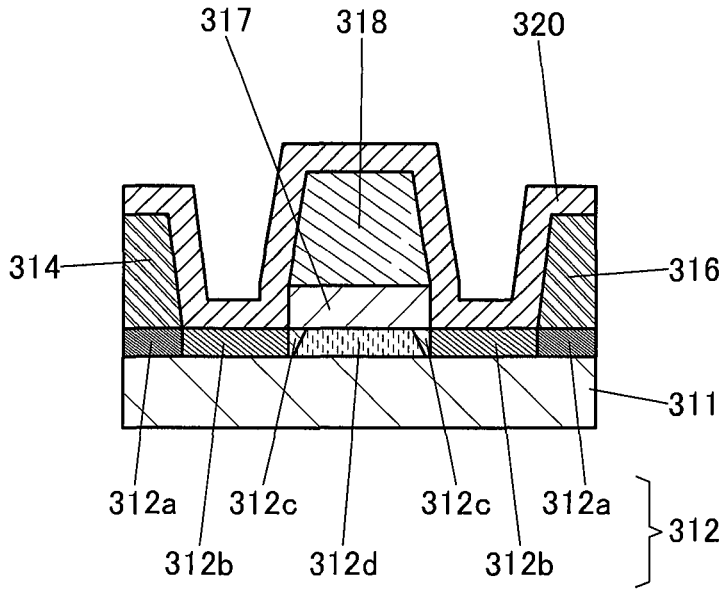
FIGS. 41A and 41B are cross-sectional views illustrating one embodiment of the present invention.
Figure 41B:
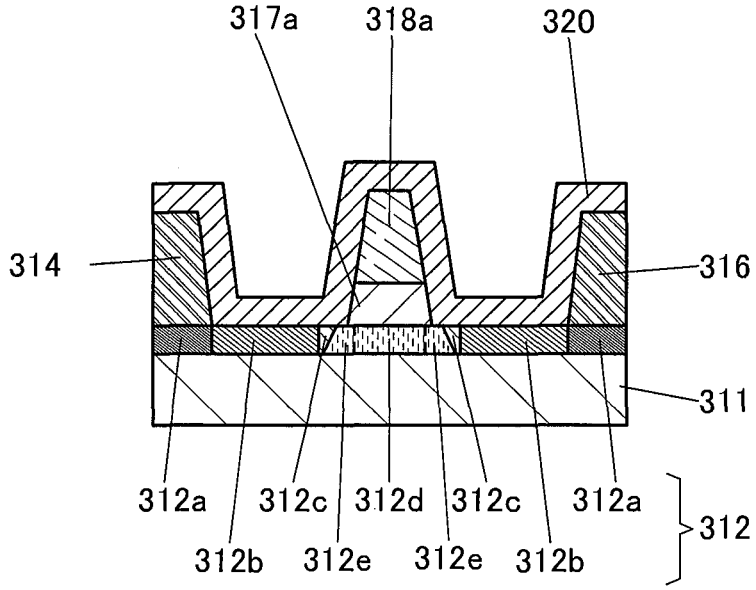

Here, FIGS. 41A and 41B are partial enlarged views of the oxide semiconductor film 312. Note that as typical examples, the description is made with reference to the partial enlarged views of the oxide semiconductor film 312 included in the transistor 300A. As shown in FIGS. 41A and 41B, the oxide semiconductor film 312 includes a region 312*a* in contact with the conductive film 314 or the conductive film 316, a region 312*b* in contact with the insulating film 320, and a region 312*d* in contact with the insulating film 317. Note that in the case where the conductive film 318 has a tapered side surface, the oxide semiconductor film 312 may include regions 312*c* overlapping with a tapered portion of the conductive film 318.

The regions 312*a* serve as a source region and a drain region. In the case where the conductive films 314 and 316 are formed using a conductive material which is easily bonded to oxygen, such as tungsten, titanium, aluminum, copper, molybdenum, chromium, tantalum, an alloy of any of these, or the like, oxygen contained in the oxide semiconductor films is bonded to the conductive material contained in the conductive films 314 and 316, and an oxygen vacancy is formed in the oxide semiconductor film. Furthermore, in some cases, part of constituent elements of the conductive material that forms the conductive films 314 and 316 is mixed into the oxide semiconductor film. As a result, the regions 312*a* in contact with the conductive film 314 and the conductive film 316 have higher conductivity and serve as a source region and a drain region.

The regions 312*b* function as low-resistance regions. The regions 312*b* contain at least a rare gas and hydrogen as the impurity elements. Note that in the case where the side surface of the conductive film 318 has a tapered shape, the impurity element is added to the regions 312*c* through the tapered portion of the conductive film 318. Therefore, although the regions 312*c* have a lower concentration of rare gas elements as an example of the impurity element than the regions 312*b*, the impurity element is contained. With the regions 312*c*, source-drain breakdown voltage of the transistor can be increased.

In the case where the oxide semiconductor film 312 is formed by a sputtering method, the regions 312*a* to 312*d* each contain a rare gas element. In addition, the rare gas element concentration of each of the regions 312*b* and 312*c* is higher than that of each of the regions 312*a* and 312*d*. This is because a rare gas is used as a sputtering gas to form the oxide semiconductor film 312 by sputtering and is therefore included in the oxide semiconductor film 312, and because a rare gas is intentionally added to the regions 312*b* and 312*c* to form an oxygen vacancy. Note that a rare gas element different from that added to the regions 312*a* and 312*d* may be added to the regions 312*b* and 312*c*.

Since the region 312*b* is in contact with the insulating film 320, the hydrogen concentration of the region 312*b* is higher than those of the region 312*a* and the region 312*d*. In the case where hydrogen is diffused from the region 312*b* to the region 312*c*, the concentration of hydrogen in the region 312*c* is higher than the concentration of hydrogen in the region 312*a* and the concentration of hydrogen in the region 312*d*. Note that the hydrogen concentration of the region 312*b* is higher than that of the region 312*c*.

In the regions 312*b* and 312*c*, the concentrations of hydrogen measured by secondary ion mass spectrometry (SIMS) can be greater than or equal to $8\times10^{19}$ atoms/cm$^3$, greater than or equal to $1\times10^{20}$ atoms/cm$^3$, or greater than or equal to $5\times10^{20}$ atoms/cm$^3$. Note that in the regions 312*a* and 312*d*, the concentration of hydrogen which is measured by SIMS can be lower than or equal to $5\times10^{19}$ atoms/cm$^3$, lower than or equal to $1\times10^{19}$ atoms/cm$^3$, lower than or equal to $5\times10^{18}$ atoms/cm$^3$, lower than or equal to $1\times10^{18}$ atoms/cm$^3$, lower than or equal to $5\times10^{17}$ atoms/cm$^3$, or lower than or equal to $1\times10^{16}$ atoms/cm$^3$.

In the case where boron, carbon, nitrogen, fluorine, aluminum, silicon, phosphorus, or chlorine is added to the oxide semiconductor film 312 as an impurity element, only the regions 312*b* and 312*c* contain the impurity element. Therefore, the concentrations of the impurity element in the regions 312*b* and 312*c* are higher than those in the regions 312*a* and 312*d*. Note that, in the region 312*b* and the region 312*c*, the impurity element concentration which is measured by SIMS can be higher than or equal to $1\times10^{18}$ atoms/cm$^3$ and lower than or equal to $1\times10^{22}$ atoms/cm$^3$, higher than or equal to $1\times10^{19}$ atoms/cm$^3$ and lower than or equal to $1\times10^{21}$ atoms/cm$^3$, or higher than or equal to $5\times10^{19}$ atoms/cm$^3$ and lower than or equal to $5\times10^{20}$ atoms/cm$^3$.

The regions 312*b* and 312*c* have higher hydrogen concentrations than the region 312*d* and have more oxygen vacancies due to addition of impurity elements than the region 312*d*. Therefore, the regions 312*b* and 312*c* have higher conductivity and serve as low-resistance regions. The resistivity of the regions 312*b* and 312*c* can be typically greater than or equal to $1\times10^{-3}$ Ωcm and less than $1\times10^{4}$ Ωcm, or greater than or equal to $1\times10^{-3}$ Ωcm and less than $1\times10^{-1}$ Ωcm.

Note that in the region 312*b* and the region 312*c*, when the amount of hydrogen is the same as or smaller than the amount of oxygen vacancies, hydrogen is easily captured by oxygen vacancies and is not easily diffused into the region 312*d* that serves as a channel. As a result, a normally-off transistor can be manufactured.

The region 312*d* serves as a channel.

In addition, after the impurity element is added to the oxide semiconductor film 312 using the conductive films 314, 316, and 318 as masks, the area of the conductive film 318 when seen from the above may be reduced. This can be performed in such a manner that a slimming process is performed on a mask over the conductive film 318 in a step of forming the conductive film 318 so as to obtain a mask with a minuter structure. Then, the conductive film 318 and the insulating film 317 are etched using the mask, so that a conductive film 318*a* and an insulating film 317*a* illustrated in FIG. 41B can be formed. As the slimming process, an ashing process using an oxygen radical or the like can be employed, for example.

As a result, an offset region 312*e* is formed between the region 312*c* and the region 312*d* serving as a channel in the oxide semiconductor film 312. Note that the length of the offset region 312*e* in the channel length direction is set to be less than 0.1 μm, whereby a decrease in the on-state current of the transistor can be suppressed.

The insulating film 317 and the insulating film 306 each function as a gate insulating film.

The conductive film 314 and the conductive film 316 serve as a source electrode and a drain electrode, and the conductive film 304 and the conductive film 305 serve as a source electrode and a drain electrode.

The conductive film 318 and the conductive film 307 each function as a gate electrode.

The transistor 300A and the transistor 300B described in this embodiment each include the region 312*b* and/or the region 312*c* that serves as a low-resistance region between the region 312*d* functioning as a channel and each of the regions 312*a* functioning as a source region and a drain region. Accordingly, resistance between the channel and each of the source region and the drain region can be reduced, and the transistor 300A and the transistor 300B each have a high on-state current and a high field-effect mobility.

In addition, in the transistor 300A and the transistor 300B, parasitic capacitance between the conductive film 318 and each of the conductive films 314 and 316 can be reduced by forming the conductive film 318 so as not overlap with the conductive films 314 and 316. Moreover, parasitic capacitance between the conductive film 307 and each of the conductive films 304 and 305 can be reduced by forming the conductive film 307 so as not to overlap with the conductive films 304 and 305. As a result, in the case where a large-sized substrate is used as the substrate 301, signal delays in the conductive films 314 and 316 and the conductive film 318, and signal delays in the conductive films 304 and 305 and the conductive film 307 can be reduced.

In the transistor 300A, a region including an oxygen vacancy is formed by adding a rare gas element to the oxide semiconductor film 312 using the conductive films 314, 316, and 318 as masks. In the transistor 300B, the impurity element is added to the oxide semiconductor film 303 using the conductive films 304, 305, and 307 as masks, so that regions having oxygen vacancies are formed. Furthermore, because the region including oxygen vacancies is in contact with the insulating film 320 containing hydrogen, hydrogen contained in the insulating film 320 is diffused into the region including oxygen vacancies, so that a low-resistance region is formed. That is, the low-resistance regions can be formed in a self-aligned manner.

In the transistor 300A and the transistor 300B described in this embodiment, the rare gas is added to the regions 312*b* to form oxygen vacancies, and furthermore, hydrogen is added thereto. Therefore, the conductivity of the region 312*b* can be increased and variation in conductivity of the region 312*b* in each transistor can be reduced. That is, by adding the rare gas and hydrogen to the region 312*b*, the conductivity of the region 312*b* can be controlled.

The structures shown in FIGS. 40A and 40B will be described below in detail.

The type of the substrate 301 is not limited to a certain type, and any of a variety of substrates can be used as the substrate 301. Examples of the substrate include a semiconductor substrate (e.g., a single crystal substrate or a silicon substrate), an SOI substrate, a glass substrate, a quartz substrate, a plastic substrate, a metal substrate, a stainless steel substrate, a substrate including stainless steel foil, a tungsten substrate, a substrate including tungsten foil, a flexible substrate, an attachment film, paper including a fibrous material, and a base material film. Examples of a glass substrate include a barium borosilicate glass substrate, an aluminoborosilicate glass substrate, and a soda lime glass substrate. Examples of a flexible substrate, an attachment film, a base material film, or the like are as follows: plastic typified by polyethylene terephthalate (PET), polyethylene naphthalate (PEN), and polyether sulfone (PES); a synthetic resin such as acrylic; polypropylene; polyester; polyvinyl fluoride; polyvinyl chloride; polyamide; polyimide; aramid; epoxy; an inorganic vapor deposition film; and paper. Specifically, when the transistors are formed using a semiconductor substrate, a single crystal substrate, an SOI substrate, or the like, it is possible to form a transistor with few variations in characteristics, size, shape, or the like, with high current supply capability, and with a small size. By forming a circuit with the use of such a transistor, power consumption of the circuit can be reduced or the circuit can be highly integrated.

Still alternatively, a flexible substrate may be used as the substrate 301, and the transistors may be directly provided on the flexible substrate. Alternatively, a separation layer may be provided between the substrate 301 and each of the transistors. The separation layer can be used when part or the whole of a semiconductor device formed over the separation layer is separated from the substrate 301 and transferred to another substrate. In such a case, the transistors can be transferred to a substrate having low heat resistance or a flexible substrate as well. For the above separation layer, a stack including inorganic films, which are a tungsten film and a silicon oxide film, or an organic resin film of polyimide or the like formed over a substrate can be used, for example.

Examples of a substrate to which the transistors are transferred include, in addition to the above-described substrates over which transistors can be formed, a paper substrate, a cellophane substrate, an aramid film substrate, a polyimide film substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), or the like), a leather substrate, a rubber substrate, and the like. When such a substrate is used, a transistor with excellent properties or a transistor with low power consumption can be formed, a device with high durability, high heat resistance can be provided, or reduction in weight or thickness can be achieved.

The insulating film 311 can be formed with a single layer or a stack using one or more of an oxide insulating film and a nitride insulating film. Note that an oxide insulating film is preferably used as at least a region of the insulating film 311 that is in contact with the oxide semiconductor films 303 and 312, in order to improve characteristics of the interface with the oxide semiconductor films 303 and 312. An oxide insulating film that releases oxygen by being heated is preferably used as the insulating film 311, in which case oxygen contained in the insulating film 311 can be moved to the oxide semiconductor films 303 and 312 by heat treatment.

The thickness of the insulating film 311 can be greater than or equal to 50 nm, greater than or equal to 100 nm and less than or equal to 3000 nm, or greater than or equal to 200 nm and less than or equal to 1000 nm. With the use of the thick insulating film 311, the amount of oxygen released from the insulating film 311 can be increased, and the interface states between the insulating film 311 and each of the oxide semiconductor films 303 and 312 and oxygen vacancies included in the oxide semiconductor film 303 and the region 312*d* of the oxide semiconductor film 312 can be reduced.

The insulating film 311 can be formed with a single layer or a stack using, for example, one or more of silicon oxide, silicon oxynitride, silicon nitride oxide, silicon nitride, aluminum oxide, hafnium oxide, gallium oxide, a Ga—Zn oxide, and the like.

The oxide semiconductor films 312 and 303 are typically formed using a metal oxide such as an In—Ga oxide, an In—Zn oxide, or an In-M-Zn oxide (M is Mg, Al, Ti, Ga, Y, Zr, La, Ce, Nd, or Hf). Note that the oxide semiconductor films 312 and 303 have light-transmitting properties.

Note that in the case of using an In-M-Zn oxide as the oxide semiconductor films 312 and 303, when the summation of In and M is assumed to be 100 atomic %, the proportions of In and M are preferably set to be greater than or equal to 25 atomic % and less than 75 atomic %, respectively, or greater than or equal to 34 atomic % and less than 66 atomic %, respectively.

The energy gaps of the oxide semiconductor films 312 and 303 are each 2 eV or more, 2.5 eV or more, or 3 eV or more.

The thickness of each of the oxide semiconductor films 312 and 303 can be greater than or equal to 3 nm and less than or equal to 200 nm, greater than or equal to 3 nm and less than or equal to 100 nm, or greater than or equal to 3 nm and less than or equal to 50 nm.

In the case where the oxide semiconductor films 312 and 303 contain an In-M-Zn oxide (M is Mg, Al, Ti, Ga, Y, Zr, La, Ce, Nd, or Hf), it is preferable that the atomic ratio of metal elements of a sputtering target used for forming a film of the In-M-Zn oxide satisfy In≥M and Zn≥M. As the atomic ratio of metal elements of such a sputtering target, In:M:Zn=1:1:1, In:M:Zn=1:1:1.2, In:M:Zn=2:1:1.5, In:M:Zn=2:1:2.3, In:M:Zn=2:1:3, In:M:Zn=3:1:2, or the like is preferable. Note that the atomic ratios of metal elements in the formed oxide semiconductor films 312 and 303 vary from the above atomic ratio of metal elements of the sputtering target within a range of ±40% as an error.

When silicon or carbon that is one of elements belonging to Group 14 is contained in the oxide semiconductor film 312 and the oxide semiconductor film 303, oxygen vacancies are increased in the oxide semiconductor film 312 and the oxide semiconductor film 303, and the oxide semiconductor film 312 and the oxide semiconductor film 303 become n-type films. Thus, the concentration of silicon or carbon (the concentration measured by SIMS) in the oxide semiconductor film 312 and the oxide semiconductor film 303, in particular, the region 312*d*, can be lower than or equal to $2\times10^{18}$ atoms/cm$^3$, or lower than or equal to $2\times10^{17}$ atoms/cm$^3$. As a result, the transistor has positive threshold voltage (normally-off characteristics).

Furthermore, the concentration of alkali metal or alkaline earth metal which is measured by SIMS in the oxide semiconductor film 312 and the oxide semiconductor film 303, in particular, the region 312*d*, can be lower than or equal to $1\times10^{18}$ atoms/cm$^3$, or lower than or equal to $2\times10^{16}$ atoms/cm$^3$. Alkali metal and alkaline earth metal might generate carriers when bonded to an oxide semiconductor, in which case the off-state current of the transistor might be increased. Therefore, it is preferable to reduce the concentration of an alkali metal or an alkaline earth metal in the region 312*d*. As a result, the transistor has positive threshold voltage (normally-off characteristics).

Furthermore, when nitrogen is contained in the oxide semiconductor film 312 and the oxide semiconductor film 303, in particular, the region 312*d*, electrons serving as carriers are generated, the carrier density is increased, and the oxide semiconductor films 312 and 303 become n-type films in some cases. Thus, a transistor including an oxide semiconductor film which contains nitrogen is likely to have normally-on characteristics. Therefore, nitrogen is preferably reduced as much as possible in the oxide semiconductor film, particularly the region 312*d*. The nitrogen concentration, which is measured by SIMS, can be set to, for example, lower than or equal to $5\times10^{18}$ atoms/cm$^3$.

By reducing the impurity elements in the oxide semiconductor film 312 and the oxide semiconductor film 303, in particular, the region 312*d*, the carrier density of the oxide semiconductor films can be lowered. In the oxide semiconductor film 312 and the oxide semiconductor film 303, in particular, the region 312*d*, carrier density can be $1\times10^{17}$/cm$^3$ or less, $1\times10^{15}$/cm$^3$ or less, $1\times10^{13}$/cm$^3$ or less, or $8\times10^{11}$/cm$^3$ or less. More preferably, the carrier density can be, for example, less than $8\times10^{11}$/cm$^3$, further preferably less than $1\times10^{11}$/cm$^3$, or still further preferably less than $1\times10^{10}$/cm$^3$ and be $1\times10^{-9}$/cm$^3$ or more.

An oxide semiconductor film with a low impurity concentration and a low density of defect states can be used for the oxide semiconductor films 312 and 303, in which case the transistors can have more excellent electrical characteristics. Here, the state in which the impurity concentration is low and the density of defect states is low (the amount of oxygen vacancies is small) is referred to as "highly purified intrinsic" or "substantially highly purified intrinsic". A highly purified intrinsic or substantially highly purified intrinsic oxide semiconductor has few carrier generation sources, and thus has a low carrier density in some cases. Thus, a transistor including the oxide semiconductor film in which a channel region is formed is likely to have positive threshold voltage (normally-off characteristics). A highly purified intrinsic or substantially highly purified intrinsic oxide semiconductor film has a low density of defect states and accordingly has low density of trap states in some cases. Furthermore, a highly purified intrinsic or substantially highly purified intrinsic oxide semiconductor film has an extremely small off-state current; the off-state current can be smaller than or equal to the measurement limit of a semiconductor parameter analyzer, i.e., smaller than or equal to $1\times10^{-13}$ A, at a voltage (drain voltage) between a source electrode and a drain electrode of from 1 V to 10 V. Thus, the transistor whose channel region is formed in the oxide semiconductor film has a small variation in electrical characteristics and high reliability in some cases.

Heat treatment may be performed to further reduce impurities such as moisture and hydrogen contained in the oxide semiconductor films 312 and 303, thereby increasing the purity of the oxide semiconductor films 312 and 303.

For example, the oxide semiconductor films 312 and 303 are subjected to heat treatment in a reduced-pressure atmosphere, an inert gas atmosphere of nitrogen, a rare gas, or the like, an oxidation atmosphere, or an ultra-dry air atmosphere (the moisture amount is 20 ppm (−55° C. by conversion into a dew point) or less, preferably 1 ppm or less, more preferably 10 ppb or less, in the case where the measurement is performed by a dew point meter in a cavity ring down laser spectroscopy (CRDS) system). Note that the oxidation atmosphere refers to an atmosphere including an oxidation gas such as oxygen, ozone, or nitrogen oxide at 10 ppm or higher. The inert gas atmosphere refers to an atmosphere including the oxidation gas at lower than 10 ppm and is filled with nitrogen or a rare gas.

Note that the heat treatment may be performed in such a manner that heat treatment is performed in an inert gas atmosphere, and then another heat treatment is performed in an atmosphere containing an oxidizing gas at 10 ppm or more, 1% or more, or 10% or more. The heat treatment may be performed at any time after the oxide semiconductor films 312 and 303 are formed. For example, the heat treatment may be performed after the oxide semiconductor films 312 and 303 are selectively etched.

The heat treatment may be performed at a temperature higher than or equal to 250° C. and lower than or equal to 650° C., preferably higher than or equal to 300° C. and lower than or equal to 500° C. The treatment time is shorter than or equal to 24 hours.

An electric furnace, a rapid thermal annealing (RTA) apparatus, or the like can be used for the heat treatment. With the use of an RTA apparatus, the heat treatment can be performed at a temperature of higher than or equal to the strain point of the substrate if the heating time is short. Therefore, the heat treatment time can be shortened.

In addition, each of the oxide semiconductor films 312 and 303 may have a non-single-crystal structure, for example. The non-single crystal structure includes a c-axis aligned crystalline oxide semiconductor (CAAC-OS), a polycrystalline structure, a microcrystalline structure described later, or an amorphous structure described later, for example. Among the non-single crystal structure, the amorphous structure has the highest density of defect states, whereas CAAC-OS has the lowest density of defect states.

Note that each of the oxide semiconductor films 312 and 303 may be a mixed film including two or more of the following: a region having an amorphous structure, a region having a microcrystalline structure, a region having a polycrystalline structure, a region of CAAC-OS, and a region having a single-crystal structure. The mixed film has a single-layer structure including, for example, two or more of a region having an amorphous structure, a region having a microcrystalline structure, a region having a polycrystalline structure, a CAAC-OS region, and a region having a single-crystal structure in some cases. Furthermore, the mixed film has a stacked-layer structure including, for example, two or more of a region having an amorphous structure, a region having a microcrystalline structure, a region having a polycrystalline structure, a CAAC-OS region, and a region having a single-crystal structure in some cases.

Note that in some cases, the regions 312*b* and 312*d* are different in crystallinity in each of the oxide semiconductor films 312 and 303. In addition, in some cases, the regions 312*c* and 312*d* are different in crystallinity in each of the oxide semiconductor films 312 and 303. This is because when an impurity element is added to the region 312*b* or 312*c*, the region 312*b* or 312*c* is damaged and thus has lower crystallinity.

The insulating films 306 and 317 can be formed with a single layer or a stack using one or more of an oxide insulating film and a nitride insulating film. Note that an oxide insulating film is preferably used as at least regions of the insulating films 306 and 317 that are in contact with the oxide semiconductor films 303 and 312, respectively, in order to improve characteristics of the interface with the oxide semiconductor films 303 and 312. The insulating films 306 and 317 can be formed with a single layer or a stack using, for example, one or more of silicon oxide, silicon oxynitride, silicon nitride oxide, silicon nitride, aluminum oxide, hafnium oxide, gallium oxide, a Ga—Zn oxide, and the like.

Furthermore, it is possible to prevent outward diffusion of oxygen from the oxide semiconductor films 312 and 303 and entry of hydrogen, water, or the like into the oxide semiconductor films 312 and 303 from the outside by providing an insulating film having a blocking effect against oxygen, hydrogen, water, and the like as the insulating films 306 and 317. As the insulating film which has an effect of blocking oxygen, hydrogen, water, and the like, an aluminum oxide film, an aluminum oxynitride film, a gallium oxide film, a gallium oxynitride film, an yttrium oxide film, an yttrium oxynitride film, a hafnium oxide film, a hafnium oxynitride film, or the like can be used.

The insulating films 306 and 317 may be formed using a high-k material such as hafnium silicate ($HfSiO_x$), hafnium silicate to which nitrogen is added ($HfSi_xO_yN_z$), hafnium aluminate to which nitrogen is added ($HfAl_xO_yN_z$), hafnium oxide, or yttrium oxide, so that gate leakage current of the transistors can be reduced.

When the insulating films 306 and 317 are formed using an oxide insulating film from which oxygen is released by heating, oxygen contained in the insulating films 306 and 317 can be moved to the oxide semiconductor films 303 and 312 by heat treatment.

In addition, a silicon oxynitride film with few defects can be used as the insulating films 306 and 317. In an ESR spectrum at 100 K or lower of the silicon oxynitride film with few defects, after heat treatment, a first signal that appears at a g-factor of greater than or equal to 2.037 and less than or equal to 2.039, a second signal that appears at a g-factor of greater than or equal to 2.001 and less than or equal to 2.003, and a third signal that appears at a g-factor of greater than or equal to 1.964 and less than or equal to 1.966 are observed. The split width of the first and second signals and the split width of the second and third signals that are obtained by ESR measurement using an X-band are each approximately 5 mT. The sum of the spin densities of the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 is lower than $1\times10^{18}$ spins/$cm^3$, typically higher than or equal to $1\times10^{17}$ spins/$cm^3$ and lower than $1\times10^{18}$ spins/$cm^3$ In the ESR spectrum at 100 K or lower, the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 correspond to signals attributed to nitrogen oxide ($NO_x$; x is greater than or equal to 0 and less than or equal to 2, or greater than or equal to 1 and smaller than or equal to 2). Accordingly, the lower the sum of the spin densities of the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 is, the smaller the amount of nitrogen oxide contained in the silicon oxynitride film is.

In the silicon oxynitride film with few defects, the concentration of nitrogen which is measured by SIMS is lower than or equal to $6\times10^{20}$ atoms/$cm^3$. When the insulating film 317 is formed using the silicon oxynitride film with few defects, nitrogen oxide is unlikely to be generated, so that the carrier traps at the interface between the oxide semiconductor films 312 and 303 and the insulating films can be reduced. Furthermore, a shift of the threshold voltage of the transistor included in the display device can be reduced, which leads to a smaller change in the electrical characteristics of the transistor.

The total thickness of the insulating films 306 and 317 can be greater than or equal to 5 nm and less than or equal to 400 nm, greater than or equal to 5 nm and less than or equal to 300 nm, or greater than or equal to 10 nm and less than or equal to 250 nm.

Each of the conductive film 314, the conductive film 316, the conductive film 318, the conductive film 304, the conductive film 305, the conductive film 302, and the conductive film 307 can be formed using, for example, a metal element selected from aluminum, chromium, copper, tantalum, titanium, molybdenum, nickel, iron, cobalt, and tungsten; an alloy containing any of these metal elements as a component; an alloy containing these metal elements in combination; or the like. Furthermore, one or more metal elements selected from manganese and zirconium may be used. Furthermore, the conductive film 314, the conductive film 316, the conductive film 318, the conductive film 304, the conductive film 305, the conductive film 302, and the conductive film 307 may have a single-layer structure or a stacked-layer structure including two or more layers. For example, any of the following can be used: a single-layer structure of an aluminum film containing silicon; a single-layer structure of a copper film containing manganese; a two-layer structure in which a titanium film is stacked over an aluminum film; a two-layer structure in which a titanium film is stacked over a titanium nitride film; a two-layer structure in which a tungsten film is stacked over a titanium nitride film; a two-layer structure in which a tungsten film is stacked over a tantalum nitride film or a tungsten nitride film; a two-layer structure in which a copper film is stacked over a copper film containing manganese; a three-layer structure in which a titanium film, an aluminum film, and a titanium film are stacked in this order; a three-layer structure in which a copper film containing manganese, a copper film, and a copper film containing manganese are stacked in this order; and the like. Alternatively, an alloy film or a nitride film which contains aluminum and one or more elements selected from titanium, tantalum, tungsten, molybdenum, chromium, neodymium, and scandium may be used.

Alternatively, the conductive film 314, the conductive film 316, the conductive film 318, the conductive film 304, the conductive film 305, the conductive film 302, and the conductive film 307 can be formed using a light-transmitting conductive material such as indium tin oxide, indium oxide containing tungsten oxide, indium zinc oxide containing tungsten oxide, indium oxide containing titanium oxide, indium tin oxide containing titanium oxide, indium zinc oxide, or indium tin oxide including silicon oxide. Alternatively, a stacked-layer structure of the above light-transmitting conductive material and a conductive material containing the above metal element may be employed.

The thicknesses of the conductive films 314 and 316, the conductive film 318, the conductive films 304 and 305, the conductive film 302, and the conductive film 307 each can be greater than or equal to 30 nm and less than or equal to 500 nm, or greater than or equal to 100 nm and less than or equal to 400 nm.

The insulating film 320 is a film containing hydrogen and is typically a nitride insulating film. The nitride insulating film can be formed using silicon nitride, aluminum nitride, or the like.

Structure Example 2 of Transistor

Next, another structure of the transistor included in the display device is described with reference to FIGS. 42A to 42C. Description is made here using a transistor 300C as a modified example of the transistor 300A provided in the pixel portion 15; however, the structure of the insulating film 311 or the structure of the conductive film 314, 316, or 318 of the transistor 300C can be applied as appropriate to the transistor 300B in the driver circuit portion.

Figure 42A:
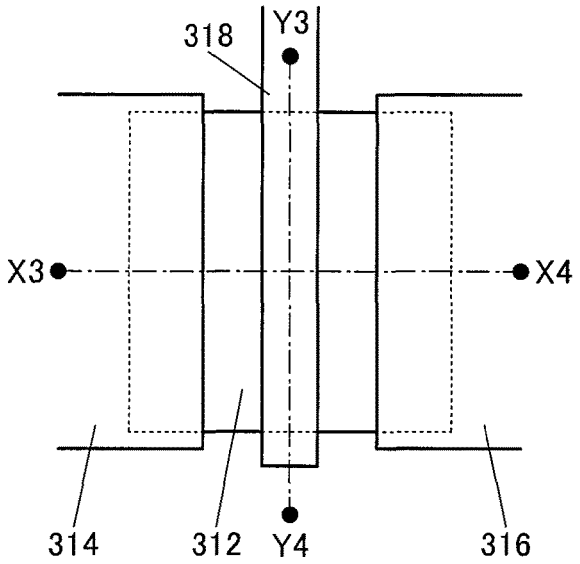
FIGS. 42A to 42C are a top view and cross-sectional views illustrating one embodiment of the present invention.
Figure 42B:
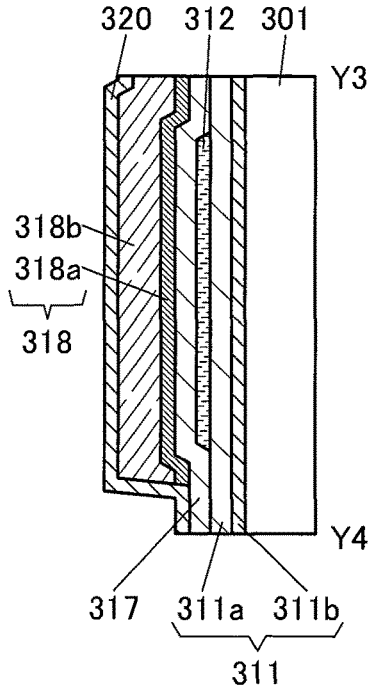
Figure 42C:
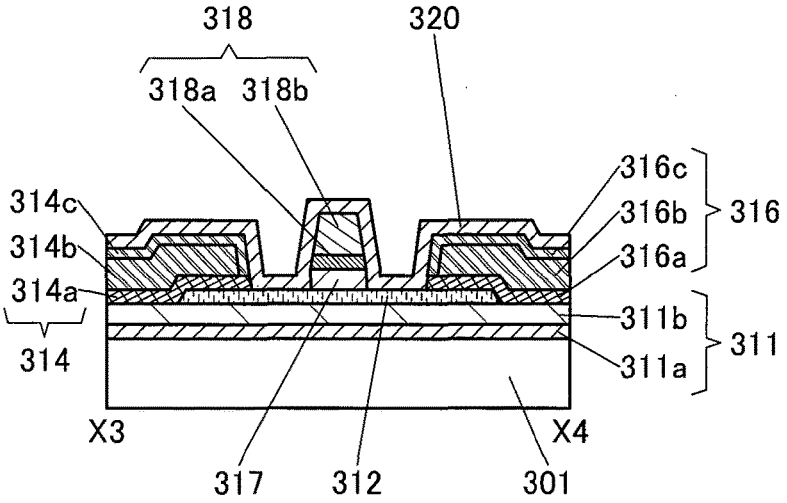

FIGS. 42A to 42C are a top view and cross-sectional views of the transistor 300C included in the display device. FIG. 42A is a top view of the transistor 300C, FIG. 42B is a cross-sectional view taken along dashed-dotted line Y3-Y4 in FIG. 42A, and FIG. 42C is a cross-sectional view taken along dashed-dotted line X3-X4 in FIG. 42A.

The transistor 300C illustrated in FIGS. 42A to 42C has a two- or three-layer structure of the conductive, films 314 and 316 and the conductive film 318. In addition, the insulating film 311 has a stacked-layer structure of a nitride insulating film 311*a* and an oxide insulating film 311*b*. The other structures are the same as those of the transistor 300A and the effect similar to that in the case of the transistor 300A can be obtained.

First, the conductive films 314 and 316 and the conductive film 318 are described.

In the conductive film 314, conductive films 314*a*, 314*b*, and 314*c* are stacked in this order and the conductive films 314*a* and 314*c* cover the surfaces of the conductive film 314*b*. That is, the conductive films 314*a* and 314*c* function as protective films of the conductive film 314*b*.

In a manner similar to that of the conductive film 314, in the conductive film 316, conductive films 316*a*, 316*b*, and 316*c* are stacked in this order and the conductive films 316*a* and 316*c* cover the surfaces of the conductive film 316*b*. That is, the conductive films 316*a* and 316*c* function as protective films of the conductive film 316*b*.

In the conductive film 318, conductive films 318*a* and 318*b* are stacked in this order.

The conductive films 314*a* and 316*a* and the conductive film 318*a* are formed using materials that prevent metal elements contained in the conductive films 314*b* and 316*b* and the conductive film 318*b*, respectively, from diffusing to the oxide semiconductor film 312. The conductive films 314*a* and 316*a* and the conductive film 318*a* can be formed using titanium, tantalum, molybdenum, tungsten, an alloy of any of these materials, titanium nitride, tantalum nitride, molybdenum nitride, or the like. Alternatively, the conductive films 314*a* and 316*a* and the conductive film 318*a* can be formed using Cu—X alloy (X is Mn, Ni, Cr, Fe, Co, Mo, Ta, or Ti) or the like.

The conductive films 314*b* and 316*b* and the conductive film 318*b* are each formed using a low-resistance material. The conductive films 314*b* and 316*b* and the conductive film 318*b* can be formed using copper, aluminum, gold, silver, an alloy of any of these materials, a compound containing any of these materials as a main component, or the like.

When the conductive films 314*c* and 316*c* are formed using films in which the metal elements contained in the conductive films 314*b* and 316*b* are passivated, the metal elements contained in the conductive films 314*b* and 316*b* can be prevented from moving to the oxide semiconductor film 312 in a step of forming the insulating film 328. The conductive films 314*c* and 316*c* can be formed using a metal silicide or a metal silicide nitride, typically, $CuSi_x$ (x>0), $CuSi_xN_y$ (x>0, y>0), or the like.

Here, a method for forming the conductive films 314*c* and 316*c* is described. Note that the conductive films 314*b* and 316*b* are formed using copper. In addition, the conductive films 314*c* and 316*c* are formed using $CuSi_xN_y$ (x>0, y>0).

The conductive films 314*b* and 316*b* are exposed to plasma generated in a reducing atmosphere such as a hydrogen atmosphere, an ammonia atmosphere, or a carbon monoxide atmosphere and the oxide formed on the surfaces of the conductive films 314*b* and 316*b* are reduced.

Next, the conductive films 314*b* and 316*b* are exposed to silane while being heated at a temperature higher than or equal to 200° C. and lower than or equal to 400° C. As a result, copper contained in the conductive films 314*b* and 316*b* acts as a catalyst, and silane is decomposed into Si and $H_2$, and $CuSi_x$ (x>0) is formed on the surfaces of the conductive films 314*b* and 316*b*.

Next, the conductive films 314*b* and 316*b* are exposed to plasma generated in an atmosphere containing nitrogen, such as an ammonia atmosphere or a nitrogen atmosphere, whereby $CuSi_x$ (x>0) formed on the surfaces of the conductive films 314*b* and 316*b* reacts with nitrogen contained in the plasma and accordingly $CuSi_xN_y$ (x>0, y>0) is formed as the conductive films 314*c* and 316*c*.

Note that in the above step, $CuSi_xN_y$ (x>0, y>0) may be formed as the conductive films 314*c* and 316*c* in such a manner that the conductive films 314*b* and 316*b* are exposed to plasma generated in an atmosphere containing nitrogen, such as an ammonia atmosphere or a nitrogen atmosphere, and then exposed to silane while being heated at a temperature higher than or equal to 200° C. and lower than or equal to 400° C.

Next, the insulating film 311 in which the nitride insulating film 311*a* and the oxide insulating film 311*b* are stacked is described.

The nitride insulating film 311*a* can be formed using silicon nitride, silicon nitride oxide, aluminum nitride, or aluminum nitride oxide, for example. The oxide insulating film 311*b* can be formed using silicon oxide, silicon oxynitride, aluminum oxide, or the like, for example. The structure in which the nitride insulating film 311*a* is provided on the substrate 301 side can prevent hydrogen, water, or the like from diffusing into the oxide semiconductor film 312 from the outside.

Structure Example 3 of Transistor

Next, another structure of the transistor included in the display device is described with reference to FIGS. 43A to 43C and FIGS. 44A to 44C. Description is made here using a transistor 300D and a transistor 300E as modified examples of the transistor 300A provided in the pixel portion 15; however, the structure of an oxide semiconductor film 312 included in the transistor 300D or the structure of an oxide semiconductor film 312 included in the transistor 300E can be applied as appropriate to the transistor 300B in the driver circuit portion.

Figure 43A:
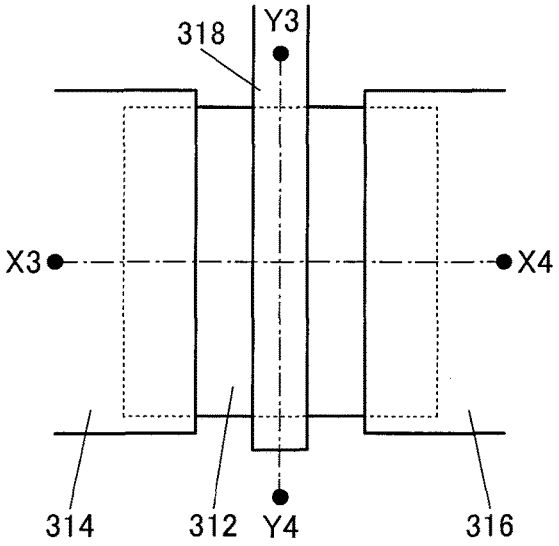
FIGS. 43A to 43C are a top view and cross-sectional views illustrating one embodiment of the present invention.
Figure 43B:
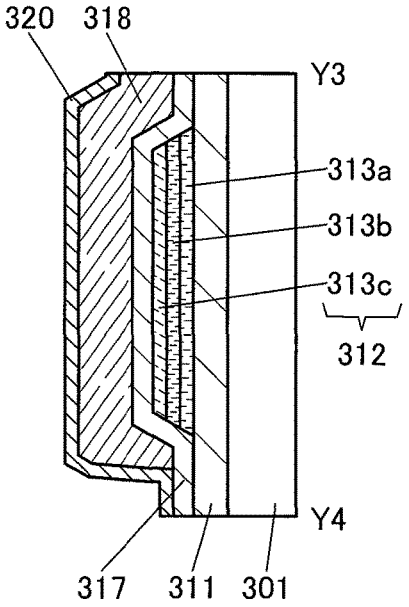
Figure 43C:
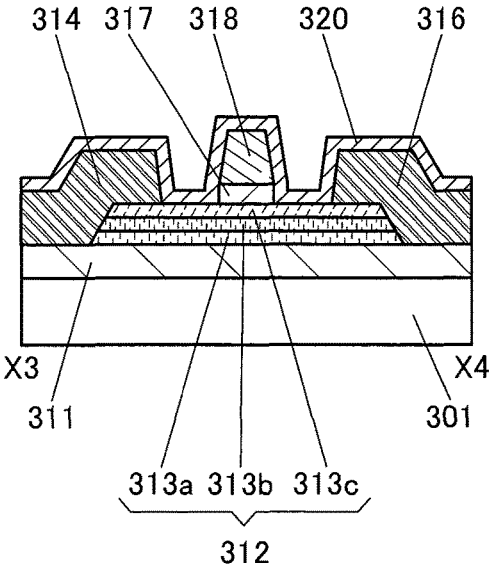

FIGS. 43A to 43C are a top view and cross-sectional views of the transistor 300D included in the display device. FIG. 43A is a top view of the transistor 300D, FIG. 43B is a cross-sectional view taken along dashed-dotted line Y3-Y4 in FIG. 43A, and FIG. 43C is a cross-sectional view taken along dashed-dotted line X3-X4 in FIG. 43A.

The oxide semiconductor film 312 of the transistor 300D illustrated in FIGS. 43A to 43C has a multilayer structure. Specifically, the oxide semiconductor film 312 includes an oxide semiconductor film 313*a* in contact with the insulating film 311, an oxide semiconductor film 313*b* in contact with the oxide semiconductor film 313*a*, and an oxide semiconductor film 313*c* in contact with the oxide semiconductor film 313*b*, the conductive films 314 and 316, and the insulating films 317 and 320. The other structures are the same as those of the transistor 300A and the effect similar to that in the case of the transistor 300A can be obtained.

The oxide semiconductor films 313*a*, 313*b*, and 313*c* are typically formed using a metal oxide such as an In—Ga oxide, an In—Zn oxide, or an In-M-Zn oxide (M is Mg, Al, Ti, Ga, Y, Zr, La, Ce, Nd, or Hf).

The oxide semiconductor films 313*a* and 313*c* are typically each an In—Ga oxide, an In—Zn oxide, an In—Mg oxide, a Zn—Mg oxide, or an In-M-Zn oxide (M is Mg, Al, Ti, Ga, Y, Zr, La, Ce, Nd, or Hf), and each have the energy at the bottom of the conduction band closer to a vacuum level than that of the oxide semiconductor film 313*b*. Typically, a difference between the energy at the bottom of the conduction band of the oxide semiconductor film 313*b* and the energy at the bottom of the conduction band of each of the oxide semiconductor films 313*a* and 313*c* is greater than or equal to 0.05 eV, greater than or equal to 0.07 eV, greater than or equal to 0.1 eV, or greater than or equal to 0.2 eV and also less than or equal to 2 eV, less than or equal to 1 eV, less than or equal to 0.5 eV, or less than or equal to 0.4 eV. Note that the difference between the vacuum level and the energy at the bottom of the conduction band is referred to as electron affinity.

In the case where the oxide semiconductor film 313*b* is an In-M-Zn oxide (M is Mg, Al, Ti, Ga, Y, Zr, La, Ce, Nd, or Hf) and a target having the atomic ratio of metal elements of In:M:Zn=$x_1$:$y_1$:$z_1$ is used for depositing the oxide semiconductor film 313*b*, $x_1/y_1$ is preferably greater than or equal to ⅓ and less than or equal to 6, or further preferably greater than or equal to 1 and less than or equal to 6, and $z_1/y_1$ is preferably greater than or equal to ⅓ and less than or equal to 6, or further preferably greater than or equal to 1 and less than or equal to 6. Note that when $z_1/y_1$ is greater than or equal to 1 and less than or equal to 6, a CAAC-OS film as the oxide semiconductor film 313*b* is easily formed. As typical examples of the atomic ratio of metal elements of the target, In:M:Zn=1:1:1, In:M:Zn=1:1:1.2, In:M:Zn=2:1:1.5, In:M:Zn=2:1:2.3, In:M:Zn=2:1:3, In:M:Zn=3:1:2, and the like can be given.

In the case where the oxide semiconductor films 313*a* and 313*c* are each an In-M-Zn oxide (M is Mg, Al, Ti, Ga, Y, Zr, La, Ce, Nd, or Hf) and a target having the atomic ratio of metal elements of In:M:Zn=$x_2$:$y_2$:$z_2$ is used for forming the oxide semiconductor films 313*a* and 313*c*, $x_2/y_2$ is preferably less than $x_1/y_1$, and $z_2/y_2$ is preferably greater than or equal to ⅓ and less than or equal to 6, or further preferably greater than or equal to 1 and less than or equal to 6. Note that when $z_2/y_2$ is greater than or equal to 1 and less than or equal to 6, a CAAC-OS film as the oxide semiconductor films 313*a* and 313*c* is easily formed. As typical examples of the atomic ratio of metal elements of the target, In:M:Zn=1:3:2, In:M:Zn=1:3:4, In:M:Zn=1:3:6, In:M:Zn=1:3:8, In:M:Zn=1:4:3, In:M:Zn=1:4:4, In:M:Zn=1:4:5, In:M:Zn=1:4:6, In:M:Zn=1:6:3, In:M:Zn=1:6:4, In:M:Zn=1:6:5, In:M:Zn=1:6:6, In:M:Zn=1:6:7, In:M:Zn=1:6:8, In:M:Zn=1:6:9, and the like can be given.

Note that a proportion of each atom in the atomic ratio of the oxide semiconductor films 313*a*, 313*b*, and 313*c* varies within a range of ±40% as an error.

The atomic ratio is not limited to the above, and the atomic ratio may be appropriately set in accordance with needed semiconductor characteristics.

The oxide semiconductor film 313*a* and the oxide semiconductor film 313*c* may have the same composition. For example, as the oxide semiconductor film 313*a* and the oxide semiconductor film 313*c*, an In—Ga—Zn oxide in which the atomic ratio of In to Ga and Zn is 1:3:2, 1:3:4, 1:4:5, 1:4:6, 1:4:7, or 1:4:8 may be used.

Alternatively, the oxide semiconductor films 313*a* and 313*c* may have different compositions. For example, an In—Ga—Zn oxide film in which the atomic ratio of In to Ga and Zn is 1:3:2 may be used as the oxide semiconductor film 313*a*, whereas an In—Ga—Zn oxide film in which the atomic ratio of In to Ga and Zn is 1:3:4 or 1:4:5 may be used as the oxide semiconductor film 313*c*.

The thickness of each of the oxide semiconductor films 313*a* and 313*c* is greater than or equal to 3 nm and less than or equal to 100 nm, or greater than or equal to 3 nm and less than or equal to 50 nm. The thickness of the oxide semiconductor film 313*b* is greater than or equal to 3 nm and less than or equal to 200 nm, greater than or equal to 3 nm and less than or equal to 100 nm, or greater than or equal to 3 nm and less than or equal to 50 nm. When the thicknesses of the oxide semiconductor films 313*a* and 313*c* are made smaller than that of the oxide semiconductor film 313*b*, the amount of change in the threshold voltage of the transistor can be reduced.

The interface between the oxide semiconductor film 313*b* and each of the oxide semiconductor films 313*a* and 313*c* can be observed by scanning transmission electron microscopy (STEM) in some cases.

Oxygen vacancies in the oxide semiconductor film 313*b* can be reduced by providing the oxide semiconductor films 313*a* and 313*c* in which oxygen vacancies are less likely to be generated than the oxide semiconductor film 313*b* in contact with the upper surface and the lower surface of the oxide semiconductor film 313*b*. Furthermore, since the oxide semiconductor film 313*b* is in contact with the oxide semiconductor films 313*a* and 313*c* containing one or more metal elements forming the oxide semiconductor film 313*b*, the interface state densities between the oxide semiconductor film 313*a* and the oxide semiconductor film 313*b* and between the oxide semiconductor film 313*b* and the oxide semiconductor film 313*c* are extremely low. Accordingly, oxygen vacancies contained in the oxide semiconductor film 313*b* can be reduced.

In addition, with the oxide semiconductor film 313*a*, variation in the electrical characteristics of the transistor, such as a threshold voltage, can be reduced.

Since the oxide semiconductor film 313*c* containing one or more metal elements forming the oxide semiconductor film 313*b* is provided in contact with the oxide semiconductor film 313*b*, scattering of carriers does not easily occur at an interface between the oxide semiconductor film 313*b* and the oxide semiconductor film 313*c*, and thus the field-effect mobility of the transistor can be increased.

Furthermore, the oxide semiconductor films 313*a* and 313*c* each also serve as a barrier film which suppresses formation of an impurity state due to the entry of the constituent elements of the insulating films 311 and 317 into the oxide semiconductor film 313*b*.

As described above, in the transistors described in this embodiment, variation in the electrical characteristics, such as a threshold voltage, is reduced. The display device described in the any of the above embodiments is formed using transistors in which variation in the threshold voltage is reduced; thus, variation in the threshold voltage can be corrected easily and effectively.

Figure 44A:
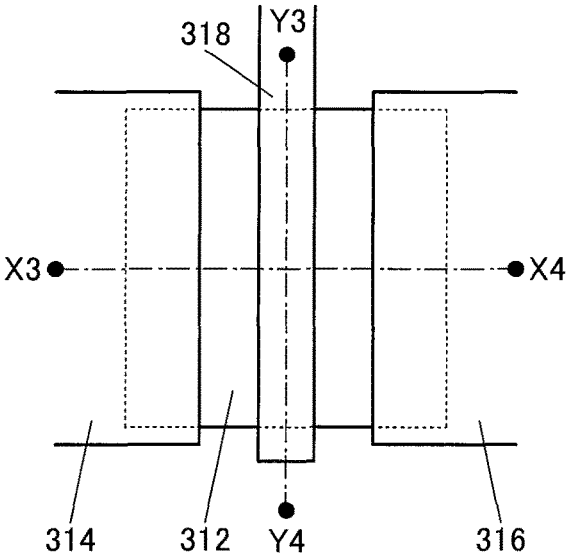
FIGS. 44A to 44C are a top view and cross-sectional views illustrating one embodiment of the present invention.
Figure 44B:
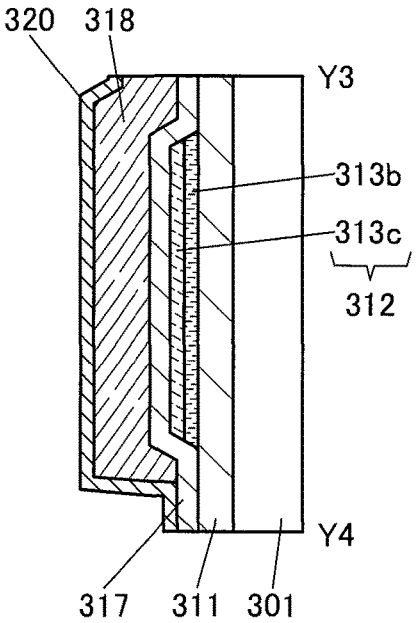
Figure 44C:
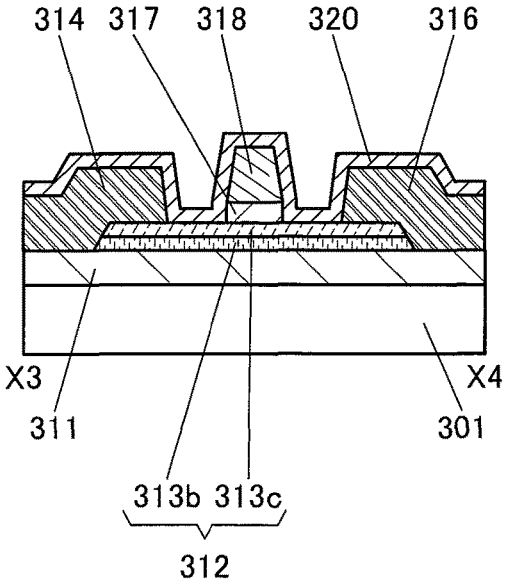

A transistor having a structure different from that in FIGS. 43A to 43C is illustrated in FIGS. 44A to 44C.

FIGS. 44A to 44C are a top view and cross-sectional views of the transistor 300E included in the display device. FIG. 44A is a top view of the transistor 300E, FIG. 44B is a cross-sectional view taken along dashed-dotted line Y3-Y4 in FIG. 44A, and FIG. 44C is a cross-sectional view taken along dashed-dotted line X3-X4 in FIG. 44A. Note that in FIG. 44A, the substrate 301, the insulating films 311, 317, and 320, and the like are omitted for simplicity. FIG. 44B is the cross-sectional view of the transistor 300E in the channel width direction. Moreover, FIG. 44C is the cross-sectional view of the transistor 300E in the channel length direction.

Like the oxide semiconductor film 312 of the transistor 300E illustrated in FIGS. 44A to 44C, the oxide semiconductor film 312 may have a stacked-layer structure of the oxide semiconductor film 313*b* in contact with the insulating film 311 and the oxide semiconductor film 313*c* in contact with the oxide semiconductor film 313*b* and the insulating film 317.

⟨Band Structure⟩

Figure 49A:
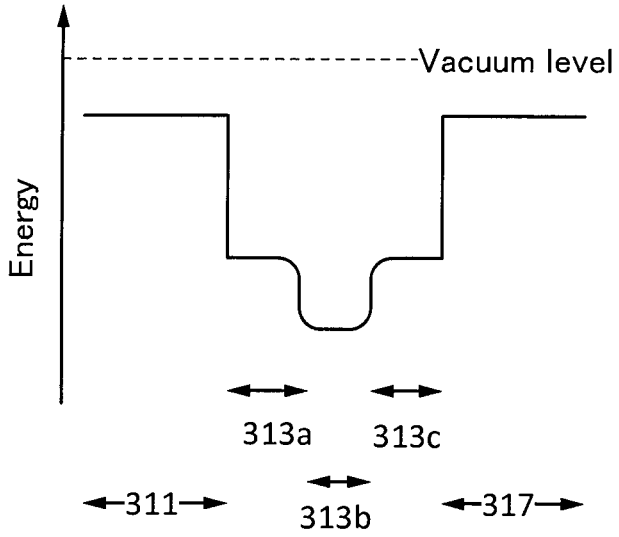
FIGS. 49A and 49B are schematic diagrams of band structures illustrating one embodiment of the present invention.
Figure 49B:
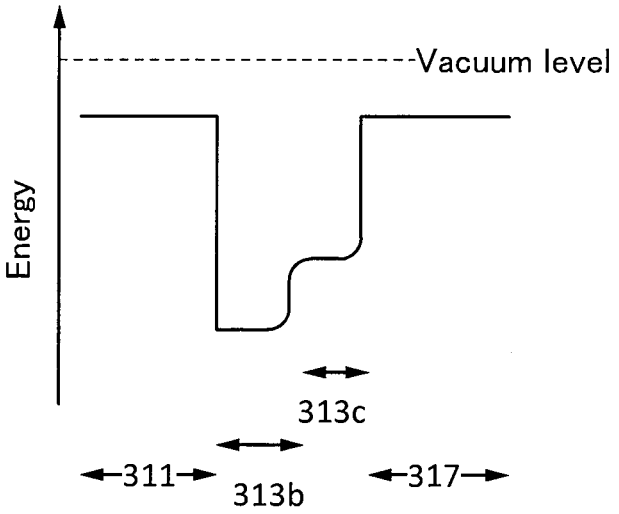

Here, the band structures of the transistor illustrated in FIGS. 43A to 43C and the transistor illustrated in FIGS. 44A to 44C are described. Note that FIG. 49A shows the band structure of the transistor 300D illustrated in FIGS. 43A to 43C, and for easy understanding, the energy (Ec) of the bottom of the conduction band of each of the insulating film 311, the oxide semiconductor film 313*a*, the oxide semiconductor film 313*b*, the oxide semiconductor film 313*c*, and the insulating film 317 is shown. FIG. 49B shows the band structure of the transistor 300E illustrated in FIGS. 44A to 44C, and for easy understanding, the energy (Ec) of the bottom of the conduction band of each of the insulating film 311, the oxide semiconductor film 313*b*, the oxide semiconductor film 313*c*, and the insulating film 317 is shown.

As illustrated in FIG. 49A, the energies at the bottoms of the conduction bands are changed continuously in the oxide semiconductor films 313*a*, 313*b*, and 313*c*. This can be understood also from the fact that the constituent elements are common among the oxide semiconductor films 313*a*, 313*b*, and 313*c* and oxygen is easily diffused among the oxide semiconductor films 313*a* to 313*c*. Thus, the oxide semiconductor films 313*a*, 313*b*, and 313*c* have a continuous physical property although they are a stack of films having different compositions.

The oxide semiconductor films that are stacked and contain the same main components have not only a simple stacked-layer structure of the layers but also a continuous energy band (here, in particular, a well structure having a U shape in which energies at the bottoms of the conduction bands are changed continuously between layers (U-shaped well)). That is, the stacked-layer structure is formed so that a defect state which serves as a trap center or a recombination center in an oxide semiconductor, or an impurity which inhibits the flow of carriers does not exist at interfaces between the layers. If impurities are mixed between the oxide semiconductor films stacked, the continuity of the energy band is lost and carriers disappear by a trap or recombination.

Note that FIG. 49A illustrates the case where the Ec of the oxide semiconductor film 313*a* and the Ec of the oxide semiconductor film 313*c* are equal to each other; however, they may be different from each other.

As illustrated in FIG. 49A, the oxide semiconductor film 313*b* serves as a well and a channel of the transistor 300D is formed in the oxide semiconductor film 313*b*. Note that since the energies at the bottoms of the conduction bands are changed continuously in the oxide semiconductor films 313*a*, 313*b*, and 313*c*, a channel in the well structure having a U shape can also be referred to as a buried channel.

As illustrated in FIG. 49B, the energies at the bottoms of the conduction bands are changed continuously in the oxide semiconductor films 313*b* and 313*c*.

As illustrated in FIG. 49B, the oxide semiconductor film 313*b* serves as a well and a channel of the transistor 300E is formed in the oxide semiconductor film 313*b*.

The transistor 300D illustrated in FIGS. 43A to 43C includes the oxide semiconductor films 313*a* and 313*c* containing one or more metal elements forming the oxide semiconductor film 313*b*; therefore, interface states are not easily formed at the interface between the oxide semiconductor film 313*a* and the oxide semiconductor film 313*b* and the interface between the oxide semiconductor film 313*c* and the oxide semiconductor film 313*b*. Thus, with the oxide semiconductor films 313*a* and 313*c*, variation or change in the electrical characteristics of the transistor, such as a threshold voltage, can be reduced.

The transistor 300E illustrated in FIGS. 44A to 44C includes the oxide semiconductor film 313*c* containing one or more metal elements forming the oxide semiconductor film 313*b*; therefore, an interface state is not easily formed at the interface between the oxide semiconductor film 313*c* and the oxide semiconductor film 313*b*. Thus, with the oxide semiconductor film 313*c*, variation or change in the electrical characteristics of the transistor, such as a threshold voltage, can be reduced. The display device described in any of the above embodiments is formed using the transistors in which variation in the threshold voltage is reduced; thus, variation in the threshold voltage can be corrected easily and effectively.

Structure Example 4 of Transistor

Next, another structure of the transistor included in the display device is described with reference to FIGS. 46A to 46D.

Figure 46A:
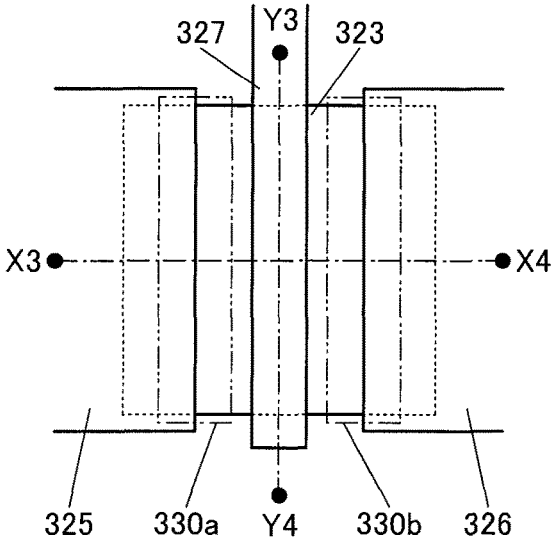
FIGS. 46A to 46D are a top view and cross-sectional views illustrating one embodiment of the present invention.
Figure 46B:
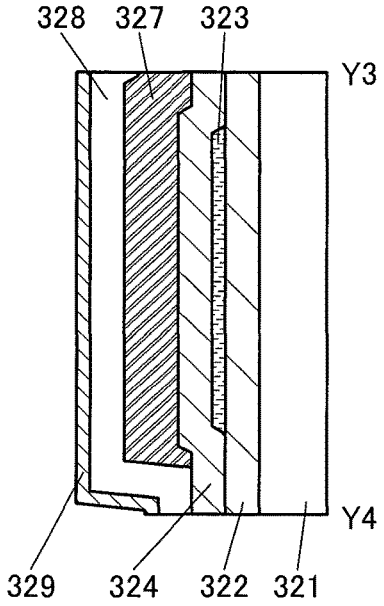
Figure 46C:
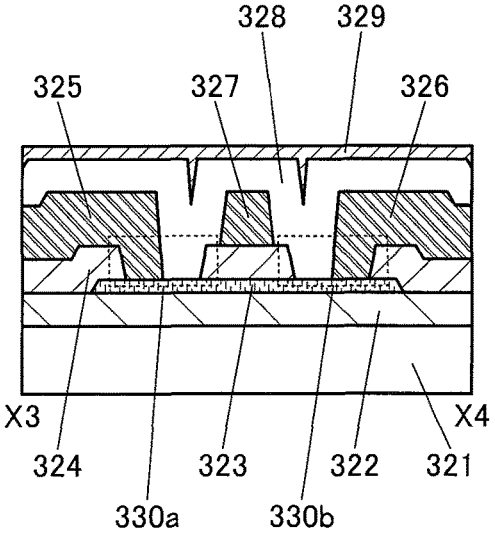

FIGS. 46A to 46C are a top view and cross-sectional views of a transistor 300F included in the display device. FIG. 46A is a top view of the transistor 300F, FIG. 46B is a cross-sectional view taken along dashed-dotted line Y3-Y4 in FIG. 46A, and FIG. 46C is a cross-sectional view taken along dashed-dotted line X3-X4 in FIG. 46A.

The transistor 300F illustrated in FIGS. 46A to 46D includes an oxide semiconductor film 323 over an insulating film 322 formed over a substrate 321, an insulating film 324 in contact with the oxide semiconductor film 323, a conductive film 325 in contact with the oxide semiconductor film 323 in part of an opening 330*a* formed in the insulating film 324, a conductive film 326 in contact with the oxide semiconductor film 323 in part of an opening 330*b* formed in the insulating film 324, and a conductive film 327 overlapping with the oxide semiconductor film 323 with the insulating film 324 provided therebetween. Note that insulating films 328 and 329 may be provided over the transistor 300F.

Regions of the oxide semiconductor film 323 not overlapping with the conductive films 325 and 326 and the conductive film 327 each include an element which forms an oxygen vacancy. An element which forms an oxygen vacancy is described below as an impurity element. Typical examples of an impurity element are hydrogen, boron, carbon, nitrogen, fluorine, aluminum, silicon, phosphorus, chlorine, a rare gas element, and the like. Typical examples of a rare gas element are helium, neon, argon, krypton, and xenon.

When the impurity element is added to the oxide semiconductor film, a bond between a metal element and oxygen in the oxide semiconductor film is cut, whereby an oxygen vacancy is formed. When the impurity element is added to the oxide semiconductor film, oxygen bonded to a metal element in the oxide semiconductor film is bonded to the impurity element, whereby oxygen is detached from the metal element and accordingly an oxygen vacancy is formed. As a result, the oxide semiconductor film has a higher carrier density and thus the conductivity thereof becomes higher.

Figure 46D:
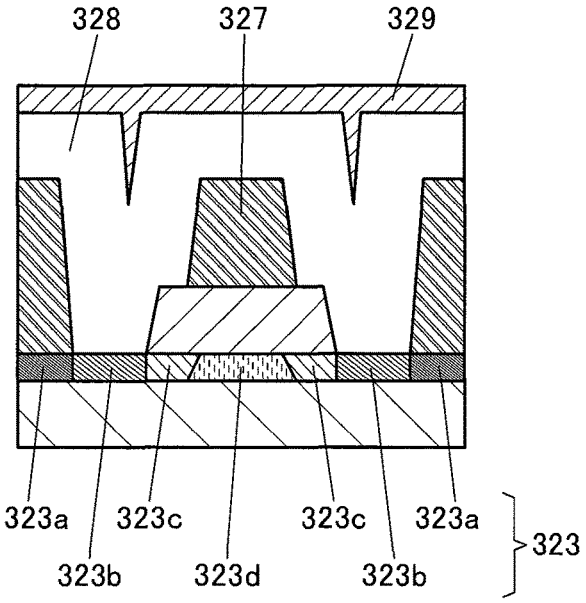

Here, FIG. 46D is a partial enlarged view of the oxide semiconductor film 323. As illustrated in FIG. 46D, the oxide semiconductor film 323 includes regions 323*a* in contact with the conductive films 325 and 326, regions 323*b* in contact with the insulating film 328, and regions 323*c* and a region 323*d* which overlap with the insulating film 324.

The regions 323*a* have high conductivity and function as a source region and a drain region in a manner similar to that of the regions 312*a* illustrated in FIGS. 41A and 41B.

The regions 323*b* and 323*c* function as low-resistance regions. The regions 323*b* and 323*c* contain an impurity element. Note that the concentrations of the impurity element in the regions 323*b* are higher than those in the regions 323*c*. Note that in the case where the conductive film 327 has a tapered side surface, part of the regions 323*c* may overlap with the conductive film 327.

In the case where a rare gas element is used as the impurity element and the oxide semiconductor film 323 is formed by a sputtering method, the regions 323*a* to 323*d* contain the rare gas element, and the concentrations of the rare gas elements in the regions 323*b* and 323*c* are higher than those in the regions 323*a* and 323*d*. This is due to the fact that in the case where the oxide semiconductor film 323 is formed by a sputtering method, the rare gas element is contained in the oxide semiconductor film 323 because the rare gas element is used as a sputtering gas and the rare gas element is intentionally added to the oxide semiconductor film 323 in order to form oxygen vacancies in the regions 323*b* and 323*c*. Note that a rare gas element different from that in the regions 323*a* and 323*d* may be added to the regions 323*b* and 323*c*.

In the case where the impurity element is boron, carbon, nitrogen, fluorine, aluminum, silicon, phosphorus, or chlorine, only the regions 323*b* and 323*c* contain the impurity element. Therefore, the concentrations of the impurity element in the regions 323*b* and 323*c* are higher than those in the regions 323*a* and 323*d*. Note that the concentrations of the impurity element in the regions 323*b* and 323*c* which are measured by SIMS can be greater than or equal to $1\times10^{18}$ atoms/cm$^3$ and less than or equal to $1\times10^{22}$ atoms/cm$^3$, greater than or equal to $1\times10^{19}$ atoms/cm$^3$ and less than or equal to $1\times10^{21}$ atoms/cm$^3$, or greater than or equal to $5\times10^{19}$ atoms/cm$^3$ and less than or equal to $5\times10^{20}$ atoms/cm$^3$.

The concentrations of the impurity element in the regions 323*b* and 323*c* are higher than those in the regions 323*a* and 323*d* in the case where the impurity elements are hydrogen. Note that the concentrations of hydrogen in the regions 323*b* and 323*c* which are measured by SIMS can be greater than or equal to $8\times10^{19}$ atoms/cm$^3$, greater than or equal to $1\times10^{20}$ atoms/cm$^3$, or greater than or equal to $5\times10^{20}$ atoms/cm$^3$.

Since the regions 323*b* and 323*c* contain the impurity elements, oxygen vacancies and carrier densities of the regions 323*b* and 323*c* are increased. As a result, the region 323*b* and the region 323*c* have higher conductivity and serve as low-resistance regions. By provision of the low-resistance regions in such a manner, the resistance between the channel and the source region and the drain region can be reduced, and the transistor 300F has a high on-state current and high field-effect mobility. Thus, the transistor 300F can be preferably used as the driver transistor (e.g., the transistor 22) described in the above embodiment.

Note that the impurity elements may be a combination of one or more of hydrogen, boron, carbon, nitrogen, fluorine, aluminum, silicon, phosphorus, and chlorine and one or more of rare gases. In that case, due to interaction between oxygen vacancies formed by the rare gas in the regions 323*b* and 323*c* and one or more of hydrogen, boron, carbon, nitrogen, fluorine, aluminum, silicon, phosphorus, and chlorine added to the above regions, the conductivity of the regions 323*b* and 323*c* might be further increased.

The region 323*d* serves as a channel.

A region of the insulating film 324 overlapping with the oxide semiconductor film 323 and the conductive film 327 functions as a gate insulating film. In addition, a region of the insulating film 324 overlapping with the oxide semiconductor film 323 and the conductive films 325 and 326 functions as an interlayer insulating film.

The conductive film 325 and the conductive film 326 serve as a source electrode and a drain electrode. The conductive film 327 functions as a gate electrode.

In the manufacturing process of the transistor 300F described in this embodiment, the conductive film 327 functioning as a gate electrode and the conductive films 325 and 326 functioning as a source electrode and a drain electrode are formed at the same time. Therefore, in the transistor 300F, the conductive film 327 does not overlap with the conductive films 325 and 326, and parasitic capacitance formed between the conductive film 327 and each of the conductive films 325 and 326 can be reduced. As a result, in the case where a large-sized substrate is used as the substrate 321, signal delays in the conductive films 325 to 327 can be reduced.

In addition, in the transistor 300F, the impurity element is added to the oxide semiconductor film 323 using the conductive films 325 to 327 as masks. That is, the low-resistance regions can be formed in a self-aligned manner.

The substrate 301 illustrated in FIGS. 40A and 40B can be used as appropriate as the substrate 321.

As the insulating film 322, the insulating film 311 illustrated in FIGS. 40A and 40B can be used as appropriate.

The oxide semiconductor films 303 and 312 illustrated in FIGS. 40A and 40B can be used as appropriate as the oxide semiconductor film 323.

The insulating films 306 and 317 illustrated in FIGS. 40A and 40B can be used as appropriate as the insulating film 324.

Since the conductive films 325 to 327 are formed at the same time, they are formed using the same materials and have the same stacked-layer structures.

The conductive films 314 and 316, the conductive film 318, the conductive films 304 and 305, the conductive film 302, and the conductive film 307 illustrated in FIGS. 40A and 40B can be used as appropriate as the conductive films 325 to 327.

The insulating film 328 can be formed with a single layer or a stack using one or more of an oxide insulating film and a nitride insulating film. Note that an oxide insulating film is preferably used as at least a region of the insulating film 328 that is in contact with the oxide semiconductor film 323, in order to improve characteristics of the interface with the oxide semiconductor film 323. An oxide insulating film that releases oxygen by being heated is preferably used as the insulating film 328, in which case oxygen contained in the insulating film 328 can be moved to the oxide semiconductor film 323 by heat treatment.

The insulating film 328 can be formed with a single layer or a stack using, for example, one or more of silicon oxide, silicon oxynitride, silicon nitride oxide, silicon nitride, aluminum oxide, hafnium oxide, gallium oxide, a Ga—Zn oxide, and the like.

It is preferable that the insulating film 329 be a film functioning as a barrier film against hydrogen, water, or the like from the outside. The insulating film 329 can be formed with a single layer or a stack using, for example, one or more of silicon nitride, silicon nitride oxide, aluminum oxide, and the like.

The thicknesses of the insulating films 328 and 329 each can be greater than or equal to 30 nm and less than or equal to 500 nm, or greater than or equal to 100 nm and less than or equal to 400 nm.

Note that in a manner similar to that of the transistor 300B illustrated in FIGS. 40A and 40B, the transistor 300F can have a dual-gate structure in which a conductive film is provided below the insulating film 322 so as to overlap with the oxide semiconductor film 323.

Structure Example 5 of Transistor

Next, another structure of the transistor included in the display device is described with reference to FIGS. 47A to 47C and FIGS. 48A and 48B.

Figure 47A:
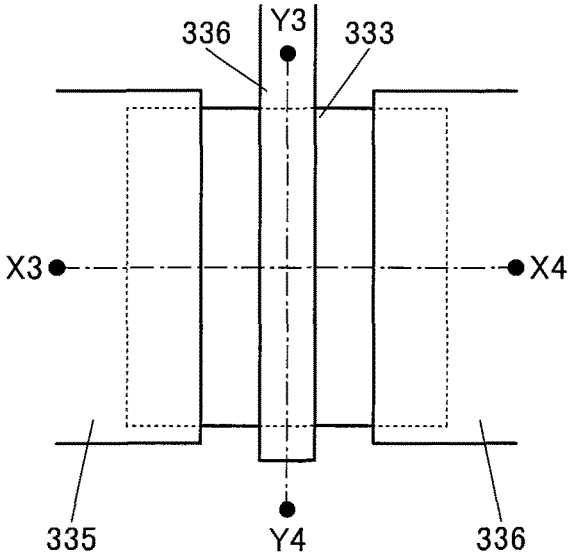
FIGS. 47A to 47C are a top view and cross-sectional views illustrating one embodiment of the present invention.
Figure 47B:
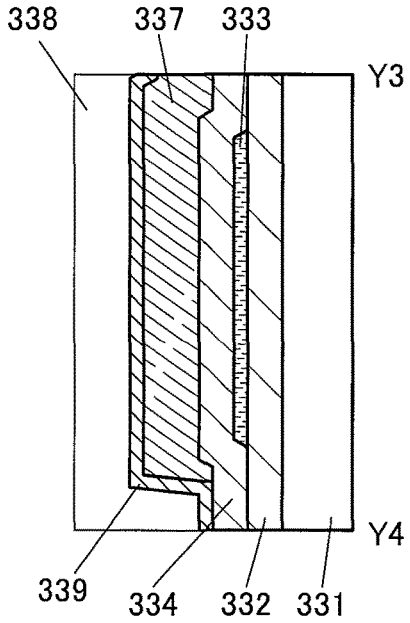
Figure 47C:
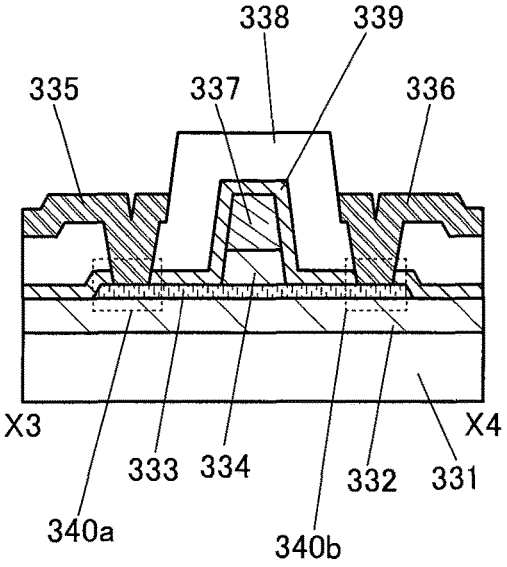

FIGS. 47A to 47C are a top view and cross-sectional views of a transistor 300G included in the display device. FIG. 47A is a top view of the transistor 300G, FIG. 47B is a cross-sectional view taken along dashed-dotted line Y3-Y4 in FIG. 47A, and FIG. 47C is a cross-sectional view taken along dashed-dotted line X3-X4 in FIG. 47A.

The transistor 300G illustrated in FIGS. 47A to 47C includes an oxide semiconductor film 333 over an insulating film 332 formed over a substrate 331, an insulating film 334 in contact with the oxide semiconductor film 333, a conductive film 337 overlapping with the oxide semiconductor film 333 with the insulating film 334 provided therebetween, an insulating film 339 in contact with the oxide semiconductor film 333, an insulating film 338 formed over the insulating film 339, a conductive film 335 in contact with the oxide semiconductor film 333 in an opening 340*a* formed in the insulating films 338 and 339, and a conductive film 336 in contact with the oxide semiconductor film 333 in an opening 340*b* formed in the insulating films 338 and 339.

The conductive film 337 of the transistor 300G functions as a gate electrode. The conductive films 335 and 336 function as a source electrode and a drain electrode.

Regions of the oxide semiconductor film 333 which do not overlap with the conductive film 335, the conductive film 336, and the conductive film 337 each include an element which forms an oxygen vacancy. An element which forms an oxygen vacancy is described below as an impurity element. Typical examples of an impurity element are hydrogen, boron, carbon, nitrogen, fluorine, aluminum, silicon, phosphorus, chlorine, a rare gas element, and the like. Typical examples of a rare gas element are helium, neon, argon, krypton, and xenon.

When the impurity element is added to the oxide semiconductor film, a bond between a metal element and oxygen in the oxide semiconductor film is cut, whereby an oxygen vacancy is formed. When the impurity element is added to the oxide semiconductor film, oxygen bonded to a metal element in the oxide semiconductor film is bonded to the impurity element, whereby oxygen is detached from the metal element and accordingly an oxygen vacancy is formed. As a result, the oxide semiconductor film has a higher carrier density and thus the conductivity thereof becomes higher.

Figure 48A:
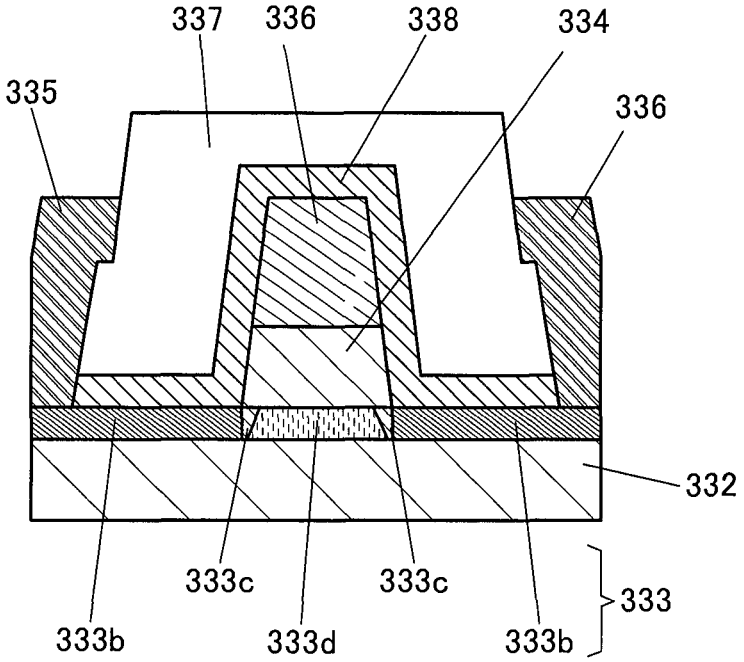
FIGS. 48A and 48B are cross-sectional views illustrating one embodiment of the present invention.
Figure 48B:
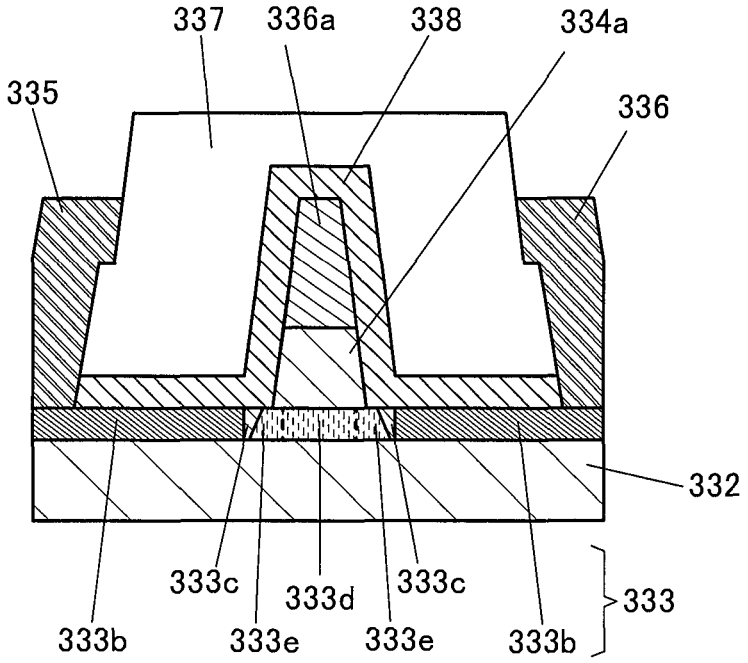

Here, FIG. 48A is a partial enlarged view of the oxide semiconductor film 333. As illustrated in FIG. 48A, the oxide semiconductor film 333 includes regions 333*b* in contact with the conductive film 335, the conductive film 336, or the insulating film 338 and a region 333*d* in contact with the insulating film 334. Note that in the case where the conductive film 337 has a tapered side surface, the oxide semiconductor film 333 may include a region 333*c* overlapping with a tapered portion of the conductive film 337.

The region 333*b* functions as a low-resistance region. The region 333*b* contains at least a rare gas element and hydrogen as impurity elements. Note that in the case where the conductive film 337 has a tapered side surface, the impurity element is added to the region 333*c* through the tapered portion of the conductive film 337; therefore, the region 333*c* contains the impurity element, though the concentration of the rare gas element which is an example of the impurity element of the region 333*c* is lower than that in the region 333*b*. With the regions 333*c*, source-drain breakdown voltage of the transistor can be increased.

In the case where the oxide semiconductor film 333 is formed by a sputtering method, the regions 333*b* to 333*d* each contain the rare gas element, and the concentrations of the rare gas elements in the regions 333*b* and 333*c* are higher than those in the region 333*d*. This is due to the fact that in the case where the oxide semiconductor film 333 is formed by a sputtering method, the rare gas element is contained in the oxide semiconductor film 333 because the rare gas element is used as a sputtering gas and the rare gas element is intentionally added to the oxide semiconductor film 333 in order to form oxygen vacancies in the regions 333*b* and 333*c*. Note that a rare gas element different from that in the region 333*d* may be added to the regions 333*b* and 333*c*.

Since the region 333*b* is in contact with the insulating film 338, the concentration of hydrogen in the region 333*b* is higher than that in the region 333*d*. In addition, in the case where hydrogen is diffused from the region 333*b* into the region 333*c*, the concentration of hydrogen in the region 333*c* is higher than that in the region 333*d*. However, the concentration of hydrogen in the region 333*b* is higher than that in the region 333*c*.

In the regions 333*b* and 333*c*, the concentrations of hydrogen measured by secondary ion mass spectrometry (SIMS) can be greater than or equal to $8\times10^{19}$ atoms/cm$^3$, greater than or equal to $1\times10^{20}$ atoms/cm$^3$, or greater than or equal to $5\times10^{20}$ atoms/cm$^3$. Note that the concentration of hydrogen in the region 333*d* which is measured by secondary ion mass spectrometry can be less than or equal to $5\times10^{19}$ atoms/cm$^3$, less than or equal to $1\times10^{19}$ atoms/cm$^3$, less than or equal to $5\times10^{18}$ atoms/cm$^3$, less than or equal to $1\times10^{18}$ atoms/cm$^3$, less than or equal to $5\times10^{17}$ atoms/cm$^3$, or less than or equal to $1\times10^{16}$ atoms/cm$^3$.

In the case where boron, carbon, nitrogen, fluorine, aluminum, silicon, phosphorus, or chlorine is added to the oxide semiconductor film 333 as an impurity element, only the regions 333*b* and 333*c* contain the impurity element.

Therefore, the concentrations of the impurity element in the regions 333*b* and 333*c* are higher than that in the region 333*d*. Note that the concentrations of the impurity element in the regions 333*b* and 333*c* which are measured by secondary ion mass spectrometry can be greater than or equal to $1\times10^{18}$ atoms/cm$^3$ and less than or equal to $1\times10^{22}$ atoms/cm$^3$, greater than or equal to $1\times10^{19}$ atoms/cm$^3$ and less than or equal to $1\times10^{21}$ atoms/cm$^3$, or greater than or equal to $5\times10^{19}$ atoms/cm$^3$ and less than or equal to $5\times10^{20}$ atoms/cm$^3$.

The regions 333*b* and 333*c* have higher concentrations of hydrogen and larger amounts of oxygen vacancies due to addition of the rare gas element than the region 333*d*. Therefore, the regions 333*b* and 333*c* have higher conductivity and function as low-resistance regions. The resistivity of the regions 333*b* and 333*c* can be typically greater than or equal to $1\times10^{-3}$ Ωcm and less than $1\times10^{4}$ Ωcm, or greater than or equal to $1\times10^{-3}$ Ωcm and less than $1\times10^{-1}$ Ωcm.

Note that when the amount of hydrogen in each of the regions 333*b* and 333*c* is the same as or smaller than the amount of oxygen vacancies therein, hydrogen is easily captured by oxygen vacancies and is less likely to be diffused into the region 333*d* serving as a channel. As a result, a transistor having normally-off characteristics can be obtained.

The region 333*d* serves as a channel.

In addition, after the impurity element is added to the oxide semiconductor film 333 using the conductive film 337 as a mask, the area of the conductive film 337 when seen from the above may be reduced. This can be performed in such a manner that a slimming process is performed on a mask over the conductive film 337 in a step of forming the conductive film 337 so as to obtain a mask with a minuter structure. Then, the conductive film 337 and the insulating film 334 are etched using the mask, so that a conductive film 337*a* and an insulating film 334*a* illustrated in FIG. 48B can be formed. As the slimming process, an ashing process using an oxygen radical or the like can be employed, for example.

As a result, an offset region 333*e* is formed between the region 333*c* and the region 333*d* serving as a channel in the oxide semiconductor film 333. Note that the length of the offset region 333*e* in the channel length direction is set to be less than 0.1 μm, whereby a decrease in the on-state current of the transistor can be suppressed.

The substrate 301 illustrated in FIGS. 40A and 40B can be used as appropriate as the substrate 331 illustrated in FIGS. 47A to 47C.

The insulating film 311 illustrated in FIGS. 40A and 40B can be used as appropriate as the insulating film 332 illustrated in FIGS. 47A to 47C.

The oxide semiconductor films 303 and 312 illustrated in FIGS. 40A and 40B can be used as appropriate as the oxide semiconductor film 333 illustrated in FIGS. 47A to 47C.

The insulating films 306 and 317 illustrated in FIGS. 40A and 40B can be used as appropriate as the insulating film 334 illustrated in FIGS. 47A to 47C.

The conductive films 314 and 316, the conductive film 318, the conductive films 304 and 305, the conductive film 302, and the conductive film 307 illustrated in FIGS. 40A and 40B can be used as appropriate as the conductive films 335 and 336 and the conductive film 337 illustrated in FIGS. 47A to 47C.

The thicknesses of the insulating films 337 and 338 each can be greater than or equal to 30 nm and less than or equal to 500 nm, or greater than or equal to 100 nm and less than or equal to 400 nm.

In the transistor 300G, the conductive film 337 does not overlap with the conductive films 335 and 336, and parasitic capacitance formed between the conductive film 337 and each of the conductive films 335 and 336 can be reduced. As a result, in the case where a large-sized substrate is used as the substrate 331, signal delays in the conductive films 335 to 337 can be reduced.

In addition, in the transistor 300G, the impurity element is added to the oxide semiconductor film 333 using the conductive film 337 as a mask. That is, the low-resistance regions can be formed in a self-aligned manner.

Note that in a manner similar to that of the transistor 300B illustrated in FIGS. 40A and 40B, the transistor 300G can have a dual-gate structure in which a conductive film is provided below the insulating film 332 so as to overlap with the oxide semiconductor film 333.

<Crystal Structure of Oxide Semiconductor Film>

A structure of an oxide semiconductor film that forms the above oxide semiconductor film is described. In this specification, trigonal and rhombohedral crystal systems are included in a hexagonal crystal system.

An oxide semiconductor film is classified roughly into a single crystal oxide semiconductor film and a non-single-crystal oxide semiconductor film. The non-single-crystal oxide semiconductor film includes any of a CAAC-OS film, a polycrystalline oxide semiconductor film, a microcrystalline oxide semiconductor film, an amorphous oxide semiconductor film, and the like.

[CAAC-OS Film]

The CAAC-OS film is one of oxide semiconductor films having a plurality of c-axis aligned crystal parts.

In a combined analysis image (also referred to as a high-resolution TEM image) of a bright-field image and a diffraction pattern of a CAAC-OS film, which is obtained using a transmission electron microscope (TEM), a plurality of crystal parts can be observed. However, in the high-resolution TEM image, a boundary between crystal parts, that is, a grain boundary is not clearly observed. Thus, in the CAAC-OS film, a reduction in electron mobility due to the grain boundary is less likely to occur.

In the high-resolution cross-sectional TEM image of the CAAC-OS film observed in a direction substantially parallel to the sample surface, metal atoms arranged in a layered manner are seen in the crystal parts. Each metal atom layer has a configuration reflecting unevenness of a surface over which the CAAC-OS film is formed (hereinafter, the surface is referred to as a formation surface) or a top surface of the CAAC-OS film, and is arranged parallel to the formation surface or the top surface of the CAAC-OS film.

While in the high-resolution planar TEM image of the CAAC-OS film observed in a direction substantially perpendicular to the sample surface, metal atoms arranged in a triangular or hexagonal configuration are seen in the crystal parts. However, there is no regularity of arrangement of metal atoms between different crystal parts.

A CAAC-OS film is subjected to structural analysis with an X-ray diffraction (XRD) apparatus. For example, when the CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

Note that in structural analysis of the CAAC-OS film including an $InGaZnO_4$ crystal by an out-of-plane method, another peak may appear when 2θ is around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 2θ appear at around 31° and a peak of 2θ not appear at around 36°.

The CAAC-OS film is an oxide semiconductor film with a low impurity concentration. The impurity is an element other than the main components of the oxide semiconductor film, such as hydrogen, carbon, silicon, or a transition metal element. An element (specifically, silicon or the like) having higher strength of bonding to oxygen than a metal element included in an oxide semiconductor film extracts oxygen from the oxide semiconductor film, which results in disorder of the atomic arrangement and reduced crystallinity of the oxide semiconductor film. A heavy metal such as iron or nickel, argon, carbon dioxide, or the like has a large atomic radius (or molecular radius), and thus disturbs the atomic arrangement of the oxide semiconductor film and decreases crystallinity. Additionally, the impurity contained in the oxide semiconductor film might serve as a carrier trap or a carrier generation source.

The CAAC-OS film is an oxide semiconductor film having a low density of defect states. For example, oxygen vacancies in the oxide semiconductor film serve as carrier traps or serve as carrier generation sources when hydrogen is captured therein.

The state in which impurity concentration is low and density of defect states is low (the number of oxygen vacancies is small) is referred to as a "highly purified intrinsic" or "substantially highly purified intrinsic" state. A highly purified intrinsic or substantially highly purified intrinsic oxide semiconductor film has few carrier generation sources, and thus has a low carrier density in some cases. Thus, a transistor including the oxide semiconductor film rarely has a negative threshold voltage (is rarely normally on). The highly purified intrinsic or substantially highly purified intrinsic oxide semiconductor film has few carrier traps. Accordingly, the transistor including the oxide semiconductor film has little variation in electrical characteristics and high reliability. A charge trapped by the carrier traps in the oxide semiconductor film takes a long time to be released. The trapped charge may behave like a fixed charge. Thus, the transistor which includes the oxide semiconductor film having a high impurity concentration and a high density of defect states might have unstable electrical characteristics.

In an OS transistor using the CAAC-OS film, change in electrical characteristics of the transistor due to irradiation with visible light or ultraviolet light is small.

[Microcrystalline Oxide Semiconductor Film]

A microcrystalline oxide semiconductor film has a region in which a crystal part is observed and a region in which a crystal part is not observed clearly in a high-resolution TEM image. In most cases, a crystal part in the microcrystalline oxide semiconductor film is greater than or equal to 1 nm and less than or equal to 100 nm, or greater than or equal to 1 nm and less than or equal to 10 nm. A microcrystal with a size greater than or equal to 1 nm and less than or equal to 10 nm, or a size greater than or equal to 1 nm and less than or equal to 3 nm is specifically referred to as nanocrystal (nc). An oxide semiconductor film including nanocrystal is referred to as a nanocrystalline oxide semiconductor (nc-OS) film. In a high-resolution TEM image of the nc-OS film, for example, a grain boundary is not clearly observed in some cases.

In the nc-OS film, a microscopic region (e.g., a region with a size greater than or equal to 1 nm and less than or equal to 10 nm, in particular, a region with a size greater than or equal to 1 nm and less than or equal to 3 nm) has a periodic atomic arrangement. There is no regularity of crystal orientation between different crystal parts in the nc-OS film. Thus, the orientation of the whole film is not observed. Accordingly, in some cases, the nc-OS film cannot be distinguished from an amorphous oxide semiconductor film depending on an analysis method. For example, when the nc-OS film is analyzed by an out-of-plane method with an XRD apparatus using an X-ray beam having a diameter larger than the size of a crystal part, a peak which shows a crystal plane does not appear. Furthermore, a diffraction pattern like a halo pattern is observed when the nc-OS film is subjected to electron diffraction using an electron beam with a probe diameter (e.g., 50 nm or larger) that is larger than the size of a crystal part (the electron diffraction is also referred to as selected-area electron diffraction). Meanwhile, spots appear in a nanobeam electron diffraction pattern of the nc-OS film when an electron beam having a probe diameter close to or smaller than the size of a crystal part is applied. Moreover, in a nanobeam electron diffraction pattern of the nc-OS film, regions with high luminance in a circular (ring) pattern are shown in some cases. Also in a nanobeam electron diffraction pattern of the nc-OS film, a plurality of spots are shown in a ring-like region in some cases.

The nc-OS film is an oxide semiconductor film that has high regularity as compared with an amorphous oxide semiconductor film. Therefore, the nc-OS film is likely to have a lower density of defect states than an amorphous oxide semiconductor film. Note that there is no regularity of crystal orientation between different crystal parts in the nc-OS film. Therefore, the nc-OS film has a higher density of defect states than the CAAC-OS film.

[Amorphous Oxide Semiconductor Film]

The amorphous oxide semiconductor film is an oxide semiconductor film having disordered atomic arrangement and no crystal part. For example, the amorphous oxide semiconductor film does not have a specific state as in quartz.

In a high-resolution TEM image of the amorphous oxide semiconductor film, crystal parts cannot be found. When the amorphous oxide semiconductor film is subjected to structural analysis by an out-of-plane method with an XRD apparatus, a peak which shows a crystal plane does not appear. A halo pattern is observed when the amorphous oxide semiconductor film is subjected to electron diffraction. Furthermore, a spot is not observed and a halo pattern appears when the amorphous oxide semiconductor film is subjected to nanobeam electron diffraction.

An oxide semiconductor film may have a structure having physical properties intermediate between the nc-OS film and the amorphous oxide semiconductor film. The oxide semiconductor film having such a structure is specifically referred to as an amorphous-like oxide semiconductor (a-like OS) film.

In a high-resolution TEM image of the a-like OS film, a void may be observed. Furthermore, in the high-resolution TEM image, there are a region where a crystal part is clearly observed and a region where a crystal part is not observed. In this manner, growth of the crystal part occurs due to the crystallization of the a-like OS film, which is induced by a slight amount of electron beam employed in the TEM observation. In contrast, crystallization by a slight amount of electron beam used for TEM observation is less observed in the nc-OS film having good quality.

Note that the crystal part size in the a-like OS film and the nc-OS film can be measured using high-resolution TEM images. For example, an $InGaZnO_4$ crystal has a layered structure in which two Ga—Zn—O layers are included between In—O layers. A unit cell of the $InGaZnO_4$ crystal has a structure in which nine layers of three In—O layers and six Ga—Zn—O layers are layered in the c-axis direction. Accordingly, the spacing between these adjacent layers is equivalent to the lattice spacing on the (009) plane (also referred to as a d value). The value is calculated to 0.29 nm from crystal structure analysis. Thus, each of the lattice fringes in which the spacing therebetween is from 0.28 nm to 0.30 nm corresponds to the a-b plane of the $InGaZnO_4$ crystal, focusing on the lattice fringes in the high-resolution TEM image.

The film density of the oxide semiconductor film varies depending on the structure in some cases. For example, the structure of an oxide semiconductor film can be estimated by comparing the film density of the oxide semiconductor film with the film density of a single crystal oxide semiconductor film having the same composition as the oxide semiconductor film. For example, the film density of the a-like OS film is higher than or equal to 78.6% and lower than 92.3% of the film density of the single crystal oxide semiconductor film having the same composition. For example, the film density of the nc-OS film and the CAAC-OS film is higher than or equal to 92.3% and lower than 100% of the film density of the single crystal oxide semiconductor film having the same composition. Note that it is difficult to form an oxide semiconductor film having a film density of lower than 78% of the film density of the single crystal oxide semiconductor film having the same composition.

Specific examples of the above description are given. For example, in the case of an oxide semiconductor film having an atomic ratio of In:Ga:Zn=1:1:1, the film density of single crystal $InGaZnO_4$ with a rhombohedral crystal structure is 6.357 g/cm$^3$. Accordingly, in the case of the oxide semiconductor film having an atomic ratio of In:Ga:Zn=1:1:1, the film density of the a-like OS film is higher than or equal to 5.0 g/cm$^3$ and lower than 5.9 g/cm$^3$. For example, in the case of the oxide semiconductor film having an atomic ratio of In:Ga:Zn=1:1:1, the film density of each of the nc-OS film and the CAAC-OS film is higher than or equal to 5.9 g/cm$^3$ and lower than 6.3 g/cm$^3$.

Note that there is a possibility that an oxide semiconductor film having a certain composition cannot exist in a single crystal structure. In that case, single crystal oxide semiconductor films with different compositions are combined in an adequate ratio to calculate the density equivalent to that of a single crystal oxide semiconductor film with the desired composition. The film density of the single crystal oxide semiconductor film having the desired composition can be calculated using a weighted average according to the combination ratio of the single crystal oxide semiconductor films with different compositions. Note that it is preferable to combine as few kinds of single crystal oxide semiconductor films as possible for film density calculation.

Note that an oxide semiconductor film may be a stacked film including two or more of an amorphous oxide semiconductor film, an a-like OS film, a microcrystalline oxide semiconductor film, and a CAAC-OS film, for example.

<Off-State Current>

Unless otherwise specified, the off-state current in this specification refers to a drain current of a transistor in the off state (also referred to as non-conduction state and cutoff state). Unless otherwise specified, the off state of an n-channel transistor means that a voltage (Vgs) between its gate and source is lower than the threshold voltage (Vth), and the off state of a p-channel transistor means that the gate-source voltage Vgs is higher than the threshold voltage Vth. For example, the off-state current of an n-channel transistor sometimes refers to a drain current that flows when the gate-source voltage Vgs is lower than the threshold voltage Vth.

The off-state current of a transistor depends on Vgs in some cases. Thus, "the off-state current of a transistor is lower than or equal to I" may mean "there is Vgs with which the off-state current of the transistor becomes lower than or equal to I". Furthermore, "the off-state current of a transistor" means "the off-state current in an off state at predetermined Vgs", "the off-state current in an off state at Vgs in a predetermined range", "the off-state current in an off state at Vgs with which sufficiently reduced off-state current is obtained", or the like.

As an example, the assumption is made of an n-channel transistor where the threshold voltage Vth is 0.5 V and the drain current is $1\times10^{-9}$ A at Vgs of 0.5 V, $1\times10^{-13}$ A at Vgs of 0.1 V, $1\times10^{-19}$ A at Vgs of −0.5 V, and $1\times10^{-22}$ A at Vgs of −0.8 V. The drain current of the transistor is $1\times10^{-19}$ A or lower at Vgs of −0.5 V or at Vgs in the range of −0.8 V to −0.5 V; therefore, it can be said that the off-state current of the transistor is $1\times10^{-19}$ A or lower. Since there is Vgs at which the drain current of the transistor is $1\times10^{-22}$ A or lower, it may be said that the off-state current of the transistor is $1\times10^{-22}$ A or lower.

In this specification, the off-state current of a transistor with a channel width W is sometimes represented by a current value in relation to the channel width W or by a current value per given channel width (e.g., 1 μm). In the latter case, the off-state current may be expressed in the unit with the dimension of current per length (e.g., A/μm).

The off-state current of a transistor depends on temperature in some cases. Unless otherwise specified, the off-state current in this specification may be an off-state current at room temperature, 60° C., 85° C., 95° C., or 125° C. Alternatively, the off-state current may be an off-state current at a temperature at which the reliability required in a semiconductor device or the like including the transistor is ensured or a temperature at which the semiconductor device or the like including the transistor is used (e.g., temperature in the range of 5° C. to 35° C.). The description "an off-state current of a transistor is lower than or equal to I" may refer to a situation where there is Vgs at which the off-state current of a transistor is lower than or equal to I at room temperature, 60° C., 85° C., 95° C., 125° C., a temperature at which the reliability required in a semiconductor device or the like including the transistor is ensured, or a temperature at which the semiconductor device or the like including the transistor is used (e.g., temperature in the range of 5° C. to 35° C.).

The off-state current of a transistor depends on voltage Vds between its drain and source in some cases. Unless otherwise specified, the off-state current in this specification may be an off-state current at Vds of 0.1 V, 0.8 V, 1 V, 1.2 V, 1.8 V, 2.5 V, 3 V, 3.3 V, 10 V, 12 V, 16 V, or 20 V. Alternatively, the off-state current might be an off-state current at Vds at which the required reliability of a semiconductor device or the like including the transistor is ensured or Vds at which the semiconductor device or the like including the transistor is used. The description "an off-state current of a transistor is lower than or equal to I" may refer to a situation where there is Vgs at which the off-state current of a transistor is lower than or equal to I at Vds of 0.1 V, 0.8 V, 1 V, 1.2 V, 1.8 V, 2.5 V, 3 V, 3.3 V, 10 V, 12 V, 16 V, or 20 V, Vds at which the required reliability of a semiconductor device or the like including the transistor is ensured, or Vds at which in the semiconductor device or the like including the transistor is used.

In the above description of off-state current, a drain may be replaced with a source. That is, the off-state current sometimes refers to a current that flows through a source of a transistor in the off state.

In this specification, the term "leakage current" sometimes expresses the same meaning as off-state current.

In this specification, the off-state current sometimes refers to a current that flows between a source and a drain when a transistor is off, for example.

The structure described above in this embodiment can be combined as appropriate with any of the structures described in the other embodiments.

Embodiment 5

Figure 50:
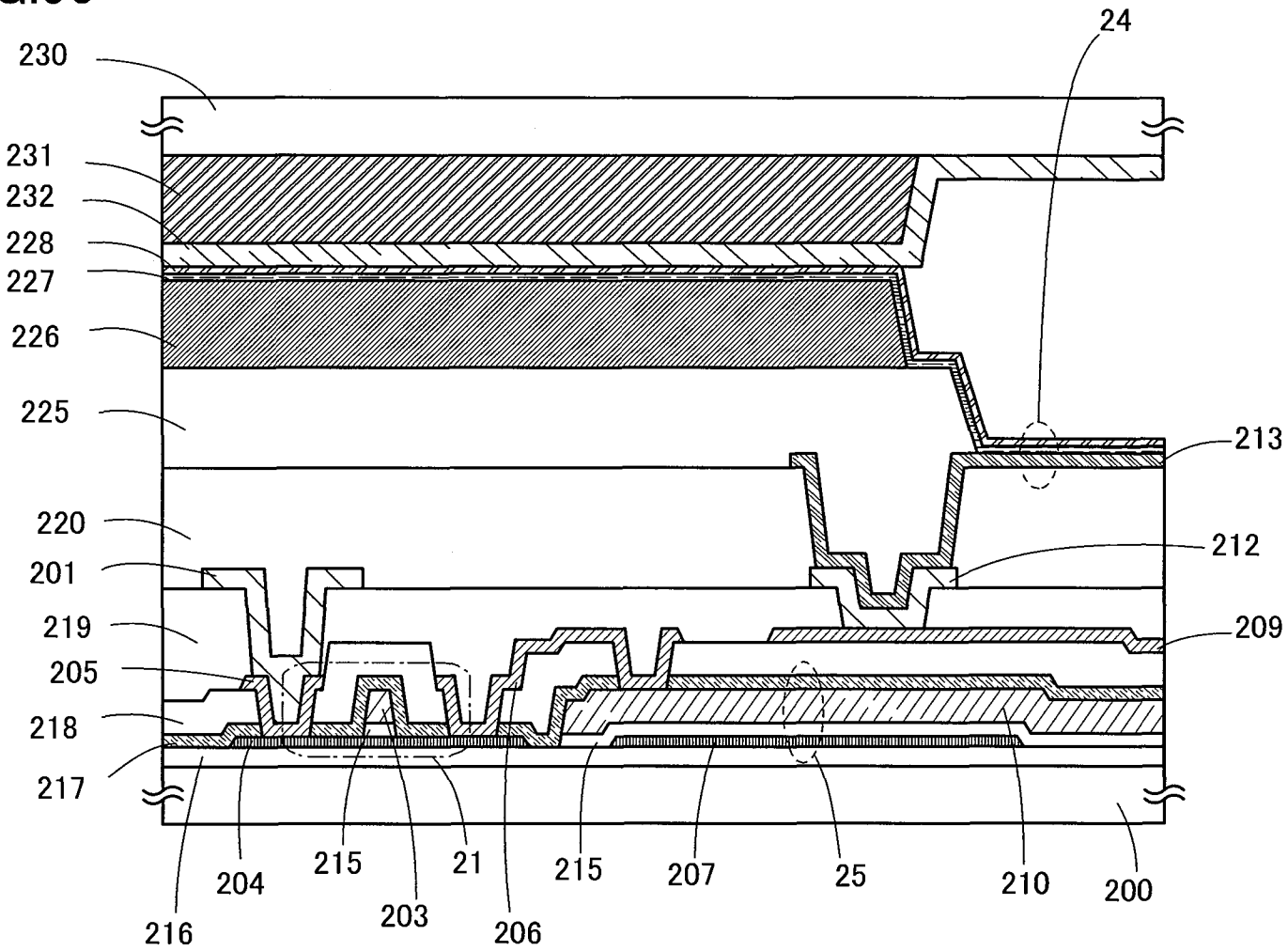
FIG. 50 is a cross-sectional view illustrating one embodiment of the present invention.

An example of a cross-sectional structure of a display pixel of a display device will be described in this embodiment. FIG. 50 illustrates the cross-sectional structure of the transistor 21, the capacitor 25, and the light-emitting element 24 of the pixel 20

Specifically, the display device illustrated in FIG. 50 includes an insulating film 216 over a substrate 200, and the transistor 21 and the capacitor 25 over the insulating film 216. The transistor 21 includes a semiconductor film 204, an insulating film 215 over the semiconductor film 204, a conductive film 203 overlapping with the semiconductor film 204 with the insulating film 215 provided therebetween and functioning as a gate, a conductive film 205 which is in contact with the semiconductor film 204 and is provided in an opening formed in an insulating film 217 and an insulating film 218, and a conductive film 206 which is similarly in contact with the semiconductor film 204 and is provided in an opening formed in the insulating films 217 and 218. Note that the conductive films 205 and 206 function as a source and a drain of the transistor 21.

The capacitor 25 includes a semiconductor film 207 functioning as an electrode, the insulating film 215 over the semiconductor film 207, and a conductive film 210 overlapping with the semiconductor film 207 with the insulating film 215 provided therebetween and functioning as an electrode.

The insulating film 215 may be formed with a single layer or a stack of an insulating film containing one or more of aluminum oxide, aluminum oxynitride, magnesium oxide, silicon oxide, silicon oxynitride, silicon nitride oxide, silicon nitride, gallium oxide, germanium oxide, yttrium oxide, zirconium oxide, lanthanum oxide, neodymium oxide, hafnium oxide, and tantalum oxide. Note that in this specification, oxynitride contains more oxygen than nitrogen, and nitride oxide contains more nitrogen than oxygen.

In the case where an oxide semiconductor is used for the semiconductor film 204, it is preferable to use a material that can supply oxygen to the semiconductor film 204 for the insulating film 216. By using the material for the insulating film 216, oxygen contained in the insulating film 216 can be moved to the semiconductor film 204, and the amount of oxygen vacancies in the semiconductor film 204 can be reduced. Oxygen contained in the insulating film 216 can be moved to the semiconductor film 204 efficiently by heat treatment performed after the semiconductor film 204 is formed.

The insulating film 217 is provided over the semiconductor film 204 and the conductive films 203 and 210; the insulating film 218 is provided over the insulating film 217; and the conductive films 205 and 206 and a conductive film 209, and an insulating film 219 are provided over the insulating film 218. Conductive films 201 and 212 are provided over the insulating film 219, the conductive film 201 is connected to the conductive film 205 in an opening formed in the insulating film 219, and the conductive film 212 is connected to the conductive film 209 in an opening formed in the insulating film 219.

In the case where an oxide semiconductor is used for the semiconductor film 204, the insulating film 217 is preferably configured to block oxygen, hydrogen, water, an alkali metal, an alkaline earth metal, and the like. It is possible to prevent outward diffusion of oxygen from the semiconductor film 204 and entry of hydrogen, water, or the like into the semiconductor film 204 from the outside by providing the insulating film 217. The insulating film 217 can be formed using a nitride insulating film, for example. As the nitride insulating film, a silicon nitride film, a silicon nitride oxide film, an aluminum nitride film, an aluminum nitride oxide film, and the like can be given. Note that instead of the nitride insulating film having a blocking effect against oxygen, hydrogen, water, an alkali metal, an alkaline earth metal, and the like, an oxide insulating film having a blocking effect against oxygen, hydrogen, water, and the like may be provided. As the oxide insulating film having a blocking effect against oxygen, hydrogen, water, and the like, an aluminum oxide film, an aluminum oxynitride film, a gallium oxide film, a gallium oxynitride film, an yttrium oxide film, an yttrium oxynitride film, a hafnium oxide film, a hafnium oxynitride film, and the like can be given.

An insulating film 220 and a conductive film 213 are provided over the insulating film 219 and the conductive films 201 and 212, and the conductive film 213 is connected to the conductive film 212 in an opening formed in the insulating film 220.

An insulating film 225 is provided over the insulating film 220 and the conductive film 213. The insulating film 225 has an opening in a region overlapping with the conductive film 213. Over the insulating film 225, an insulating film 226 is provided in a region different from the opening of the insulating film 225. An EL layer 227 and a conductive film 228 are sequentially stacked over the insulating films 225 and 226. A portion in which the conductive films 213 and 228 overlap with each other with the EL layer 227 provided therebetween functions as the light-emitting element 24. One of the conductive films 213 and 228 functions as an anode, and the other functions as a cathode.

The light-emitting device includes a substrate 230 that faces the substrate 200 with the light-emitting element 24 provided therebetween. A blocking film 231 having a function of blocking light is provided under the substrate 230, i.e., on a surface of the substrate 230 that is closer to the light-emitting element 24. The blocking film 231 has an opening in a region overlapping with the light-emitting element 24. In the opening overlapping with the light-emitting element 24, a coloring layer 232 that transmits visible light in a specific wavelength range is provided under the substrate 230.

Note that the insulating film 226 is provided to adjust the distance between the light-emitting element 24 and the substrate 230 and may be omitted in some cases.

Although the top-emission structure is employed in this embodiment in which light of the light-emitting element 24 is extracted from the side opposite to the element substrate, a bottom-emission structure in which light of the light-emitting element 24 is extracted from the element substrate side or a dual-emission structure in which light of the light-emitting element 24 is extracted from both the element substrate side and the side opposite to the element substrate can also be applied to embodiments of the present invention.

The structure described above in this embodiment can be combined as appropriate with any of the structures described in the other embodiments.

Embodiment 6

In this embodiment, a display device including a light-emitting element of one embodiment of the present invention and an electronic device in which the display device is provided with an input device will be described with reference to FIGS. 51A and 51B, FIGS. 52A to 52C, and FIGS. 53A and 53B.

<Description 1 of Touch Panel>

In this embodiment, a touch panel 500 including a display device and an input device will be described as an example of an electronic device. In addition, an example in which a touch sensor is used as an input device will be described.

Figure 51A:
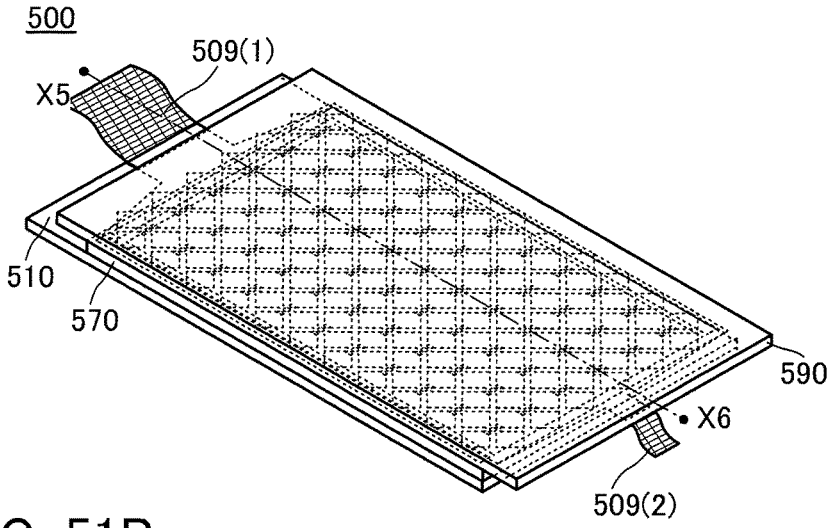
FIGS. 51A and 51B are perspective views illustrating one embodiment of the present invention.
Figure 51B:
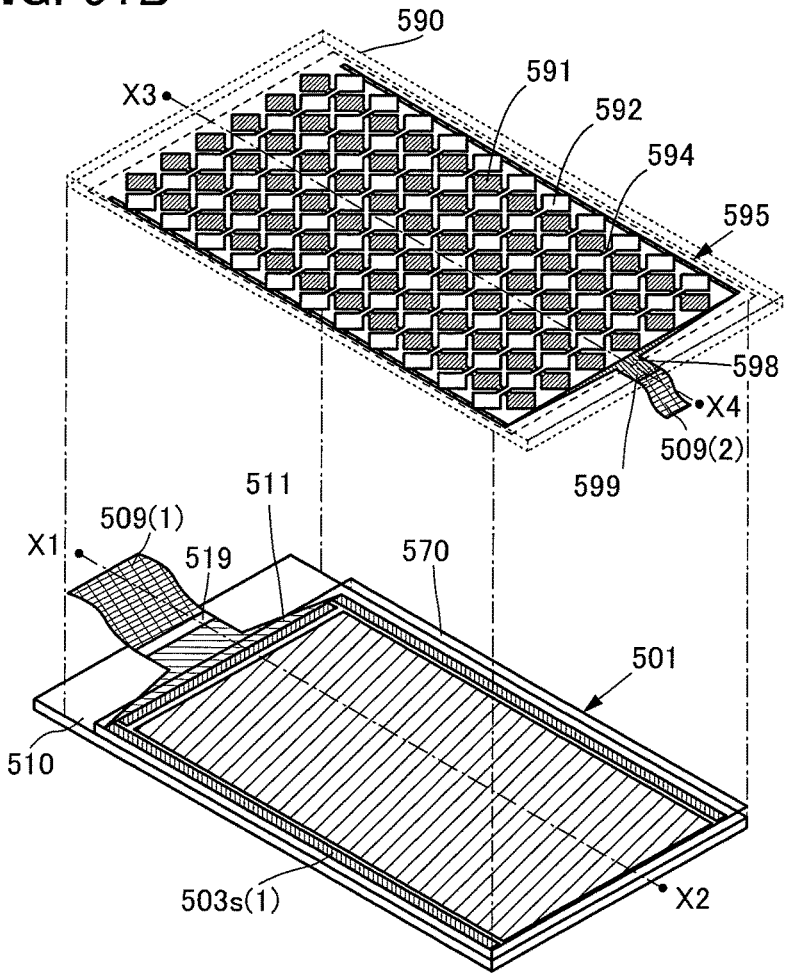

FIGS. 51A and 51B are perspective views of the touch panel 500. Note that FIGS. 51A and 51B illustrate only main components of the touch panel 500 for simplicity.

The touch panel 500 includes a display device 501 and a touch sensor 595 (see FIG. 51B). The touch panel 500 also includes a substrate 510, a substrate 570, and a substrate 590. The substrate 510, the substrate 570, and the substrate 590 each have flexibility. Note that one or all of the substrates 510, 570, and 590 may be inflexible.

The display device 501 includes a plurality of pixels over the substrate 510 and a plurality of wirings 511 through which signals are supplied to the pixels. The plurality of wirings 511 are led to a peripheral portion of the substrate 510, and parts of the plurality of wirings 511 form a terminal 519. The terminal 519 is electrically connected to an FPC 509(1).

The substrate 590 includes the touch sensor 595 and a plurality of wirings 598 electrically connected to the touch sensor 595. The plurality of wirings 598 are led to a peripheral portion of the substrate 590, and parts of the plurality of wirings 598 form a terminal. The terminal is electrically connected to an FPC 509(2). Note that in FIG. 51B, electrodes, wirings, and the like of the touch sensor 595 provided on the back side of the substrate 590 (the side facing the substrate 510) are indicated by solid lines for clarity.

As the touch sensor 595, a capacitive touch sensor can be used. Examples of the capacitive touch sensor are a surface capacitive touch sensor and a projected capacitive touch sensor.

Examples of the projected capacitive touch sensor are a self-capacitive touch sensor and a mutual capacitive touch sensor, which differ mainly in the driving method. The use of a mutual capacitive type is preferable because multiple points can be sensed simultaneously.

Note that the touch sensor 595 illustrated in FIG. 51B is an example of using a projected capacitive touch sensor.

Note that a variety of sensors that can sense proximity or touch of a sensing target such as a finger can be used as the touch sensor 595.

The projected capacitive touch sensor 595 includes electrodes 591 and electrodes 592. The electrodes 591 are electrically connected to any of the plurality of wirings 598, and the electrodes 592 are electrically connected to any of the other wirings 598.

The electrodes 592 each have a shape of a plurality of quadrangles arranged in one direction with one corner of a quadrangle connected to one corner of another quadrangle as illustrated in FIGS. 51A and 51B.

The electrodes 591 each have a quadrangular shape and are arranged in a direction intersecting with the direction in which the electrodes 592 extend.

A wiring 594 electrically connects two electrodes 591 between which the electrode 592 is positioned. The intersecting area of the electrode 592 and the wiring 594 is preferably as small as possible. Such a structure allows a reduction in the area of a region where the electrodes are not provided, reducing variation in transmittance. As a result, variation in luminance of light passing through the touch sensor 595 can be reduced.

Note that the shapes of the electrodes 591 and the electrodes 592 are not limited thereto and can be any of a variety of shapes. For example, a structure may be employed in which the plurality of electrodes 591 are arranged so that gaps between the electrodes 591 are reduced as much as possible, and the electrodes 592 are spaced apart from the electrodes 591 with an insulating layer interposed therebetween to have regions not overlapping with the electrodes 591. In this case, it is preferable to provide, between two adjacent electrodes 592, a dummy electrode electrically insulated from these electrodes because the area of regions having different transmittances can be reduced.

<Display Device>

Figure 52A:
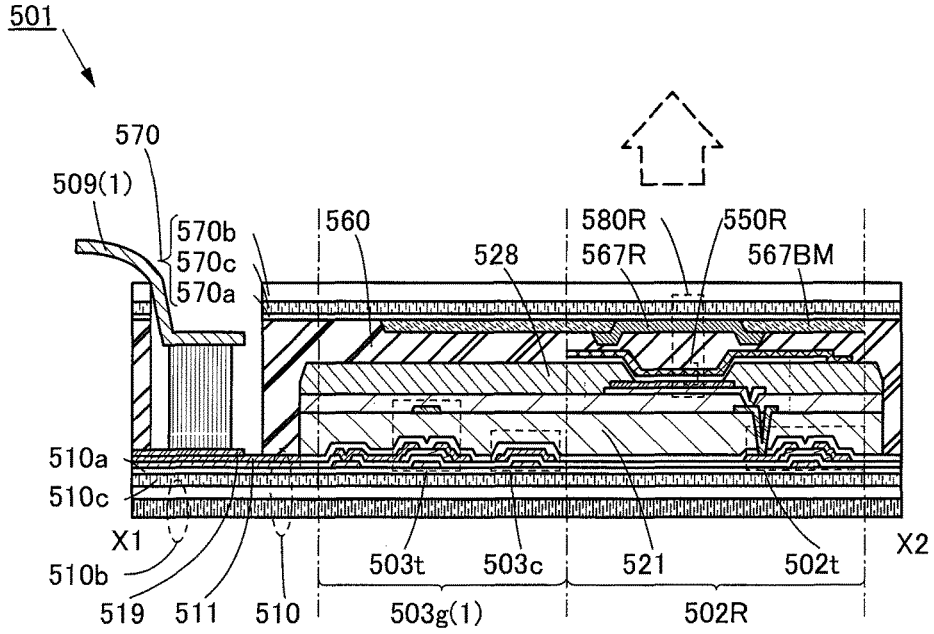
FIGS. 52A to 52C are cross-sectional views illustrating one embodiment of the present invention.

Next, the display device 501 will be described in detail with reference to FIG. 52A. FIG. 52A corresponds to a cross-sectional view taken along dashed-dotted line X1-X2 in FIG. 51B.

The display device 501 includes a plurality of pixels arranged in a matrix. Each of the pixels includes a display element and a pixel circuit for driving the display element.

In the following description, an example of using a light-emitting element that emits white light as a display element will be described; however, the display element is not limited to such an element. For example, light-emitting elements that emit light of different colors may be included so that the light of different colors can be emitted from adjacent pixels.

For the substrate 510 and the substrate 570, for example, a flexible material with a vapor permeability of lower than or equal to $10^{-5}$ g/(m$^2$·day), preferably lower than or equal to $10^{-6}$ g/(m$^2$·day) can be favorably used. Alternatively, materials whose thermal expansion coefficients are substantially equal to each other are preferably used for the substrate 510 and the substrate 570. For example, the coefficients of linear expansion of the materials are preferably lower than or equal to $1\times10^{-3}$/K, further preferably lower than or equal to $5\times10^{-5}$/K, still further preferably lower than or equal to $1\times10^{-5}$/K.

Note that the substrate 510 is a stacked body including an insulating layer 510*a* for preventing impurity diffusion into the light-emitting element, a flexible substrate 510*b*, and an adhesive layer 510*c* for attaching the insulating layer 510*a* and the flexible substrate 510*b* to each other. The substrate 570 is a stacked body including an insulating layer 570*a* for preventing impurity diffusion into the light-emitting element, a flexible substrate 570*b*, and an adhesive layer 570*c* for attaching the insulating layer 570*a* and the flexible substrate 570*b* to each other.

For the adhesive layer 510*c* and the adhesive layer 570*c*, for example, materials that include polyester, polyolefin, polyamide (e.g., nylon, aramid), polyimide, polycarbonate, polyurethane, an acrylic resin, an epoxy resin, or a resin having a siloxane bond can be used.

A sealing layer 560 is provided between the substrate 510 and the substrate 570. The sealing layer 560 preferably has a refractive index higher than that of air. In the case where light is extracted to the sealing layer 560 side as illustrated in FIG. 52A, the sealing layer 560 also serves as a layer (hereinafter, also referred to as an optical bonding layer) that optically bonds two components (here, the substrates 510 and 570) between which the sealing layer 560 is sandwiched.

A sealant may be formed in the peripheral portion of the sealing layer 560. With the use of the sealant, a light-emitting element 550R can be provided in a region surrounded by the substrate 510, the substrate 570, the sealing layer 560, and the sealant. Note that an inert gas (such as nitrogen or argon) may be used instead of the sealing layer 560. A drying agent may be provided in the inert gas so as to adsorb moisture or the like. For example, an epoxy-based resin or a glass frit is preferably used as the sealant. As a material used for the sealant, a material which is impermeable to moisture or oxygen is preferably used.

The display device 501 includes a pixel 502R. The pixel 502R includes a light-emitting module 580R.

The pixel 502R includes the light-emitting element 550R and a transistor 502*t* that can supply power to the light-emitting element 550R. Note that the transistor 502*t* functions as part of the pixel circuit. The light-emitting module 580R includes the light-emitting element 550R and a coloring layer 567R.

The light-emitting element 550R includes a lower electrode, an upper electrode, and an EL layer between the lower electrode and the upper electrode. As the light-emitting element 550R, any of the light-emitting elements described in any of the above Embodiments can be used, for example.

A microcavity structure may be employed between the lower electrode and the upper electrode so as to increase the intensity of light having a specific wavelength.

In the case where the sealing layer 560 is provided on the light extraction side, the sealing layer 560 is in contact with the light-emitting element 550R and the coloring layer 567R.

The coloring layer 567R is positioned in a region overlapping with the light-emitting element 550R. Accordingly, part of light emitted from the light-emitting element 550R passes through the coloring layer 567R and is emitted to the outside of the light-emitting module 580R as indicated by an arrow in FIG. 52A.

The display device 501 includes a light-blocking layer 567BM on the light extraction side. The light-blocking layer 567BM is provided so as to surround the coloring layer 567R.

The coloring layer 567R is a coloring layer having a function of transmitting light in a particular wavelength region. For example, a color filter for transmitting light in a red wavelength range, a color filter for transmitting light in a green wavelength range, a color filter for transmitting light in a blue wavelength range, a color filter for transmitting light in a yellow wavelength range, or the like can be used. Each color filter can be formed with any of various materials by a printing method, an inkjet method, an etching method using a photolithography technique, or the like.

An insulating layer 521 is provided in the display device 501. The insulating layer 521 covers the transistor 502*t*. The insulating layer 521 has a function of covering unevenness caused by the pixel circuit. The insulating layer 521 may have a function of suppressing impurity diffusion. This can prevent the reliability of the transistor 502*t* or the like from being lowered by impurity diffusion.

The light-emitting element 550R is formed over the insulating layer 521. A partition 528 is provided so as to overlap with an end portion of the lower electrode of the light-emitting element 550R. Note that a spacer for controlling the distance between the substrate 510 and the substrate 570 may be formed over the partition 528.

A gate line driver circuit 503*g*(1) includes a transistor 503*t* and a capacitor 503*c*. Note that the driver circuit can be formed in the same process and over the same substrate as those of the pixel circuits.

The wirings 511 through which signals can be supplied are provided over the substrate 510. The terminal 519 is provided over the wirings 511. The FPC 509(1) is electrically connected to the terminal 519. The FPC 509(1) is configured to supply a video signal, a clock signal, a start signal, a reset signal, or the like. Note that the FPC 509(1) may be provided with a printed wiring board (PWB).

Figure 52B:
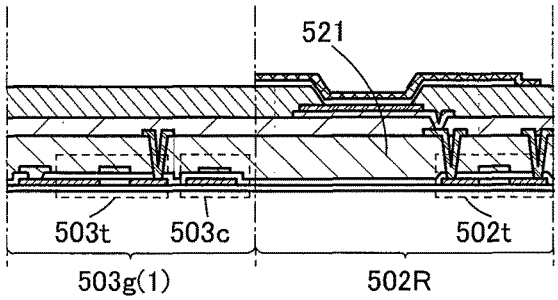

In the display device 501, transistors with any of a variety of structures can be used. FIG. 52A illustrates an example of using bottom-gate transistors; however, the present invention is not limited to this example, and top-gate transistors may be used in the display device 501 as illustrated in FIG. 52B.

The description in the above embodiment can be referred to for the structures of the transistors 502*t* and 503*t*.

<Touch Sensor>

Figure 52C:
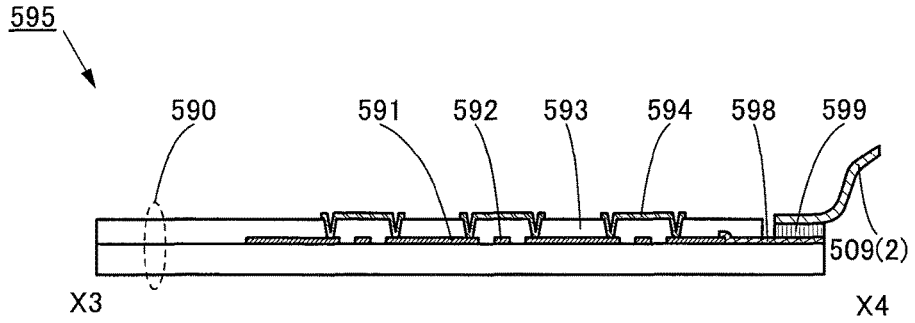

Next, the touch sensor 595 will be described in detail with reference to FIG. 52C. FIG. 52C corresponds to a cross-sectional view taken along dashed-dotted line X3-X4 in FIG. 51B.

The touch sensor 595 includes the electrodes 591 and the electrodes 592 provided in a staggered arrangement on the substrate 590, an insulating layer 593 covering the electrodes 591 and the electrodes 592, and the wiring 594 that electrically connects the adjacent electrodes 591 to each other.

The electrodes 591 and the electrodes 592 are formed using a light-transmitting conductive material. As a light-transmitting conductive material, a conductive oxide such as indium oxide, indium tin oxide, indium zinc oxide, zinc oxide, or zinc oxide to which gallium is added can be used. Note that a film including graphene may be used as well. The film including graphene can be formed, for example, by reducing a film containing graphene oxide. As a reducing method, a method with application of heat or the like can be employed.

The electrodes 591 and the electrodes 592 may be formed by, for example, depositing a light-transmitting conductive material on the substrate 590 by a sputtering method and then removing an unnecessary portion by any of various patterning techniques such as photolithography.

Examples of a material for the insulating layer 593 are a resin such as an acrylic resin or an epoxy resin, a resin having a siloxane bond such as silicone, and an inorganic insulating material such as silicon oxide, silicon oxynitride, or aluminum oxide.

Openings reaching the electrodes 591 are formed in the insulating layer 593, and the wiring 594 electrically connects the adjacent electrodes 591. A light-transmitting conductive material can be favorably used as the wiring 594 because the aperture ratio of the touch panel can be increased. Moreover, a material with higher conductivity than the conductivities of the electrodes 591 and 592 can be favorably used for the wiring 594 because electric resistance can be reduced.

One electrode 592 extends in one direction, and a plurality of electrodes 592 are provided in the form of stripes. The wiring 594 intersects with the electrode 592.

Adjacent electrodes 591 are provided with one electrode 592 provided therebetween. The wiring 594 electrically connects the adjacent electrodes 591.

Note that the plurality of electrodes 591 are not necessarily arranged in the direction orthogonal to one electrode 592 and may be arranged to intersect with one electrode 592 at an angle of more than 0 degrees and less than 90 degrees.

The wiring 598 is electrically connected to any of the electrodes 591 and 592. Part of the wiring 598 functions as a terminal. For the wiring 598, a metal material such as aluminum, gold, platinum, silver, nickel, titanium, tungsten, chromium, molybdenum, iron, cobalt, copper, or palladium or an alloy material containing any of these metal materials can be used.

Note that an insulating layer that covers the insulating layer 593 and the wiring 594 may be provided to protect the touch sensor 595.

A connection layer 599 electrically connects the wiring 598 to the FPC 509(2).

As the connection layer 599, any of anisotropic conductive films (ACF), anisotropic conductive pastes (ACP), and the like can be used.

<Description 2 of Touch Panel>

Figure 53A:
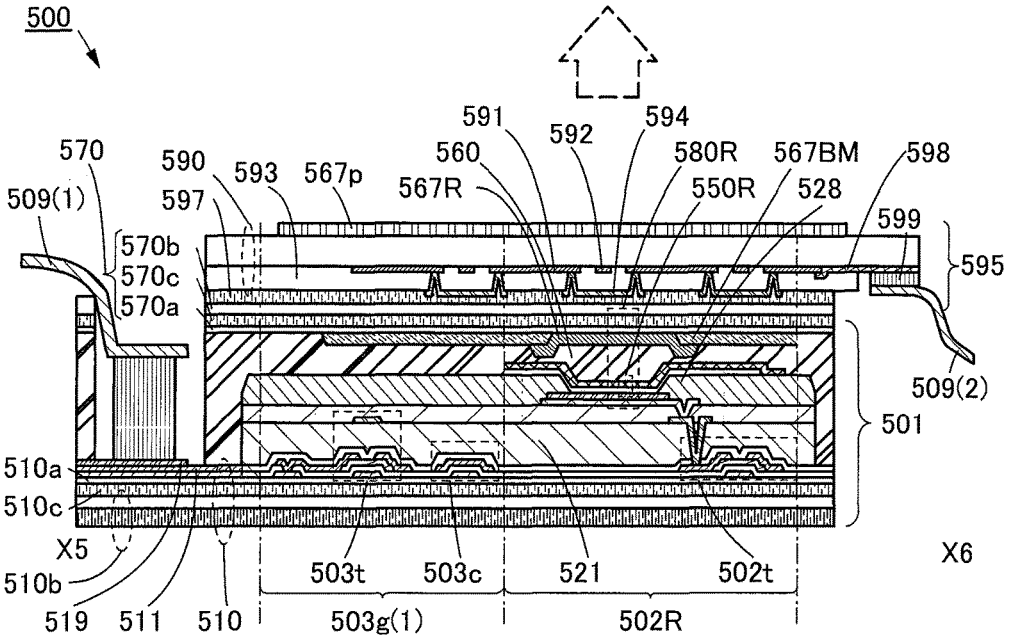
FIGS. 53A and 53B are cross-sectional views each illustrating one embodiment of the present invention.

Next, the touch panel 500 will be described in detail with reference to FIG. 53A. FIG. 53A corresponds to a cross-sectional view taken along dashed-dotted line X5-X6 in FIG. 51A.

In the touch panel 500 illustrated in FIG. 53A, the display device 501 described with reference to FIG. 52A and the touch sensor 595 described with reference to FIG. 52C are attached to each other.

The touch panel 500 illustrated in FIG. 53A includes an adhesive layer 597 and an anti-reflective layer 567*p* in addition to the components described with reference to FIGS. 52A and 52C.

The adhesive layer 597 is provided in contact with the wiring 594. Note that the adhesive layer 597 attaches the substrate 590 to the substrate 570 so that the touch sensor 595 overlaps with the display device 501. The adhesive layer 597 preferably has a light-transmitting property. A heat curable resin or an ultraviolet curable resin can be used for the adhesive layer 597. For example, an acrylic resin, a urethane-based resin, an epoxy-based resin, or a siloxane-based resin can be used.

The anti-reflective layer 567*p* is positioned in a region overlapping with pixels. As the anti-reflective layer 567*p*, a circularly polarizing plate can be used, for example.

Next, a touch panel having a structure different from that illustrated in FIG. 53A will be described with reference to FIG. 53B.

Figure 53B:
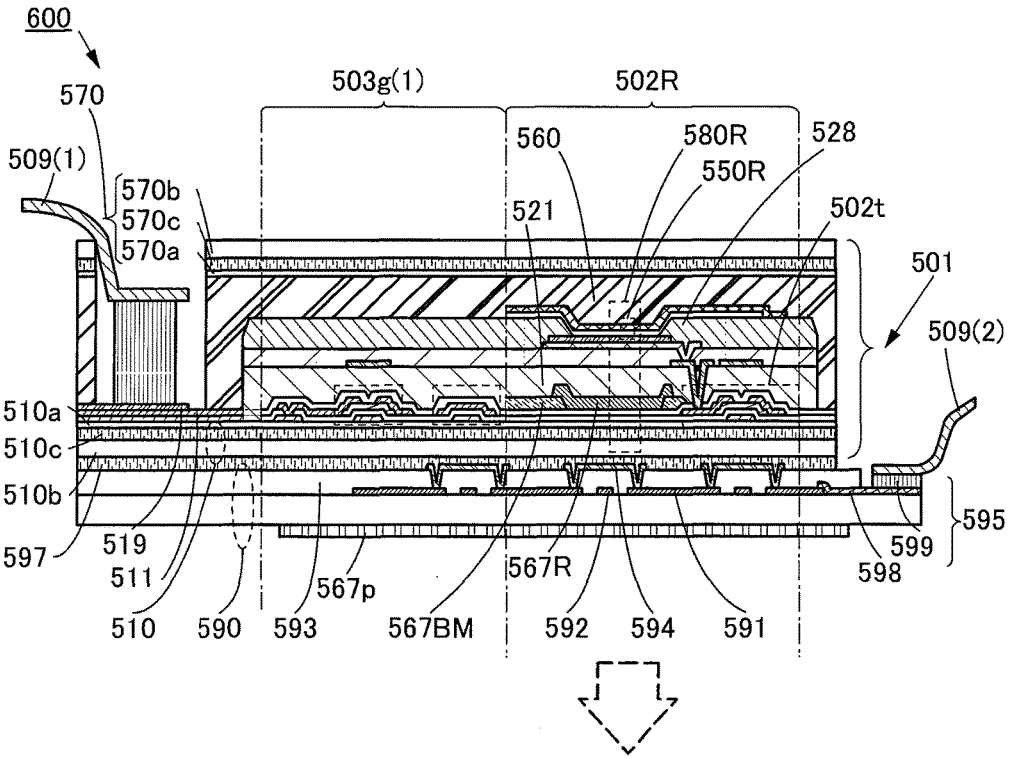

FIG. 53B is a cross-sectional view of a touch panel 600. The touch panel 600 illustrated in FIG. 53B differs from the touch panel 500 illustrated in FIG. 53A in the position of the touch sensor 595 relative to the display device 501. Different parts are described in detail below, and the above description of the touch panel 500 is referred to for the other similar parts.

The coloring layer 567R is positioned in a region overlapping with the light-emitting element 550R. The light-emitting element 550R illustrated in FIG. 53B emits light to the side where the transistor 502*t* is provided. Accordingly, part of light emitted from the light-emitting element 550R passes through the coloring layer 567R and is emitted to the outside of the light-emitting module 580R as indicated by an arrow in FIG. 53B.

The touch sensor 595 is provided on the substrate 510 side of the display device 501.

The adhesive layer 597 is provided between the substrate 510 and the substrate 590 and attaches the touch sensor 595 to the display device 501.

As illustrated in FIG. 53A or 53B, light may be emitted from the light-emitting element to one of upper and lower sides, or both, of the substrate.

The display device and the electronic device described in this embodiment have any structure described in the above embodiments, so that variation in threshold voltages can be corrected more accurately. Thus, the display device with a narrow frame can be obtained. Alternatively, the display device and the electronic device with small variation in luminance and small display unevenness can be obtained. Further alternatively, the display device and the electronic device which are capable of high definition display can be obtained.

The structure described in this embodiment can be used in appropriate combination with the structure described in any of the other embodiments.

Embodiment 7

In this embodiment, a display module and an electronic device that can be formed using the display device described in any of the above embodiments are described.

<External View of Display Device>

Figure 54:
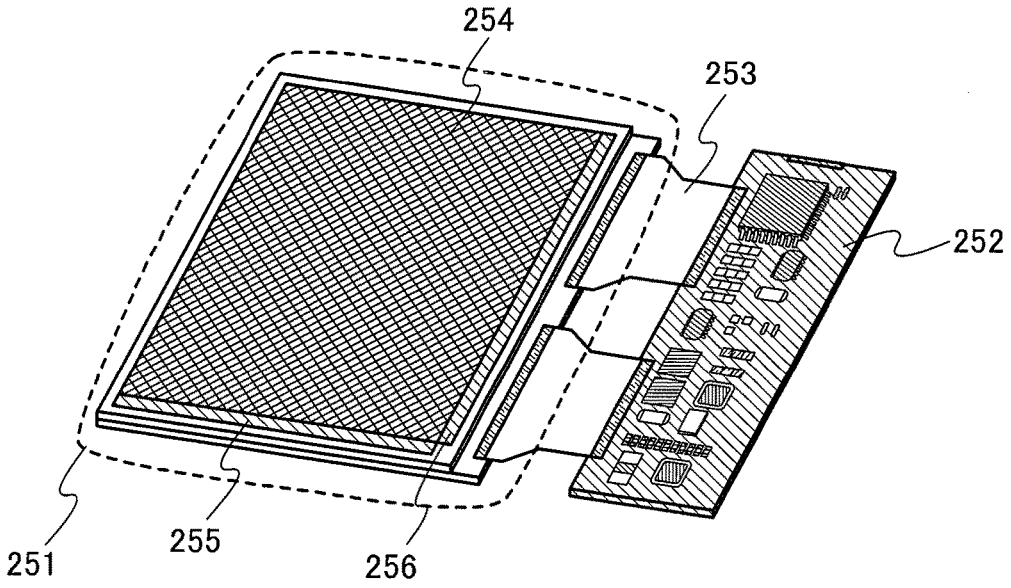
FIG. 54 is a perspective view illustrating one embodiment of the present invention.

FIG. 54 is a perspective view illustrating an example of an external view of a display device. The display device in FIG. 54 includes a panel 251; a circuit board 252 including a controller, a power supply circuit, an image processing circuit, an image memory, a CPU, and the like; and a connection portion 253. The panel 251 includes a pixel portion 254 including a plurality of pixels, a driver circuit 255 that selects pixels row by row, and a driver circuit 256 that controls input of a video signal to the pixels in a selected row.

A variety of signals and power supply potentials are input from the circuit board 252 to the panel 251 through the connection portion 253. As the connection portion 253, a flexible printed circuit (FPC) or the like can be used. In the case where a COF tape is used as the connection portion 253, part of circuits in the circuit board 252 or part of the driver circuit 255 or the driver circuit 256 included in the panel 251 may be formed on a chip separately prepared, and the chip may be electrically connected to the COF tape by a chip-on-film (COF) method.

<Structural Example of Electronic Device>

The display device described in any of the above embodiments can be used for display devices, laptops, or image reproducing devices provided with recording media (typically devices which reproduce the content of recording media such as DVDs (digital versatile disc) and have displays for displaying the reproduced images). In addition to the above examples, as an electronic device which include the display device according to one embodiment of the present invention, mobile phones, portable game machines, portable information terminals, e-book readers, cameras such as video cameras and digital still cameras, goggle-type displays (head mounted displays), navigation systems, audio reproducing devices (e.g., car audio components and digital audio players), copiers, facsimiles, printers, multifunction printers, automated teller machines (ATM), vending machines, and the like can be given. Specific examples of such an electronic device are illustrated in FIGS. 55A to 55F.

Figure 55A:
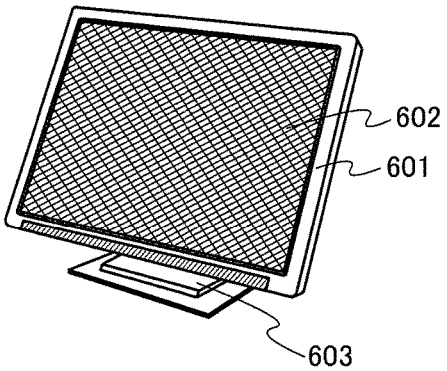
FIGS. 55A to 55F are electronic devices each illustrating one embodiment of the present invention.

FIG. 55A illustrates a display device including a housing 601, a display portion 602, a supporting base 603, and the like. The display device described in any of the above embodiments can be used in the display portion 602. Note that a display device includes all display devices for displaying information, such as display devices for personal computers, for receiving television broadcast, and for displaying advertisement, in its category.

Figure 55B:
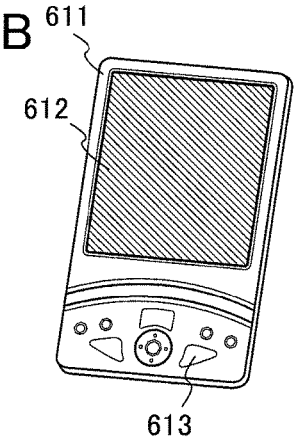

FIG. 55B illustrates a portable information terminal including a housing 611, a display portion 612, an operation key 613, and the like. The display device described in any of the above embodiments can be used in the display portion 612.

Figure 55C:
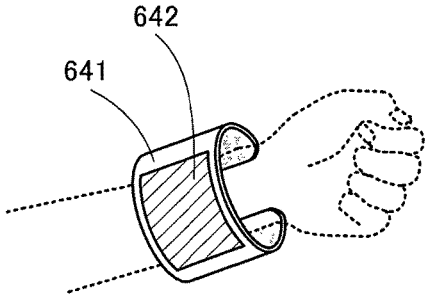

FIG. 55C illustrates a display device, which includes a housing 641 having a curved surface, a display portion 642, and the like. When a flexible substrate is used for the display device described in any of the above embodiments, it is possible to use the display device as the display portion 642 supported by the housing 641 having a curved surface. Consequently, it is possible to provide a user-friendly display device that is flexible and lightweight.

Figure 55D:
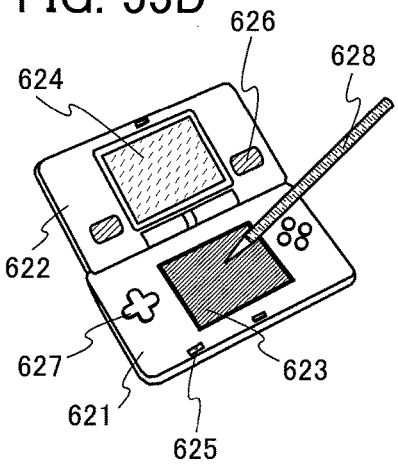

FIG. 55D illustrates a portable game machine including a housing 621, a housing 622, a display portion 623, a display portion 624, a microphone 625, speakers 626, an operation key 627, a stylus 628, and the like. The display device described in any of the above embodiments can be used in the display portion 623 or the display portion 624. When the display device described in any of the above embodiments is used in the display portion 623 or 624, it is possible to provide a user-friendly portable game machine with quality that hardly deteriorates. Note that although the portable game machine illustrated in FIG. 55D includes the two display portions 623 and 624, the number of display portions included in the portable game machine is not limited to two.

Figure 55E:
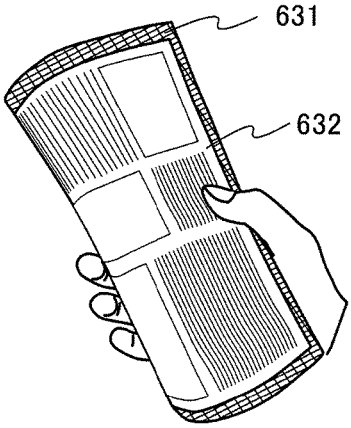

FIG. 55E illustrates an e-book reader, which includes a housing 631, a display portion 632, and the like. The display device described in any of the above embodiments can be used in the display portion 632. When a flexible substrate is used, the display device can have flexibility, so that it is possible to provide a user-friendly e-book reader which is flexible and lightweight.

Figure 55F:
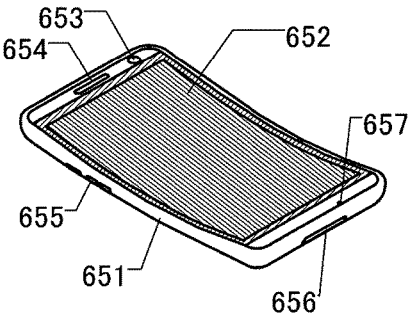

FIG. 55F illustrates a mobile phone which includes a display portion 652, a microphone 657, a speaker 654, a camera 653, an external connection port 656, and an operation button 655 in a housing 651. The display device described in any of the above-described embodiments can be used in the display portion 652. When the display device described in any of the above embodiments is provided over a flexible substrate, the display device can be used in the display portion 652 having a curved surface as illustrated in FIG. 55F.

With the use of the display device described in any of the above embodiments for the electronic device of this embodiment, variation in threshold voltages can be corrected more accurately. Thus, the display device with a narrow frame can be obtained. Alternatively, the electronic device with small variation in luminance and small display unevenness can be obtained. Further alternatively, the electronic device capable of high definition display can be obtained.

The structure described above in this embodiment can be combined as appropriate with any of the structures described in the other embodiments.

(Supplementary Notes on the Description in this Specification and the Like)

The following are notes on the description of the above embodiments and structures in the embodiments.

<Notes on One Embodiment of the Present Invention Described in Embodiments>

One embodiment of the present invention can be constituted by appropriately combining the structure described in an embodiment with any of the structures described the other embodiments. In addition, in the case where a plurality of structure examples are described in one embodiment, some of the structure examples can be combined as appropriate.

Note that a content (or may be part of the content) described in one embodiment may be applied to, combined with, or replaced by a different content (or may be part of the different content) described in the embodiment and/or a content (or may be part of the content) described in one or a plurality of different embodiments.

Note that in each embodiment, a content described in the embodiment is a content described with reference to a variety of diagrams or a content described with a text described in this specification.

Note that by combining a diagram (or may be part of the diagram) illustrated in one embodiment with another part of the diagram, a different diagram (or may be part of the different diagram) illustrated in the embodiment, and/or a diagram (or may be part of the diagram) illustrated in one or a plurality of different embodiments, much more diagrams can be formed.

In each Embodiment, one embodiment of the present invention has been described; however, one embodiment of the present invention is not limited to the described embodiments. For example, a structure in which a light-emitting element is used as an example of a display element is described in the above embodiment; however, one embodiment of the invention is not limited to that structure. Another display element, e.g., a liquid crystal element, may be used depending on conditions. A structure in which data on the threshold voltage is read out in the blanking period is described in the above embodiments; however, one embodiment of the present invention is not limited thereto. Data on transistors may be read out in a period other than the blanking period depending on conditions. Furthermore, a structure in which data on current characteristics of driver transistors in pixels is read out is described in the above embodiments; however, one embodiment of the present invention is not limited thereto. Depending on conditions, data on current characteristics of transistors other than the driver transistor may be read out, for example. Alternatively, depending on circumstances or conditions, data on current characteristics of the transistors is not necessarily read out. Alternatively, depending on circumstances or conditions, external correction is not necessarily performed.

<Notes on the Description for Drawings>

In this specification and the like, terms for explaining arrangement, such as "over" and "under", are used for convenience to describe the positional relation between components with reference to drawings. Furthermore, the positional relation between components is changed as appropriate in accordance with a direction in which the components are described. Therefore, the terms for explaining arrangement are not limited to those used in this specification and may be changed to other terms as appropriate depending on the situation.

The term "over" or "below" does not necessarily mean that a component is placed directly on or directly below and directly in contact with another component. For example, the expression "electrode B over insulating layer A" does not necessarily mean that the electrode B is on and in direct contact with the insulating layer A and can mean the case where another component is provided between the insulating layer A and the electrode B.

Furthermore, in a block diagram in this specification and the like, components are functionally classified and shown by blocks that are independent from each other. However, in an actual circuit and the like, such components are sometimes hard to classify functionally, and there is a case in which one circuit is concerned with a plurality of functions or a case in which a plurality of circuits are concerned with one function. Therefore, blocks in a block diagram do not necessarily show components described in the specification, which can be explained with another term as appropriate depending on the situation.

In drawings, the size, the layer thickness, or the region is determined arbitrarily for description convenience. Therefore, the size, the layer thickness, or the region is not limited to the illustrated scale. Note that the drawings are schematically shown for clarity, and embodiments of the present invention are not limited to shapes or values shown in the drawings. For example, the following can be included: variation in signal, voltage, or current due to noise or difference in timing.

In top views (also referred to as plan views or layout views) and perspective views, some of components might not be illustrated for clarity of the drawings.

<Notes on Expressions that can be Rephrased>

In this specification or the like, in describing connections of a transistor, one of a source and a drain is referred to as "one of a source and a drain" (or a first electrode or a first terminal), and the other of the source and the drain is referred to as "the other of the source and the drain" (or a second electrode or a second terminal). This is because a source and a drain of a transistor are interchangeable depending on the structure, operation conditions, or the like of the transistor. Note that the source or the drain of the transistor can also be referred to as a source (or drain) terminal, a source (or drain) electrode, or the like as appropriate depending on the situation.

In addition, in this specification and the like, the term such as an "electrode" or a "wiring" does not limit a function of the component. For example, an "electrode" is used as part of a "wiring" in some cases, and vice versa. Furthermore, the term "electrode" or "wiring" can also mean a combination of a plurality of "electrodes" and "wirings" formed in an integrated manner.

In this specification and the like, "voltage" and "potential" can be replaced with each other. The term "voltage" refers to a potential difference from a reference potential. When the reference potential is a ground potential, for example, "voltage" can be replaced with "potential." The ground potential does not necessarily mean 0 V. Potentials are relative values, and the potential applied to a wiring or the like is changed depending on the reference potential, in some cases.

In this specification and the like, the terms "film" and "layer" can be interchanged with each other depending on the case or circumstances. For example, the term "conductive layer" can be changed into the term "conductive film" in some cases. Also, the term "insulating film" can be changed into the term "insulating layer" in some cases.

<Notes on Definitions of Terms>

The following are definitions of the terms mentioned in the above embodiments.

<<Switch>>

In this specification and the like, a switch is conducting or not conducting (is turned on or off) to determine whether current flows therethrough or not. Alternatively, a switch is configured to select and change a current path.

Examples of a switch are an electrical switch, a mechanical switch, and the like. That is, any element can be used as a switch as long as it can control current, without limitation to a certain element.

Examples of the electrical switch are a transistor (e.g., a bipolar transistor or a MOS transistor), a diode (e.g., a PN diode, a PIN diode, a Schottky diode, a metal-insulator-metal (MIM) diode, a metal-insulator-semiconductor (MIS) diode, or a diode-connected transistor), and a logic circuit in which such elements are combined.

In the case of using a transistor as a switch, an "on state" of the transistor refers to a state in which a source and a drain of the transistor are electrically short-circuited. Furthermore, an "off state" of the transistor refers to a state in which the source and the drain of the transistor are electrically disconnected. In the case where a transistor operates just as a switch, the polarity (conductivity type) of the transistor is not particularly limited to a certain type.

An example of a mechanical switch is a switch formed using a micro electro mechanical systems (MEMS) technology, such as a digital micromirror device (DMD). Such a switch includes an electrode which can be moved mechanically, and operates by controlling conduction and non-conduction in accordance with movement of the electrode.

<<Channel Length>>

In this specification and the like, the channel length refers to, for example, a distance between a source and a drain in a region where a semiconductor (or a portion where current flows in a semiconductor when a transistor is on) and a gate overlap with each other or a region where a channel is formed in a plan view of the transistor.

In one transistor, channel lengths in all regions are not necessarily the same. In other words, the channel length of one transistor is not fixed to one value in some cases. Therefore, in this specification, the channel length is any one of values, the maximum value, the minimum value, or the average value in a region where a channel is formed.

<<Channel Width>>

In this specification and the like, the channel width refers to, for example, the length of a portion where a source and a drain face each other in a region where a semiconductor (or a portion where current flows in a semiconductor when a transistor is on) and a gate electrode overlap with each other, or a region where a channel is formed.

In one transistor, channel widths in all regions are not necessarily the same. In other words, the channel width of one transistor is not fixed to one value in some cases. Therefore, in this specification, the channel width is any one of values, the maximum value, the minimum value, or the average value in a region where a channel is formed.

<<Pixel>>

In this specification and the like, one pixel refers to one element whose brightness can be controlled, for example. Therefore, for example, one pixel expresses one color element by which brightness is expressed. Accordingly, in the case of a color display device formed of color elements of R (red), G (green), and B (blue), the smallest unit of an image is formed of three pixels of an R pixel, a G pixel, and a B pixel.

Note that the number of color elements is not limited to three, and more color elements may be used. For example, RGBW (W: white), RGB added with yellow, cyan, or magenta, and the like may be employed.

<<Connection>>

In this specification and the like, when it is described that "A and B are connected to each other", the case where A and B are electrically connected to each other is included in addition to the case where A and B are directly connected to each other. Here, the expression "A and B are electrically connected" means the case where electric signals can be transmitted and received between A and B when an object having any electric action exists between A and B.

For example, in this specification and the like, an explicit description "X and Y are connected" means that X and Y are electrically connected, X and Y are functionally connected, and X and Y are directly connected. Accordingly, without limitation to a predetermined connection relation, for example, a connection relation shown in drawings or text, another connection relation is included in the drawings or the text.

Here, X and Y each denote an object (e.g., a device, an element, a circuit, a wiring, an electrode, a terminal, a conductive film, or a layer).

Examples of the case where X and Y are directly connected include the case where an element that allows an electrical connection between X and Y (e.g., a switch, a transistor, a capacitor, an inductor, a resistor, a diode, a display element, a light-emitting element, or a load) is not connected between X and Y, that is, the case where X and Y are connected without the element that allows the electrical connection between X and Y provided therebetween.

For example, in the case where X and Y are electrically connected, one or more elements that enable electrical connection between X and Y (e.g., a switch, a transistor, a capacitor, an inductor, a resistor, a diode, a display element, a light-emitting element, or a load) can be connected between X and Y. A switch is controlled to be on or off. That is, a switch is conducting or not conducting (is turned on or off) to determine whether a current flows therethrough or not. Alternatively, the switch has a function of selecting and changing a current path. Note that the case where X and Y are electrically connected includes the case where X and Y are directly connected.

For example, in the case where X and Y are functionally connected, one or more circuits that enable functional connection between X and Y (e.g., a logic circuit such as an inverter, a NAND circuit, or a NOR circuit; a signal converter circuit such as a DA converter circuit, an AD converter circuit, or a gamma correction circuit; a potential level converter circuit such as a power supply circuit (e.g., a step-up circuit and a step-down circuit) or a level shifter circuit for changing the potential level of a signal; a voltage source; a current source; a switching circuit; an amplifier circuit such as a circuit that can increase signal amplitude, the amount of current, or the like, an operational amplifier, a differential amplifier circuit, a source follower circuit, or a buffer circuit; a signal generation circuit; a memory circuit; and/or a control circuit) can be connected between X and Y. Note that for example, in the case where a signal output from Xis transmitted to Y even when another circuit is interposed between X and Y, X and Y are functionally connected. Note that the case where X and Y are functionally connected includes the case where X and Y are directly connected and X and Y are electrically connected.

Note that in this specification and the like, an explicit description "X and Y are electrically connected" means that X and Y are electrically connected (i.e., the case where X and Y are connected with another element or another circuit provided therebetween), X and Y are functionally connected (i.e., the case where X and Y are functionally connected with another circuit provided therebetween), and X and Y are directly connected (i.e., the case where X and Y are connected without another element or another circuit provided therebetween). That is, in this specification and the like, the explicit description "X and Y are electrically connected" is the same as the description "X and Y are connected".

Note that, for example, the case where a source (or a first terminal or the like) of a transistor is electrically connected to X through (or not through) Z1 and a drain (or a second terminal or the like) of the transistor is electrically connected to Y through (or not through) Z2, or the case where a source (or a first terminal or the like) of a transistor is directly connected to one part of Z1 and another part of Z1 is directly connected to X while a drain (or a second terminal or the like) of the transistor is directly connected to one part of Z2 and another part of Z2 is directly connected to Y, can be expressed by using any of the following expressions.

Examples of the expressions include, "X, Y, a source (or a first terminal or the like) of a transistor, and a drain (or a second terminal or the like) of the transistor are electrically connected to each other, and X, the source (or the first terminal or the like) of the transistor, the drain (or the second terminal or the like) of the transistor, and Y are electrically connected to each other in this order", "a source (or a first terminal or the like) of a transistor is electrically connected to X, a drain (or a second terminal or the like) of the transistor is electrically connected to Y, and X, the source (or the first terminal or the like) of the transistor, the drain (or the second terminal or the like) of the transistor, and Y are electrically connected to each other in this order", and "X is electrically connected to Y through a source (or a first terminal or the like) and a drain (or a second terminal or the like) of a transistor, and X, the source (or the first terminal or the like) of the transistor, the drain (or the second terminal or the like) of the transistor, and Y are provided to be connected in this order". When the connection order in a circuit configuration is defined by an expression similar to the above examples, a source (or a first terminal or the like) and a drain (or a second terminal or the like) of a transistor can be distinguished from each other to specify the technical scope.

Other examples of the expressions include, "a source (or a first terminal or the like) of a transistor is electrically connected to X through at least a first connection path, the first connection path does not include a second connection path, the second connection path is a path between the source (or the first terminal or the like) of the transistor and a drain (or a second terminal or the like) of the transistor, Z1 is on the first connection path, the drain (or the second terminal or the like) of the transistor is electrically connected to Y through at least a third connection path, the third connection path does not include the second connection path, and Z2 is on the third connection path" and "a source (or a first terminal or the like) of a transistor is electrically connected to X at least with a first connection path through Z1, the first connection path does not include a second connection path, the second connection path includes a connection path through which the transistor is provided, a drain (or a second terminal or the like) of the transistor is electrically connected to Y at least with a third connection path through Z2, and the third connection path does not include the second connection path." Still another example of the expression is "a source (or a first terminal or the like) of a transistor is electrically connected to X through at least Z1 on a first electrical path, the first electrical path does not include a second electrical path, the second electrical path is an electrical path from the source (or the first terminal or the like) of the transistor to a drain (or a second terminal or the like) of the transistor, the drain (or the second terminal or the like) of the transistor is electrically connected to Y through at least Z2 on a third electrical path, the third electrical path does not include a fourth electrical path, and the fourth electrical path is an electrical path from the drain (or the second terminal or the like) of the transistor to the source (or the first terminal or the like) of the transistor." When the connection path in a circuit configuration is defined by an expression similar to the above examples, a source (or a first terminal or the like) and a drain (or a second terminal or the like) of a transistor can be distinguished from each other to specify the technical scope.

Note that these expressions are examples and there is no limitation on the expressions. Here, X, Y, Z1, and Z2 each denote an object (e.g., a device, an element, a circuit, a wiring, an electrode, a terminal, a conductive film, and a layer).

For example, in this specification and the like, a display element, a display device which is a device including a display element, a light-emitting element, and a light-emitting device which is a device including a light-emitting element can employ a variety of modes or can include a variety of elements. The display element, the display device, the light-emitting element, or the light-emitting device includes at least one of an electroluminescent (EL) element (e.g., an EL element including organic and inorganic materials, an organic EL element, or an inorganic EL element), an LED (e.g., a white LED, a red LED, a green LED, or a blue LED), a transistor (a transistor that emits light depending on a current), an electron emitter, a liquid crystal element, electronic ink, an electrophoretic element, a grating light valve (GLV), a plasma display panel (PDP), a display element using micro electro mechanical systems (MEMS), a digital micromirror device (DMD), a digital micro shutter (DMS), MIRASOL (registered trademark), an interferometric modulator display (IMOD) element, a MEMS shutter display element, an optical-interference-type MEMS display element, an electrowetting element, a piezoelectric ceramic display, a display element including a carbon nanotube, and the like. Other than the above, a display medium whose contrast, luminance, reflectance, transmittance, or the like is changed by an electric or magnetic effect may be included. Examples of a display device using an EL element include an EL display. Display devices using electron emitters include a field emission display (FED), an SED-type flat panel display (SED: surface-conduction electron-emitter display), and the like. Examples of display devices including liquid crystal elements include a liquid crystal display (e.g., a transmissive liquid crystal display, a transflective liquid crystal display, a reflective liquid crystal display, a direct-view liquid crystal display, or a projection liquid crystal display). Examples of a display device including electronic ink, Electronic Liquid Powder (registered trademark), or electrophoretic elements include electronic paper. In the case of a transflective liquid crystal display or a reflective liquid crystal display, some or all of pixel electrodes function as reflective electrodes. For example, some or all of pixel electrodes are formed to contain aluminum, silver, or the like. In such a case, a memory circuit such as an SRAM can be provided under the reflective electrodes, leading to lower power consumption. Note that in the case of using an LED, graphene or graphite may be provided under an electrode or a nitride semiconductor of the LED. Graphene or graphite may be a multilayer film in which a plurality of layers are stacked. Such provision of graphene or graphite enables a nitride semiconductor such as an n-type GaN semiconductor layer including crystals to be easily formed thereover. Furthermore, a p-type GaN semiconductor layer including crystals, or the like can be provided thereover, and thus the LED can be formed. Note that an AlN layer may be provided between the n-type GaN semiconductor layer including crystals and graphene or graphite. The GaN semiconductor layers included in the LED may be formed by MOCVD. Note that when the graphene is provided, the GaN semiconductor layers included in the LED can also be formed by a sputtering method.

This application is based on Japanese Patent Application serial no. 2014-222285 filed with Japan Patent Office on Oct. 31, 2014, the entire contents of which are hereby incorporated by reference.

What is claimed is:

1. A display device comprising:

a pixel comprising a transistor and a display element;

a first circuit comprising a second circuit and an operational amplifier; and a wiring, wherein the transistor is electrically connected to the second circuit through the wiring, wherein the operational amplifier is electrically connected to the second circuit, wherein the second circuit is configured to select whether the first circuit is configured as an integrator circuit whose input terminal is an inverting input terminal of the operational amplifier or a voltage follower circuit whose input terminal is a non-inverting input terminal of the operational amplifier, wherein the second circuit is configured to establish an electrical continuity between the input terminal of the integrator circuit and the wiring, and wherein the second circuit is configured to establish an electrical continuity between the input terminal of the voltage follower circuit and the wiring.

2. The display device according to claim 1, wherein the second circuit includes a passive element.

3. The display device according to claim 1, wherein the first circuit is a read circuit in a driver circuit portion of the display device.

4. The display device according to claim 1, wherein the display element is a light-emitting element.

5. A display device comprising:

a pixel comprising a transistor and a display element;

a first circuit comprising a second circuit and an operational amplifier electrically connected to the second circuit, the second circuit comprising a capacitor;

a first wiring; and a second wiring, wherein the transistor is electrically connected to the second circuit through the first wiring, wherein one electrode of the capacitor is electrically connected to an inverting input terminal of the operational amplifier, wherein the other electrode of the capacitor is electrically connected to an output terminal of the operational amplifier, wherein the second circuit includes a first switch, a second switch, a third switch, and a fourth switch, wherein the inverting input terminal of the operational amplifier is electrically connected to the first wiring through the first switch, wherein a non-inverting input terminal of the operational amplifier is electrically connected to the first wiring through the second switch, wherein the non-inverting input terminal of the operational amplifier is electrically connected to the second wiring through the third switch, and wherein the output terminal of the operational amplifier is electrically connected to the inverting input terminal of the operational amplifier through the fourth switch.

6. The display device according to claim 5, wherein the first circuit is a read circuit in a driver circuit portion of the display device.

7. The display device according to claim 5, wherein the second circuit is configured to select whether the first circuit is configured as an integrator circuit whose input terminal is the inverting input terminal of the operational amplifier or a voltage follower circuit whose input terminal is the non-inverting input terminal of the operational amplifier.

8. The display device according to claim 5, wherein the display element is a light-emitting element.

9. The display device according to claim 5, wherein the second wiring is configured to supply a reference potential.

10. A display device comprising:

a pixel comprising a transistor and a display element;

a first circuit comprising a second circuit and an operational amplifier; and a first wiring, wherein the transistor is electrically connected to the second circuit through the first wiring, wherein the operational amplifier is electrically connected to the second circuit, wherein the second circuit is configured to select whether the first circuit is configured as a current-voltage converter circuit whose input terminal is an inverting input terminal of the operational amplifier or a voltage follower circuit whose input terminal is a non-inverting input terminal of the operational amplifier, wherein the second circuit is configured to establish an electrical continuity between the input terminal of the current-voltage converter circuit and the wiring, and wherein the second circuit is configured to establish an electrical continuity between the input terminal of the voltage follower circuit and the wiring.

11. The display device according to claim 10, further comprising a second wiring, wherein the second circuit includes a resistor, a first switch, a second switch, a third switch, a fourth switch, and a fifth switch, wherein the inverting input terminal of the operational amplifier is electrically connected to the first wiring through the first switch, wherein the non-inverting input terminal of the operational amplifier is electrically connected to the first wiring through the second switch, wherein the non-inverting input terminal of the operational amplifier is electrically connected to the second wiring through the third switch, wherein an output terminal of the operational amplifier is electrically connected to the inverting input terminal of the operational amplifier through the fourth switch and the resistor, and wherein the output terminal of the operational amplifier is electrically connected to the inverting input terminal of the operational amplifier through the fifth switch.

12. The display device according to claim 11, wherein the second wiring is configured to supply a reference potential.

13. The display device according to claim 10, wherein the first circuit is a read circuit in a driver circuit portion of the display device.

14. The display device according to claim 10, wherein the display element is a light-emitting element.

15. A display device comprising:

a pixel comprising a transistor and a display element;

a first circuit comprising a second circuit and an operational amplifier; and a first wiring, wherein the transistor is electrically connected to the second circuit through the first wiring, wherein the operational amplifier is electrically connected to the second circuit, wherein the second circuit is configured to select whether the first circuit is configured as an integrator circuit whose input terminal is an inverting input terminal of the operational amplifier or a current-voltage converter circuit whose input terminal is the inverting input terminal of the operational amplifier, wherein the second circuit is configured to establish an electrical continuity between the input terminal of the integrator circuit and the wiring, and wherein the second circuit is configured to establish an electrical continuity between the input terminal of the current-voltage converter circuit and the wiring.

16. The display device according to claim 15, further comprising a second wiring, wherein the second circuit includes a capacitor, a resistor, a first switch, a second switch and a third switch, wherein the inverting input terminal of the operational amplifier is electrically connected to the first wiring, wherein a non-inverting input terminal of the operational amplifier is electrically connected to the second wiring, wherein the inverting input terminal of the operational amplifier is electrically connected to an output terminal of the operational amplifier through the resistor and the first switch, wherein the inverting input terminal of the operational amplifier is electrically connected to the output terminal of the operational amplifier through the resistor and the first switch, wherein the inverting input terminal of the operational amplifier is electrically connected to the output terminal of the operational amplifier through the capacitor and the second switch, and wherein the inverting input terminal of the operational amplifier is electrically connected to the output terminal of the operational amplifier through the third switch.

17. The display device according to claim 16, wherein the second wiring is configured to supply a reference potential.

18. The display device according to claim 15, wherein the first circuit is a read circuit in a driver circuit portion of the display device.

19. The display device according to claim 15, wherein the display element is a light-emitting element.

20. A display module comprising:

the display device according to claim 15; and a circuit board, an FPC, or a touch sensor.

21. An electronic device comprising:

the display device according to claim 15; and a speaker, a microphone, an operation key, or a housing.

* * * * *